US008215121B2

(12) United States Patent
Yoshimi et al.

(10) Patent No.: US 8,215,121 B2
(45) Date of Patent: Jul. 10, 2012

(54) REFRIGERANT QUANTITY DETERMINING SYSTEM OF AIR CONDITIONER

(75) Inventors: Manabu Yoshimi, Sakai (JP); Takahiro Yamaguchi, Sakai (JP); Tadafumi Nishimura, Sakai (JP); Shinichi Kasahara, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 883 days.

(21) Appl. No.: 11/887,935

(22) PCT Filed: Apr. 6, 2006

(86) PCT No.: PCT/JP2006/307341

§ 371 (c)(1),
(2), (4) Date: Oct. 5, 2007

(87) PCT Pub. No.: WO2006/109677

PCT Pub. Date: Oct. 19, 2006

(65) Prior Publication Data

US 2009/0025406 A1 Jan. 29, 2009

(30) Foreign Application Priority Data

Apr. 7, 2005 (JP) ..... 2005-110830
Dec. 16, 2005 (JP) ..... 2005-363731

(51) Int. Cl.
*F25B 45/00* (2006.01)
*G01K 13/00* (2006.01)
*G05D 23/00* (2006.01)

(52) U.S. Cl. ..... 62/149; 62/127; 62/129; 236/51

(58) Field of Classification Search ..... 62/127, 62/129, 149; 236/51
See application file for complete search history.

(56) References Cited

U.S. PATENT DOCUMENTS 4,829,779 A * 5/1989 Munson et al. ..... 62/175
(Continued)

FOREIGN PATENT DOCUMENTS

CN 1455186 A 11/2003
EP 1 731 857 A1 12/2006
(Continued)

OTHER PUBLICATIONS

European Search Report of corresponding EP Application No. 06 73 1289.2 dated Oct. 12, 2011.

*Primary Examiner* — Frantz Jules
*Assistant Examiner* — Daniel C Comings
(74) *Attorney, Agent, or Firm* — Global IP Counselors

(57) ABSTRACT

In a multi-type air conditioner, the adequacy of the refrigerant quantity charged in the air conditioner can be accurately determined, even when the refrigerant quantity charged on site is inconsistent, or even when a reference value of the operation state quantity, which is used for determining the adequacy of the refrigerant quantity, fluctuates depending on the pipe length of the refrigerant communication pipe, combination of utilization units, and the difference in the installation height among each unit. In an air conditioner (1) including a refrigerant circuit (10) configured by the interconnection of a heat source unit (2) and utilization units (4, 5) via refrigerant communication pipes (6, 7), a refrigerant quantity determining system determines the adequacy of the refrigerant quantity and includes a state quantity storing means and a refrigerant quantity determining means. The state quantity storing means stores the operation state quantity of constituent equipment or the refrigerant flowing in the refrigerant circuit (10) in which refrigerant is charged up to an initial refrigerant quantity by on-site refrigerant charging. The refrigerant quantity determining means compares the operation state quantity during test operation as a reference value with a current value of the operation state quantity, and thereby determines the adequacy of the refrigerant quantity.

16 Claims, 35 Drawing Sheets

U.S. PATENT DOCUMENTS

| | | | | |
|---|---|---|---|---|
| 5,214,918 | A | 6/1993 | Oguni et al. | |
| 6,463,747 | B1 * | 10/2002 | Temple | 62/129 |
| 6,701,722 | B1 | 3/2004 | Seo et al. | |
| 2003/0051490 | A1 | 3/2003 | Jayanth | |
| 2003/0226367 | A1 * | 12/2003 | Palmer et al. | 62/149 |

FOREIGN PATENT DOCUMENTS

| | | | |
|---|---|---|---|
| JP | 63-213766 | A | 9/1988 |
| JP | 2-85964 | | 7/1990 |
| JP | H02-208469 | A | 8/1990 |
| JP | 3-177763 | | 8/1991 |
| JP | 3-186170 | | 8/1991 |
| JP | 04-151475 | A | 5/1992 |
| JP | 5-99540 | | 4/1993 |
| JP | 06-201234 | A | 7/1994 |
| JP | 7-218008 | | 8/1995 |
| JP | 10-176877 | A | 6/1998 |
| JP | 11-83250 | | 3/1999 |
| JP | 2997487 | B | 10/1999 |
| JP | 2000-283583 | | 10/2000 |
| JP | 2000-304388 | A | 11/2000 |
| JP | 2002-243301 | | 8/2002 |
| JP | 2002-350014 | A | 12/2002 |
| JP | 2003-161551 | | 6/2003 |
| JP | 3097971 | | 9/2003 |
| JP | 2003-314909 | | 11/2003 |
| JP | 2004-077000 | A | 3/2004 |
| JP | 2005-207644 | A | 8/2005 |
| JP | 2005-257219 | A | 9/2005 |
| WO | WO 94/08809 | A1 | 4/1994 |
| WO | WO-2004/016999 | A1 | 2/2004 |
| WO | WO-2005/071332 | A1 | 8/2005 |

* cited by examiner

REFRIGERANT QUANTITY DETERMINING SYSTEM OF AIR CONDITIONER

TECHNICAL FIELD

The present invention relates to a function to determine the adequacy of the refrigerant quantity charged in an air conditioner. More specifically, the present invention relates to a function to determine the adequacy of the refrigerant quantity charged in a multi-type air conditioner in which a heat source unit and a plurality of utilization units are interconnected via refrigerant communication pipes.

BACKGROUND ART

Conventionally, there has been known a separate-type air conditioner in which a refrigerant circuit is configured by the interconnection of a heat source unit and a utilization unit via a refrigerant communication pipe. In such an air conditioner, the refrigerant may leak from the refrigerant circuit for some reasons. Such refrigerant leak causes deterioration of air conditioning performance and damages to constituent equipment. Therefore, it is preferable to provide a function to determine the adequacy of the refrigerant quantity charged in the air conditioner.

For such problems, a method has been proposed in which the adequacy of the refrigerant quantity is determined by using the degree of superheating of the refrigerant at an outlet of an outdoor heat exchanger during heating operation and the degree of superheating of the refrigerant at an outlet of an indoor heat exchanger during cooling operation (see Patent Document 1). Also, another method has been proposed in which the adequacy of the refrigerant quantity is determined by using the degree of subcooling at the outlet of the outdoor heat exchanger during cooling operation (see Patent Document 2).

Patent Document 1

Japanese Patent Application Publication No. H02-208469

Patent Document 2

Japanese Patent Application Publication No. 2000-304388

DISCLOSURE OF THE INVENTION

In addition, as a separate-type air conditioner, there is a multi-type air conditioner which comprises a plurality of utilization units and is used for building air conditioning and the like. In such a multi-type air conditioner, refrigerant is charged until the quantity reaches a prescribed refrigerant quantity, which is calculated on site based on the pipe length, the capacities of constituent equipment, and the like. However, there are cases where the initial refrigerant quantity, which is the quantity that was actually charged on site, is inconsistent with the prescribed refrigerant quantity, because of a calculation error when calculating the prescribed refrigerant quantity or an error in charging operation. Because of this, when the above described conventional function to determine the adequacy of the refrigerant quantity is applied to the multi-type air conditioner, even if the initial refrigerant quantity is inconsistent with the prescribed refrigerant quantity, a value of the degree of subcooling, a value of the degree of superheating, and the like (hereinafter referred to as "operation state quantity") that are obtained when the prescribed refrigerant quantity is charged will be used as they are as reference values and compared with current values of operation state quantity in order to determine the adequacy of the refrigerant quantity, and this results in causing a problem of degrading the accuracy for determining the adequacy of the refrigerant quantity. In addition, in the multi-type air conditioner, the reference values themselves of operation state quantity fluctuate depending on the pipe length of the refrigerant communication pipes, combination of the utilization units, and the difference in the installation height among each unit. Consequently, even if the refrigerant is charged to the prescribed refrigerant quantity, the reference values of operation state quantity with respect to the refrigerant quantity cannot be uniquely determined. This results in causing a problem of degrading the accuracy for determining the adequacy of the refrigerant quantity.

Therefore, it is an object of the present invention to enable, in a multi-type air conditioner in which a heat source unit and a plurality of utilization units are interconnected via refrigerant communication pipes, an accurate judgment of the adequacy of the refrigerant quantity charged in the air conditioner, even when the refrigerant quantity charged on site is inconsistent, or even when a reference value of operation state quantity, which is used for determining the adequacy of the refrigerant quantity, fluctuates depending on the pipe length of the refrigerant communication pipes, combination of the utilization units, and the difference in the installation height among each unit.

A refrigerant quantity determining system of an air conditioner according to a first aspect of the present invention is a refrigerant quantity determining system of an air conditioner including a refrigerant circuit configured by the interconnection of a heat source unit and a plurality of utilization units via refrigerant communication pipes, the refrigerant quantity determining system configured to determine the adequacy of the refrigerant quantity and comprising a state quantity storing means and a refrigerant quantity determining means. During a test operation after installment of the air conditioner, the state quantity storing means stores operation state quantity of constituent equipment or refrigerant flowing in the refrigerant circuit in which refrigerant is charged up to an initial refrigerant quantity by on-site refrigerant charging. The refrigerant quantity determining means compares operation state quantity during the test operation as a reference value with a current value of operation state quantity of constituent equipment or refrigerant flowing in the refrigerant circuit, and thereby determines the adequacy of the refrigerant quantity.

In this refrigerant quantity determining system of the air conditioner, during the test operation after installment of the air conditioner, the state quantity storing means stores operation state quantity in the state after the refrigerant is charged up to the initial refrigerant quantity by on-site refrigerant charging, and compares operation state quantity stored as the reference value with the current value of operation state quantity in order to determine the adequacy of the refrigerant quantity. Therefore, the refrigerant quantity that has actually been charged in the air conditioner, i.e., the initial refrigerant quantity can be compared with the current refrigerant quantity.

Accordingly, in this refrigerant quantity determining system of the air conditioner, even when the refrigerant quantity charged on site is inconsistent or even when the reference value of operation state quantity, which is used for determining the adequacy of the refrigerant quantity, fluctuates depending on the pipe length of the refrigerant communication pipes, combination of the utilization units, and the difference in the installation height among each unit, it is possible to accurately determine the adequacy of the refrigerant quantity charged in the air conditioner.

A refrigerant quantity determining system of an air conditioner according to a second aspect of the present invention is the refrigerant quantity determining system of the air conditioner according to the first aspect of the present invention, wherein the test operation includes an operation that involves refrigerant charging into the refrigerant circuit. The state quantity storing means stores operation state quantity of constituent equipment or refrigerant flowing in the refrigerant circuit during the operation that involves refrigerant charging.

In this refrigerant quantity determining system of the air conditioner, the state quantity storing means can store not only operation state quantity in the state after the refrigerant is charged up to the initial refrigerant quantity but also operation state quantity in a state where refrigerant with less quantity than the initial refrigerant quantity is charged in the refrigerant circuit.

Accordingly, in this refrigerant quantity determining system of the air conditioner, operation state quantity in the state where the refrigerant quantity is less than the initial refrigerant quantity is used as the reference value and compared with the current value of operation state quantity. Therefore, the accuracy for determining the adequacy of the refrigerant quantity charged in the air conditioner can be further improved.

A refrigerant quantity determining system of an air conditioner according to a third aspect of the present invention is the refrigerant quantity determining system of the air conditioner according to either the first aspect or the second aspect of the present invention, wherein the test operation includes an operation to change control variables of constituent equipment of the air conditioner. The state quantity storing means stores operation state quantity of constituent equipment or refrigerant flowing in the refrigerant circuit during the operation to change control variables.

In this refrigerant quantity determining system of the air conditioner, in order to obtain not only operation state quantity in the state after the refrigerant is charged up to the initial refrigerant quantity but also operation state quantity in a state where operating conditions such as refrigerant temperature and refrigerant pressure at each portion in the refrigerant circuit, outdoor temperature, room temperature, and the like are different from those during the test operation, control variables of constituent equipment are changed in order to perform an operation to simulate operating conditions different from those during the test operation, and operation state quantity during this operation can be stored in the state quantity storing means.

Accordingly, in this refrigerant quantity determining system of the air conditioner, based on operation state quantity during operation with the control variables of constituent equipment changed, for example, a correlation and a correction formula for operation state quantity for different operating conditions are determined. Using such a correlation and a correction formula, it is possible to compensate differences in the operating conditions when comparing operation state quantity during the test operation with the current value of operation state quantity. In this way, in this refrigerant quantity determining system of the air conditioner, based on the data of operation state quantity during operation with the control variables of constituent equipment changed, it is possible to compensate differences in the operating conditions when comparing operation state quantity during the test operation with the current value of operation state quantity. Therefore, the accuracy for determining the adequacy of the refrigerant quantity charged in the air conditioner can be further improved.

A refrigerant quantity determining system of an air conditioner according to a fourth aspect of the present invention is the refrigerant quantity determining system of the air conditioner according to any of the first aspect to the third aspect of the present invention, wherein a state quantity obtaining means manages the air conditioner. The state quantity storing means, the refrigerant quantity determining means, and the state quantity correcting means are located remotely from the air conditioner, and are connected to the state quantity obtaining means via a communication circuit.

In this refrigerant quantity determining system of the air conditioner, the state quantity storing means, the refrigerant quantity determining means, and the state quantity correcting means are located remotely from the air conditioner. Consequently, it is possible to easily create a configuration in which a large amount of past operation data of the air conditioner can be stored. Accordingly, for example, it is possible to select, from the past operation data stored in the storing means, operation data similar to current the operation data obtained by the state quantity obtaining means, compare these data with each other and determine the adequacy of the refrigerant quantity.

A refrigerant quantity determining system of an air conditioner according to a fifth aspect of the present invention is the refrigerant quantity determining system of the air conditioner according to any of the first aspect to the fourth aspect of the present invention, further comprising a refrigerant quantity calculating means configured to calculate the refrigerant quantity from operation state quantity during the test operation. The refrigerant quantity calculated from operation state quantity during the test operation is stored in the state quantity storing means as the reference value.

In this refrigerant quantity determining system of the air conditioner, the refrigerant quantity is calculated from operation state quantity during the test operation, and this refrigerant quantity is used as the reference value and compared with the current value of operation state quantity. Therefore, the refrigerant quantity that has actually been charged in the air conditioner, i.e., the initial refrigerant quantity can be compared with the current refrigerant quantity.

An air conditioner according to a sixth aspect of the present invention is an air conditioner comprising a refrigerant circuit configured by the interconnection of an outdoor unit having a compressor and an outdoor heat exchanger, and an indoor unit having an indoor heat exchanger via refrigerant communication pipes, the air conditioner comprising a refrigerant quantity determining means and a state quantity correcting means. The refrigerant quantity determining means determines the adequacy of the refrigerant quantity based on a current value of operation state quantity of constituent equipment or refrigerant flowing in the refrigerant circuit, and a reference value of operation state quantity of constituent equipment or refrigerant flowing in the refrigerant circuit. When the adequacy of the refrigerant quantity is determined by the refrigerant quantity determining means, the state quantity correcting means corrects operation state quantity by using the refrigerant pressure or the refrigerant temperature in the outdoor heat exchanger; and the outdoor temperature.

An air conditioner according to a seventh aspect of the present invention is an air conditioner comprising a refrigerant circuit configured by the interconnection of an outdoor unit having a compressor and an outdoor heat exchanger, and an indoor unit having an indoor heat exchanger via refrigerant communication pipes, the air conditioner comprising a refrigerant quantity determining means and a state quantity correcting means. The refrigerant quantity determining means determines the adequacy of the refrigerant quantity based on a current value of operation state quantity of constituent equipment or refrigerant flowing in the refrigerant circuit, and a reference value of operation state quantity of constituent equipment or refrigerant flowing in the refrigerant circuit.

When the adequacy of the refrigerant quantity is determined by the refrigerant quantity determining means, the state quantity correcting means corrects operation state quantity by using the refrigerant pressure or the refrigerant temperature in the indoor heat exchanger and the room temperature.

An air conditioner according to an eighth aspect of the present invention is an air conditioner comprising a refrigerant circuit configured by the interconnection of an outdoor unit having a compressor and an outdoor heat exchanger, and an indoor unit having an indoor heat exchanger via refrigerant communication pipes, the air conditioner comprising a refrigerant quantity determining means and a state quantity correcting means. The refrigerant quantity determining means determines the adequacy of the refrigerant quantity based on a current value of operation state quantity of constituent equipment or refrigerant flowing in the refrigerant circuit, and a reference value of operation state quantity of constituent equipment or refrigerant flowing in the refrigerant circuit. When the adequacy of the refrigerant quantity is determined by the refrigerant quantity determining means, the state quantity correcting means corrects operation state quantity by using the refrigerant pressure or the refrigerant temperature in the outdoor heat exchanger, the outdoor temperature, the refrigerant pressure or the refrigerant temperature in the indoor heat exchanger, and the room temperature.

A refrigerant quantity determining system of an air conditioner according to a ninth aspect of the present invention comprises a state quantity obtaining means, a state quantity storing means, a refrigerant quantity determining means, and a state quantity correcting means. The state quantity obtaining means obtains operation state quantity of constituent equipment or refrigerant flowing in a refrigerant circuit of the air conditioner. The air conditioner comprises the refrigerant circuit configured by the interconnection of an outdoor unit having a compressor and an outdoor heat exchanger, and an indoor unit having an indoor heat exchanger via refrigerant communication pipes. The state quantity storing means stores operation state quantity obtained by the state quantity obtaining means as a reference value of operation state quantity. The refrigerant quantity determining means determines the adequacy of the refrigerant quantity based on a current value of operation state quantity obtained by the state quantity obtaining means, and the reference value of operation state quantity stored in the state quantity storing means. When the adequacy of the refrigerant quantity is determined by the refrigerant quantity determining means, the state quantity correcting means corrects operation state quantity by using the refrigerant pressure or the refrigerant temperature in the outdoor heat exchanger, the outdoor temperature, the refrigerant pressure or the refrigerant temperature in the indoor heat exchanger, and the room temperature.

A refrigerant quantity determining system of an air conditioner according to a tenth aspect of the present invention is the refrigerant quantity determining system of the air conditioner according to the ninth aspect of the present invention, wherein the state quantity obtaining means manages the air conditioner. The state quantity storing means, the refrigerant quantity determining means, and the state quantity correcting means are located remotely from the air conditioner, and are connected to the state quantity obtaining means via a communication circuit.

An air conditioner according to an eleventh aspect of the present invention comprises a refrigerant circuit configured by the interconnection of a heat source unit having a compressor, a heat source side heat exchanger, and a receiver, and a utilization unit having a utilization side heat exchanger via refrigerant communication pipes, wherein the air conditioner is capable of at least performing operation in which the heat source side heat exchanger is caused to function as a condenser of the refrigerant compressed in the compressor and the utilization side heat exchanger is caused to function as an evaporator of the refrigerant sent from the heat source side heat exchanger via the receiver; and the air conditioner comprises a liquid level detecting means for detecting the liquid level in the receiver, an operation controlling means, and a refrigerant quantity determining means. The operation controlling means is capable of switching and operating between a normal operation mode where constituent equipment of the heat source unit and the utilization unit is controlled according to the operation loads of the utilization unit, and a refrigerant quantity determining operation mode where the control is performed based on a value detected by the liquid level detecting means such that the liquid level in the receiver becomes constant. The refrigerant quantity determining means determines the adequacy of the refrigerant quantity based on operation state quantity of constituent equipment or refrigerant flowing in the refrigerant circuit during the refrigerant quantity determining operation mode.

An air conditioner according to a twelfth aspect of the present invention is the air conditioner according to the eleventh aspect of the present invention, wherein the liquid level in the receiver in the refrigerant quantity determining operation mode is controlled so as to become constant at a higher liquid level than the liquid level in the receiver in the normal operation mode.

An air conditioner according to a thirteenth aspect of the present invention is the air conditioner according to either the eleventh aspect or the twelfth aspect of the present invention, wherein the heat source unit or the utilization unit further includes an expansion valve connected between the receiver and the utilization side heat exchanger, and the liquid level in the receiver in the refrigerant quantity determining operation mode is controlled so as to become constant by the expansion valve.

The air conditioner according to a fourteenth aspect of the present invention is the air conditioner according to any one of the eleventh aspect to the thirteenth aspect of the present invention, wherein the liquid level detecting means is a liquid level detection circuit capable of extracting a portion of the refrigerant in the receiver from a predetermined position in the receiver, depressurizing the portion, measuring the refrigerant temperature, and subsequently returning the portion back to the suction side of the compressor.

A refrigerant quantity determining system of an air conditioner according to a fifteenth aspect of the present invention comprises a state quantity obtaining means, a liquid level detecting means, an operation controlling means, a state quantity storing means, and a refrigerant quantity determining means. The state quantity obtaining means obtains operation state quantity from an air conditioner comprising a refrigerant circuit configured by the interconnection of a heat source unit having a compressor, a heat source side heat exchanger, and a receiver, and a utilization unit having a utilization side heat exchanger via refrigerant communication pipes, and a liquid level detecting means for detecting the liquid level in the receiver, and capable of at least performing operation in which the heat source side heat exchanger is caused to function as a condenser of the refrigerant compressed in the compressor and the utilization side heat exchanger is caused to function as an evaporator of the refrigerant sent from the heat source side heat exchanger via the receiver. The operation controlling means is capable switching and operating between a normal operation mode where constituent equipment of the heat source unit and the utilization unit are controlled according to the operation loads of the utilization unit, and a refrigerant quantity determining operation mode where the control is performed based on a value detected by the liquid level detecting means such that the liquid level in the receiver becomes constant. In the refrigerant quantity determining operation mode, the state quantity storing means stores operation state quantity obtained by the state quantity obtaining means as a reference value of operation state quantity. In the refrigerant quantity determining operation mode, the refrigerant quantity determining means determines the adequacy of the refrigerant quantity based on a current value of operation state quantity obtained by the state quantity obtaining means, and the reference value of operation state quantity stored in the state quantity storing means.

A refrigerant quantity determining system of an air conditioner according to a sixteenth aspect of the present invention is the refrigerant quantity determining system of the air conditioner according to the fifteenth aspect of the present invention, wherein the state quantity obtaining means manages the air conditioner. The state quantity storing means and the refrigerant quantity determining means are located remotely from the air conditioner, and are connected to the state quantity obtaining means via a communication circuit.

An air conditioner according to a seventeenth aspect of the present invention comprises a main refrigerant circuit configured by the interconnection of a heat source unit having a compressor, a heat source side heat exchanger, and a receiver, and a utilization unit having a utilization side expansion valve and a utilization side heat exchanger via refrigerant communication pipes, wherein the air conditioner is capable of at least performing operation in which the heat source side heat exchanger is caused to function as a condenser of the refrigerant compressed in the compressor and the utilization side heat exchanger is caused to function as an evaporator of the refrigerant sent from the heat source side heat exchanger via the receiver and the utilization side expansion valve; and the air conditioner comprises a bypass refrigerant circuit, a subcooler, and a refrigerant quantity determining means. The bypass refrigerant circuit includes a bypass side flow rate adjusting valve that adjusts the flow rate of the refrigerant, and is connected to the main refrigerant circuit so as to cause a portion of the refrigerant sent from the heat source side heat exchanger to the utilization side heat exchanger to branch from the main refrigerant circuit and return to a suction side of the compressor. The subcooler is disposed in the heat source unit, and cools the refrigerant sent from the receiver to the utilization side expansion valve by the refrigerant returned from an outlet of the bypass side flow rate adjusting valve to the suction side of the compressor. The refrigerant quantity determining means determines the adequacy of the refrigerant quantity based on at least one of the followings: the degree of subcooling of the refrigerant at an outlet of the subcooler and operation state quantity that fluctuates according to the fluctuation in the degree of subcooling.

An air conditioner according to an eighteenth aspect of the present invention is the air conditioner according to the seventeenth aspect of the present invention, wherein the bypass side flow rate adjusting valve is controlled such that the degree of superheating of the refrigerant at an outlet on a bypass refrigerant circuit side of the subcooler becomes a predetermined value.

An air conditioner according to a nineteenth aspect of the present invention is the air conditioner according to either the seventeenth aspect or the eighteenth aspect of the present invention, wherein the heat source unit further comprises a fan that supplies air as a heat source to the heat source side heat exchanger. When the adequacy of the refrigerant quantity is determined by the refrigerant quantity determining means, the fan controls the flow rate of air supplied to the heat source side heat exchanger such that the refrigerant pressure in the heat source side heat exchanger becomes equal to or higher than a predetermined value.

A refrigerant quantity determining system of an air conditioner according to a twentieth aspect of the present invention comprises a state quantity obtaining means, a bypass refrigerant circuit, a subcooler, a state quantity storing means, and a refrigerant quantity determining means. The state quantity obtaining means obtains operation state quantity from an air conditioner comprising a main refrigerant circuit configured by the interconnection of a heat source unit having a compressor, a heat source side heat exchanger, and a receiver, and a utilization unit having a utilization side heat exchanger via refrigerant communication pipes; a bypass refrigerant circuit which includes a bypass side flow rate adjusting valve that adjusts the flow rate of the refrigerant and which is connected to the main refrigerant circuit so as to cause a portion of the refrigerant sent from the heat source side heat exchanger to the utilization side heat exchanger to branch from the main refrigerant circuit and return to a suction side of the compressor; and a subcooler which is disposed in the heat source unit and which cools the refrigerant sent from the receiver to the utilization side expansion valve by the refrigerant returned from an outlet of the bypass side flow rate adjusting valve to the suction side of the compressor, and the air conditioner being capable of at least performing operation in which the heat source side heat exchanger is caused to function as a condenser of the refrigerant compressed in the compressor and the utilization side heat exchanger is caused to function as an evaporator of the refrigerant sent from the heat source side heat exchanger via the receiver, the subcooler and the utilization side expansion valve. The state quantity storing means stores, as a reference value of operation state quantity, at least one of the followings obtained by the state quantity obtaining means: the degree of subcooling of the refrigerant at an outlet of the subcooler and operation state quantity that fluctuates according to the fluctuation in the degree of subcooling. The refrigerant quantity determining means determines the adequacy of the refrigerant quantity based on at least one of the following current values obtained by the state quantity obtaining means: the degree of subcooling of the refrigerant at the outlet of the subcooler and operation state quantity that fluctuates according to the fluctuation in the aforementioned degree of subcooling; and also based on the reference value of operation state quantity stored in the state quantity storing means.

A refrigerant quantity determining system of an air conditioner according to a twenty-first aspect of the present invention is the refrigerant quantity determining system of the air conditioner according to the twentieth aspect of the present invention, wherein the state quantity obtaining means manages the air conditioner. The state quantity storing means and the refrigerant quantity determining means are located remotely from the air conditioner, and are connected to the state quantity obtaining means via a communication circuit.

A method for adding a refrigerant quantity determining function of an air conditioner according to a twenty-second aspect of the present invention is a method for adding a function to determine the adequacy of the refrigerant quantity in an air conditioner comprising a refrigerant circuit configured by the interconnection of a heat source unit with actual use history having a compressor, a heat source side heat exchanger, and a receiver, and a utilization unit having a utilization side heat exchanger via refrigerant communication pipes, wherein a subcooling device that cools refrigerant flowing between the receiver and the utilization side heat exchanger is disposed in the heat source unit, and a refrigerant quantity determining means is disposed which determines the adequacy of the refrigerant quantity based on at least one of the followings: the degree of subcooling of the refrigerant at an outlet of the subcooling device and operation state quantity that fluctuates according to the fluctuation in the degree of subcooling. Note that the "heat source unit with actual use history" refers to a heat source unit whose manufacturing process has been completed and at least refrigerant has been charged therein.

A method for adding a refrigerant quantity determining function of an air conditioner according to a twenty-third aspect of the present invention is the method for adding a refrigerant quantity determining function of an air conditioner according to the twenty-second aspect of the present invention, wherein the subcooling device is a heat exchanger connected between the receiver and the utilization side heat exchanger; and before connecting the subcooling device between the receiver and the utilization side heat exchanger, refrigerant is extracted from the refrigerant circuit, the subcooling device is connected between the receiver and the utilization side heat exchanger, and a subcooling refrigerant circuit that supplies refrigerant flowing in the refrigerant circuit as a cooling source to the subcooling device is disposed in the heat source unit.

A method for adding a refrigerant quantity determining function of an air conditioner according to a twenty-fourth aspect of the present invention is the method for adding a refrigerant quantity determining function of an air conditioner according to the twenty-second aspect of the present invention, wherein the subcooling device can be attached to an outer circumference portion of the refrigerant pipe that interconnects the receiver and the utilization side heat exchanger.

An air conditioner according to a twenty-fifth aspect of the present invention comprises a refrigerant circuit configured by the interconnection of a heat source unit having a compressor, a heat source side heat exchanger, and a receiver, and a utilization unit having a utilization side heat exchanger via refrigerant communication pipes, wherein the air conditioner is capable of at least performing operation in which the heat source side heat exchanger is caused to function as a condenser of the refrigerant compressed in the compressor and the utilization side heat exchanger is caused to function as an evaporator of the refrigerant sent from the heat source side heat exchanger via the receiver; and the air conditioner comprises a subcooling device and a refrigerant quantity determining means. The subcooling device can be attached to an outer circumference portion of the refrigerant pipe that interconnects the receiver and the utilization side heat exchanger. The refrigerant quantity determining means determines the adequacy of the refrigerant quantity based on at least one of the followings: the degree of subcooling of the refrigerant at an outlet of the subcooling device and operation state quantity that changes according to the fluctuation in the degree of subcooling.

A refrigerant quantity determining system of an air conditioner according to a twenty-sixth aspect of the present invention comprises a state quantity obtaining means, a state quantity storing means, and a refrigerant quantity determining means. The state quantity obtaining means obtains operation state quantity from an air conditioner comprising a refrigerant circuit configured by the interconnection of a heat source unit having a compressor, a heat source side heat exchanger, and a receiver, and a utilization unit having a utilization side heat exchanger via refrigerant communication pipes; and a subcooling device attached to an outer circumference of the refrigerant pipe that interconnects the receiver and the utilization side heat exchanger in order to cool the refrigerant sent from the receiver to the utilization side heat exchanger, and the air conditioner being capable of at least performing operation in which the heat source side heat exchanger is caused to function as a condenser of the refrigerant compressed in the compressor and the utilization side heat exchanger is caused to function as an evaporator of the refrigerant sent from the heat source side heat exchanger via the receiver, the subcooling device and the utilization side expansion valve. The state quantity storing means stores, as a reference value of operation state quantity, at least one of the followings obtained by the state quantity obtaining means: the degree of subcooling of the refrigerant at an outlet of the subcooling device and operation state quantity that fluctuates according to the fluctuation in the degree of subcooling. The refrigerant quantity determining means determines the adequacy of the refrigerant quantity based on of at least one of the followings current values obtained by the state quantity obtaining means: the degree of subcooling of the refrigerant at the outlet of the subcooling device and operation state quantity that fluctuates according to the fluctuation in the degree of subcooling; and also based on the reference value of operation state quantity stored in the state quantity storing means.

A refrigerant quantity determining system of an air conditioner according to a twenty-seventh aspect of the present invention is the refrigerant quantity determining system of the air conditioner according to the twenty-sixth aspect of the present invention, wherein the state quantity obtaining means manages the air conditioner. The state quantity storing means and the refrigerant quantity determining means are located remotely from the air conditioner, and are connected to the state quantity obtaining means via a communication circuit.

DESCRIPTION OF THE REFERENCE NUMERALS

| | |
|---|---|
| 1, 101, 201, 301 | air conditioner |
| 2, 102, 202, 302 | outdoor unit |
| 4, 5, 104, 105, 204, 205, 304, 305 | indoor unit |
| 6, 7, 106, 107, 206, 207, 306, 307 | refrigerant communication pipe |
| 10, 110, 210, 310 | refrigerant circuit |

BEST MODE FOR CARRYING OUT THE INVENTION

Preferred embodiments of a refrigerant quantity determining system of an air conditioner according to the present invention are described below with reference to the drawings.

First Embodiment

(1) Configuration of the Air Conditioner

Figure 1:
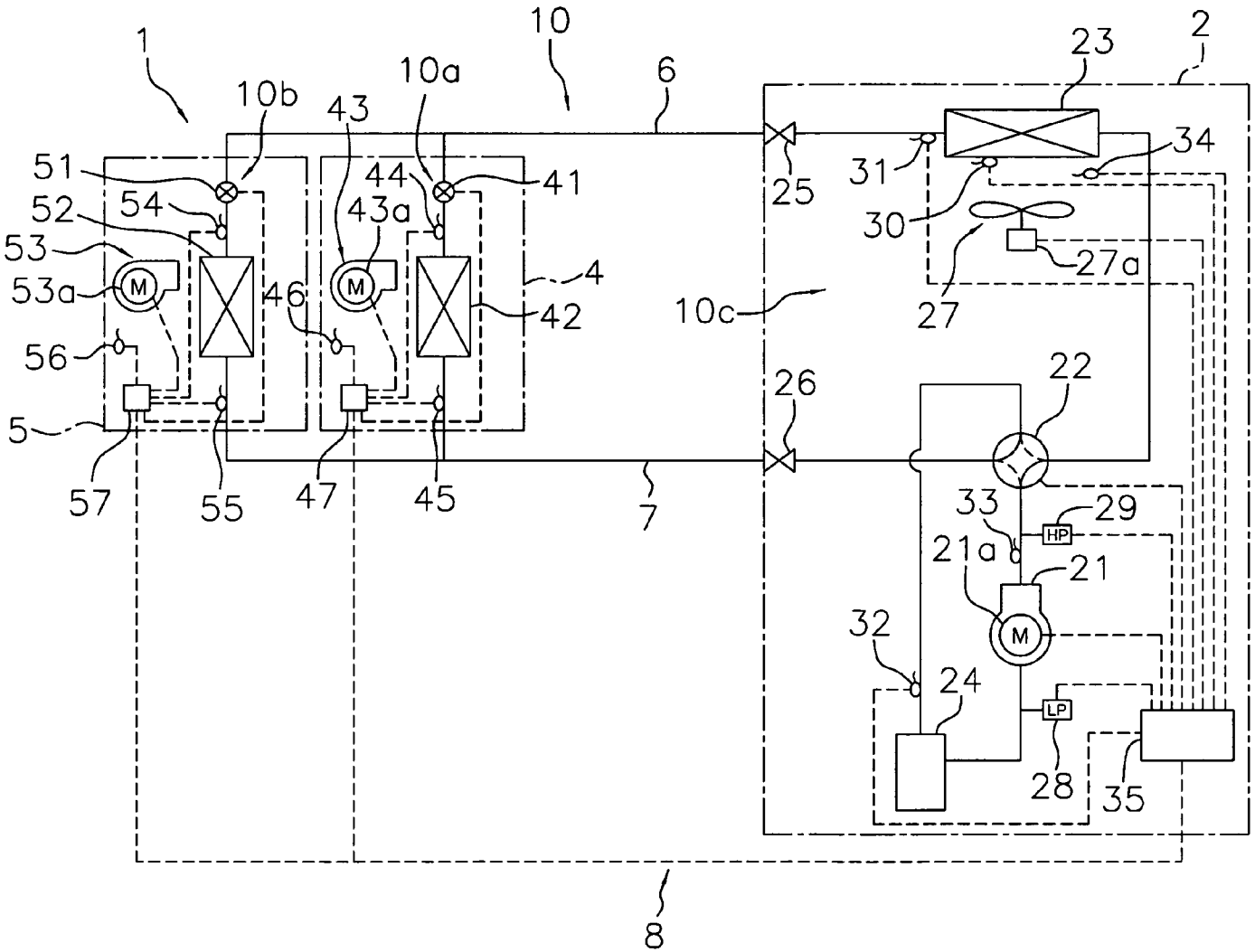
FIG. 1 is a schematic refrigerant circuit diagram of an air conditioner in which a refrigerant quantity determining system according to a first embodiment of the present invention is employed.

FIG. 1 is a schematic refrigerant circuit diagram of an air conditioner 1 in which a refrigerant quantity determining system according to a first embodiment of the present invention is employed. The air conditioner 1 is a device that is used to cool and heat the inside of a building and the like by performing a vapor compression-type refrigeration cycle operation. The air conditioner 1 mainly comprises one outdoor unit 2 as a heat source unit, indoor units 4 and 5 as a plurality of (two in the present embodiment) utilization units connected in parallel thereto, and a liquid refrigerant communication pipe 6 and a gas refrigerant communication pipe 7 as refrigerant communication pipes which interconnect the outdoor unit 2 and the indoor units 4 and 5. In other words, a vapor compression-type the refrigerant circuit 10 of the air conditioner 1 in the present embodiment is configured by the interconnection of the outdoor unit 2, the indoor units 4 and 5, and the liquid refrigerant communication pipe 6 and the gas refrigerant communication pipe 7.

<Indoor Unit>

The indoor units 4 and 5 are installed by being embedded in or hung from a ceiling inside of a building and the like or by being mounted on a wall surface inside of a building. The indoor units 4 and 5 are connected to the outdoor unit 2 via the liquid refrigerant communication pipe 6 and the gas refrigerant communication pipe 7, and configure a part of the refrigerant circuit 10.

Next, the configurations of the indoor units 4 and 5 are described. Note that, since the indoor units 4 and 5 have the same configuration, only the configuration of the indoor unit 4 is described here, and in regard to the configuration of the indoor unit 5, reference numerals in the 50s are used instead of reference numerals in the 40s representing the respective portions of the indoor unit 4, and description of those respective portions are omitted.

The indoor unit 4 mainly comprises an indoor side refrigerant circuit 10*a* (in the indoor unit 5, an indoor side refrigerant circuit 10*b*) that configures a part of the refrigerant circuit 10. The indoor side refrigerant circuit 10*a* mainly comprises an indoor expansion valve 41 as a utilization side expansion valve and an indoor heat exchanger 42 as a utilization side heat exchanger.

In the present embodiment, the indoor expansion valve 41 is an electrically powered expansion valve connected to a liquid side of the indoor heat exchanger 42 in order to adjust the flow rate or the like of the refrigerant flowing in the indoor side refrigerant circuit 10*a*.

In the present embodiment, the indoor heat exchanger 42 is a cross fin-type fin-and-tube type heat exchanger configured by a heat transfer tube and numerous fins, and is a heat exchanger that functions as an evaporator of the refrigerant during cooling operation to cool the room air and functions as a condenser of the refrigerant during heating operation to heat the room air.

In the present embodiment, the indoor unit 4 comprises an indoor fan 43 for taking in room air into the unit, performing heat exchange and then supplying the air to the room as supply air, and is capable of performing heat exchange between the room air and the refrigerant flowing in the indoor heat exchanger 42. The indoor fan 43 is a fan capable of varying the flow rate of the air it supplies to the indoor heat exchanger 42, and in the present embodiment, is a centrifugal fan, multi-blade fan, or the like, which is driven by a motor 43*a* comprising a DC fan motor.

In addition, various types of sensors are disposed in the indoor unit 4. A liquid side temperature sensor 44 that detects the temperature of the refrigerant in a liquid state or a gas-liquid two-phase state (i.e., the refrigerant temperature corresponding to the condensation temperature Tc during heating operation or the evaporation temperature Te during cooling operation) is disposed at the liquid side of the indoor heat exchanger 42. A gas side temperature sensor 45 that detects the temperature of the refrigerant in a gas state or a gas-liquid two-phase state is disposed at a gas side of the indoor heat exchanger 42. A room temperature sensor 46 that detects the temperature of the room air that flows into the unit (i.e., the room temperature Tr) is disposed at a room air intake side of the indoor unit 4. In the present embodiment, the liquid side temperature sensor 44, the gas side temperature sensor 45, and the room temperature sensor 46 comprise thermistors. In addition, the indoor unit 4 comprises an indoor side controller 47 that controls the operation of each portion constituting the indoor unit 4. Additionally, the indoor side controller 47 includes a microcomputer and a memory and the like disposed in order to control the indoor unit 4, and is configured such that it can exchange control signals and the like with a remote controller (not shown) for separately operating the indoor unit 4 and can exchange control signals and the like with the outdoor unit 2.

<Outdoor Unit>

The outdoor unit 2 is installed on the roof or the like of a building and the like, is connected to the indoor units 4 and 5 via the liquid refrigerant communication pipe 6 and the gas refrigerant communication pipe 7, and configures the refrigerant circuit 10 with the indoor units 4 and 5.

Next, the configuration of the outdoor unit 2 is described. The outdoor unit 2 mainly comprises an outdoor side refrigerant circuit 10*c* that configures a part of the refrigerant circuit 10. This outdoor side refrigerant circuit 10*c* mainly comprises a compressor 21, a four-way switching valve 22, an outdoor heat exchanger 23 as a heat source side heat exchanger, an accumulator 24, a liquid side stop valve 25, and a gas side stop valve 26.

The compressor 21 is a compressor whose operation capacity can be varied, and in the present embodiment, is a positive displacement-type compressor driven by a motor 21*a* controlled by an inverter. In the present embodiment, the compressor 21 comprises only one compressor, but the compressor is not limited thereto and may also be one where two or more compressors are connected in parallel depending on the connection number of indoor units and the like.

The four-way switching valve 22 is a valve for switching the direction of the flow of the refrigerant such that, during cooling operation, the four-way switching valve 22 is capable of connecting a discharge side of the compressor 21 and a gas side of the outdoor heat exchanger 23 and connecting an suction side of the compressor 21 (specifically, the accumulator 24) and the gas refrigerant communication pipe 7 (see the solid lines of the four-way switching valve 22 in FIG. 1) to cause the outdoor heat exchanger 23 to function as a condenser of the refrigerant compressed in the compressor 21 and to cause the indoor heat exchangers 42 and 52 to function as evaporators of the refrigerant condensed in the outdoor heat exchanger 23; and such that, during heating operation, the four-way switching valve 22 is capable of connecting the discharge side of the compressor 21 and the gas refrigerant communication pipe 7 and connecting the suction side of the compressor 21 and the gas side of the indoor heat exchanger 23 (see the dotted lines of the four-way switching valve 22 in FIG. 1) to cause the indoor heat exchangers 42 and 52 to function as condensers of the refrigerant compressed in the compressor 21 and to cause the outdoor heat exchanger 23 to function as an evaporator of the refrigerant condensed in the indoor heat exchangers 42 and 52.

In the present embodiment, the outdoor heat exchanger 23 is a cross-fin type fin-and-tube type heat exchanger configured by a heat transfer tube and numerous fins, and is a heat exchanger that functions as a condenser of the refrigerant during cooling operation and as an evaporator of the refrigerant during heating operation. The gas side of the outdoor heat exchanger 23 is connected to the four-way switching valve 22, and the liquid side thereof is connected to the liquid refrigerant communication pipe 6.

In the present embodiment, the outdoor unit 2 comprises an outdoor fan 27 for taking in outdoor air into the unit, supplying the air to the outdoor heat exchanger 23, and then discharging the air to the outside, and is capable of performing heat exchange between the outdoor air and the refrigerant flowing in the outdoor heat exchanger 23. The outdoor fan 27 is a fan capable of varying the flow rate of the air it supplies to the outdoor heat exchanger 23, and in the present embodiment, is a propeller fan driven by a motor 27*a* comprising a DC fan motor.

The accumulator 24 is connected between the four-way switching valve 22 and the compressor 21, and is a container capable of accumulating excess refrigerant generated in the refrigerant circuit 10 depending on the operation loads of the indoor units 4 and 5.

The liquid side stop valve 25 and the gas side stop valve 26 are valves disposed at ports connected to external equipment and pipes (specifically, the liquid refrigerant communication pipe 6 and the gas refrigerant communication pipe 7). The liquid side stop valve 25 is connected to the outdoor heat exchanger 23. The gas side stop valve 26 is connected to the four-way switching valve 22.

Figure 2:
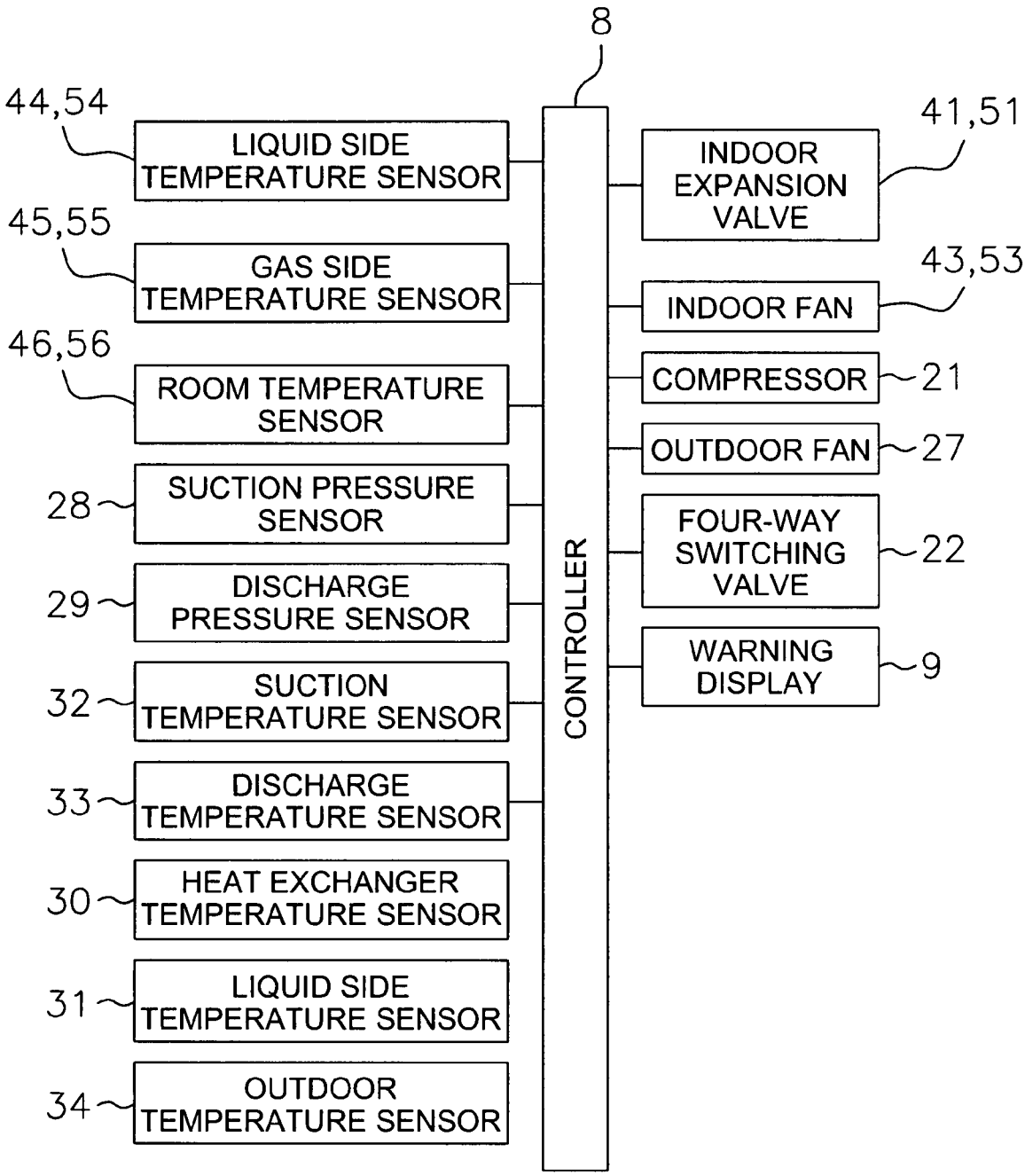
FIG. 2 is a control block diagram of the air conditioner.

In addition, various types of sensors are disposed in the outdoor unit 2. Specifically, disposed in the outdoor unit 2 are an suction pressure sensor 28 that detects the suction pressure Ps of the compressor 21, a discharge pressure sensor 29 that detects the discharge pressure Pd of the compressor 21, a suction temperature sensor 32 that detects the suction temperature Ts of the compressor 21, and a discharge temperature sensor 33 that detects the discharge temperature Td of the compressor 21. The suction temperature sensor 32 is disposed at an inlet side of the accumulator 24. A heat exchanger temperature sensor 30 that detects the temperature of the refrigerant flowing in the outdoor heat exchanger 23 (i.e., the refrigerant temperature corresponding to the condensation temperature Tc during cooling operation or the evaporation temperature Te during heating operation) is disposed in the outdoor heat exchanger 23. A liquid side temperature sensor 31 that detects the temperature of the refrigerant in a liquid state or gas-liquid two-phase state is disposed at the liquid side of the outdoor heat exchanger 23. An outdoor temperature sensor 34 that detects the temperature of the outdoor air that flows into the unit (i.e., the outdoor temperature Ta) is disposed at an outdoor air intake side of the outdoor unit 2. In addition, the outdoor unit 2 comprises an outdoor side controller 35 that controls the operation of each portion constituting the outdoor unit 2. Additionally, the outdoor side controller 35 includes a microcomputer and a memory disposed in order to control the outdoor unit 2, an inverter circuit that controls the motor 21*a*, and the like, and is configured such that it can exchange control signals and the like with the indoor side controller 47 and 57 of the indoor units 4 and 5. In other words, a controller 8 that performs operation control of the entire air conditioner 1 is configured by the indoor side controllers 47 and 57 and the outdoor side controller 35. As shown in FIG. 2, the controller 8 is connected so as to be able to receive detection signals of sensors 29 to 34, 44 to 46, and 54 to 56, and to be able to control various equipment and valves 21, 22, 27*a*, 41, 43*a*, 51, and 53*a* based on these detection signals and the like. In addition, a warning display 9 comprising LEDs and the like, which is configured to indicate that a refrigerant leak is detected in the below described refrigerant leak detection mode, is connected to the controller 8. Here, FIG. 2 is a control block diagram of the air conditioner 1.

As described above, the refrigerant circuit 10 of the air conditioner 1 is configured by the interconnection of the indoor side refrigerant circuits 10*a* and 10*b*, the outdoor side refrigerant circuit 10*c*, and the refrigerant communication pipes 6 and 7. Additionally, with the controller 8 comprising the indoor side controllers 47 and 57 and the outdoor side controller 35, the air conditioner 1 in the present embodiment is configured to switch and operate between cooling operation and heating operation by the four-way switching valve 22 and to control each equipment of the outdoor unit 2 and the indoor units 4 and 5 depending on the operation load of each of the indoor units 4 and 5.

(2) Operation of the Air Conditioner

Next, the operation of the air conditioner 1 in the present embodiment is described.

Operation modes of the air conditioner 1 in the present embodiment include: a normal operation mode where control of each equipment of the outdoor unit 2 and the indoor units 4 and 5 is performed depending on the operation load of each of the indoor units 4 and 5; a test operation mode where test operation to be performed after installment of the air conditioner 1 is performed; and a refrigerant leak detection mode where, after test operation is finished and normal operation has started, the adequacy of the refrigerant quantity charged in the refrigerant circuit 10 is determined by detecting the degree of subcooling of the refrigerant at the outlet of the outdoor exchanger 23 that functions as a condenser while causing of the indoor units 4 and 5 to perform cooling operation. The normal operation mode mainly includes cooling operation and heating operation. In addition, the test operation mode includes automatic refrigerant charging operation and control variables changing operation.

Operation in each operation mode of the air conditioner 1 is described below.

<Normal Operation Mode>

First, cooling operation in the normal operation mode is described with reference to FIGS. 1 and 2.

During cooling operation, the four-way switching valve 22 is in the state represented by the solid lines in FIG. 1, i.e., a state where the discharge side of the compressor 21 is connected to the gas side of the outdoor heat exchanger 23 and also the suction side of the compressor 21 is connected to the gas sides of the indoor heat exchangers 42 and 52. In addition, the liquid side stop valve 25 and the gas side stop valve 26 are opened, and the opening degree of the indoor expansion valves 41 and 51 is adjusted such that the degree of superheating of the refrigerant at the outlets of the indoor heat exchangers 42 and 52 becomes a predetermined value. In the present embodiment, the degree of superheating of the refrigerant at the outlets of the indoor heat exchangers 42 and 52 is detected by subtracting a refrigerant temperature value detected by the liquid side temperature sensors 44 and 54 from a refrigerant temperature value detected by the gas side temperature sensors 45 and 55, or is detected by converting the suction pressure Ps of the compressor 21 detected by the suction pressure sensor 28 to a saturated temperature value corresponding to the evaporation temperature Te and subtracting this saturated temperature value of the refrigerant from a refrigerant temperature value detected by the gas side temperature sensors 45 and 55. Note that, although it is not employed in the present embodiment, a temperature sensor that detects the temperature of the refrigerant flowing in the indoor heat exchangers 42 and 52 may be disposed such that the degree of superheating of the refrigerant at the outlets of the indoor heat exchangers 42 and 52 is detected by subtracting a refrigerant temperature value corresponding to the evaporation temperature Te which is detected by this temperature sensor from a refrigerant temperature value detected by the gas side temperature sensors 45 and 55.

When the compressor 21, the outdoor fan 27, the indoor fans 43 and 53 are started in this state of the refrigerant circuit 10, low-pressure gas refrigerant is sucked into the compressor 21 and compressed into high-pressure gas refrigerant. Subsequently, the high-pressure gas refrigerant is sent to the outdoor heat exchanger 23 via the four-way switching valve 22, exchanges heat with the outdoor air supplied by the outdoor fan 27, and is condensed into high-pressure liquid refrigerant.

Then, this high-pressure liquid refrigerant is sent to the indoor units 4 and 5 via the liquid side stop valve 25 and the liquid refrigerant communication pipe 6.

The high-pressure liquid refrigerant sent to the indoor units 4 and 5 is depressurized by the indoor expansion valves 41 and 51, becomes refrigerant in a low-pressure gas-liquid two-phase state, is sent to the indoor heat exchangers 42 and 52, exchanges heat with the room air in the indoor heat exchangers 42 and 52, and is evaporated into low-pressure gas refrigerant. Here, the indoor expansion valves 41 and 51 control the flow rate of the refrigerant flowing in the indoor heat exchangers 42 and 52 such that the degree of superheating at the outlets of the indoor heat exchangers 42 and 52 becomes a predetermined value. Consequently, the low-pressure gas refrigerant evaporated in the indoor heat exchangers 42 and 52 is in a state of having a predetermined degree of superheating. In this way, the refrigerant whose flow rate corresponds to the operation loads required for the air-conditioned space where each of the indoor units 4 and 5 is installed flows in each of the indoor heat exchangers 42 and 52.

This low-pressure gas refrigerant is sent to the outdoor unit 2 via the gas refrigerant communication pipe 7 and flows into the accumulator 24 via the gas side stop valve 26 and the four-way switching valve 22. Then, the low-pressure gas refrigerant that flowed into the accumulator 24 is again sucked into the compressor 21. Here, when an excess quantity of the refrigerant is generated in the refrigerant circuit 10 depending on the operation loads of the indoor units 4 and 5, for example such as when the operation load of one of the indoor units 4 and 5 is small or one of them is stopped, or when the operation loads of both of the indoor units 4 and 5 are small, the excess refrigerant is accumulated in the accumulator 24.

Next, heating operation in the normal operation mode is described.

During heating operation, the four-way switching valve 22 is in the state represented by the dotted lines in FIG. 1, i.e., a state where the discharge side of the compressor 21 is connected to the gas sides of the indoor heat exchangers 42 and 52 and also the suction side of the compressor 21 is connected to the gas side of the outdoor heat exchanger 23. In addition, the liquid side stop valve 25 and the gas side stop valve 26 are opened, and the opening degree of the indoor expansion valves 41 and 51 is adjusted such that the degree of subcooling of the refrigerant at the outlets of the indoor heat exchangers 42 and 52 becomes a predetermined value. In the present embodiment, the degree of subcooling of the refrigerant at the outlets of the indoor heat exchangers 42 and 52 is detected by converting the discharge pressure Pd of the compressor 21 detected by the discharge pressure sensor 29 to a saturated temperature value corresponding to the condensation temperature Tc and subtracting a refrigerant temperature value detected by the liquid side temperature sensors 44 and 54 from this saturated temperature value of the refrigerant. Note that, although it is not employed in the present embodiment, a temperature sensor that detects the temperature of the refrigerant flowing in the indoor heat exchangers 42 and 52 may be disposed such that the degree of subcooling of the refrigerant at the outlets of the indoor heat exchangers 42 and 52 is detected by subtracting a refrigerant temperature value corresponding to the condensation temperature Tc which is detected by this temperature sensor from a refrigerant temperature value detected by the liquid side temperature sensors 44 and 54.

When the compressor 21, the outdoor fan 27, and the indoor fans 43 and 53 are started in this state of the refrigerant circuit 10, low-pressure gas refrigerant is sucked into the compressor 21, compressed into high-pressure gas refrigerant, and sent to the indoor units 4 and 5 via the four-way switching valve 22, the gas side stop valve 26, and the gas refrigerant communication pipe 7.

Then, the high-pressure gas refrigerant sent to the indoor units 4 and 5 exchanges heat with the room air in the outdoor heat exchangers 42 and 52 and is condensed into high-pressure liquid refrigerant. Subsequently, it is depressurized by the indoor expansion valves 41 and 51 and becomes refrigerant in a low-pressure gas-liquid two-phase state. Here, the indoor expansion valves 41 and 51 control the flow rate of the refrigerant flowing in the indoor heat exchangers 42 and 52 such that the degree of subcooling at the outlets of the indoor heat exchangers 42 and 52 becomes a predetermined value. Consequently, the high-pressure liquid refrigerant condensed in the indoor heat exchangers 42 and 52 is in a state of having a predetermined degree of subcooling. In this way, the refrigerant whose flow rate corresponds to the operation loads required for the air-conditioned space where each of the indoor units 4 and 5 is installed flows in each of the indoor heat exchangers 42 and 52.

This refrigerant in a low-pressure gas-liquid two-phase state is sent to the outdoor unit 2 via the liquid refrigerant communication pipe 6 and flows into the outdoor heat exchanger 23 via the liquid side stop valve 25. Then, the refrigerant in a low-pressure gas-liquid two-phase state flowing into the outdoor heat exchanger 23 exchanges heat with the outdoor air supplied by the outdoor fan 27, is condensed into low-pressure gas refrigerant, and flows into the accumulator 24 via the four-way switching valve 22. Then, the low-pressure gas refrigerant that flowed into the accumulator 24 is again sucked into the compressor 21. Here, depending on the operation loads of the indoor units 4 and 5, when an excess quantity of the refrigerant is generated in the refrigerant circuit 10, for example such as when the operation load of one of the indoor units 4 and 5 is small or one of them is stopped, or when the operation loads of both of the indoor units 4 and 5 are small, the excess refrigerant is accumulated in the accumulator 24 as is the case during cooling operation.

In this way, normal operation process that includes the above described cooling operation and heating operation is performed by the controller 8 that functions as a normal operation controlling means for performing normal operation that includes cooling operation and heating operation.

<Test Operation Mode>

Figure 3:
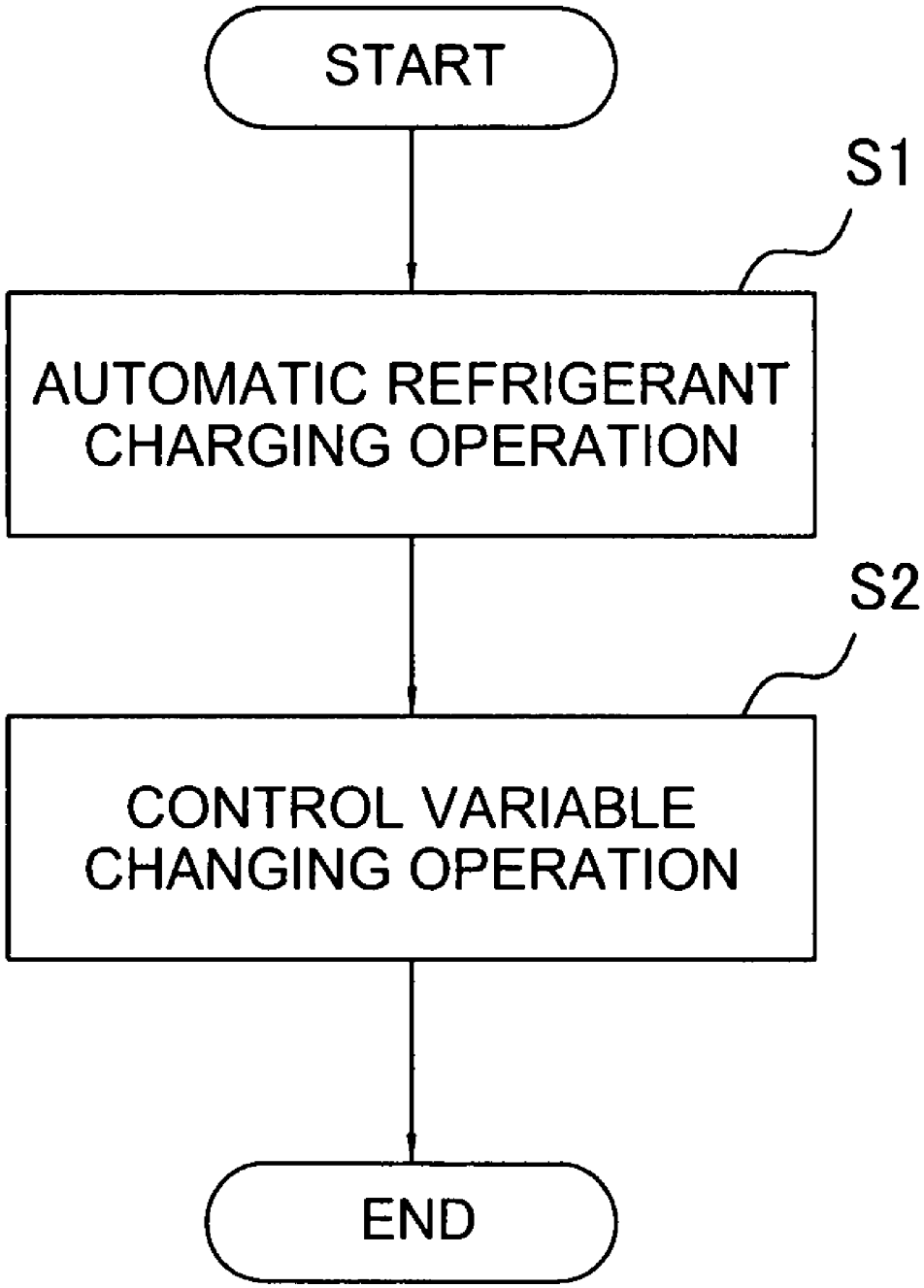
FIG. 3 is a flowchart of a test operation mode.

Next, the test operation mode is described with reference to FIGS. 1 to 3. Here, FIG. 3 is a flowchart of the test operation mode. In the present embodiment, in the test operation mode, automatic refrigerant charging operation in Step S1 is first performed. Subsequently, control variables changing operation in Step S2 is performed.

In the present embodiment, an example of a case is described where, the outdoor unit 2 in which a prescribed quantity of the refrigerant is charged in advance and the indoor units 4 and 5 are installed and interconnected via the liquid refrigerant communication pipe 6 and the gas refrigerant communication pipe 7 to configure the refrigerant circuit 10 on site, and subsequently additional refrigerant is charged in the refrigerant circuit 10 whose refrigerant quantity is insufficient depending on the lengths of the liquid refrigerant communication pipe 6 and the gas refrigerant communication pipe 7.

<Step S1: Automatic Refrigerant Charging Operation>

First, the liquid side stop valve 25 and the gas side stop valve 26 of the outdoor unit 2 are opened and the refrigerant circuit 10 is filled with the refrigerant that is charged in the outdoor unit 2 in advance.

Figure 4:
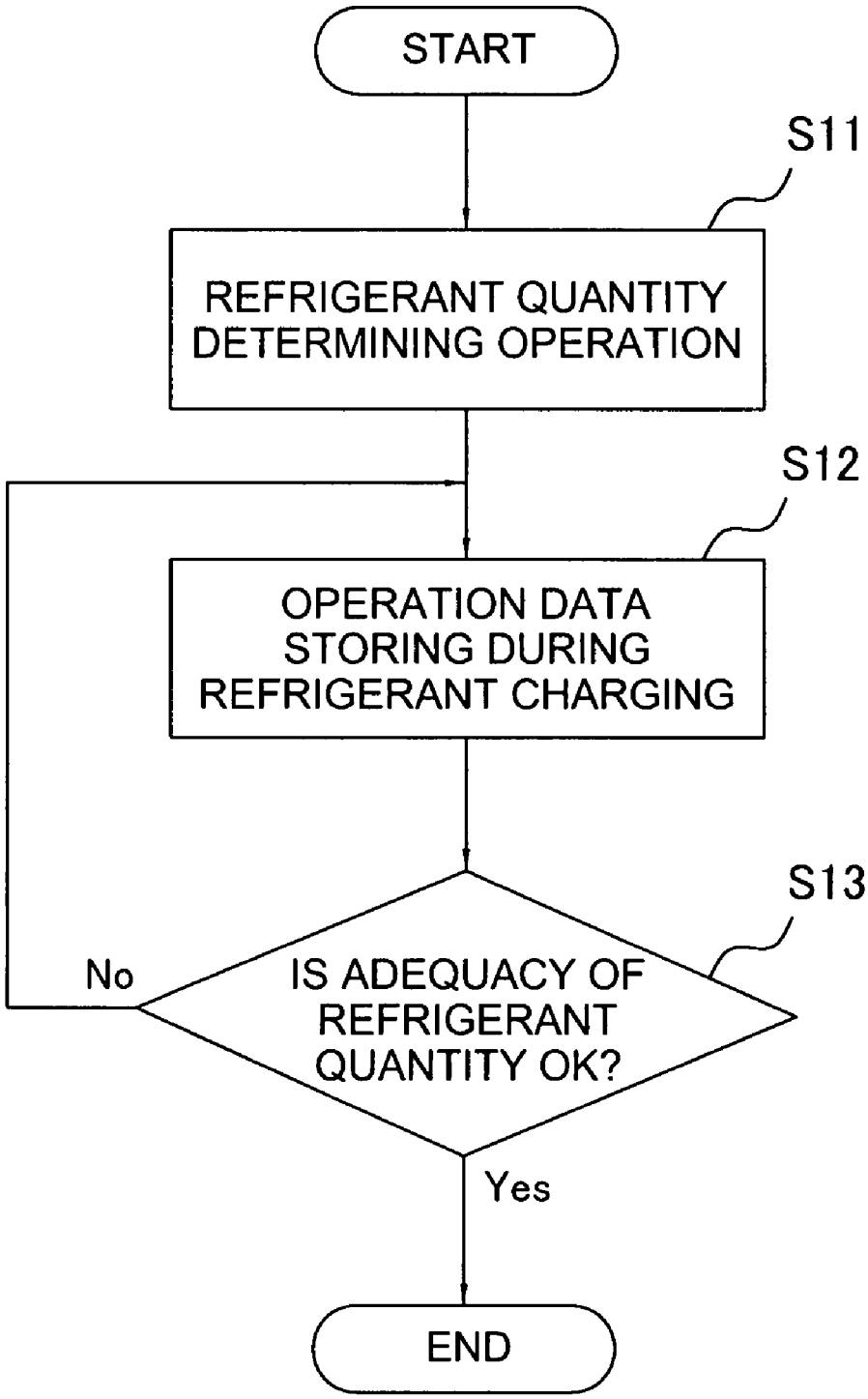
FIG. 4 is a flowchart of an automatic refrigerant charging operation.

Next, when a person performing test operation issues a command to start test operation directly to the controller 8 or remotely by a remote controller (not shown) and the like, the controller 8 starts the process from Step S11 to Step S13 shown in FIG. 4. Here, FIG. 4 is a flowchart of automatic refrigerant charging operation.

<Step S11: Refrigerant Quantity Determining Operation>

When a command to start automatic refrigerant charging operation is issued, the refrigerant circuit 10, with the four-way switching valve 22 of the outdoor unit 2 in the state represented by the solid lines in FIG. 1, becomes a state where the indoor expansion valves 41 and 51 of the indoor units 4 and 5 are opened. Then, the compressor 21, the outdoor fan 27, and the indoor fans 43 and 53 are started, and cooling operation is forcibly performed in all of the indoor units 4 and 5 (hereinafter referred to as "all indoor unit operation").

Consequently, in the refrigerant circuit 10, the high-pressure gas refrigerant that has been compressed and discharged in the compressor 21 flows along a flow path from the compressor 21 to the outdoor heat exchanger 23 that functions as a condenser; the high-pressure refrigerant that undergoes phase-change from a gas state to a liquid state by heat exchange with the outdoor air flows in the outdoor heat exchanger 23 that functions as a condenser; the high-pressure liquid refrigerant flows along a flow path including the liquid refrigerant communication pipe 6 from the outdoor heat exchanger 23 to the indoor expansion valves 41 and 51; the low-pressure refrigerant that undergoes phase-change from a gas-liquid two-phase state to a gas state by heat exchange with the room air flows in the indoor heat exchangers 42 and 52 that function as evaporators; and the low-pressure gas refrigerant flows along a flow path including the gas refrigerant communication pipe 7 and the accumulator 24 from the indoor heat exchangers 42 and 52 to the compressor 21.

Next, equipment control described below is performed to proceed to operation to stabilize the state of the refrigerant circulating in the refrigerant circuit 10. Specifically, the motor 21*a* of the compressor 21 is controlled such that the rotation frequency f becomes constant at a predetermined value (compressor rotation frequency constant control) and the indoor expansion valves 41 and 51 are controlled such that the degree of superheating $SH_i$ of the indoor heat exchangers 42 and 52 that function as evaporators becomes constant at a predetermined value (hereinafter referred to as "indoor heat exchange superheat degree constant control"). Here, the reason to perform the rotation frequency constant control is to stabilize the flow rate of the refrigerant sucked into and discharged by the compressor 21. In addition, the reason to perform the superheat degree control is to maintain constant the refrigerant quantity in the indoor heat exchangers 42 and 52 and the gas refrigerant communication pipe 7.

Consequently, in the refrigerant circuit 10, the state of the refrigerant circulating in the refrigerant circuit 10 becomes stabilized, and the refrigerant quantity in equipment other than the outdoor heat exchanger 23 and in the pipes becomes substantially constant. Therefore, when refrigerant charging into the refrigerant circuit 10 starts by additional refrigerant charging which is performed subsequently, it is possible to create a state where only liquid refrigerant quantity that is accumulated in the outdoor heat exchanger 23 changes (hereinafter this operation is referred to as "refrigerant quantity determining operation").

In this way, the process in Step S11 is performed by the controller 8 that functions as the refrigerant quantity determining operation controlling means for performing refrigerant quantity determining operation including all indoor unit operation, compressor rotation frequency constant control, and indoor heat exchange superheat degree constant control.

Note that, unlike the present embodiment, when refrigerant is not charged in advance in the outdoor unit 2, it is necessary prior to Step S11 to charge refrigerant until the refrigerant quantity reaches a level where refrigerating cycle operation can be performed.

<Step S12: Operation Data Storing During Refrigerant Charging>

Next, additional refrigerant is charged into the refrigerant circuit 10 while performing the above described refrigerant quantity determining operation. At this time, in Step S12, the operation state quantity of constituent equipment or the refrigerant flowing in the refrigerant circuit 10 during additional refrigerant charging is obtained as the operation data and stored in the memory of the controller 8. In the present embodiment, the degree of subcooling $SC_o$ at the outlet of the outdoor heat exchanger 23, the outdoor temperature Ta, the room temperature Tr, the discharge pressure Pd, and the suction pressure Ps are stored in the memory of the controller 8 as the operation data during refrigerant charging. Note that, in the present embodiment, the degree of subcooling $SC_o$ at the outlet of the outdoor heat exchanger 23 is detected by subtracting a refrigerant temperature value detected by the liquid side temperature sensor 31 from a refrigerant temperature value is detected by the heat exchange temperature sensor 30 corresponding to the condensation temperature Tc, or is detected by converting the discharge pressure Pd of the compressor 21 detected by the discharge pressure sensor 29 to a saturated temperature value corresponding to the condensation temperature Tc and subtracting a refrigerant temperature value detected by the liquid side temperature sensor 31 from this saturated temperature value of the refrigerant.

This Step S12 is repeated until the condition for determining the adequacy of the refrigerant quantity in the below described Step S13 is satisfied. Therefore, in the period from the start to the completion of additional refrigerant charging, the above described the operation state quantity during refrigerant charging is stored as the operation data during refrigerant charging in the controller 8. Note that, as for the operation data stored in the controller 8, appropriately thinned-out operation data may be stored. For example, for the operation data in the period from the start to the completion of additional refrigerant charging, the degree of subcooling $SC_o$ may be stored at each appropriate temperature interval and also a different value of the operation state quantity that corresponds to these degrees of subcooling $SC_o$ may be stored.

In this way, the process in Step S12 is performed by the controller 8 that functions as a state quantity storing means for storing, as the operation data, the operation state quantity of constituent equipment or the refrigerant flowing in the refrigerant circuit 10 during the operation that involves refrigerant charging. Therefore, it is possible to obtain, as the operation data, the operation state quantity in a state where refrigerant with less quantity than the refrigerant quantity after completion of additional refrigerant charging (hereinafter referred to as "initial refrigerant quantity") is charged in the refrigerant circuit 10.

<Step S13: Determination of the Adequacy of the Refrigerant Quantity>

Figure 5:
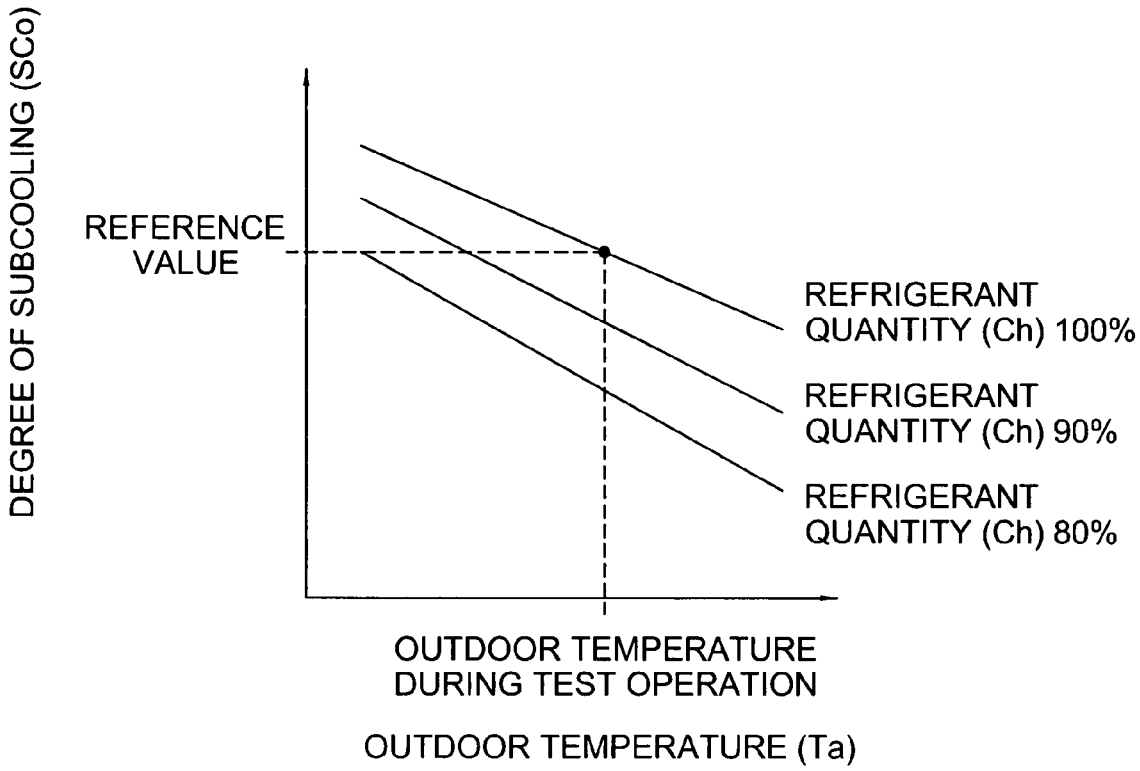
FIG. 5 is a graph to show a relationship between the degree of subcooling at an outlet of an outdoor heat exchanger, and an outdoor temperature and the refrigerant quantity during a refrigerant quantity determining operation.

As described above, when additional refrigerant charging into the refrigerant circuit 10 starts, the refrigerant quantity in the refrigerant circuit 10 gradually increases. Consequently, the refrigerant quantity in the outdoor heat exchanger 23 increases, and a tendency of an increase in the degree of subcooling $SC_o$ at the outlet of the outdoor heat exchanger 23 appears. This tendency indicates that there is a correlation as shown in FIG. 5 between the degree of subcooling $SC_o$ at the outlet of the outdoor heat exchanger 23 and the refrigerant quantity charged in the refrigerant circuit 10. Here, FIG. 5 is a graph to show a relationship between the degree of subcooling $SC_o$ at the outlet of the outdoor heat exchanger 23, and the outdoor temperature Ta and the refrigerant quantity Ch during refrigerant quantity determining operation. This correlation indicates a relationship between the outdoor temperature Ta and a value of the degree of subcooling $SC_o$ at the outlet of the outdoor heat exchanger 23 when refrigerant is charged in the refrigerant circuit 10 in advance until a prescribed refrigerant quantity reached (hereinafter referred to as "prescribed value of the degree of subcooling $SC_o$"), in the case where the above described refrigerant quantity determining operation was performed by using the air conditioner 1 in a state immediately after being installed on site and started to be used. In other words, it means that a prescribed value of the degree of subcooling $SC_o$ at the outlet of the outdoor heat exchanger 23 is determined by the outdoor temperature Ta during test operation (specifically, during automatic refrigerant charging), and comparison between this prescribed value of the degree of subcooling $SC_o$ and the current value of the degree of subcooling $SC_o$ detected during refrigerant charging enables determination of the adequacy of the refrigerant quantity charged into the refrigerant circuit 10 by additional refrigerant charging.

Step S13 is a process to determine the adequacy of the refrigerant quantity charged in the refrigerant circuit 10 by additional refrigerant charging, by using the correlation as described above.

In other words, when the additional refrigerant quantity to be charged is small and the refrigerant quantity in the refrigerant circuit 10 has not reached the initial refrigerant quantity, it is a state where the refrigerant quantity in the outdoor heat exchanger 23 is small. Here, the state where the refrigerant quantity in the outdoor heat exchanger 23 is small means that the current value of the degree of subcooling $SC_o$ at the outlet of the outdoor heat exchanger 23 is smaller than the prescribed value of the degree of subcooling $SC_o$. Accordingly, when the degree of subcooling $SC_o$ at the outlet of the outdoor heat exchanger 23 is smaller than the prescribed value and additional refrigerant charging is not completed, the process in Step S13 is repeated until the current value of the degree of subcooling $SC_o$ reaches the prescribed value. In addition, when the current value of the degree of subcooling $SC_o$ reaches the prescribed value, additional refrigerant charging is completed and Step S1 as the automatic refrigerant charging operation is finished. Note that there are cases where the prescribed refrigerant quantity calculated on site based on the pipe length, the capacities of constituent equipment, and the like is not consistent with the initial refrigerant quantity after additional refrigerant charging is completed. In the present embodiment, a value of the degree of subcooling $SC_o$ and a different value of the operation state quantity at the time of completion of additional refrigerant charging are used as reference values of the operation state quantity including the degree of subcooling $SC_o$ and the like in the below described refrigerant leak detection mode.

In this way, the process in Step S13 is performed by the controller 8 that functions as a refrigerant quantity determining means for determining the adequacy of the refrigerant quantity charged in the refrigerant circuit 10 during refrigerant quantity determining operation.

<Step S2: Control Variables Changing Operation>

Figure 6:
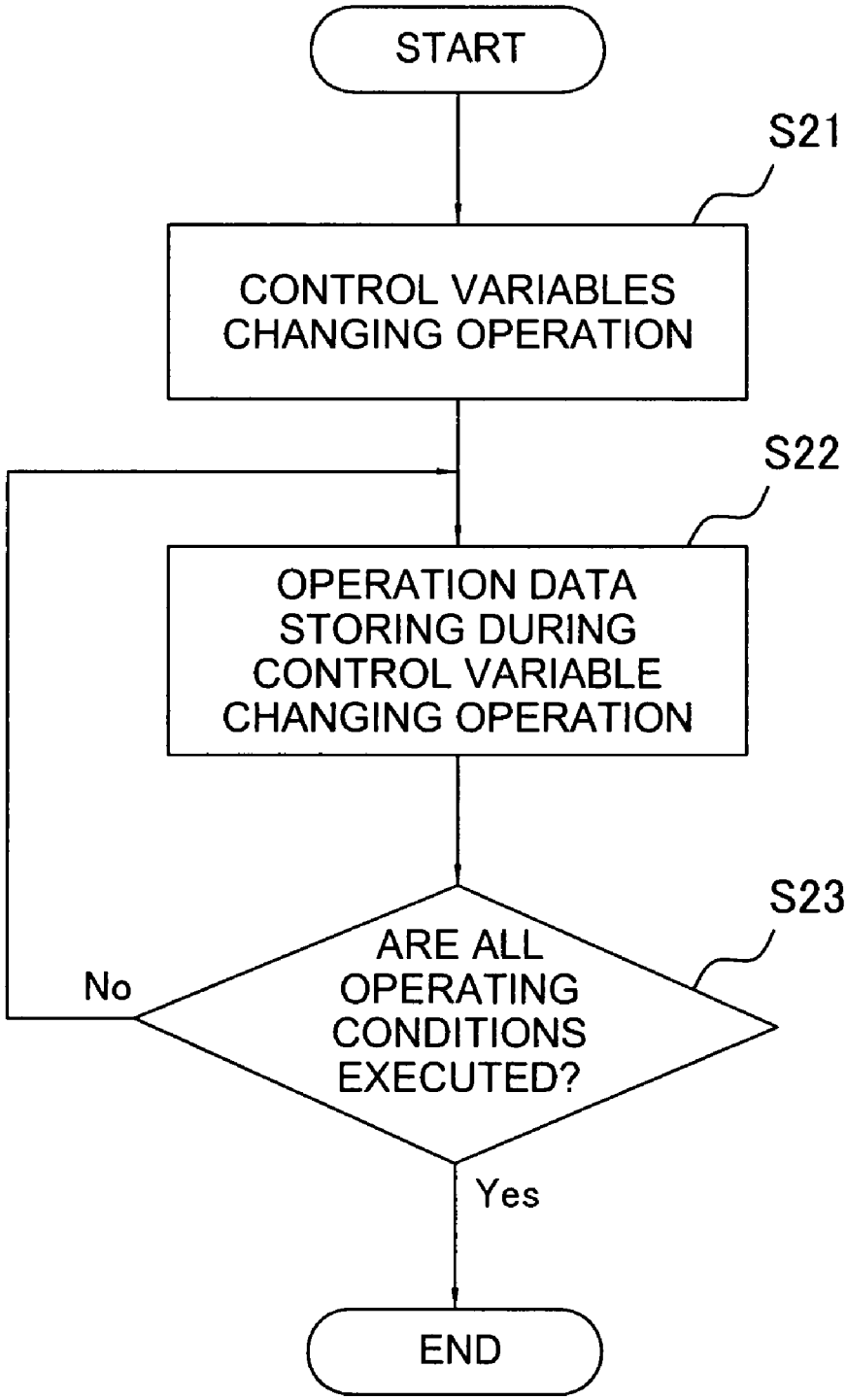
FIG. 6 is a flowchart of a control variables changing operation.

When the above described automatic refrigerant charging operation of Step S1 is finished, the process proceeds to control variables changing operation of Step S2. During control variables changing operation, the process in Step S21 to Step S23 shown in FIG. 6 is performed by the controller 8. Here, FIG. 6 is a flowchart of control variables changing operation.

<Steps S21 to S23: Control Variables Changing Operation and Operation Data Storing During the Control Variables Changing Operation>

In Step S21, after the above described automatic refrigerant charging operation is finished, the refrigerant quantity determining operation same as Step S11 is performed with the initial refrigerant quantity charged in the refrigerant circuit 10.

Here, in a state where refrigerant quantity determining operation is performed in a state after refrigerant is charged up to the initial refrigerant quantity, the air flow rate of the outdoor fan 27 is changed, thereby performing operation for simulating a state where there was a fluctuation in the heat exchange performance of the outdoor heat exchanger 23 during test operation, i.e., after installment of the air conditioner 1. Also, the air flow rate of the indoor fans 43 and 53 is changed, thereby performing operation for simulating a state where there was a fluctuation in the heat exchange performance of the indoor heat exchangers 42 and 52 (hereinafter such operation is referred to as "control variables changing operation").

Figure 7:
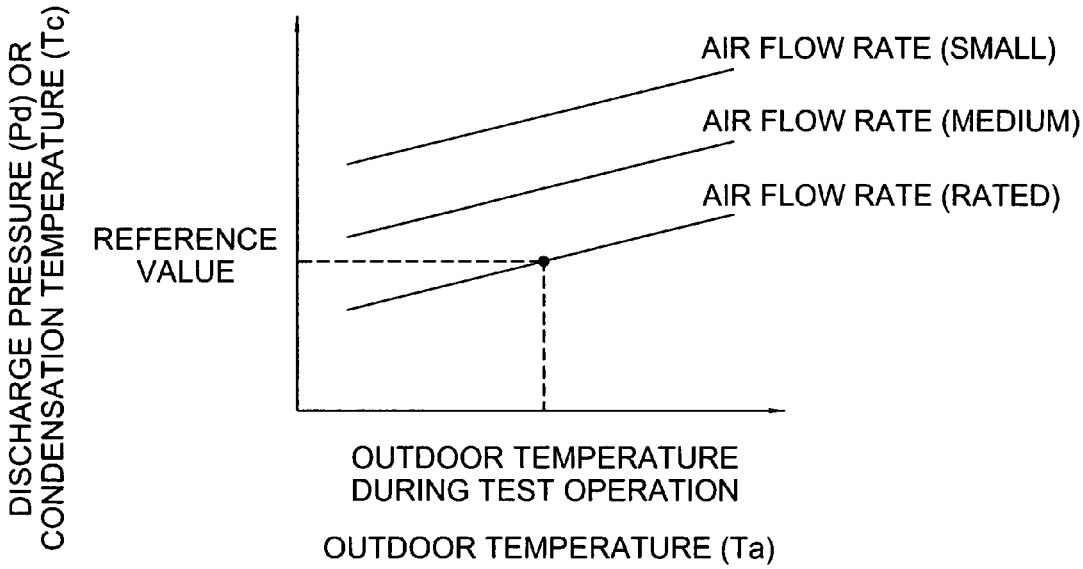
FIG. 7 is a graph to show a relationship between the discharge pressure and the outdoor temperature during the refrigerant quantity determining operation.
Figure 8:
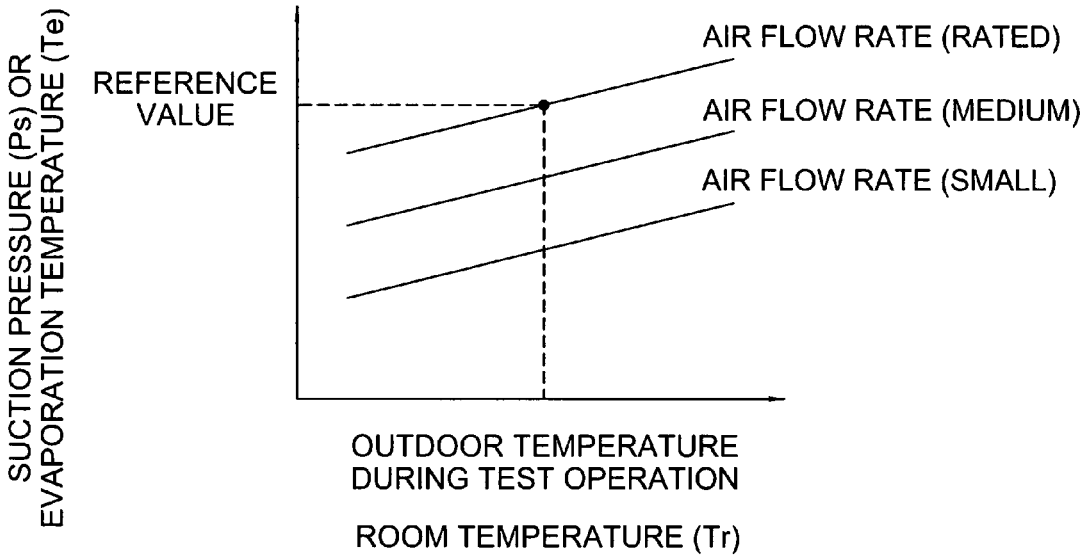
FIG. 8 is a graph to show a relationship between the suction pressure and the outdoor temperature during the refrigerant quantity determining operation.

For example, during refrigerant quantity determining operation, when the air flow rate of the outdoor fan 27 is reduced, a heat transfer coefficient K of the outdoor heat exchanger 23 becomes smaller and the heat exchange performance drops. Consequently, as shown in FIG. 7, the condensation temperature Tc of the refrigerant in the outdoor heat exchanger 23 increases, and consequently the discharge pressure Pd of the compressor 21 corresponding to the condensation pressure Pc of the refrigerant in the outdoor heat exchanger 23 tends to increase. In addition, during refrigerant quantity determining operation, when the air flow rate of the indoor fans 43 and 53 is reduced, the heat transfer coefficient K of the indoor heat exchangers 42 and 52 becomes smaller and the heat exchange performance drops. Consequently, as shown in FIG. 8, the evaporation temperature Te of the refrigerant in the indoor heat exchangers 42 and 52 decreases, and consequently the suction pressure Ps of the compressor 21 corresponding to the evaporation pressure Pe of the refrigerant in the indoor heat exchangers 42 and 52 tends to decrease. When such control variables changing operation is performed, the operation state quantity of constituent equipment or the refrigerant flowing in the refrigerant circuit 10 changes depending on each operating condition, while the initial refrigerant quantity charged in the refrigerant circuit 10 remains constant. Here, FIG. 7 is a graph to show a relationship between the discharge pressure Pd and the outdoor temperature Ta during refrigerant quantity determining operation. FIG. 8 is a graph to show a relationship between the suction pressure Ps and the outdoor temperature Ta during refrigerant quantity determining operation.

In Step S22, the operation state quantity of constituent equipment or the refrigerant flowing in the refrigerant circuit 10 in each operating condition of control variables changing operation is obtained as the operation data and stored in the memory of the controller 8. In the present embodiment, the degree of subcooling $SC_o$ at the outlet of the outdoor heat exchanger 23, the outdoor temperature Ta, the room temperature Tr, the discharge pressure Pd, and the suction pressure Ps are stored, as the operation data at the beginning of the refrigerant charging, in the memory of the controller 8.

This Step S22 is repeated until it is determined in Step S23 that all the operating conditions for control variables changing operation have been executed.

In this way, the process in Steps S21 and S23 is performed by the controller 8 that functions as the control variables changing operation means for performing control variable changing operation that includes operation for simulating a state where there was a fluctuation in the heat exchange performance of the outdoor heat exchanger 23 and the indoor heat exchangers 42 and 52 by changing the air flow rate of the outdoor fan 27 and the indoor fans 43 and 53 while performing refrigerant quantity determining operation. In addition, the process in Step S22 is performed by the controller 8 that functions as the state quantity storing means for storing, as the operation data, the operation state quantity of constituent equipment or the refrigerant flowing in the refrigerant circuit 10 during control variables changing operation, it is possible to obtain, as the operation data, the operation state quantity during operation for simulating a state where there was a fluctuation in the heat exchange performance of the outdoor heat exchanger 23 and the indoor heat exchangers 42 and 52.

<Refrigerant Leak Detection Mode>

Figure 9:
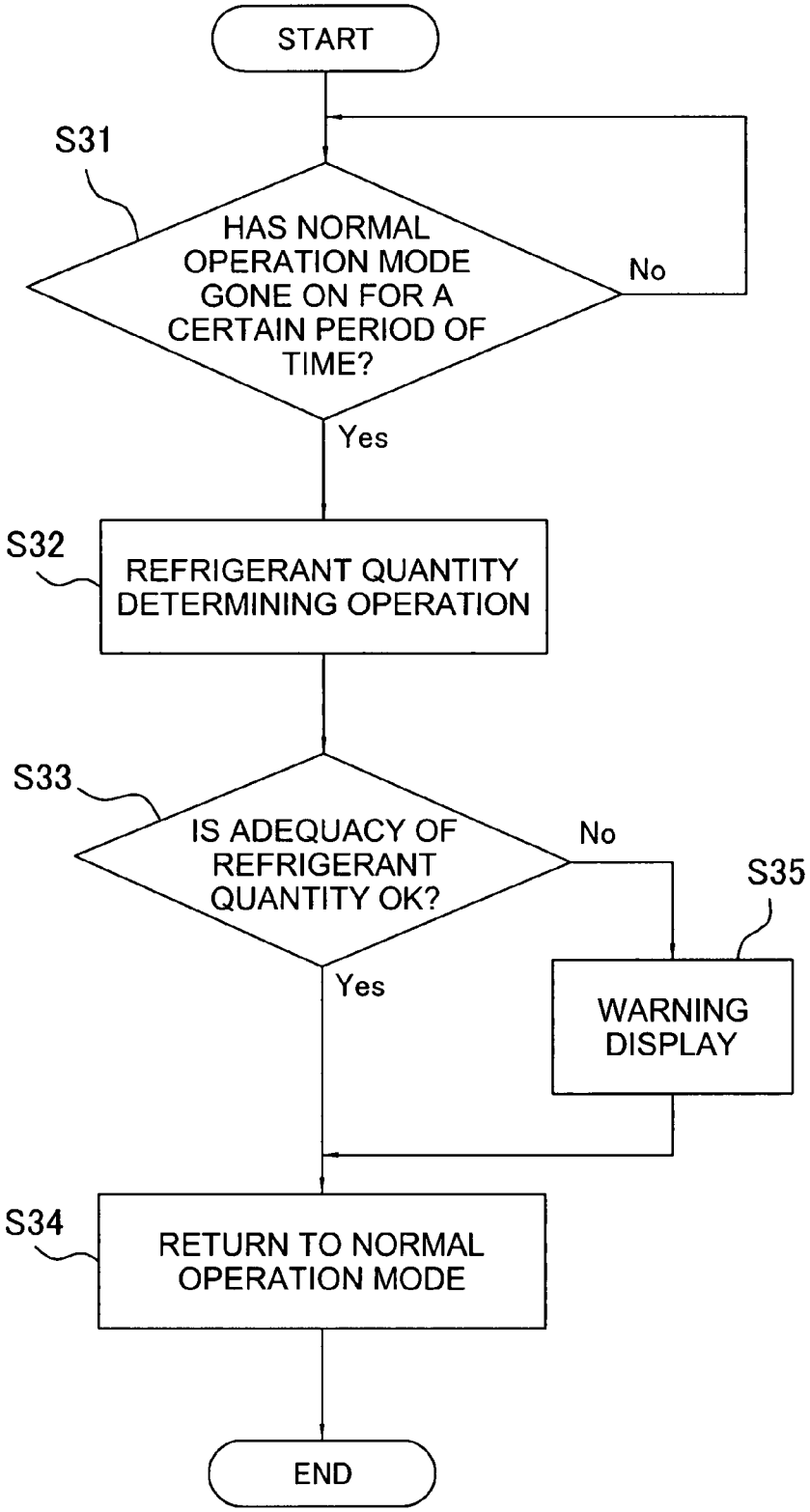
FIG. 9 is a flowchart of a refrigerant leak detection mode.

Next, the refrigerant leak detection mode is described with reference to FIGS. 1, 2, and 9. Here, FIG. 9 is a flowchart of the refrigerant leak detection mode.

In the present embodiment, an example of a case is described where, whether or not the refrigerant in the refrigerant circuit 10 is leaking out due to an unforeseen factor during cooling operation or heating operation in the normal operation mode is detected periodically (for example, during a period of time such as on a holiday or in the middle of the night when air conditioning is not needed).

<Step S31, Determining Whether or not the Normal Operation Mode has Gone on for a Certain Period of Time>

First, whether or not operation in the normal operation mode such as the above described cooling operation or heating operation has gone on for a certain period of time (every one month or the like) is determined, and when operation in the normal operation mode has gone on for a certain period of time, the process proceeds to the next Step S32.

<Step S32: Refrigerant Quantity Determining Operation>

When the operation in the normal operation mode has gone on for a certain period of time, as is the case with Step S11 in the above described automatic refrigerant charging operation, refrigerant quantity determining operation including all indoor unit operation, compressor rotation frequency constant control, and indoor heat exchange superheat degree constant control is performed. Here, values to be used for the frequency f of the compressor 21 and the degree of superheating $SH_i$ at the outlets of the indoor heat exchangers 42 and 52 are same as the predetermined values of the frequency f and the degree of superheating $SH_i$ during refrigerant quantity determining operation of Step S11 during automatic refrigerant charging operation.

In this way, the process in Step S32 is performed by the controller 8 that functions as the refrigerant quantity determining operation controlling means for performing refrigerant quantity determining operation including all indoor unit operation, compressor rotation frequency constant control, and indoor heat exchange superheat degree constant control.

<Steps S33 to S35: Determination of the Adequacy of the Refrigerant quantity, returning to the normal operation mode, Warning Display>

When refrigerant in the refrigerant circuit 10 leaks out, the refrigerant quantity in the refrigerant circuit 10 decreases, and consequently a tendency of a decrease in the current value of the degree of subcooling $SC_o$ at the outlet of the outdoor heat exchanger 23 appears (see FIG. 5). In other words, it means that the adequacy of the refrigerant quantity charged in the refrigerant circuit 10 can be determined by comparison using the current value of the degree of subcooling $SC_o$ at the outlet of the outdoor heat exchanger 23. In the present embodiment, comparison is made between the current value of the degree of subcooling $SC_o$ at the outlet of the outdoor heat exchanger 23 during refrigerant leak detection operation and the reference value (prescribed value) of the degree of subcooling $SC_o$ corresponding to the initial refrigerant quantity charged in the refrigerant circuit 10 at the completion of the above described automatic refrigerant charging operation, and thereby determination of the adequacy of the refrigerant quantity, i.e., detection of a refrigerant leak is performed.

Here, when the reference value of the degree of subcooling $SC_o$ corresponding to the initial refrigerant quantity charged in the refrigerant circuit 10 at the completion of the above described automatic refrigerant charging operation is used as a reference value of the degree of subcooling $SC_o$ during refrigerant leak detection operation, a drop in the heat exchange performance of the outdoor heat exchanger 23 and the indoor heat exchangers 42 and 52, caused by age-related degradation, poses a problem.

Generally, the heat exchange performance of the heat exchanger is determined by a multiplication value of a heat transfer coefficient K and a heating surface area A (hereinafter referred to as "coefficient KA"), and the amount of heat exchange is determined by multiplying this coefficient KA by the temperature difference between the inside and outside of the heat exchanger. Accordingly, as long as the coefficient KA is constant, the heat exchange performance of the heat exchanger is determined by the inside-outside temperature difference (in case of the outdoor heat exchanger 23, it is the temperature difference between the outdoor temperature Ta and the condensation temperature Tc as the temperature of the refrigerant flowing in the outdoor heat exchanger 23; whereas in the case of the indoor heat exchangers 42 and 52, it is the temperature difference between the room temperature Tr and the evaporation temperature Te as the temperature of the refrigerant flowing in the indoor heat exchangers 42 and 52).

Figure 10:
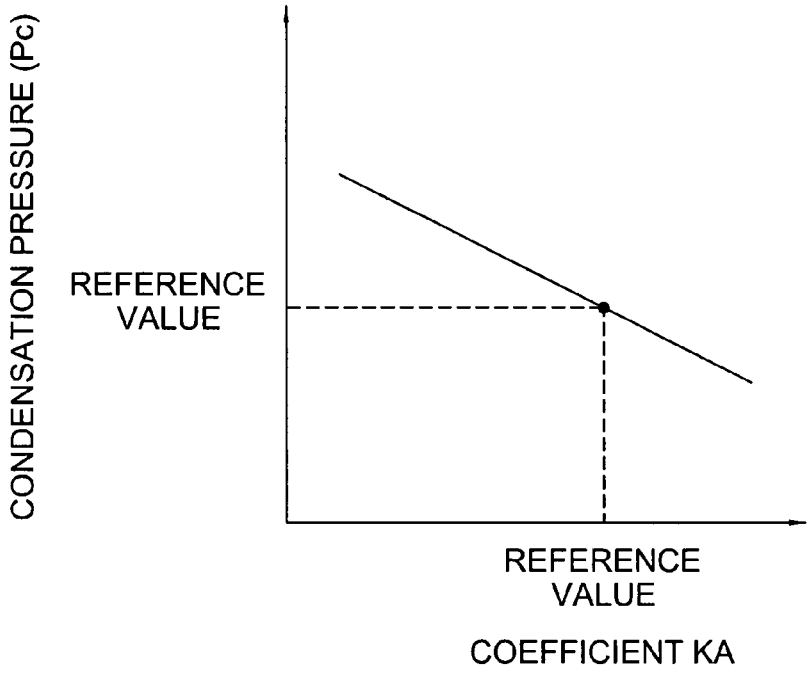
FIG. 10 is a graph to show a relationship between a coefficient KA and the condensation pressure in the outdoor heat exchanger.

However, the coefficient KA fluctuates due to age-related degradation such as contamination of plate fins and the heat transfer tube of the outdoor heat exchanger 23 and clogging between the plate fins. Therefore, in reality, such coefficient will not become a constant value. Specifically, the coefficient KA in a state where age-related degradation has occurred is smaller than the coefficient KA in a state immediately after the outdoor heat exchanger 23 (i.e., the air conditioner 1) is installed on site and has started to be used. In this way, when the coefficient KA fluctuates, a correlation between the condensation pressure Pc in the outdoor heat exchanger 23 and the outdoor temperature Ta fluctuates according to the fluctuation in the coefficient KA (see lines other than the reference lines in FIG. 7); whereas, under the condition that the coefficient KA is constant, a correlation between the refrigerant pressure (i.e., the condensation pressure Pc) in the outdoor heat exchanger 23 and the outdoor temperature Ta is almost uniquely determined (see the reference lines in FIG. 7). For example, under the condition of the same outdoor temperature Ta, as for the condensation pressure Pc in the outdoor heat exchanger 23 that has been degraded due to aging, the condensation pressure Pc becomes higher as the coefficient KA becomes smaller (see FIG. 10), compared with the condensation pressure Pc in the outdoor heat exchanger 23 in a state immediately after being installed on site and started to be used, and the coefficient fluctuates such that the inside-outside temperature difference in the outdoor heat exchanger 23 increases. Consequently, when the method for determining the adequacy of the refrigerant quantity by comparing the current value of the degree of subcooling $SC_o$ with the reference value of the degree of subcooling $SC_o$ is used as the refrigerant quantity determining means, the current degree of subcooling $SC_o$ in a state after the outdoor heat exchanger 23 has degraded due to aging is compared with the reference value of the degree of subcooling $SC_o$ in a state immediately after the outdoor heat exchanger 23 is installed on site and started to be used. As a result, different degrees of subcooling $SC_o$, which are detected in the air conditioner 1 comprising the outdoor heat exchanger 23 whose coefficient KA has changed, are compared with each other. Accordingly the effect of the fluctuation in the degree of subcooling $SC_o$ by age-related degradation cannot be eliminated and therefore the adequacy of the refrigerant quantity may not be accurately determined in some cases.

Figure 11:
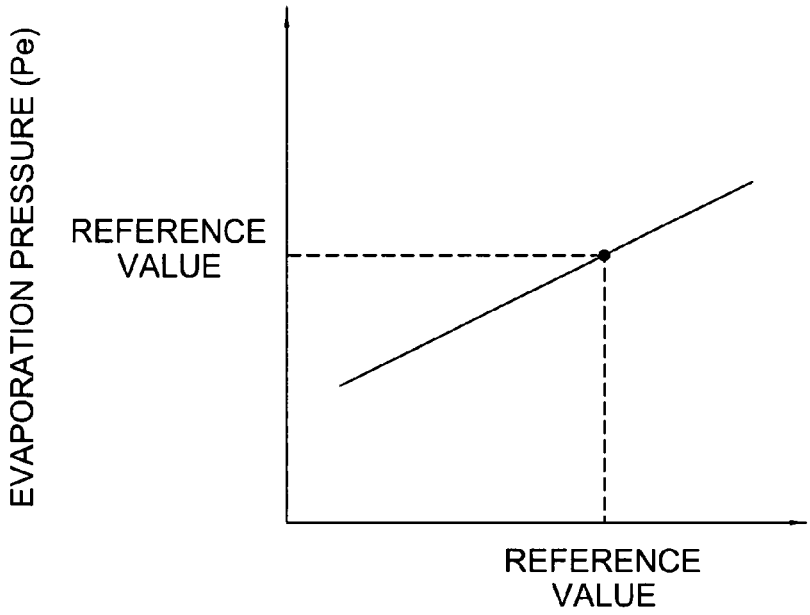
FIG. 11 is a graph to show a relationship between a coefficient KA and the evaporation pressure in an indoor heat exchanger.

The same applies to the indoor heat exchangers 42 and 52. Under the condition of the same room temperature Tr, as for the evaporation pressure Pe in the indoor heat exchangers 42 and 52 that have been degraded due to aging, the evaporation pressure Pe becomes lower as the coefficient KA becomes smaller (see FIG. 11), compared with the evaporation pressure Pe in the indoor heat exchangers 42 and 52 in a state immediately after being installed on site and started to be used, and the coefficient fluctuates such that the inside-outside temperature difference in the indoor heat exchangers 42 and 52 increases. Consequently, when the method for determining the adequacy of the refrigerant quantity by comparing the current value of the degree of subcooling $SC_o$ with the reference value of the degree of subcooling $SC_o$, is used as the refrigerant quantity determining means, the current degree of subcooling $SC_o$ after the indoor heat exchangers 42 and 52 has degraded due to aging is compared with the reference value of the degree of subcooling $SC_o$ in a state immediately after the indoor heat exchangers 42 and 52 is installed on site and started to be used. As a result, different degrees of subcooling $SC_o$, which are detected in the air conditioner 1 comprising the indoor heat exchangers 42 and 52 whose coefficient KA has changed, are compared with each other. Accordingly, the effect of the fluctuation in the degree of subcooling $SC_o$ by age-related degradation cannot be eliminated and therefore the adequacy of the refrigerant quantity may not be accurately determined in some cases.

Therefore, in the air conditioner 1 in the present embodiment, the focus is placed on the fluctuations in the coefficients KA of the outdoor heat exchanger 23 and the indoor heat exchangers 42 and 52 according to the degree of age-related degradation. In other words, the focus is placed on the fluctuations in the correlation between the condensation pressure Pc in the outdoor heat exchanger 23 and the outdoor temperature Ta and in correlation between the evaporation pressure Pe in the indoor heat exchangers 42 and 52 and the room temperature Tr, which occur along with the fluctuation in the coefficient KA. Then, the current value of the degree of subcooling $SC_o$ or the reference value of the degree of subcooling $SC_o$, which is used when determining the adequacy of the refrigerant quantity, is corrected by using the discharge pressure Pd of the compressor 21 which corresponds to the condensation pressure Pc in the outdoor heat exchanger 23, the outdoor temperature Ta, the suction pressure Ps of the compressor 21 which corresponds to the evaporation pressure Pe in the indoor heat exchangers 42 and 52, and the room temperature Tr. Thereby, different degrees of subcooling $SC_o$, which are detected in the air conditioner 1 comprising the outdoor heat exchanger 23 and the indoor heat exchangers 42 and 52 whose coefficients KA remain the same, are compared with each other. In this way, the effect of the fluctuation in the degree of subcooling $SC_o$ by age-related degradation is eliminated.

Note that, fluctuation in the heat exchange performance of the outdoor heat exchanger 23 may also occur due to the effect of weather conditions such as rain, heavy gale, etc., besides age-related degradation. Specifically, in case of rain, the plate fins and the heat transfer tube of the outdoor heat exchanger 23 get wet with rain, which can therefore cause a fluctuation in the heat exchange performance, i.e., a fluctuation in the coefficient KA. In addition, in case of heavy gale, the air flow rate of the outdoor fan 27 becomes larger or smaller by the heavy gale, which can therefore cause a fluctuation in the heat exchange performance, i.e., a fluctuation in the coefficient KA. Such effect of weather conditions on the heat exchange performance of the outdoor heat exchanger 23 will appear as a fluctuation in the correlation between the condensation pressure Pc in the outdoor heat exchanger 23 and the outdoor temperature Ta according to the fluctuation in the coefficient KA (see FIG. 7). Consequently, elimination of the effect of the fluctuation in the degree of subcooling $SC_o$ by age-related degradation can result in the elimination of the effect of the fluctuation in the degree of subcooling $SC_o$ by weather conditions.

As a specific correction method, for example, there is a method in which the refrigerant quantity Ch charged in the refrigerant circuit 10 is expressed as a function of the degree of subcooling $SC_o$, the discharge pressure Pd, the outdoor temperature Ta, the suction pressure Ps, and the room temperature Tr. Then, the refrigerant quantity Ch is calculated from the current value of the degree of subcooling $SC_o$ during refrigerant leak detection operation and the current values of the discharge pressure Pd, the outdoor temperature Ta, the suction pressure Ps and the room temperature Tr during the same operation. In this way, the current refrigerant quantity is compared with the initial refrigerant quantity which serves as a reference value of the refrigerant quantity, and thereby the effect of age-related degradation and weather conditions on the degree of subcooling $SC_o$ at the outlet of the outdoor heat exchanger 23 is compensated.

Here, the refrigerant quantity Ch charged in the refrigerant circuit 10 can be expressed as a following multiple regression function:

$$Ch=k1\times SC_o+k2\times Pd+k3\times Ta+\times k4\times Ps+k5\times Tr+k6,$$

and accordingly, by using the operation data (i.e., data of the degree of subcooling $SC_o$ at the outlet of the outdoor heat exchanger 23, the outdoor temperature Ta, the room temperature Tr, the discharge pressure Pd, and the suction pressure Ps) stored in the memory of the controller 8 during refrigerant charging and control variables changing operation in the above described test operation mode, a multiple regression analysis is performed in order to calculate parameters k1 to k6 and thereby a function of the refrigerant quantity Ch can be defined.

Note that, in the present embodiment, a function of the refrigerant quantity Ch is defined by the controller 8 in the period from after control variables changing operation in the above described test operation mode is performed until the mode is switched to the refrigerant quantity leak detection mode for the first time.

In this way, a process to determine a correction formula is performed by the controller 8 that functions as a state quantity correction formula computing means for defining a function in order to compensate the effects on the degree of subcooling $SC_o$ by age-related degradation of the outdoor heat exchanger 23 and the indoor heat exchangers 42 and 52 and weather conditions when detecting whether or not there is a refrigerant leak in the refrigerant leak detection mode.

Then, the current value of the refrigerant quantity Ch is calculated from the current value of the degree of subcooling $SC_o$ at the outlet of the outdoor heat exchanger 23 during this refrigerant leak detection operation. When the current value is substantially the same as the reference value of the refrigerant quantity Ch (i.e., initial refrigerant quantity) for the reference value of the degree of subcooling $SC_o$ (for example, the absolute value of the difference between the refrigerant quantity Ch corresponding to the current value of the degree of subcooling $SC_o$ and the initial refrigerant quantity is less than a predetermined value), it is determined that there is no refrigerant leak. Subsequently, the process proceeds to next Step S34 and the operation mode is returned to the normal operation mode.

On the other hand, the current value of the refrigerant quantity Ch is calculated from the current value of the degree of subcooling $SC_o$ at the outlet of the outdoor heat exchanger 23 during refrigerant leak detection operation, and when the current value is smaller than the initial refrigerant quantity (for example, the absolute value of the difference between the refrigerant quantity Ch corresponding to the current value of the degree of subcooling $SC_o$ and the initial refrigerant quantity is equal to or greater than a predetermined value), it is determined that there is a refrigerant leak. Then, the process proceeds to Step S35 and a warning indicating that a refrigerant leak is detected is displayed on the warning display 9. Subsequently, the process proceeds to Step S34 and the operation mode is returned to the normal operation mode.

Accordingly, it is possible to obtain a result similar to that obtained when the current value of the degree of subcooling $SC_o$ is compared with the reference value of the degree of subcooling $SC_o$ under conditions substantially the same as those under which different degrees of subcooling $SC_o$, which are detected in the air conditioner 1 comprising the outdoor heat exchanger 23 and the indoor heat exchangers 42 and 52 whose coefficients KA remain the same are compared with each other. Consequently, the effect of the fluctuation in the degree of subcooling $SC_o$ by age-related degradation can be eliminated.

In this way, the process from Steps S33 to S35 is performed by the controller 8 that functions as a refrigerant leak detection means, which is one of the refrigerant quantity determining means, and which detects whether or not there is a refrigerant leak by determining the adequacy of the refrigerant quantity charged in the refrigerant circuit 10 while performing refrigerant quantity determining operation in the refrigerant leak detection mode. In addition, a part of the process in Step S33 is performed by the controller 8 that functions as a state quantity correcting means for compensating the effect on the degree of subcooling $SC_o$ by age-related degradation of the outdoor heat exchanger 23 and the indoor heat exchangers 42 and 52 when detecting whether or not there is a refrigerant leak in the refrigerant leak detection mode.

As described above, in the air conditioner 1 in the present embodiment, the controller 8 functions as a refrigerant quantity determining operation means, the state quantity storing means, the refrigerant quantity determining means, the control variables changing operation means, the state quantity correction formula computing means, and the state quantity correcting means, and thereby configures the refrigerant quantity determining system for determining the adequacy of the refrigerant quantity charged in the refrigerant circuit 10.

(3) Characteristics of the Air Conditioner

The air conditioner 1 in the present embodiment has the following characteristics.

(A)

In the air conditioner 1 in the present embodiment, the focus is placed on the fluctuations in the coefficients KA of the outdoor heat exchanger 23 and the indoor heat exchangers 42 and 52 according to the degree of age-related degradation that has occurred since the outdoor heat exchanger 23 and the indoor heat exchangers 42 and 52 (i.e., the air conditioner 1) were in a state immediately after being installed on site and started to be used. In other words, the focus is placed on the fluctuations in the correlation between the condensation pressure Pc that is the refrigerant pressure in the outdoor heat exchanger 23 and the outdoor temperature Ta and in the correlation between the evaporation pressure Pe that is the refrigerant pressure in the indoor heat exchangers 42 and 52 and the room temperature Tr, which occur along with the fluctuation in the coefficient KA (see FIGS. 10 and 11). Then, by the controller 8 that functions as the refrigerant quantity determining means and the state quantity correcting means, the current value of the refrigerant quantity Ch is expressed as a function of the degree of subcooling $SC_o$, the discharge pressure Pd, the outdoor temperature Ta, the suction pressure Ps, and the room temperature Tr, and the current value of the refrigerant quantity Ch is calculated from the current value of the degree of subcooling $SC_o$ during refrigerant leak detection operation and the current values of the discharge pressure Pd, the outdoor temperature Ta, the suction pressure Ps and the room temperature Tr during the same operation. In this way, the current refrigerant quantity is compared with the initial refrigerant quantity which serves as a reference value of the refrigerant quantity, and thereby the effect of the fluctuation in the degree of subcooling $SC_o$ as the operation state quantity, which is caused by age-related degradation, can be eliminated.

Accordingly, in this air conditioner 1, even if the outdoor heat exchanger 23 and the indoor heat exchangers 42 and 52 are degraded due to aging, the adequacy of the refrigerant quantity charged in the air conditioner, i.e., whether or not there is a refrigerant leak can be accurately determined.

In addition, in particular, the coefficient KA of the outdoor heat exchanger 23 may fluctuate due to fluctuation in weather conditions such as rain, heavy gale, etc. As is the case with age-related degradation, fluctuation in weather conditions causes fluctuation in the correlation between the condensation pressure Pc that is the refrigerant pressure in the outdoor heat exchanger 23, and the outdoor temperature Ta, along with the fluctuation in the coefficient KA. As a result, the effect of the fluctuation in the degree of subcooling $SC_o$ in such a case can also be eliminated.

(B)

In the air conditioner 1 in the present embodiment, during test operation after installment of the air conditioner 1, the controller 8 that functions as the state quantity storing means stores the operation state quantity (specifically, the reference values of the degree of subcooling $SC_o$, the discharge pressure Pd, the outdoor temperature Ta, the suction pressure Ps, and the room temperature Tr) in a state after the refrigerant is charged up to the initial refrigerant quantity by on-site refrigerant charging. Then, such operation state quantity is used as a reference value and compared with the current value of the operation state quantity in the refrigerant leak detection mode in order to determine the adequacy of the refrigerant quantity, i.e., whether or not there is a refrigerant leak. Therefore, the refrigerant quantity that has actually been charged in the air conditioner, i.e., the initial refrigerant quantity can be compared with the current refrigerant quantity.

Accordingly, in this air conditioner 1, even when the prescribed refrigerant quantity specified in advance before refrigerant charging is inconsistent with the initial refrigerant quantity charged on site or even when a reference value of the operation state quantity (specifically, the degree of subcooling $SC_o$) used for determining the adequacy of the refrigerant quantity fluctuates depending on the pipe length of the refrigerant communication pipes 6 and 7, combination of indoor units 4 and 5, and the difference in the installation height among the each units 2, 4, and 5, it is possible to accurately determine the adequacy of the refrigerant quantity charged in the air conditioner.

(C)

In the air conditioner 1 in the present embodiment, not only the operation state quantity (specifically, the reference values of the degree of subcooling $SC_o$, the discharge pressure Pd, the outdoor temperature Ta, the suction pressure Ps, and the room temperature Tr) in a state after the refrigerant is charged up to the initial refrigerant quantity are changed but also the control variables of constituent equipment of the air conditioner 1 such as the outdoor fan 27 and the indoor fans 43 and 53 are also changed. In this way, an operation to simulate operating conditions different from those during test operation is performed, and such operation state quantity during this operation can be stored in the controller 8 that functions as the state quantity storing means.

Accordingly, in the air conditioner 1, based on the data of the operation state quantity during operation with the control variables of constituent equipment such as the outdoor fan 27, the indoor fans 43 and 53, and the like changed, a correlation and a correction formula for values of the operation state quantity in different operating conditions such as when the outdoor heat exchanger 23 and the indoor heat exchangers 42 and 52 are degraded due to aging are determined. Using such a correlation and a correction formula, it is possible to compensate differences in the operating conditions when comparing the reference value of the operation state quantity during test operation with the current value of the operation state quantity. In this way, in this air conditioner 1, based on the data of the operation state quantity during operation with the control variables of constituent equipment changed, it is possible to compensate differences in the operating conditions when comparing the reference value of the operation state quantity during test operation with the current value of the operation state quantity. Therefore, the accuracy for determining the adequacy of the refrigerant quantity charged in the air conditioner can be further improved.

(4) Alternative Embodiment 1

In the above described air conditioner 1, for determination of the adequacy of the refrigerant quantity of Step S33 in the refrigerant leak detection mode, practically, whether or not there is a refrigerant leak is detected by comparing the reference value of the degree of subcooling $SC_o$ in a state after the refrigerant is charged up to the initial refrigerant quantity with the current value of the degree of subcooling $SC_o$. In addition to this, in Step S12 in automatic refrigerant charging operation, the adequacy of the refrigerant quantity charged in the air conditioner may be determined by utilizing data of the operation state quantity in a state where refrigerant with less quantity than the initial refrigerant quantity in the period from the start to the completion of additional refrigerant charging is charged in the refrigerant circuit 10.

For example, in Step S33 in the refrigerant leak detection mode, the adequacy of the refrigerant quantity can be determined by comparison between the reference value of the degree of subcooling $SC_o$ in a state after the refrigerant is charged up to the above described initial refrigerant quantity and the current value of the degree of subcooling $SC_o$, and also, the data of the operation state quantity, which is stored in the memory of the controller 8, in a state where refrigerant with less quantity than the initial refrigerant quantity is charged in the refrigerant circuit 10 can be used as a reference value and compared with the current value of the operation state quantity. Accordingly, the accuracy for determining the adequacy of the refrigerant quantity charged in the air conditioner can be further improved.

(5) Alternative Embodiment 2

In the above described air conditioner 1, in order to compensate age-related degradation and the like of both the outdoor heat exchanger 23 and the indoor heat exchangers 42 and 52, four different values of the operation state quantity, i.e., the discharge pressure Pd, the outdoor temperature Ta, the suction pressure Ps, and the room temperature Tr, are used. However, when compensating age-related degradation and the like of only the outdoor heat exchanger 23, it suffices to take into consideration only the discharge pressure Pd and the outdoor temperature Ta. In addition, when compensating age-related degradation and the like of only the indoor heat exchangers 42 and 52, it suffices to take into consideration only the suction pressure Ps and the room temperature Tr.

Note that, in this case, the controller 8 that functions as the state quantity storing means stores data of the discharge pressure Pd and the outdoor temperature Ta when compensating age-related degradation and the like of only the outdoor heat exchanger 23, and data of the suction pressure Ps and the room temperature Tr when compensating age-related degradation and the like of only the indoor heat exchangers 42 and 52.

(6) Alternative Embodiment 3

In the above described air conditioner 1, the controller 8 that functions as the state quantity storing means stores the discharge pressure Pd of the compressor 21 as the operation state quantity corresponding to the condensation pressure Pc as the refrigerant pressure in the outdoor heat exchanger 23, and also suction pressure Ps of the compressor 21 as the operation state quantity corresponding to the evaporation pressure Pe as the refrigerant pressure in the indoor heat exchangers 42 and 52, and these values are used when defining a parameter of the correction formula for compensating age-related degradation and the like of the outdoor heat exchanger 23 and the indoor heat exchangers 42 and 52. However, the condensation temperature Tc instead of the discharge pressure Pd of the compressor 21 may be used. Also, the evaporation temperature Te instead of the suction pressure Ps of the compressor 21 may be used. Also in this case, as is the case with the above described air conditioner 1, age-related degradation can be compensated.

(7) Alternative Embodiment 4

In the above described air conditioner 1, the correlation (see FIG. 5) between the refrigerant quantity charged in the refrigerant circuit 10 and the degree of subcooling $SC_o$ at the outlet of the outdoor heat exchanger 23 during refrigerant quantity determining operation including all indoor unit operation, compressor rotation frequency constant control, and indoor heat exchange superheat degree constant control is utilized in order to determine the adequacy of the refrigerant quantity during automatic refrigerant charging and refrigerant leak detection. However, a correlation between a different value of the operation state quantity and the refrigerant quantity charged in the refrigerant circuit 10 may be utilized in order to determine the adequacy of the refrigerant quantity during automatic refrigerant charging and refrigerant leak detection.

Figure 12:
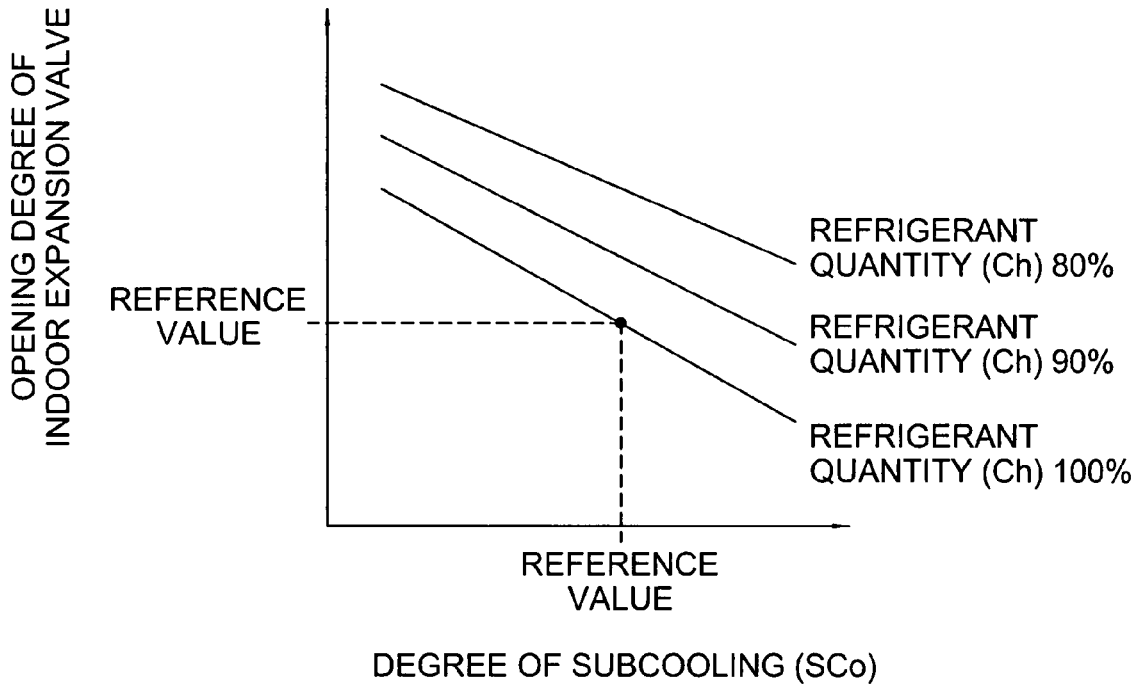
FIG. 12 is a graph to show a relationship between the opening degree of an indoor expansion valve, and the degree of subcooling at the outlet of the outdoor heat exchanger and the refrigerant quantity during the refrigerant quantity determining operation.

For example, during refrigerant quantity determining operation including all indoor units operation, compressor rotation frequency constant control, and indoor heat exchange superheat degree constant control, increase in the degree of subcooling $SC_o$ at the outlet of the outdoor heat exchanger 23 reduces the quality of wet vapor of the refrigerant that flows into the indoor heat exchangers 42 and 52 after the refrigerant is expanded by the indoor expansion valves 41 and 51. Consequently, a tendency of a decrease in the opening degree of the indoor expansion valves 41 and 51 which perform indoor heat exchange superheat degree constant control appears. This tendency indicates that there is a correlation, as shown in FIG. 12, between the opening degree of the indoor expansion valves 41 and 51 and the refrigerant quantity charged in the refrigerant circuit 10. Accordingly, the adequacy of the refrigerant quantity charged in the refrigerant circuit 10 can be determined by the opening degree of the indoor expansion valves 41 and 51.

In addition, as the standard for determining the adequacy of the refrigerant quantity, the adequacy of the refrigerant quantity may also be determined by a combination of several values of operation state quantity, such as determining the adequacy of the refrigerant quantity utilizing both the judgment result from the degree of subcooling $SC_o$ at the outlet of the outside heat exchanger 23 and the judgment result from the opening degree of the indoor expansion valves 41 and 51.

Note that, in this case, in the test operation mode, the controller 8 that functions as the state quantity storing means stores the data of the opening degree of the indoor expansion valves 41 and 51 as the reference value instead of the degree of subcooling $SC_o$ at the outlet of the outdoor heat exchanger 23 or together with the degree of subcooling $SC_o$.

(8) Alternative Embodiment 5

In the above described air conditioner 1, refrigerant quantity determining operation is an operation that includes all indoor units operation, compressor rotation frequency constant control, and indoor heat exchange superheat degree constant control. However, the adequacy of the refrigerant quantity during automatic refrigerant charging and refrigerant leak detection may be determined by performing refrigerant quantity determining operation using a different control condition instead of the indoor heat exchange superheat degree constant control and by utilizing a correlation between a different value of the operation state quantity and the refrigerant quantity charged in the refrigerant circuit 10.

For example, refrigerant quantity determining operation may be performed such that the opening degree of the indoor expansion valves 41 and 51 is fixed at a predetermined value. When such refrigerant quantity determining operation is performed, the degree of superheating $SH_i$ at the outlets of the indoor heat exchangers 42 and 52 fluctuates. Consequently, the adequacy of the refrigerant quantity charged in the refrigerant circuit 10 can be determined by the degree of superheating $SH_i$ at the outlets of the indoor heat exchangers 42 and 52.

Note that, in this case, in the test operation mode, the controller 8 that functions as the state quantity storing means stores the data of the degree of superheating $SH_i$ at the outlets of the indoor heat exchangers 42 and 52 as a reference value, instead of or together with the degree of subcooling $SC_o$ at the outlet of the outdoor heat exchanger 23 and the opening degree of the indoor expansion valves 41 and 51.

(9) Alternative Embodiment 6

Figure 13:
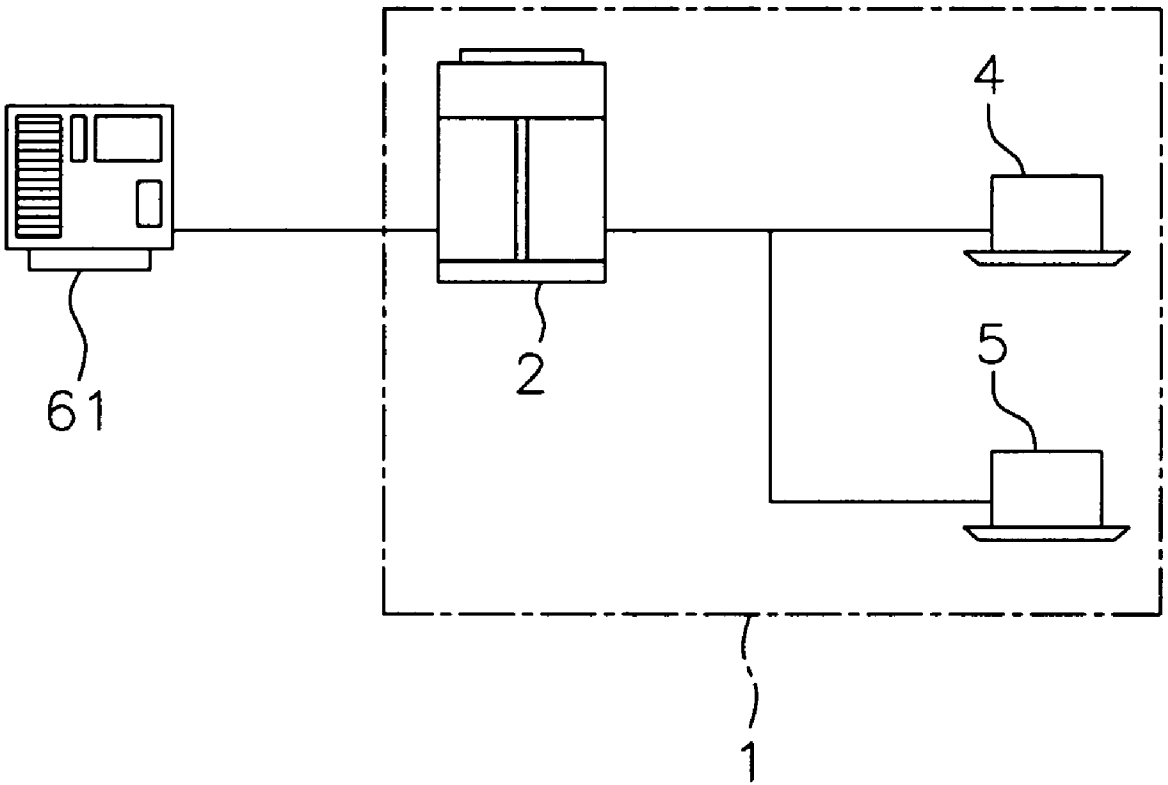
FIG. 13 is a refrigerant quantity determining system in which a local controller is used.

In the above described embodiment and its alternative embodiments, the controller 8 of the air conditioner 1 configures the refrigerant quantity determining system having all of the following functions: the operation controlling means, the state quantity storing means, the refrigerant quantity determining means, the state quantity correcting means, and the state quantity correction formula computing means. However, it is not limited thereto. For example, as shown in FIG. 13, the refrigerant quantity determining system may be configured in which a personal computer 62 is connected to the air conditioner 1 and this personal computer 62 is caused to function as the state quantity storing means and the state quantity correction formula computing means. In this case, there will be no need for the controller 8 of the air conditioner 1 to have functions to store a large amount of data of the operation state quantity used only for defining parameters of the state quantity correction formula and to serve as the state quantity correction formula computing means.

(10) Alternative Embodiment 7

In addition, in the above described embodiment and its alternative embodiment, during automatic refrigerant charging operation, data of the operation state quantity in a state where refrigerant with less quantity than the initial refrigerant quantity in the period from the start to the completion of additional refrigerant charging is charged in the refrigerant circuit 10 are stored in the memory of the controller 8. However, in the refrigerant leak detection mode, when these data are not used, data of the operation state quantity in the period from the start to the completion of additional refrigerant charging do not need to be stored, and it suffices to store data of the operation state quantity in a state after the refrigerant is charged up to the initial refrigerant quantity.

(11) Alternative Embodiment 8

Figure 14:
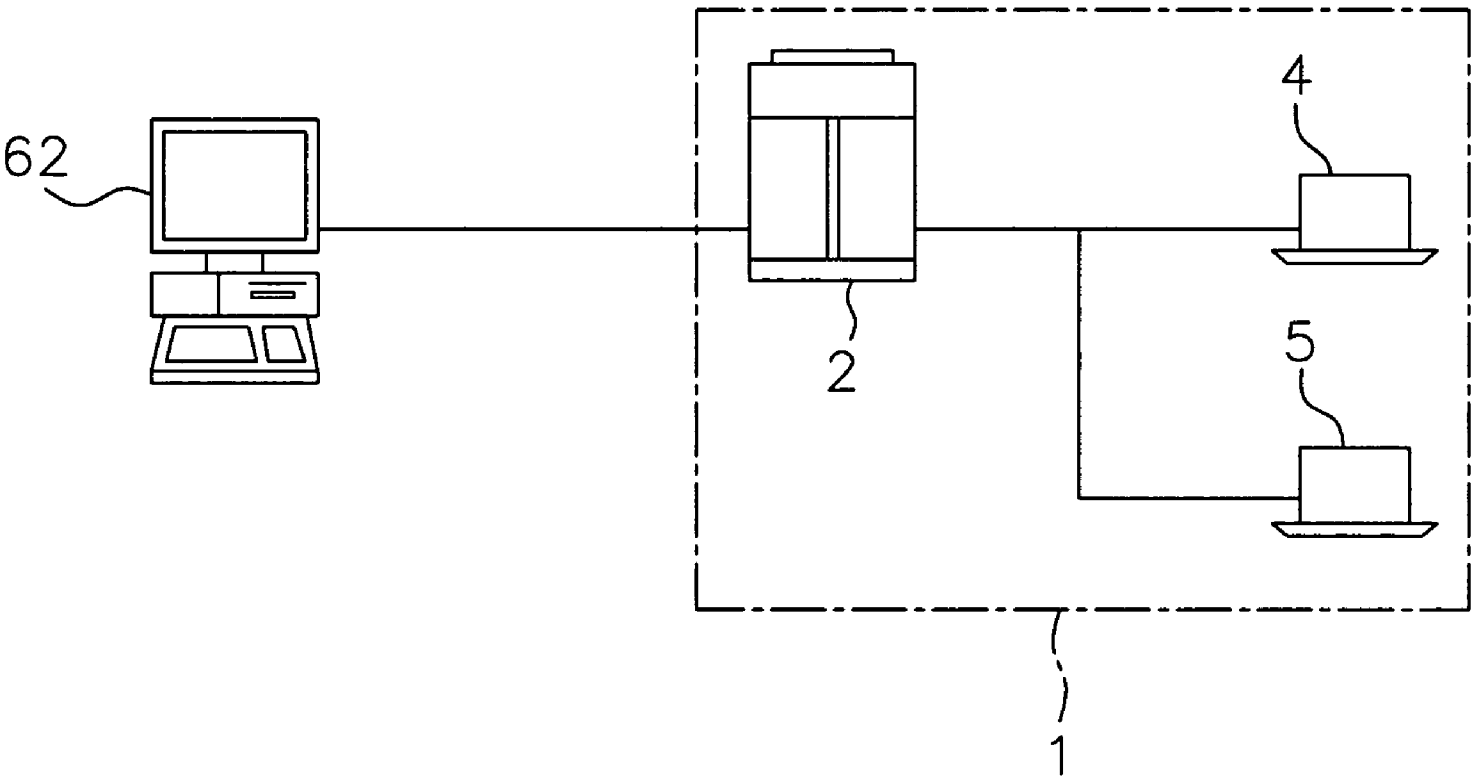
FIG. 14 is a refrigerant quantity determining system in which a personal computer is used.

In the above described embodiment and its alternative embodiments, the controller 8 of the air conditioner 1 configures the refrigerant quantity determining system having all of the following functions: the operation controlling means, the state quantity storing means, the refrigerant quantity determining means, the state quantity correcting means, and the state quantity correction formula computing means. However, it is not limited thereto. For example, as shown in FIG. 14, when a local controller 61 permanently installed as a management device that manages each constituent equipment of the air conditioner 1 is connected to the air conditioner 1, the refrigerant quantity determining system having all of the functions provided to the above described controller 8 may be configured by the air conditioner 1 and the local controller 61. For example, such a configuration may be considered that the local controller 61 is caused to function not only as the state quantity obtaining means for obtaining the operation state quantity of the air conditioner 1 but also as the state quantity storing means, the refrigerant quantity determining means, the state quantity correcting means, and the state quantity correction formula computing means. In this case, there will be no need for the controller 8 of the air conditioner 1 to have functions to store a large amount of data of the operation state quantity used only for defining parameters of the state quality correction formula and to serve as the refrigerant quantity determining means, the state quantity correcting means, and the state quantity correction formula computing means.

In addition, as shown in FIG. 14, such a configuration may be considered that the personal computer 62 is connected to the air conditioner 1 for a temporary period of time (for example, when a service person performs inspection that includes test operation, refrigerant leak detection operation, and the like) and the same functions as those of the above described local controller 61 are achieved by the air conditioner 1 and the personal computer 62. Note that the personal computer 62 may be used for a different application. Therefore, as the state quantity storing means, it is preferable to use an external memory device, instead of a memory device such as a disk device built in the personal computer 62. In this case, during test operation and refrigerant leak detection operation, an external memory device is connected to the personal computer 62 and thereby data of the operation state quantity necessary for various types of operation are read out and data of the operation state quantity obtained by each operation are written in.

(12) Alternative Embodiment 9

Figure 15:
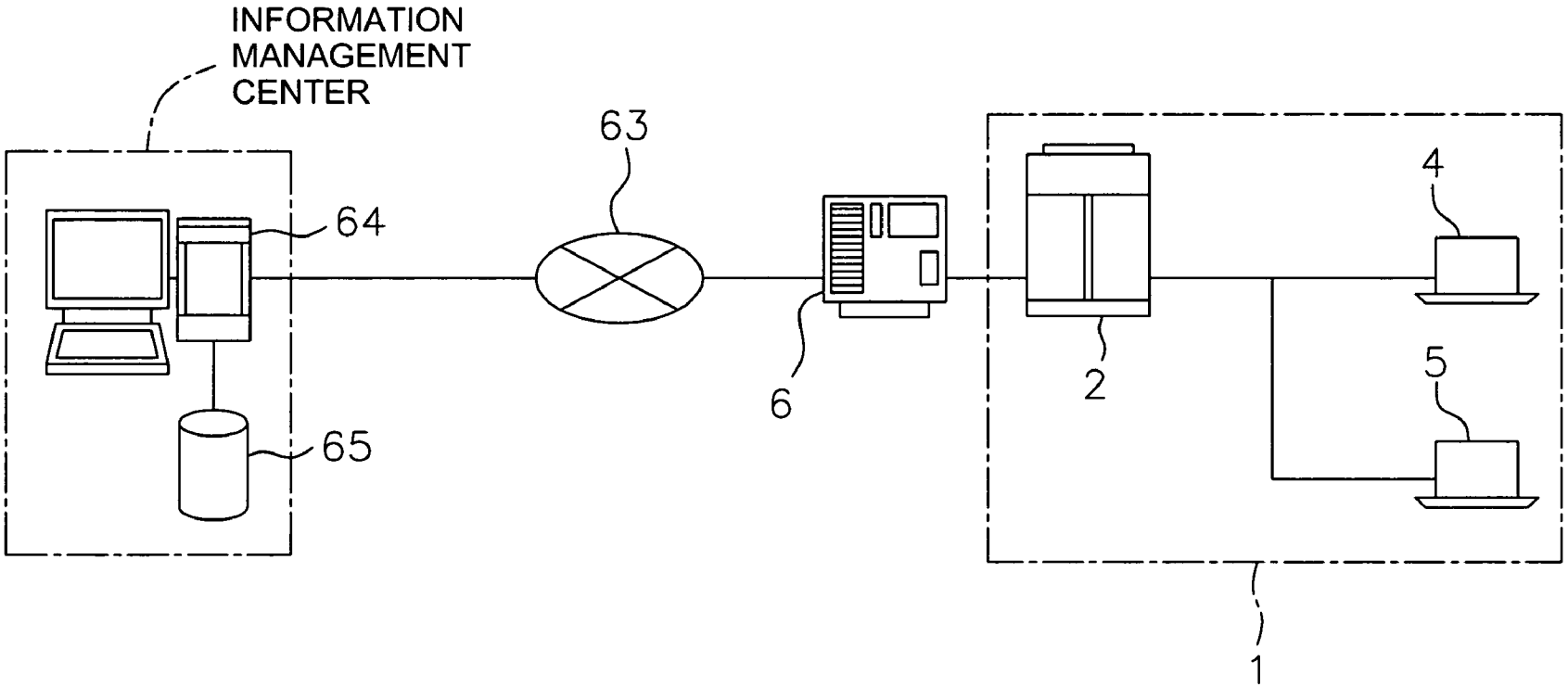
FIG. 15 is a refrigerant quantity determining system in which a remote server and a memory device are used.

In addition, as shown in FIG. 15, the refrigerant quantity determining system may be configured by achieving a connection between the air conditioner 1 and the local controller 61 as a management device that manages each constituent equipment of the air conditioner 1 and obtains the operation data, connecting the local controller 61 via a network 63 to a remote server 64 of an information management center that receives the operation data of the air conditioner 1, and connecting a memory device 65 such as a disk device as the state quantity storing means to the remote server 64. For example, such a configuration may be considered that the local controller 61 is caused to function as the state quantity obtaining means for obtaining the operation state quantity of the air conditioner 1; the memory device 65 is caused to function as the state quantity storing means; and the remote server 64 is caused to function as the refrigerant quantity determining means, the state quantity correcting means and the state quantity correction formula computing means. Also in this case, there will be no need for the controller 8 of the air conditioner 1 to have functions to store a large amount of data of the operation state quantity used only for defining parameters of the state quantity correction formula and to serve as the refrigerant quantity determining means, the state quantity correcting means, and the state quantity correction formula computing means.

Moreover, the memory device 65 can store a large amount of operation data from the air conditioner 1. Therefore, past operation data of the air conditioner 1 including the operation data in the refrigerant leak detection mode can also be stored, and operation data similar to the current operation data obtained by the local controller 61 can be selected from these past operation data by the remote server 64. Consequently, these data can be compared with each other and the adequacy of the refrigerant quantity can be determined. Accordingly, it becomes possible to determine the adequacy of the refrigerant quantity with the unique characteristics of the air conditioner 1 taken in to consideration. In addition, by combining a result of determination of the adequacy of the refrigerant quantity by the above described refrigerant quantity determining means, it becomes possible to further accurately determine the adequacy of the refrigerant quantity.

Second Embodiment

An embodiment of an air conditioner according to the present invention is described below with reference to the drawings.

(1) Configuration of Air Conditioner

Figure 16:
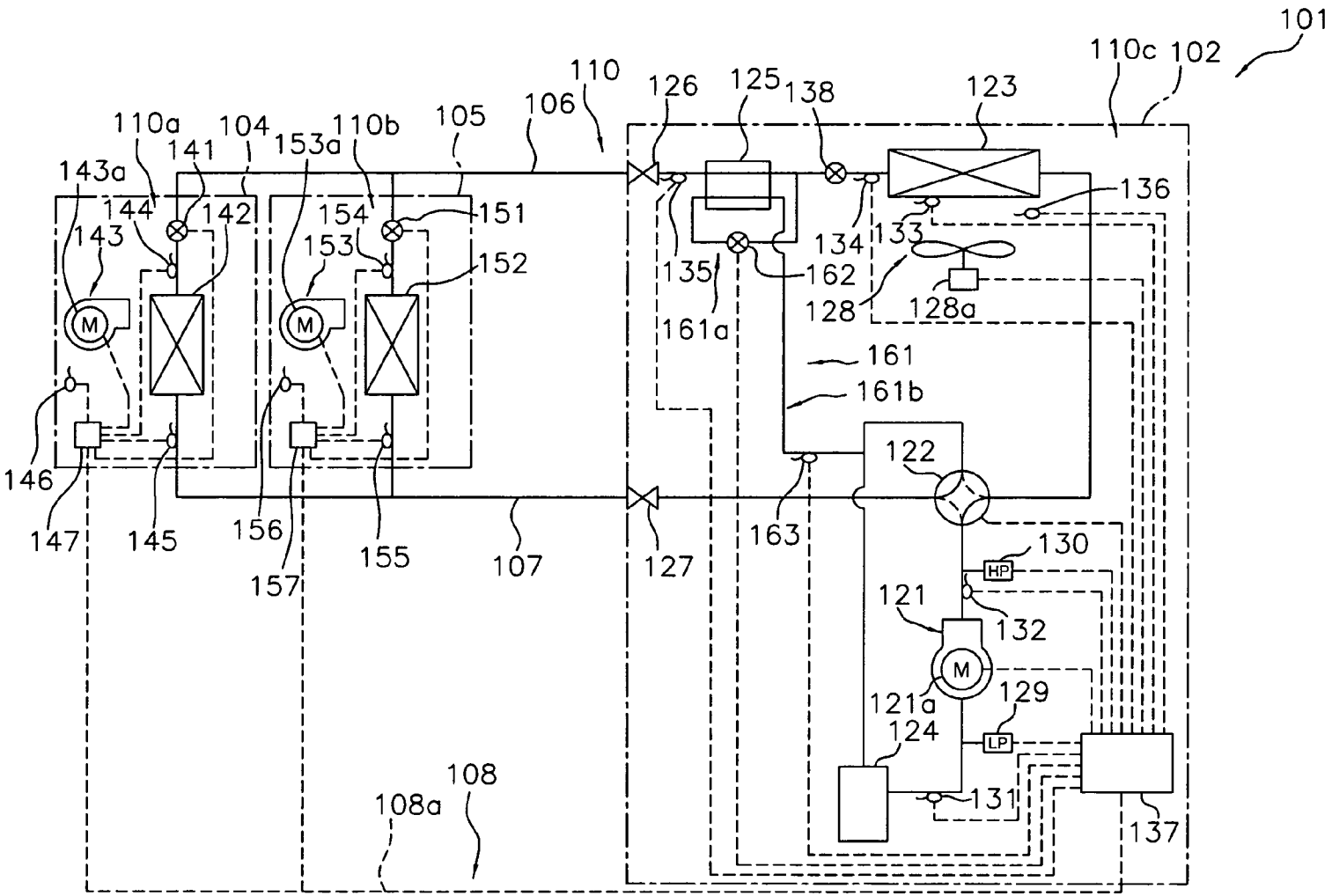
FIG. 16 is a schematic block diagram of an air conditioner in which a refrigerant quantity determining system according to a second embodiment of the present invention is employed.

FIG. 16 is a schematic block diagram of an air conditioner 101 according to a second embodiment of the present invention. The air conditioner 101 is a device that is used to cool and heat the inside of a room in a building and the like by performing a vapor compression-type refrigeration cycle operation. The air conditioner 101 mainly comprises one outdoor unit 102 as a heat source unit, a plurality of (two in the present embodiment) indoor units 104 and 105 as utilization units connected in parallel thereto, and a liquid refrigerant communication pipe 106 and a gas refrigerant communication pipe 107 as refrigerant communication pipes which interconnect the outdoor unit 102 and the indoor units 104 and 105. In other words, a vapor compression-type refrigerant circuit 110 of the air conditioner 101 in the present embodiment is configured by the interconnection of the outdoor unit 102, the indoor units 104 and 105, and the liquid refrigerant communication pipe 106 and the gas refrigerant communication pipe 107.

<Indoor Unit>

The indoor units 104 and 105 are installed by being embedded in or hung from a ceiling inside a room in a building and the like or by being mounted on a wall surface inside a room. The indoor units 104 and 105 are connected to the outdoor unit 102 via the liquid refrigerant communication pipe 106 and the gas refrigerant communication pipe 107, and configure a part of the refrigerant circuit 110.

Next, the configurations of the indoor units 104 and 105 are described. Note that, since the indoor units 104 and 105 have the same configuration, only the configuration of the indoor unit 104 is described here, and in regard to the configuration of the indoor unit 105, reference numerals in the 150s are used instead of reference numerals in the 140s representing the respective portions of the indoor unit 104, and description of those respective portions are omitted.

The indoor unit 104 mainly includes an indoor side refrigerant circuit 110*a* (in the indoor unit 105, an indoor side refrigerant circuit 110*b*) that configures a part of the refrigerant circuit 110. The indoor side refrigerant circuit 110*a* mainly includes an indoor expansion valve 141 as an expansion mechanism, and an indoor heat exchanger 142 as a utilization side heat exchanger.

In the present embodiment, the indoor expansion valve 141 is an electrically powered expansion valve connected to a liquid side of the indoor heat exchanger 142 in order to adjust the flow rate or the like of the refrigerant flowing in the indoor side refrigerant circuit 110*a*.

In the present embodiment, the indoor heat exchanger 142 is a cross fin-type fin-and-tube type heat exchanger configured by a heat transfer tube and numerous fins, and is a heat exchanger that functions as an evaporator of the refrigerant during cooling operation so as to cool the room air, and functions as a condenser of the refrigerant during heating operation so as to heat the room air.

In the present embodiment, the indoor unit 104 is disposed with an indoor fan 143 as a ventilation fan for taking in room air into the unit, causing the air to exchange heat with refrigerant in the indoor heat exchanger 142, and then supplying the air as supply air to the room. The outdoor fan 143 is a fan capable of varying the air flow rate Wr of the air supplied to the indoor heat exchanger 142, and in the present embodiment, is a centrifugal fan, multi-blade fan, or the like, which is driven by a motor 143*a* comprising a DC fan motor.

In addition, various types of sensors are disposed in the indoor unit 104. A liquid side temperature sensor 144 that detects the temperature of the refrigerant (i.e., the refrigerant temperature corresponding to the condensation temperature Tc during heating operation or the evaporation temperature Te during cooling operation) is disposed at the liquid side of the indoor heat exchanger 142. A gas side temperature sensor 145 that detects the temperature of the refrigerant Teo is disposed at a gas side of the indoor heat exchanger 142. A room temperature sensor 146 that detects the temperature of the room air that flows into the unit (i.e., the room temperature Tr) is disposed at a room air intake side of the indoor unit 104. In the present embodiment, the liquid side temperature sensor 144, the gas side temperature sensor 145, and the room temperature sensor 146 comprise thermistors. In addition, the indoor unit 104 includes an indoor side controller 147 that controls the operation of each portion constituting the indoor unit 104. Additionally, the indoor side controller 147 includes a microcomputer and a memory and the like disposed in order to control the indoor unit 104, and is configured such that it can exchange control signals and the like with a remote controller (not shown) for separately operating the indoor unit 104 and can exchange control signals and the like with the outdoor unit 102 via a transmission line 108*a*.

<Outdoor Unit>

The outdoor unit 102 is installed at the outside of a building and the like, is connected to the indoor units 104 and 105 via the liquid refrigerant communication pipe 106 and the gas refrigerant communication pipe 107, and constitute the refrigerant circuit 110 with the indoor units 104 and 105.

Next, the configuration of the outdoor unit 102 is described. The outdoor unit 102 mainly includes an outdoor side refrigerant circuit 110*c* that configures a part of the refrigerant circuit 110. The outdoor the refrigerant circuit 110*c* mainly includes a compressor 121, a four-way switching valve 122, an outdoor heat exchanger 123 as a heat source side heat exchanger, an outdoor expansion valve 138 as an expansion mechanism, an accumulator 124, a subcooler 125 as a temperature adjustment mechanism, a liquid side stop valve 126, and a gas side stop valve 127.

The compressor 121 is a compressor whose operation capacity can be varied, and in the present embodiment, is a positive displacement-type compressor driven by a motor 121*a* whose rotation frequency Rm is controlled by an inverter. In the present embodiment, the compressor 121 comprises only one compressor, but the compressor is not limited thereto and may also be one where two or more compressors are connected in parallel depending on the connection number of indoor units and the like.

The four-way switching valve 122 is a valve for switching the direction of the flow of the refrigerant such that, during cooling operation, the four-way switching valve 122 is capable of connecting a discharge side of the compressor 121 and a gas side of the outdoor heat exchanger 123 and connecting an suction side of the compressor 121 (specifically, the accumulator 124) and the gas refrigerant communication pipe 107 side (see the solid lines of the four-way switching valve 122 in FIG. 16) to cause the outdoor heat exchanger 123 to function as a condenser of the refrigerant compressed in the compressor 121 and to cause the indoor heat exchangers 142 and 152 to function as evaporators of the refrigerant condensed in the outdoor heat exchanger 123, and such that, during heating operation, the four-way switching valve 122 is capable of connecting the discharge side of the compressor 121 and the gas refrigerant communication pipe 107 side and connecting the suction side of the compressor 121 and the gas side of the outdoor heat exchanger 123 (see the dotted lines of the four-way switching valve 122 in FIG. 16) to cause the indoor heat exchangers 142 and 152 to function as condensers of the refrigerant compressed in the compressor 121 and to cause the outdoor heat exchanger 123 to function as an evaporator of the refrigerant condensed in the indoor heat exchangers 142 and 152.

In the present embodiment, the outdoor heat exchanger 123 is a cross-fin type fin-and-tube type heat exchanger configured by a heat transfer tube and numerous fins, and is a heat exchanger that functions as a condenser of the refrigerant during cooling operation and as an evaporator of the refrigerant during heating operation. The gas side of the outdoor heat exchanger 123 is connected to the four-way switching valve 122, and the liquid side thereof is connected to the liquid refrigerant communication pipe 106.

In the present embodiment, the outdoor expansion valve 138 is an electrically powered expansion valve connected to a liquid side of the outdoor heat exchanger 123 in order to adjust the pressure, the flow rate, or the like of the refrigerant flowing in the outdoor side refrigerant circuit 110*c*.

In the present embodiment, the outdoor unit 102 includes an outdoor fan 128 as a ventilation fan for taking in outdoor air into the unit, causing the air to exchange heat with refrigerant in the outdoor heat exchanger 123, and then exhausting the air to the outside. The outdoor fan 128 is a fan capable of varying the air flow rate Wo of the air supplied to the outdoor heat exchanger 123, and in the present embodiment, is a propeller fan or the like, which is driven by a motor 128*a* comprising a DC fan motor.

The accumulator 124 is connected between the four-way switching valve 122 and the compressor 121, and is a container capable of storing excess refrigerant generated in the refrigerant circuit 110 depending on the fluctuation in the operation loads and the like of the indoor units 104 and 105.

In the present embodiment, the subcooler 125 is a double tube heat exchanger, and is disposed to cool the refrigerant sent to the indoor expansion valves 141 and 151 after the refrigerant is condensed in the outdoor heat exchanger 123. In the present embodiment, the subcooler 125 is connected between the outdoor expansion valve 138 and the liquid side stop valve 126.

In the present embodiment, a bypass refrigerant circuit 161 is disposed as a cooling source of the subcooler 125. Note that, in the description below, a portion corresponding to the refrigerant circuit 110 excluding the bypass refrigerant circuit 161 is referred to as a main refrigerant circuit for convenience sake.

The bypass refrigerant circuit 161 is connected to the main refrigerant circuit so as to cause a portion of the refrigerant sent from the outdoor heat exchanger 123 to the indoor expansion valves 141 and 151 to branch from the main refrigerant circuit and return to the suction side of the compressor 121. Specifically, the bypass refrigerant circuit 161 includes a branch circuit 161*a* connected so as to branch a portion of the refrigerant sent from the outdoor expansion valve 138 to the indoor expansion valves 141 and 151 at a position between the outdoor heat exchanger 123 and the subcooler 125, and a merging circuit 161*b* connected to the suction side of the compressor 121 so as to return a portion of refrigerant from an outlet on a bypass refrigerant circuit side of the subcooler 125 to the suction side of the compressor 121. Further, the branch circuit 161*a* is disposed with a bypass expansion valve 162 for adjusting the flow rate of the refrigerant flowing in the bypass refrigerant circuit 161. Here, the bypass expansion valve 162 comprises a motor-operated expansion valve. In this way, the refrigerant sent from the outdoor heat exchanger 123 to the indoor expansion valves 141 and 151 is cooled in the subcooler 125 by the refrigerant flowing in the bypass refrigerant circuit 161 which has been depressurized by the bypass expansion valve 162. In other words, performance of the subcooler 125 is controlled by adjusting the opening degree of the bypass expansion valve 162.

The liquid side stop valve 126 and the gas side stop valve 127 are valves disposed at ports connected to external equipment and pipes (specifically, the liquid refrigerant communication pipe 106 and the gas refrigerant communication pipe 107). The liquid side stop valve 126 is connected to the outdoor heat exchanger 123. The gas side stop valve 127 is connected to the four-way switching valve 122.

In addition, various types of sensors are disposed in the outdoor unit 102. Specifically, disposed in the outdoor unit 102 are an suction pressure sensor 129 that detects the suction pressure Ps of the compressor 121, a discharge pressure sensor 130 that detects the discharge pressure Pd of the compressor 121, a suction temperature sensor 131 that detects the suction temperature Ts of the compressor 121, and a discharge temperature sensor 132 that detects the discharge temperature Td of the compressor 121. The suction temperature sensor 131 is disposed at a position between the accumulator 124 and the compressor 121. A heat exchanger temperature sensor 133 that detects the refrigerant temperature flowing in the outdoor heat exchanger 123 (i.e., the refrigerant temperature corresponding to the condensation temperature Tc during cooling operation or the evaporation temperature Te during heating operation) is disposed in the outdoor heat exchanger 123. A liquid side temperature sensor 134 that detects the refrigerant temperature Tco is disposed at the liquid side of the outdoor heat exchanger 123. A liquid pipe temperature sensor 135 that detects the refrigerant temperature (i.e., liquid pipe temperature Tlp) is disposed at the outlet on the main refrigerant circuit side of the subcooler 125. The merging circuit 161*b* of the bypass refrigerant circuit 161 is disposed with a bypass temperature sensor 163 for detecting the refrigerant temperature flowing at the outlet on the bypass refrigerant circuit side of the subcooler 125. An outdoor temperature sensor 136 that detects the temperature of the outdoor air that flows into the unit (i.e., the outdoor temperature Ta) is disposed at an outdoor air intake side of the outdoor unit 102. In the present embodiment, the suction temperature sensor 131, the discharge temperature sensor 132, the heat exchanger temperature sensor 133, the liquid side temperature sensor 134, the liquid pipe temperature sensor 135, the outdoor temperature sensor 136 and the bypass temperature sensor 163 comprise thermistors. In addition, the outdoor unit 102 includes an outdoor side controller 137 that controls the operation of each portion constituting the outdoor unit 102. Additionally, the outdoor side controller 137 includes a microcomputer and a memory disposed in order to control the outdoor unit 102, an inverter circuit that controls the motor 121*a*, and the like, and is configured such that it can exchange control signals and the like with the indoor side controllers 147 and 157 of the indoor units 104 and 105 via the transmission line 108*a*. In other words, a controller 108 that performs operation control of the entire air conditioner 101 is configured by the indoor side controllers 147 and 157, the outdoor side controller 137, and the transmission line 108*a* that interconnects the controllers 137 and 147, 157.

Figure 17:
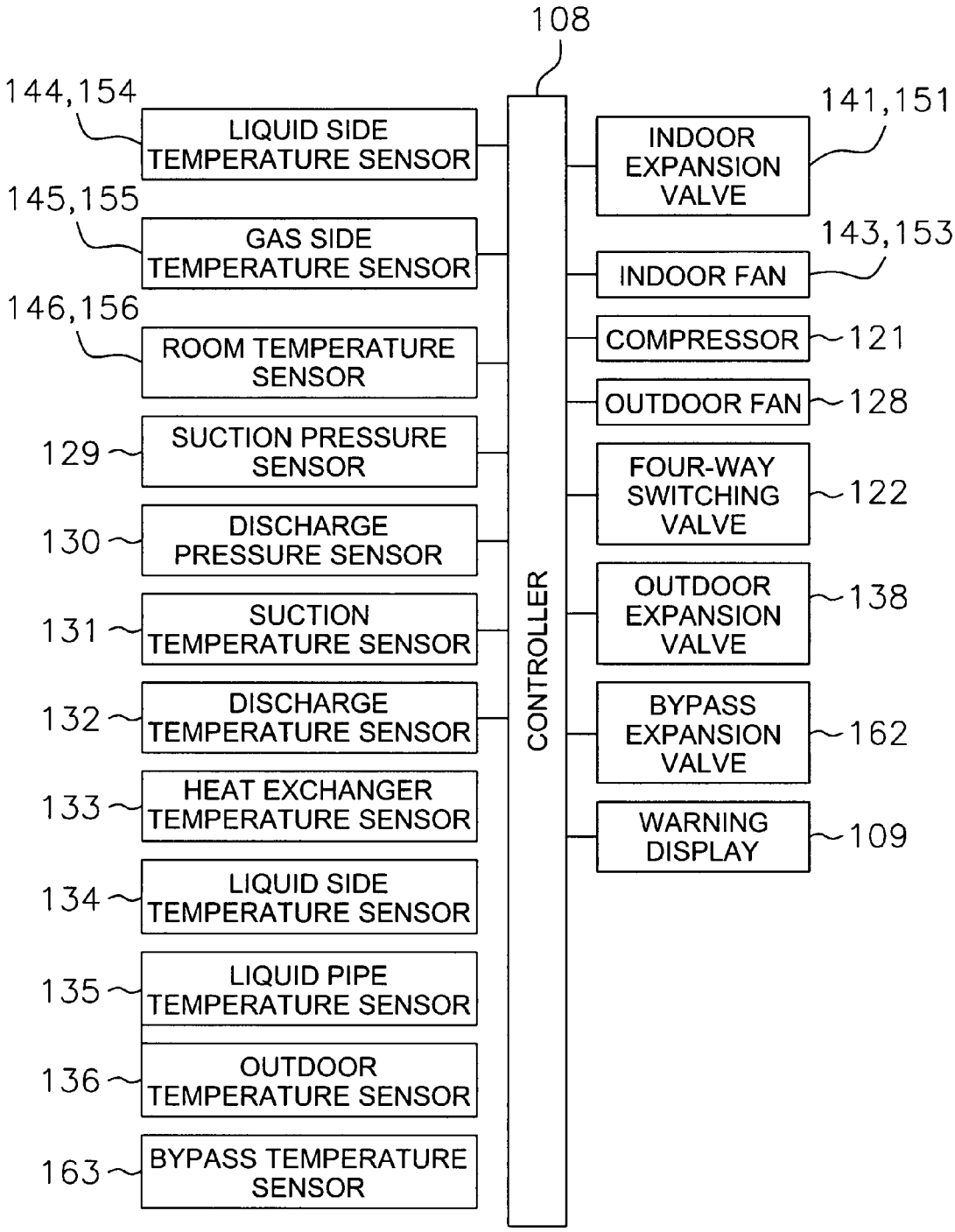
FIG. 17 is a control block diagram of the air conditioner.

As shown in FIG. 17, the controller 108 is connected so as to be able to receive detection signals of sensors 129 to 136, 144 to 146, 154 to 156, and 163, and to be able to control various equipment and valves 121, 122, 124, 128*a*, 138, 141, 143*a*, 151, 153*a*, and 162 based on these detection signals. In addition, a warning display 109 comprising LEDs and the like, which is configured to indicate that a refrigerant leak is detected during the below described refrigerant leak detection operation, is connected to the controller 108. Here, FIG. 17 is a control block diagram of the air conditioner 101.

<Refrigerant Communication Pipe>

The refrigerant communication pipes 106 and 107 are refrigerant pipes that are arranged on site when installing the air conditioner 101 at an installing location such as a building. As the refrigerant communication pipes 106 and 107, pipes having various lengths and pipe diameters are used depending on the installing conditions such as installing location, combination of an outdoor unit and an indoor unit, and the like. Accordingly, for example, when installing a new air conditioner, in order to calculate the charging quantity of the refrigerant, it is necessary to obtain accurate information regarding the lengths and pipe diameters and the like of the refrigerant communication pipes 106 and 107. However, management of such information and the calculation itself of the refrigerant quantity are difficult. In addition, when utilizing an existing pipe to renew an indoor unit and an outdoor unit, information regarding the lengths and pipe diameters and the like of the refrigerant communication pipes 106 and 107 may have been lost in some cases.

As described above, the refrigerant circuit 110 of the air conditioner 101 is configured by the interconnection of the indoor side refrigerant circuits 110*a* and 110*b*, the outdoor side refrigerant circuit 110*c*, and the refrigerant communication pipes 106 and 107. It can also be said that this the refrigerant circuit 110 comprises the bypass refrigerant circuit 161 and the main refrigerant circuit excluding the bypass refrigerant circuit 161. Further, with the controller 108 comprising the indoor side controllers 147 and 157 and the outdoor side controller 137, the air conditioner 101 in the present embodiment is configured to switch and operate between cooling operation and heating operation by the four-way switching valve 122 and control each equipment of the outdoor unit 102 and the indoor units 104 and 105 depending on the operation load of each of the indoor units 104 and 105.

(2) Operation of the Air Conditioner

Next, the operation of the air conditioner 101 in the present embodiment is described.

The operation modes of the air conditioner 101 in the present embodiment include: a normal operation mode where control of constituent equipment of the outdoor unit 102 and the indoor units 104 and 105 is performed depending on the operation load of each of the indoor units 104 and 105; a test operation mode where test operation to be performed after installment of constituent equipment of the air conditioner 101 is performed (specifically, it is not limited to after the first installment of equipment: it also includes, for example, after modification by adding or removing constituent equipment such as an indoor unit, after repair of damaged equipment) and the like; and a refrigerant leak detection operation mode where, after test operation is finished and normal operation has started, whether or not there is a refrigerant leak from the refrigerant circuit 110 is determined. The normal operation mode mainly includes cooling operation for cooling the room and heating operation for heating the room. In addition, the test operation mode mainly includes automatic refrigerant charging operation to charge refrigerant into the refrigerant circuit 110; pipe volume determining operation to detect the volumes of the refrigerant communication pipes 106 and 107; and initial refrigerant quantity detecting operation to detect the initial refrigerant quantity after installment of constituent equipment or after charging refrigerant in the refrigerant circuit 110.

Operation in each operation mode of the air conditioner 101 is described below.

<Normal Operation Mode>

(Cooling Operation)

First, cooling operation in the normal operation mode is described with reference to FIGS. 16 and 17.

During cooling operation, the four-way switching valve 122 is in the state represented by the solid lines in FIG. 16, i.e., a state where the discharge side of the compressor 121 is connected to the gas side of the outdoor heat exchanger 123 and also the suction side of the compressor 121 is connected to the gas sides of the indoor heat exchangers 142 and 152 via the gas side stop valve 127 and the gas refrigerant communication pipe 107. The outdoor expansion valve 138 is in a fully opened state. The liquid side stop valve 126 and the gas side stop valve 127 are in an opened state. The opening degree of each of the indoor expansion valves 141 and 151 is adjusted such that the degree of superheating SHr of the refrigerant at the outlets of the indoor heat exchangers 142 and 152 (i.e., the gas sides of the indoor heat exchangers 142 and 152) becomes constant at the target superheat degree SHrs. In the present embodiment, the degree of superheating SHr of the refrigerant at the outlet of each of the indoor heat exchangers 142 and 152 is detected by subtracting a refrigerant temperature value (which corresponds to the evaporation temperature Te) detected by the liquid side temperature sensors 144 and 154 from a refrigerant temperature value detected by the gas side temperature sensors 145 and 155, or is detected by converting the suction pressure Ps of the compressor 121 detected by the suction pressure sensor 129 to a saturated temperature value corresponding to the evaporation temperature Te and subtracting this saturated temperature value of the refrigerant from a refrigerant temperature value detected by the gas side temperature sensors 145 and 155. Note that, although it is not employed in the present embodiment, a temperature sensor that detects the temperature of the refrigerant flowing in each of the indoor heat exchangers 142 and 152 may be disposed such that the degree of superheating SHr of the refrigerant at the outlet of each of the indoor heat exchangers 142 and 152 is detected by subtracting a refrigerant temperature value corresponding to the evaporation temperature Te which is detected by this temperature sensor from a refrigerant temperature value detected by the gas side temperature sensors 145 and 155. In addition, the opening degree of the bypass expansion valve 162 is adjusted such that the degree of superheating SHb of the refrigerant at the outlet on the bypass refrigerant circuit side of the subcooler 125 becomes the target superheat degree SHbs. In the present embodiment, the degree of superheating SHb of the refrigerant at the outlet on the bypass refrigerant circuit side of the subcooler 125 is detected by converting the suction pressure Ps of the compressor 121 detected by the suction pressure sensor 129 to a saturated temperature value corresponding to the evaporation temperature Te, and subtracting this saturated temperature value of the refrigerant from a refrigerant temperature value detected by the bypass temperature sensor 163. Note that, although it is not employed in the present embodiment, a temperature sensor may be disposed at an inlet on the bypass refrigerant circuit side of the subcooler 125 such that the degree of superheating SHb of the refrigerant at the outlet on the bypass refrigerant circuit side of the subcooler 125 is detected by subtracting a refrigerant temperature value detected by this temperature sensor from a refrigerant temperature value detected by the bypass temperature sensor 163.

When the compressor 121, the outdoor fan 128, the indoor fans 143 and 153 are started in this state of the refrigerant circuit 110, low-pressure gas refrigerant is sucked into the compressor 121 and compressed into high-pressure gas refrigerant. Subsequently, the high-pressure gas refrigerant is sent to the outdoor heat exchanger 123 via the four-way switching valve 122, exchanges heat with the outdoor air supplied by the outdoor fan 128, and becomes condensed into high-pressure liquid refrigerant. Then, this high-pressure liquid refrigerant passes through the outdoor expansion valve 138, flows into the subcooler 125, exchanges heat with the refrigerant flowing in the bypass refrigerant circuit 161, is further cooled, and becomes subcooled. At this time, a portion of the high-pressure liquid refrigerant condensed in the outdoor heat exchanger 123 branches into the bypass refrigerant circuit 161 and is depressurized by the bypass expansion valve 162. Subsequently, it is returned to the suction side of the compressor 121. Here, the refrigerant that passes through the bypass expansion valve 162 is depressurized close to the suction pressure Ps of the compressor 121 and thereby a portion of the refrigerant evaporates. Then, the refrigerant flowing from the outlet of the bypass expansion valve 162 of the bypass refrigerant circuit 161 toward the suction side of the compressor 121 passes through the subcooler 125 and exchanges heat with high-pressure liquid refrigerant sent from the outdoor heat exchanger 123 on the main refrigerant circuit side to the indoor units 104 and 105.

Then, the high-pressure liquid refrigerant that has become subcooled is sent to the indoor units 104 and 105 via the liquid side stop valve 126 and the liquid refrigerant communication pipe 106. The high-pressure liquid refrigerant sent to the indoor units 104 and 105 is depressurized close to the suction pressure Ps of the compressor 121 by the indoor expansion valves 141 and 151, becomes refrigerant in a gas-liquid two-phase state, is sent to the indoor heat exchangers 142 and 152, exchanges heat with the room air in the indoor heat exchangers 142 and 152, and is evaporated into low-pressure gas refrigerant.

This low-pressure gas refrigerant is sent to the outdoor unit 102 via the gas refrigerant communication pipe 107, and flows into the accumulator 124 via the gas side stop valve 127 and the four-way switching valve 122. Then, the low-pressure gas refrigerant flowed into the accumulator 124 is again sucked into the compressor 121.

(Heating Operation)

Next, heating operation in the normal operation mode is described.

During heating operation, the four-way switching valve 122 is in the state represented by the dotted lines in FIG. 16, i.e., a state where the discharge side of the compressor 121 is connected to the gas sides of the indoor heat exchangers 142 and 152 via the gas side stop valve 127 and the gas refrigerant communication pipe 107 and also the suction side of the compressor 121 is connected to the gas side of the outdoor heat exchanger 123. The opening degree of the outdoor expansion valve 138 is adjusted so as to be able to depressurize the refrigerant that flows into the outdoor heat exchanger 123 to a pressure where the refrigerant is evaporated (i.e., the evaporation pressure Pe) in the outdoor heat exchanger 123. In addition, the liquid side stop valve 126 and the gas side stop valve 127 are in an opened state. The opening degree of each of the indoor expansion valves 141 and 151 is adjusted such that the degree of subcooling SCr of the refrigerant at the outlets of the indoor heat exchangers 142 and 152 becomes constant at the target subcool degree SCrs. In the present embodiment, the degree of subcooling SCr of the refrigerant at the outlets of the indoor heat exchangers 142 and 152 is detected by converting the discharge pressure Pd of the compressor 121 detected by the discharge pressure sensor 130 to a saturated temperature value corresponding to the condensation temperature Tc, and subtracting a refrigerant temperature value detected by the liquid side temperature sensors 144 and 154 from this saturated temperature value of the refrigerant. Note that, although it is not employed in the present embodiment, a temperature sensor that detects the temperature of the refrigerant flowing in each of the indoor heat exchangers 142 and 152 may be disposed such that the degree of subcooling SCr of the refrigerant at the outlets of the indoor heat exchangers 142 and 152 is detected by subtracting a refrigerant temperature value corresponding to the condensation temperature Tc which is detected by this temperature sensor from a refrigerant temperature value detected by the liquid side temperature sensors 144 and 154. In addition, the bypass expansion valve 162 is closed.

When the compressor 121, the outdoor fan 128, the indoor fans 143 and 153 are started in this state of the refrigerant circuit 110, low-pressure gas refrigerant is sucked into the compressor 121, compressed into high-pressure gas refrigerant, and sent to the indoor units 104 and 105 via the four-way switching valve 122, the gas side stop valve 127, and the gas refrigerant communication pipe 107.

Then, the high-pressure gas refrigerant sent to the indoor units 104 and 105 exchanges heat with the room air in the outdoor heat exchangers 142 and 152 and is condensed into high-pressure liquid refrigerant. Subsequently, it is depressurized according to the opening degree of the indoor expansion valves 141 and 151 when passing through the indoor expansion valves 141 and 151.

The refrigerant that passed through the indoor expansion valves 141 and 151 is sent to the outdoor unit 102 via the liquid refrigerant communication pipe 106, is further depressurized via the liquid side stop valve 126, the subcooler 125, and the outdoor expansion valve 138, and then flows into the outdoor heat exchanger 123. Then, the refrigerant in a low-pressure gas-liquid two-phase state that flowed into the outdoor heat exchanger 123 exchanges heat with the outdoor air supplied by the outdoor fan 128, is evaporated into low-pressure gas refrigerant, and flows into the accumulator 124 via the four-way switching valve 122. Then, the low-pressure gas refrigerant that flowed into the accumulator 124 is again sucked into the compressor 121.

Such operation control as described above in the normal operation mode is performed by the controller 108 (more specifically, the indoor side controllers 147 and 157, the outdoor side controller 137, and the transmission line 108*a* that connects between the controllers 137, 147 and 157) that functions as a normal operation controlling means for performing normal operation that includes cooling operation and heating operation.

<Test Operation Mode>

Figure 18:
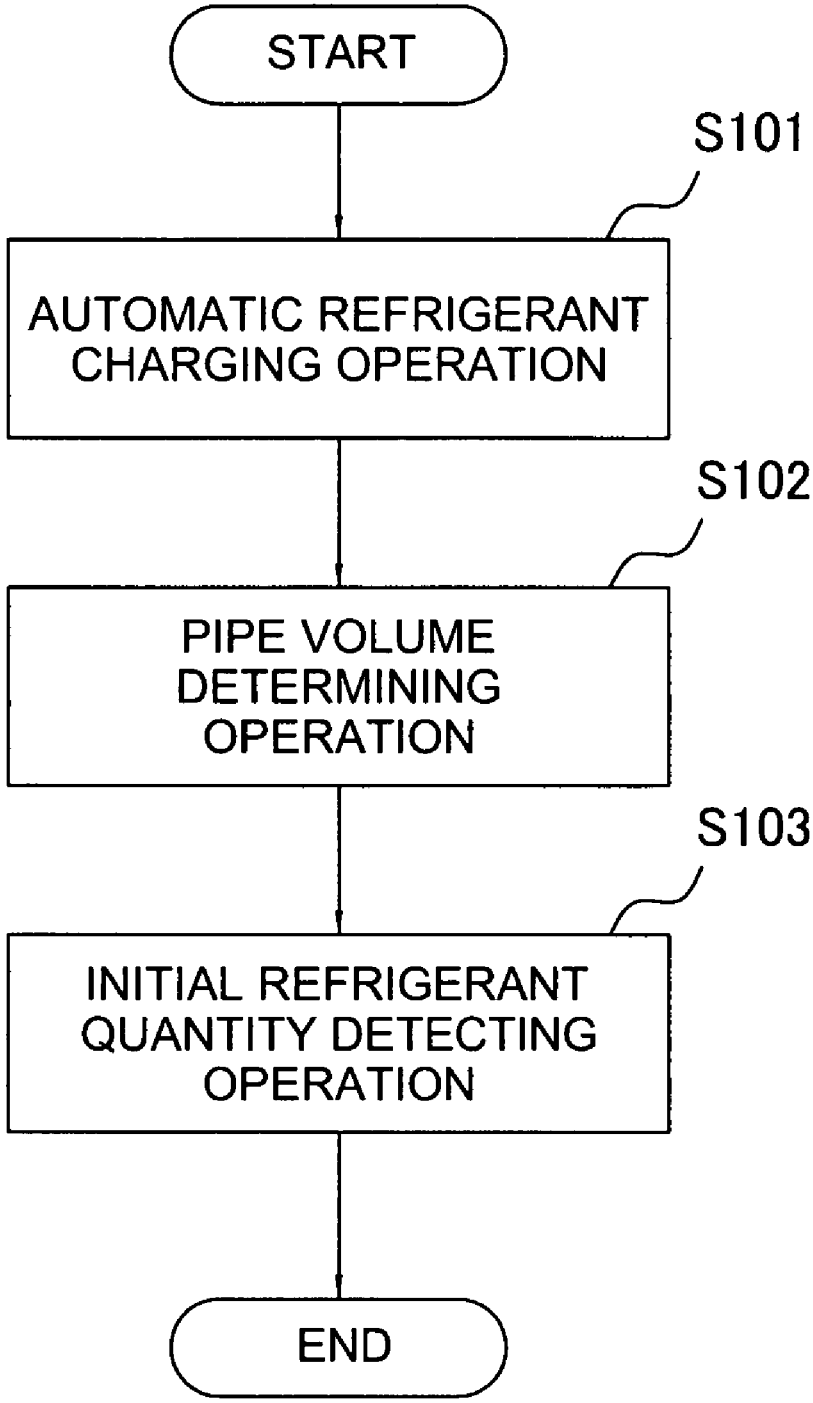
FIG. 18 is a flowchart of a test operation mode.

Next, the test operation mode is described with reference to FIGS. 16 to 18. Here, FIG. 18 is a flowchart of the test operation mode. In the present embodiment, in the test operation mode, first, automatic refrigerant charging operation of Step S101 is performed. Subsequently, pipe volume determining operation of Step S102 is performed, and then initial refrigerant quantity detecting operation of Step S103 is performed.

In the present embodiment, an example of a case is described where, the outdoor unit 102 in which a prescribed refrigerant quantity is charged in advance and the indoor units 104 and 105 are installed at an installing location such as a building, and interconnected via the liquid refrigerant communication pipe 106 and the gas refrigerant communication pipe 107 to configure the refrigerant circuit 110, and subsequently additional refrigerant is charged in the refrigerant circuit 110 whose refrigerant quantity is insufficient depending on the volumes of the liquid refrigerant communication pipe 106 and the gas refrigerant communication pipe 107.

(Step S101: Automatic Refrigerant Charging Operation)

First, the liquid side stop valve 126 and the gas side stop valve 127 of the outdoor unit 102 are opened and the refrigerant circuit 110 is filled with the refrigerant that is charged in the outdoor unit 102 in advance.

Figure 19:
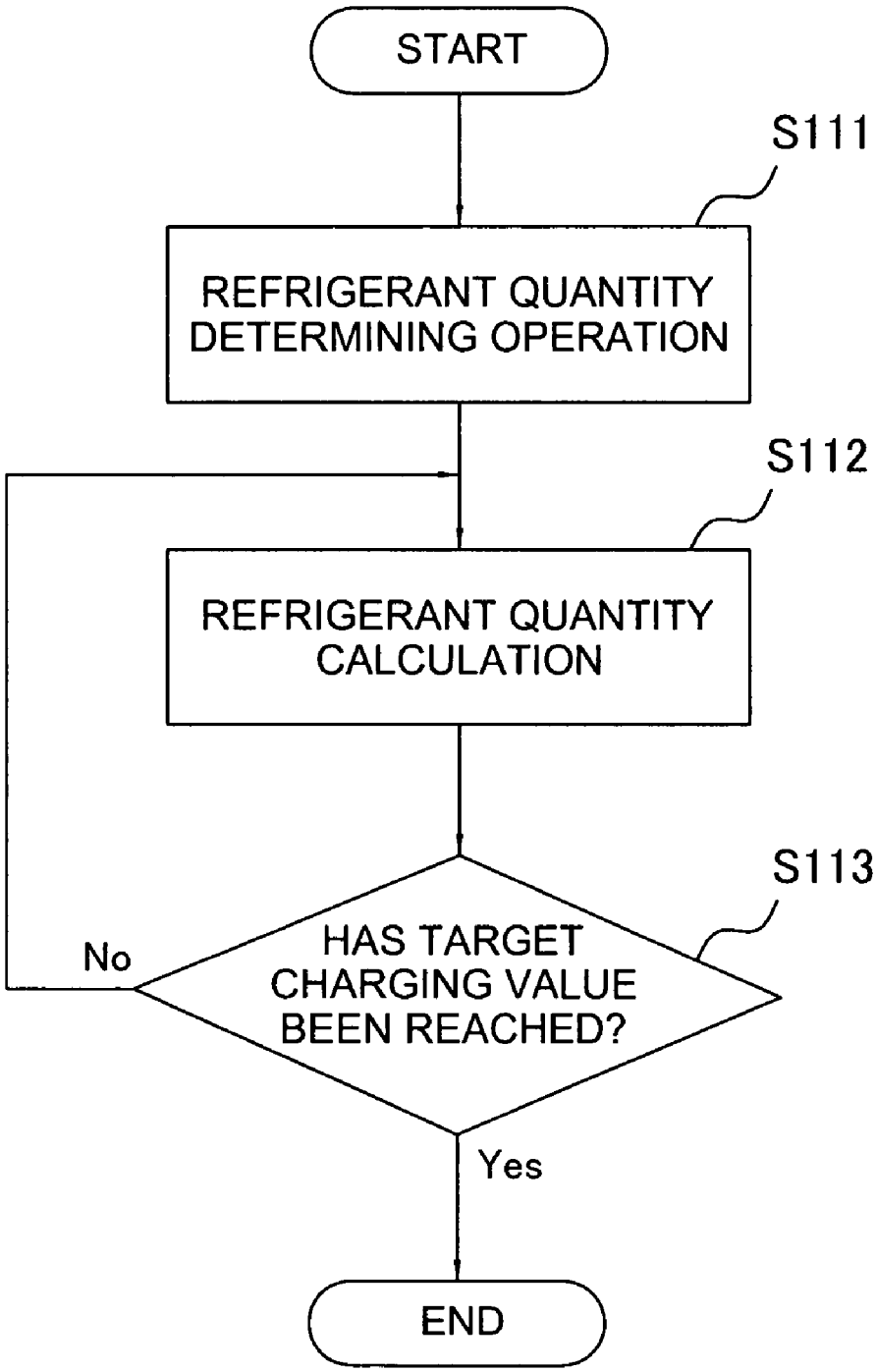
FIG. 19 is a flowchart of an automatic refrigerant charging operation.

Next, when a worker performing test operation connects a refrigerant cylinder for additional charging to a service port (not shown) of the refrigerant circuit 110 and issues a command to start test operation directly to the controller 108 or remotely by a remote controller (not shown) and the like, the controller 108 starts the process from Step S111 to Step S113 shown in FIG. 19. Here, FIG. 19 is a flowchart of automatic refrigerant charging operation.

(Step S111: Refrigerant Quantity Determining Operation)

When a command to start automatic refrigerant charging operation is issued, the refrigerant circuit 110, with the four-way switching valve 122 of the outdoor unit 102 in the state represented by the solid lines in FIG. 16, becomes a state where the indoor expansion valves 141 and 151 of the indoor units 104 and 105 and the outdoor expansion valve 138 are opened. Then, the compressor 121, the outdoor fan 128, and the indoor fans 143 and 153 are started, and cooling operation is forcibly performed in regard to all of the indoor units 104 and 105 (hereinafter referred to as "all indoor unit operation").

Figure 20:
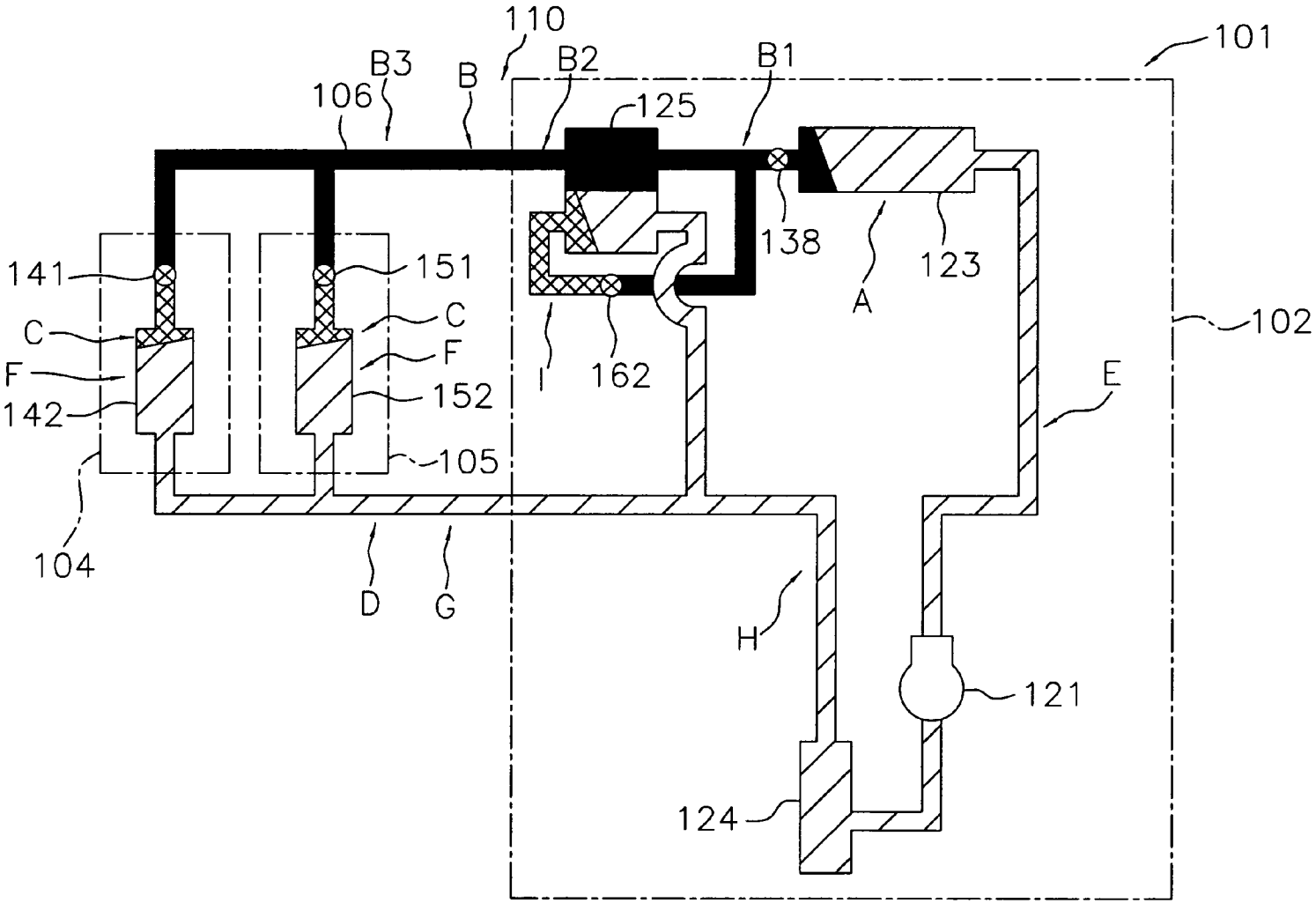
FIG. 20 is a schematic diagram to show a state of refrigerant flowing in a refrigerant circuit during a refrigerant quantity determining operation (illustrations of a four-way switching valve and the like are omitted).

Consequently, as shown in FIG. 20, in the refrigerant circuit 110, the high-pressure gas refrigerant compressed and discharged in the compressor 121 flows along a flow path from the compressor 121 to the outdoor heat exchanger 123 that functions as a condenser (see the portion from the compressor 121 to the outdoor heat exchanger 123 in the area indicated by the diagonal line hatching in FIG. 20); the high-pressure refrigerant that undergoes phase-change from a gas state to a liquid state by heat exchange with the outdoor air flows in the outdoor heat exchanger 123 that functions as a condenser (see the portion corresponding to the outdoor heat exchanger 123 in the area indicated by the diagonal line hatching and the black hatching in FIG. 20); the high-pressure liquid refrigerant flows along a flow path from the outdoor heat exchanger 123 to the indoor expansion valves 141 and 151 including the outdoor expansion valve 138, the portion corresponding to the main refrigerant circuit side of the subcooler 125 and the liquid refrigerant communication pipe 106, and a flow path from the outdoor heat exchanger 123 to the bypass expansion valve 162 (see the portions from the outdoor heat exchanger 123 to the indoor expansion valves 141 and 151 and to the bypass expansion valve 162 in the area indicated by the black hatching in FIG. 20); the low-pressure refrigerant that undergoes phase-change from a gas-liquid two-phase state to a gas state by heat exchange with the room air flows in the portions corresponding to the indoor heat exchangers 142 and 152 that function as evaporators and the portion corresponding to the bypass refrigerant circuit side of the subcooler 125 (see the portions corresponding to the indoor heat exchangers 142 and 152 and the portion corresponding to the subcooler 125 in the area indicated by the lattice hatching and the diagonal line hatching in FIG. 20); and the low-pressure gas refrigerant flows along a flow path from the indoor heat exchangers 142 and 152 to the compressor 121 including the gas refrigerant communication pipe 107 and the accumulator 124 and a flow path from the portion corresponding to the bypass refrigerant circuit side of the subcooler 125 to the compressor 121 (see the portion from the indoor heat exchangers 142 and 152 to the compressor 121 and the portion from the portion corresponding to the bypass refrigerant circuit side of the subcooler 125 to the compressor 121 in the area indicated by the diagonal line hatching in FIG. 20). FIG. 20 is a schematic diagram to show a state of the refrigerant flowing in the refrigerant circuit 110 during refrigerant quantity determining operation (illustrations of the four-way switching valve 122 and the like are omitted).

Next, equipment control as described below is performed to proceed to operation to stabilize the state of the refrigerant circulating in the refrigerant circuit 110. Specifically, the indoor expansion valves 141 and 151 are controlled such that the degree of superheating SHr of the indoor heat exchangers 142 and 152 that function as evaporators becomes constant (hereinafter referred to as "super heat degree control"); the operation capacity of the compressor 121 is controlled such that the evaporation pressure Pe becomes constant (hereinafter referred to as "evaporation pressure control"); the air flow rate Wo of outdoor air supplied to the outdoor heat exchanger 123 by the outdoor fan 128 is controlled such that the condensation pressure Pc of the refrigerant in the outdoor heat exchanger 123 becomes constant (hereinafter referred to as "condensation pressure control"); the operation capacity of the subcooler 125 is controlled such that the temperature of the refrigerant sent from the subcooler 125 to the indoor expansion valves 141 and 151 becomes constant (hereinafter referred to as "liquid pipe temperature control"); the indoor expansion valves 141 and 151 are controlled such that the degree of superheating SHr of the indoor heat exchangers 142 and 152 that function as evaporators becomes constant (hereinafter referred to as "superheat degree control"); and the air flow rate Wr of room air supplied to the indoor heat exchangers 142 and 152 by the indoor fans 143 and 153 is maintained constant such that the evaporation pressure Pe of the refrigerant is stably controlled by the above described evaporation pressure control.

Here, the reason to perform the evaporation pressure control is that the evaporation pressure Pe of the refrigerant in the indoor heat exchangers 142 and 152 that function as evaporators is greatly affected by the refrigerant quantity in the indoor heat exchangers 142 and 152 where low-pressure refrigerant flows while undergoing a phase change from a gas-liquid two-phase state to a gas state as a result of heat exchange with the room air (see the portions corresponding to the indoor heat exchangers 142 and 152 in the area indicated by the lattice hatching and the diagonal line hatching in FIG. 20, which is hereinafter referred to as "evaporator portion C"). The evaporation pressure of the refrigerant in the evaporator portion C creates a state where the refrigerant quantity in the evaporator portion C changes mainly by the evaporation pressure Pe by causing the evaporation pressure Pe of the refrigerant in the indoor heat exchangers 142 and 152 to become constant and stabilizing the state of the refrigerant flowing in the evaporator portion C as a result of controlling the operation capacity of the compressor 121 by the motor 121*a* whose rotation frequency Rm is controlled by an inverter. Note that, the control of the evaporation pressure Pe by the compressor 121 in the present embodiment is achieved in the following manner: a refrigerant temperature value (which corresponds to the evaporation temperature Te) detected by the liquid side temperature sensors 144 and 154 of the indoor heat exchangers 142 and 152 is converted to a saturation pressure value; the operation capacity of the compressor 121 is controlled such that this pressure value becomes constant at the target low-pressure value Pes (in other words, the control to change the rotation frequency Rm of the motor 121*a* is performed); and then the refrigerant circulation flow rate Wc flowing in the refrigerant circuit 110 is increased or decreased. Note that, although it is not employed in the present embodiment, the operation capacity of the compressor 121 may be controlled such that the suction pressure Ps of the compressor 121 detected by the suction pressure sensor 129, which is the operation state quantity equivalent to the pressure of the refrigerant at the evaporation pressure Pe of the refrigerant in the indoor heat exchangers 142 and 152, becomes constant at the target low-pressure value Pes, or a saturation temperature value (which corresponds to the evaporation temperature Te) corresponding to the suction pressure Ps becomes constant at the target low-pressure value Tes. Also, the operation capacity of the compressor 121 may be controlled such that a refrigerant temperature value (which corresponds to the evaporation temperature Te) detected by the liquid side temperature sensors 144 and 154 of the indoor heat exchangers 142 and 152 becomes constant at the target low-pressure value Tes.

Then, by performing such evaporation pressure control, the state of the refrigerant flowing in the refrigerant pipes from the indoor heat exchangers 142 and 152 to the compressor 121 including the gas refrigerant communication pipe 107 and the accumulator 124 (see the portion from the indoor heat exchangers 142 and 152 to the compressor 121 in the area indicated by the diagonal line hatching in FIG. 20, which is hereinafter referred to as "gas refrigerant distribution portion D") becomes stabilized, creating a state where the refrigerant quantity in the gas refrigerant distribution portion D changes mainly by the evaporation pressure Pe (i.e., suction pressure Ps), which is the operation state quantity equivalent to the pressure of the refrigerant in the gas refrigerant distribution portion D.

In addition, the reason to perform the condensation pressure control is that the condensation pressure Pc of the refrigerant is greatly affected by the refrigerant quantity in the outdoor heat exchanger 123 where high-pressure refrigerant flows while undergoing a phase change from a gas state to a liquid state as a result of heat exchange with the outdoor air (see the portions corresponding to the outdoor heat exchanger 123 in the area indicated by the diagonal line hatching and the black hatching in FIG. 20, which is hereinafter referred to as "condenser portion A"). The condensation pressure Pc of the refrigerant in the condenser portion A greatly changes due to the effect of the outdoor temperature Ta. Therefore, the air flow rate Wo of room air supplied from the outdoor fan 128 to the outdoor heat exchanger 123 is controlled by the motor 128*a*, and thereby the condensation pressure Pc of the refrigerant in the outdoor heat exchanger 123 is maintained constant and the state of the refrigerant flowing in the condenser portion A is stabilized, creating a state where the refrigerant quantity in condenser portion A changes mainly by the degree of subcooling SCo at the liquid side of the outdoor heat exchanger 123 (hereinafter regarded as the outlet of the outdoor heat exchanger 123 in the description regarding the refrigerant quantity determining operation). Note that, for the control of the condensation pressure Pc by the outdoor fan 128 in the present embodiment, the discharge pressure Pd of the compressor 121 detected by the discharge pressure sensor 130, which is the operation state quantity equivalent to the condensation pressure Pc of the refrigerant in the outdoor heat exchanger 123, or the temperature of the refrigerant flowing in the outdoor heat exchanger 123 (i.e., the condensation temperature Tc) detected by the heat exchanger temperature sensor 133 is used. Here, FIG. 20 is a schematic diagram to show a state of the refrigerant flowing in a refrigerant circuit 110 during refrigerant quantity determining operation (illustrations of the four-way switching valve 122 and the like are omitted).

Then, by performing such condensation pressure control, the high-pressure liquid refrigerant flows along a flow path from the outdoor heat exchanger 123 to the indoor expansion valves 141 and 151 including the outdoor expansion valve 138, the portion on the main refrigerant circuit side of the subcooler 125, and the liquid refrigerant communication pipe 106 and a flow path from the outdoor heat exchanger 123 to the bypass expansion valve 162 of the bypass refrigerant circuit 161; the pressure of the refrigerant in the portions from the outdoor heat exchanger 123 to the indoor expansion valves 141 and 151 and to the bypass expansion valve 162 (see the area indicated by the black hatching in FIG. 20, which is hereinafter referred to as "liquid refrigerant distribution portion B") also becomes stabilized; and the liquid refrigerant distribution portion B is sealed by the liquid refrigerant, thereby becoming a stable state.

In addition, the reason to perform the liquid pipe temperature control is to prevent a change in the density of the refrigerant in the refrigerant pipes from the subcooler 125 to the indoor expansion valves 141 and 151 including liquid refrigerant communication pipe 106 (see the portion from the subcooler 125 to the indoor expansion valves 141 and 151 in the liquid refrigerant distribution portion B shown in FIG. 20). Performance of the subcooler 125 is controlled by increasing or decreasing the flow rate of the refrigerant flowing in the bypass refrigerant circuit 161 such that the refrigerant temperature Tlp detected by the liquid pipe temperature sensor 135 disposed at the outlet on the main refrigerant circuit side of the subcooler 125 becomes constant at the target liquid pipe temperature value Tlps, and by adjusting the quantity of heat exchange between the refrigerant flowing at the main refrigerant circuit side and the flowing at the bypass refrigerant circuit side of the subcooler 125. Note that, the flow rate of the refrigerant flowing in the bypass refrigerant circuit 161 is increased or decreased by adjustment of the opening degree of the bypass expansion valve 162. In this way, the liquid pipe temperature control is achieved in which the refrigerant temperature in the refrigerant pipes from the subcooler 125 to the indoor expansion valves 141 and 151 including the liquid refrigerant communication pipe 106 becomes constant.

Then, by performing such liquid pipe temperature constant control, even when the refrigerant temperature Tco at the outlet of the outdoor heat exchanger 123 (i.e., the degree of subcooling SCo of the refrigerant at the outlet of the outdoor heat exchanger 123) changes along with a gradual increase in the refrigerant quantity in the refrigerant circuit 110 by charging refrigerant in the refrigerant circuit 110, the effect of a change in the refrigerant temperature Tco at the outlet of the outdoor heat exchanger 123 will extend only within the refrigerant pipes from the outlet of the outdoor heat exchanger 123 to the subcooler 125, and the effect will not extend to the refrigerant pipes from the subcooler 125 to the indoor expansion valves 141 and 151 including the liquid refrigerant communication pipe 106 in the liquid refrigerant distribution portion B.

Further, the reason to perform the superheat degree control is because the refrigerant quantity in the evaporator portion C greatly affects the quality of wet vapor of the refrigerant at the outlets of the indoor heat exchangers 142 and 152. The degree of superheating SHr of the refrigerant at the outlets of the indoor heat exchangers 142 and 152 is controlled such that the degree of superheating SHr of the refrigerant at the gas sides of the indoor heat exchangers 142 and 152 (hereinafter regarded as the outlets of the indoor heat exchangers 142 and 152 in the description regarding refrigerant quantity determining operation) becomes constant at the target superheat degree SHrs (in other words, the gas refrigerant at the outlets of the indoor heat exchangers 142 and 152 is in a superheat state) by controlling the opening degree of the indoor expansion valves 141 and 151, and thereby the state of the refrigerant flowing in the evaporator portion C is stabilized.

By each control described above, the state of the refrigerant circulating in the refrigerant circuit 110 becomes stabilized, and the distribution of the refrigerant quantity in the refrigerant circuit 110 becomes constant. Therefore, when refrigerant starts to be charged in the refrigerant circuit 110 by additional refrigerant charging, it is possible to create a state where a change in the refrigerant quantity in the refrigerant circuit 110 mainly appear as a change of the refrigerant quantity in the outdoor heat exchanger 123 (hereinafter this operation is referred to as "refrigerant quantity determining operation").

Such control as described above is performed as the process in Step S111 by the controller 108 (more specifically, by the indoor side controllers 147 and 157, the outdoor side controller 137, and the transmission line 108*a* that connects between the controllers 137, 147 and 157) that functions as the refrigerant quantity determining operation controlling means for performing refrigerant quantity determining operation.

Note that, unlike the present embodiment, when refrigerant is not charged in advance in the outdoor unit 102, it is necessary prior to Step S111 to charge refrigerant until the refrigerant quantity reaches a level where constituent equipment will not abnormally stop during the above described refrigerant quantity determining operation.

(Step S112: Refrigerant Quantity Calculation)

Next, additional refrigerant is charged into the refrigerant circuit 110 while performing the above described refrigerant quantity determining operation. At this time, the controller 108 that functions as a refrigerant quantity calculating means calculates the refrigerant quantity in the refrigerant circuit 110 from the operation state quantity of constituent equipment or the refrigerant flowing in the refrigerant circuit 110 during additional refrigerant charging in Step S112.

First, the refrigerant quantity calculating means in the present embodiment is described. The refrigerant quantity calculating means divides the refrigerant circuit 110 into a plurality of portions, calculates the refrigerant quantity for each divided portion, and thereby calculates the refrigerant quantity in the refrigerant circuit 110. More specifically, a relational expression between the refrigerant quantity in each portion and the operation state quantity of constituent equipment or the refrigerant flowing in the refrigerant circuit 110 is defined for each divided portion, and the refrigerant quantity in each portion can be calculated by using these relational expressions. In the present embodiment, in a state where the four-way switching valve 22 is represented by the solid lines in FIG. 16, i.e., a state where the discharge side of the compressor 121 is connected to the gas side of the outdoor heat exchanger 123 and where the suction side of the compressor 121 is connected to the outlets of the indoor heat exchangers 142 and 152 via the gas side stop valve 127 and the gas refrigerant communication pipe 107, the refrigerant circuit 110 is divided into the following portions and a relational expression is defined for each portion: a portion corresponding to the compressor 121 and a portion from the compressor 121 to the outdoor heat exchanger 123 including the four-way switching valve 122 (not shown in FIG. 20) (hereinafter referred to as "high-pressure gas pipe portion E"); a portion corresponding to the outdoor heat exchanger 123 (i.e., the condenser portion A); a portion from the outdoor heat exchanger 123 to the subcooler 125 and an inlet side half of the portion corresponding to the main refrigerant circuit side of the subcooler 125 in the liquid refrigerant distribution portion B (hereinafter referred to as "high temperature side liquid pipe portion B1"); an outlet side half of a portion corresponding to the main refrigerant circuit side of the subcooler 125 and a portion from the subcooler 125 to the liquid side stop valve 126 (not shown in FIG. 20) in the liquid refrigerant distribution portion B (hereinafter referred to as "low temperature side liquid pipe portion B2"); a portion corresponding to the liquid refrigerant communication pipe 106 in the liquid refrigerant distribution portion B (hereinafter referred to as "liquid refrigerant communication pipe portion B3"); a portion from the liquid refrigerant communication pipe 106 in the liquid refrigerant distribution portion B to the gas refrigerant communication pipe 107 in the gas refrigerant distribution portion D including portions corresponding to the indoor expansion valves 141 and 151 and the indoor heat exchangers 142 and 152 (i.e., the evaporator portion C) (hereinafter referred to as "indoor unit portion F"); a portion corresponding to the gas refrigerant communication pipe 107 in the gas refrigerant distribution portion D (hereinafter referred to as "gas refrigerant communication pipe portion G"); a portion from the gas side stop valve 127 (not shown in FIG. 20) in the gas refrigerant distribution portion D to the compressor 121 including the four-way switching valve 122 and the accumulator 124 (hereinafter referred to as "low-pressure gas pipe portion H"); and a portion from the high temperature side liquid pipe portion B1 in the liquid refrigerant distribution portion B to the low-pressure gas pipe portion H including the bypass expansion valve 162 and a portion corresponding to the bypass refrigerant circuit side of the subcooler 125 (hereinafter referred to as "bypass circuit portion I"). Next, the relational expressions defined for each portion described above are described.

In the present embodiment, a relational expression between the refrigerant quantity Mog 1 in the high-pressure gas pipe portion E and the operation state quantity of constituent equipment or the refrigerant flowing in the refrigerant circuit 110 is, for example, expressed by $$Mog1 = Vog1 \times \rho d,$$

which is a function expression in which the volume Vog 1 of the high-pressure gas pipe portion E in the outdoor unit 2 is multiplied by the density pd of the refrigerant in high-pressure gas pipe portion E. Note that, the volume Vog 1 of the high-pressure gas pipe portion E is a value that is known prior to installment of outdoor unit 102 at the installing location and is stored in advance in the memory of the controller 108. In addition, the density pd of the refrigerant in the high-pressure gas pipe portion E is obtained by converting the discharge temperature Td and the discharge pressure Pd.

A relational expression between the refrigerant quantity Mc in the condenser portion A and the operation state quantity of constituent equipment or the refrigerant flowing in the refrigerant circuit 110 is, for example, expressed by $$Mc = kc1 \times Ta + kc2 \times Tc + kc3 \times SHm + kc4 \times Wc + kc5 \times \rho c + kc6 \times \rho co + kc7,$$

which is a function expression of the outdoor temperature Ta, the condensation temperature Tc, the compressor discharge superheat degree SHm, the refrigerant circulation flow rate Wc, the saturated liquid density ρc of the refrigerant in the outdoor heat exchanger 123, and the density ρco of the refrigerant at the outlet of the outdoor heat exchanger 123. Note that, the parameters kc1 to kc7 in the above described relational expression are derived from a regression analysis of results of tests and detailed simulations and are stored in advance in the memory of the controller 108. In addition, the compressor discharge superheat degree SHm is the degree of superheating of the refrigerant at the discharge side of the compressor, and is obtained by converting the discharge pressure Pd to a refrigerant saturation temperature value and subtracting this refrigerant saturation temperature value from the discharge temperature Td. The refrigerant circulation flow rate Wc is expressed as a function of the evaporation temperature Te and the condensation temperature Tc (i.e., Wc=f (Te, Tc)). The saturated liquid density ρc of the refrigerant is obtained by converting the condensation temperature Tc. The density ρco of the refrigerant at the outlet of the outdoor heat exchanger 123 is obtained by converting the condensation pressure Pc and the refrigerant temperature Tco which are obtained by converting the condensation temperature Tc.

A relational expression between the refrigerant quantity Mol1 in the high temperature liquid pipe portion B1 and the operation state quantity of constituent equipment or the refrigerant flowing in the refrigerant circuit 110 is, for example, expressed by $$Mol1 = Vol1 \times \rho co,$$

which is a function expression in which the volume Vol1 of the high temperature liquid pipe portion B1 in the outdoor unit 102 is multiplied by the density ρco of the refrigerant in the high temperature liquid pipe portion B1 (i.e., the above described density of the refrigerant at the outlet of the outdoor heat exchanger 123). Note that, the volume Vol1 of the high-pressure liquid pipe portion B1 is a value that is known prior to installment of outdoor unit 102 at the installing location and is stored in advance in the memory of the controller 108.

A relational expression between the refrigerant quantity Mol2 in the low temperature liquid pipe portion B2 and the operation state quantity of constituent equipment or the refrigerant flowing in the refrigerant circuit 110 is, for example, expressed by $$Mol2 = Vol2 \times \rho lp,$$

which is a function expression in which the volume Vol2 of the low temperature liquid pipe portion B2 in the outdoor unit 102 is multiplied by the density ρlp of the refrigerant in the low temperature liquid pipe portion B2. Note that, the volume Vol2 of the low temperature liquid pipe portion B2 is a value that is known prior to installment of outdoor unit 102 at the installing location and is stored in advance in the memory of the controller 108. In addition, the density ρlp of the refrigerant in the low temperature liquid pipe portion B2 is the density of the refrigerant at the outlet of the subcooler 125, and is obtained by converting the condensation pressure Pc and the refrigerant temperature Tlp at the outlet of the subcooler 125.

A relational expression between the refrigerant quantity Mlp in the liquid refrigerant communication pipe portion B3 and the operation state quantity of constituent equipment or the refrigerant flowing in the refrigerant circuit 110 is, for example, expressed by $$Mlp = Vlp \times \rho lp,$$

which is a function expression in which the volume Vlp of the liquid refrigerant communication pipe 106 is multiplied by the density ρlp of the refrigerant in the liquid refrigerant communication pipe portion B3 (i.e., the density of the refrigerant at the outlet of the subcooler 125). Note that, as for the volume Vlp of the liquid refrigerant communication pipe 106, since the liquid refrigerant communication pipe 106 is a refrigerant pipe arranged on site when installing the air conditioner 101 at an installing location such as a building, a value calculated on site from the information regarding the length, pipe diameter and the like is input or information regarding the length, pipe diameter and the like is input on site, and the controller 108 calculates the volume Vlp from the input information of the liquid refrigerant communication pipe 106. Or, as described below, the volume Vlp is calculated by using the operation results of pipe volume determining operation.

A relational expression between the refrigerant quantity Mr indoor unit portion F and the operation state quantity of constituent equipment or the refrigerant flowing in the refrigerant circuit 110 is, for example, expressed by $$Mr=kr1\times Tlp+kr2\times\Delta T+kr3\times SHr+kr4\times Wr+kr5,$$

which is a function expression of the refrigerant temperature Tlp at the outlet of the subcooler 125, the temperature difference ΔT in which the evaporation temperature Te is subtracted from the room temperature Tr, the degree of superheating SHr of the refrigerant at the outlets of the indoor heat exchangers 142 and 152, and the air flow rate Wr of the indoor fans 143 and 153. Note that, the parameters kr1 to kr5 in the above described relational expression are derived from a regression analysis of results of tests and detailed simulations and are stored in advance in the memory of the controller 108. Note that, here, the relational expression for the refrigerant quantity Mr is defined for each of the two indoor units 104 and 105, and the entire refrigerant quantity in the indoor unit portion F is calculated by adding the refrigerant quantity Mr in the indoor unit 104 and the refrigerant quantity Mr in the indoor unit 105. Note that, when the model and the capacity are different between the indoor unit 104 and the indoor unit 105, relational expressions having parameters kr1 to kr5 with different values will be used.

A relational expression between the refrigerant quantity Mgp in the gas refrigerant communication pipe portion G and the operation state quantity of constituent equipment or the refrigerant flowing in the refrigerant circuit 110 is, for example, expressed by $$Mgp=Vgp\times\rho gp,$$

which is a function expression in which the volume Vgp of the gas refrigerant communication pipe 107 is multiplied by the density ρgp of the refrigerant in the gas refrigerant communication pipe portion H. Note that, as for the volume Vgp of the gas refrigerant communication pipe 107, as is the case with the liquid refrigerant communication pipe 106, since the gas refrigerant communication pipe 107 is a refrigerant pipe arranged on site when installing the air conditioner 101 at an installing location such as a building, a value calculated on site from the information regarding the length, pipe diameter and the like is input or information regarding the length, pipe diameter and the like is input on site, and the controller 108 calculates the volume Vgp from the input information of the gas refrigerant communication pipe 107. Or, as described below, the volume Vgp is calculated by using the operation results of pipe volume determining operation. In addition, the density ρgp of the refrigerant in the gas refrigerant communication pipe portion G is an average value between the density ρs of the refrigerant at the suction side of the compressor 121 and the density ρeo of the refrigerant at the outlets of the indoor heat exchangers 142 and 152 (i.e., the inlet of the gas refrigerant communication pipe 107). The density ρs of the refrigerant is obtained by converting the suction pressure Ps and the suction temperature Ts, and the density ρeo of the refrigerant is obtained by converting the evaporation pressure Pe, which is a converted value of the evaporation temperature Te, and the outlet temperature Teo of the indoor heat exchangers 142 and 152.

A relational expression between the refrigerant quantity Mog 2 in the low-pressure gas pipe portion H and the operation state quantity of constituent equipment or the refrigerant flowing in the refrigerant circuit 110 is, for example, expressed by $$Mog2=Vog2\times\rho s,$$

which is a function expression in which the volume Vog 2 of the low-pressure gas pipe portion H in the outdoor unit 102 is multiplied by the density ρs of the refrigerant in the low-pressure gas pipe portion H. Note that, the volume Vog 2 of the low-pressure gas pipe portion H is a value that is known prior to shipment to the installing location and is stored in advance in the memory of the controller 108.

A relational expression between the refrigerant quantity Mob in the bypass circuit portion I and the operation state quantity of constituent equipment or the refrigerant flowing in the refrigerant circuit 110 is, for example, expressed by $$Mob=kob1\times\rho co+kob2\times\rho s+kob3\times Pe+kob4,$$

which is a function expression of the density ρco of the refrigerant at the outlet of the outdoor heat exchanger 123, and the density ρs and evaporation pressure Pe of the refrigerant at the outlet on the bypass circuit side of the subcooler 125. Note that, the parameters kob 1 to kob 3 in the above described relational expression are derived from a regression analysis of results of tests and detailed simulations and are stored in advance in the memory of the controller 108. In addition, the refrigerant quantity Mob of the bypass circuit portion I may be calculated using a simpler relational expression since the refrigerant quantity there is smaller compared to the other portions. For example, it is expressed as follows:

$$Mob=Vob\times\rho e\times kob5,$$

which is a function expression in which the volume Vob of the bypass circuit portion I is multiplied by the saturated liquid density ρe at the portion corresponding to the bypass circuit side of the subcooler 125 and the correct coefficient kob. Note that, the volume Vob of the bypass circuit portion I is a value that is known prior to installment of outdoor unit 102 at the installing location and is stored in advance in the memory of the controller 108. In addition, the saturated liquid density ρe at the portion corresponding to the bypass circuit side of the subcooler 125 is obtained by converting the suction pressure Ps or the evaporation temperature Te.

Note that, in the present embodiment, there is one outdoor unit 102. However, when a plurality of outdoor units are connected, as for the refrigerant quantity in the outdoor unit such as Mog 1, Mc, Mol1, Mol2, Mog 2, and Mob, a relational expression for such refrigerant quantity in each portion is defined for each of the plurality of outdoor units, and the entire refrigerant quantity of the outdoor units is calculated by adding the refrigerant quantity in each portion of the plurality of the outdoor units. Note that, when a plurality of outdoor units with different models and capacities are connected, relational expressions having parameters with different values will be used for the refrigerant quantity in each portion.

As described above, in the present embodiment, by using the relational expressions for each portion in the refrigerant circuit 110, the refrigerant quantity in each portion is calculated from the operation state quantity of constituent equipment or the refrigerant flowing in the refrigerant circuit 110 during refrigerant quantity determining operation, and thereby the refrigerant quantity in the refrigerant circuit 110 can be calculated.

This Step S112 is repeated until the condition for determining the adequacy of the refrigerant quantity in the below described Step S113 is satisfied. Therefore, in the period from the start to the completion of additional refrigerant charging, the refrigerant quantity in each portion is calculated from the operation state quantity during refrigerant charging by using the relational expressions for each portion in the refrigerant circuit 110. More specifically, the refrigerant quantity Mo in the outdoor unit 102 and the refrigerant quantity Mr in each of the indoor units 104 and 105 (i.e., the refrigerant quantity in each portion in the refrigerant circuit 110 excluding the refrigerant communication pipes 106 and 107) necessary for determination of the adequacy of the refrigerant quantity in the below described Step S113 are calculated. Here, the refrigerant quantity Mo in the outdoor unit 102 is calculated by adding Mog1, Mc, Mol1, Mol2, Mog2, and Mob described above, each of which is the refrigerant quantity in each portion in the outdoor unit 102.

In this way, the process in Step S112 is performed by the controller 108 that functions as that refrigerant quantity calculating means for calculating the refrigerant quantity in each portion in the refrigerant circuit 110 from the operation state quantity of constituent equipment or the refrigerant flowing in the refrigerant circuit 110 during automatic refrigerant charging operation.

(Step S113: Determination of the Adequacy of the Refrigerant Quantity)

As described above, when additional refrigerant charging in the refrigerant circuit 110 starts, the refrigerant quantity in the refrigerant circuit 110 gradually increases. Here, when the volumes of the refrigerant communication pipes 106 and 107 are unknown, the refrigerant quantity that should be charged into the refrigerant circuit 110 after additional refrigerant charging cannot be prescribed as the refrigerant quantity of the entire refrigerant circuit 110. However, when the focus is placed only on the outdoor unit 102 and the indoor units 104 and 105 (i.e., the refrigerant circuit 110 excluding the refrigerant communication pipes 106 and 107), it is possible to know in advance the optimal refrigerant quantity of the outdoor unit 102 in the normal operation mode by tests and detailed simulations. Therefore, a value of this refrigerant quantity is stored in advance in the memory of the controller 108 as the target charging value Ms; using the above described relational expressions, the refrigerant quantity Mo in the outdoor unit 102 and the refrigerant quantity Mr in the indoor units 104 and 105 are calculated from the operation state quantity of constituent equipment or the refrigerant flowing in the refrigerant circuit 110 during automatic refrigerant charging operation; and additional refrigerant is charged until a value of the refrigerant quantity determined by adding the refrigerant quantity Mo and the refrigerant quantity Mr reaches the target charging value Ms. In other words, Step S113 is a process in which whether or not the refrigerant quantity, which is obtained by adding the refrigerant quantity Mo in the outdoor unit 102 and the refrigerant quantity Mr in the indoor units 104 and 105 during automatic refrigerant charging operation, has reached the target charging value Ms is determined, and thereby the adequacy of the refrigerant quantity charged in the refrigerant circuit 110 by additional refrigerant charging is determined.

Then, in Step S113, when a value of the refrigerant quantity obtained by adding the refrigerant quantity Mo in the outdoor unit 102 and the refrigerant quantity Mr in the indoor units 104 and 105 is smaller than the target charging value Ms and additional refrigerant charging has not been completed, the process in Step S113 is repeated until the target charging value Ms is reached. In addition, when a value of the refrigerant quantity obtained by adding the refrigerant quantity Mo in the outdoor unit 102 and the refrigerant quantity Mr in the indoor units 104 and 105 reaches the target charging value Ms, additional refrigerant charging is completed, and Step S101 as the automatic refrigerant charging operation process is completed.

Note that, in the above described refrigerant quantity determining operation, as the additional refrigerant is charged in the refrigerant circuit 110, a tendency of an increase in the degree of subcooling SCo at the outlet of the outdoor heat exchanger 123 appears, causing the refrigerant quantity Mc in the outdoor heat exchanger 123 to increase, and the refrigerant quantity in the other portions tends to be maintained substantially constant. Therefore, the target charging value Ms may be defined as a value corresponding to only the refrigerant quantity Mo in the outdoor unit 102 but not the outdoor unit 102 and the indoor units 104 and 105, or may be defined as a value corresponding to the refrigerant quantity Mc in the outdoor heat exchanger 123, and additional refrigerant may be charged until the target charging value Ms is reached.

In this way, the process in Step S113 is performed by the controller 108 that functions as the refrigerant quantity determining means for determining the adequacy of the refrigerant quantity in the refrigerant circuit 110 during refrigerant quantity determining operation in automatic refrigerant charging operation (i.e., for determining whether or not the refrigerant quantity has reached the target charging value Ms).

(Step S102: Pipe Volume Determining Operation)

Figure 21:
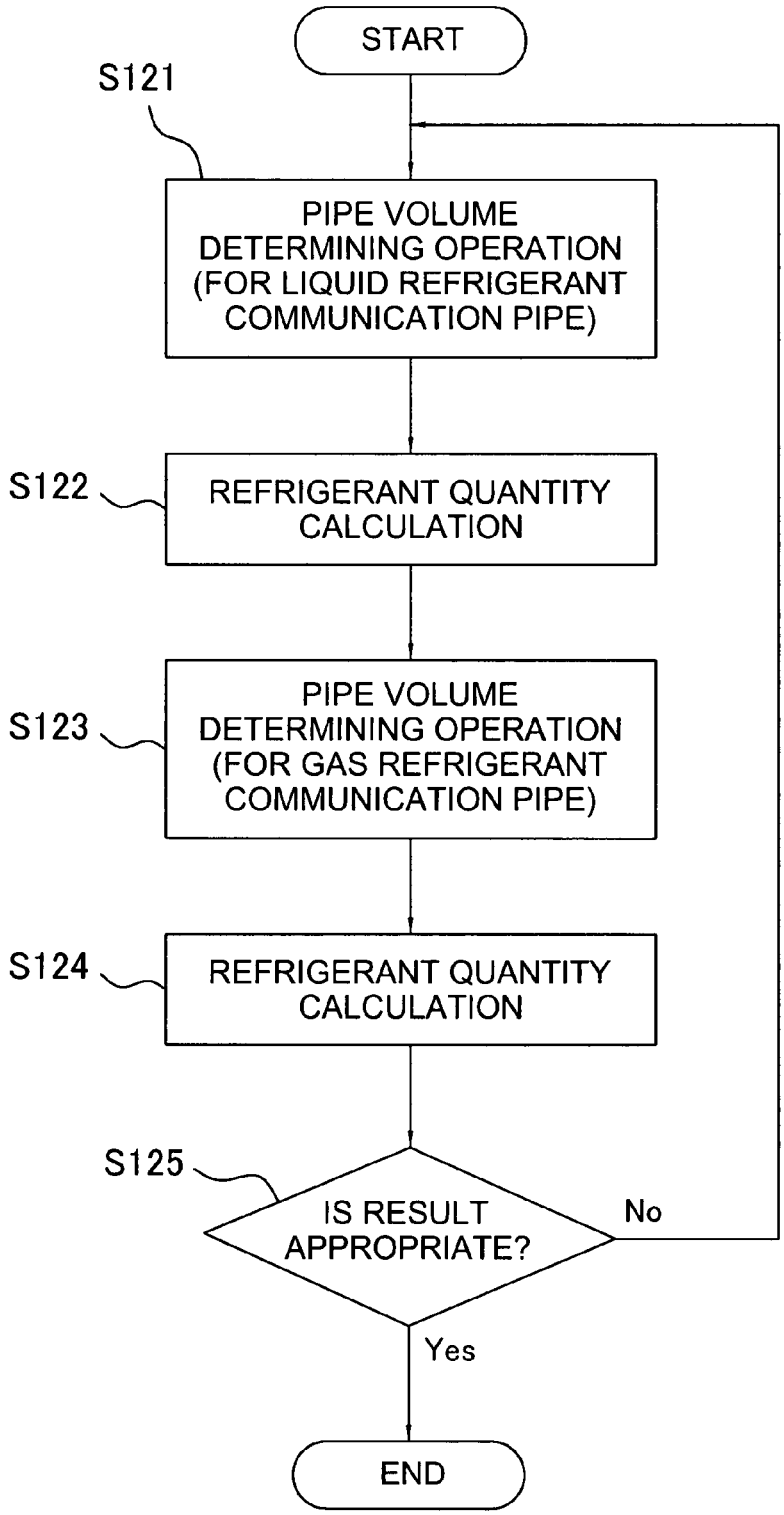
FIG. 21 is a flowchart of a pipe volume determining operation.

When the above described automatic refrigerant charging operation of Step S101 is completed, the process proceeds to pipe volume determining operation of Step S102. In pipe volume determining operation, the process from Step S121 to Step S125 as shown in FIG. 21 is performed by the controller 108. Here, FIG. 21 is a flowchart of pipe volume determining operation.

(Steps S121, S122: Pipe Volume Determining Operation for a Liquid Refrigerant Communication Pipe and Calculation of the Volume)

Figure 22:
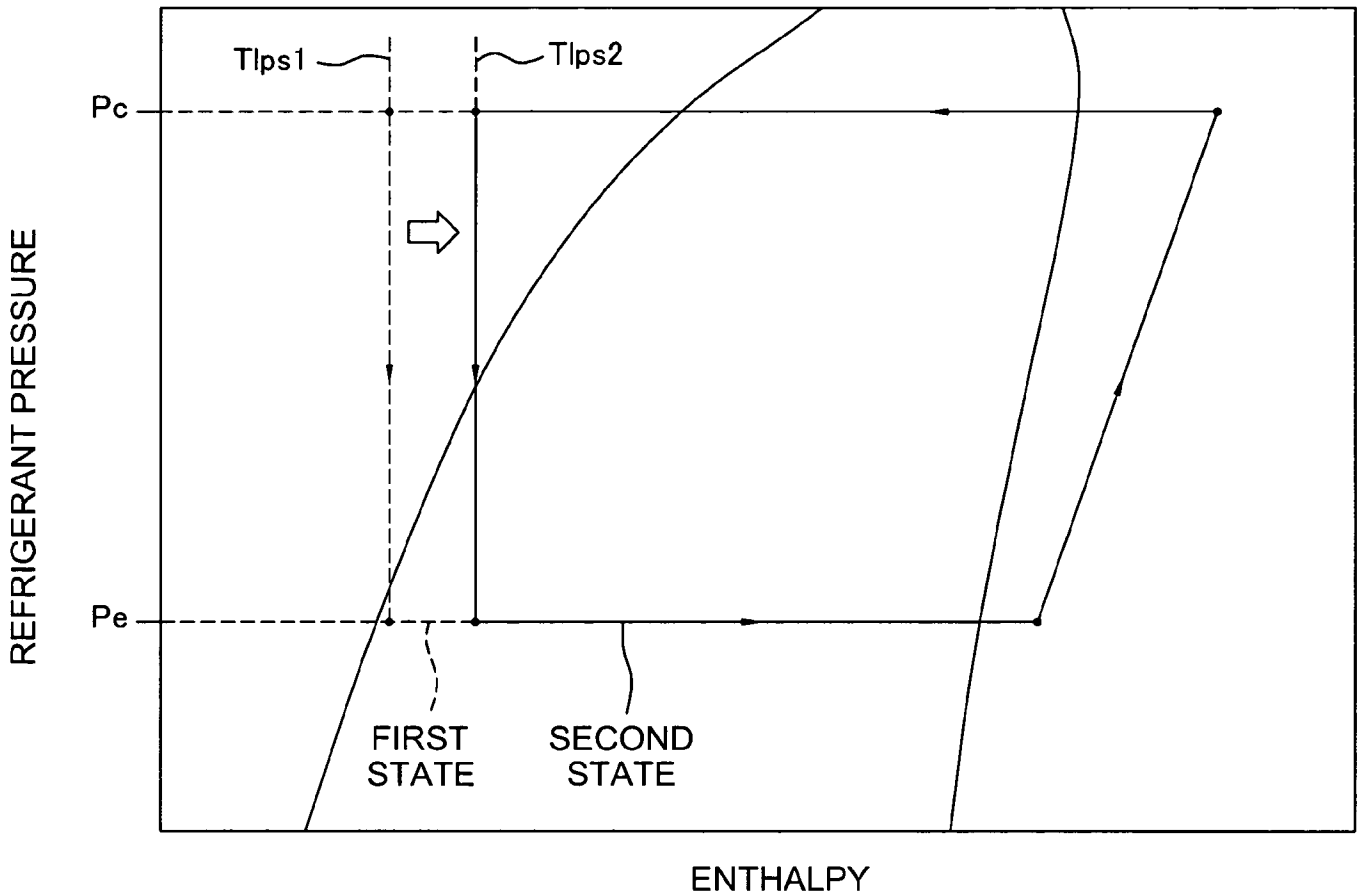
FIG. 22 is a Mollier diagram to show a refrigerating cycle of the air conditioner during the pipe volume determining operation for a liquid refrigerant communication pipe.

In Step S121, as is the case with above described refrigerant quantity determining operation of Step S111 during the automatic refrigerant charging operation, pipe volume determining operation for the liquid refrigerant communication pipe 106, including all indoor unit operation, condensation pressure control, liquid pipe temperature control, superheat degree control, and evaporation pressure control, is performed. Here, the target liquid pipe temperature value Tlps of the temperature Tlp of the refrigerant at the outlet on the main refrigerant circuit side of the subcooler 125 under the liquid pipe temperature control is regarded as a first target value Tlps1, and the state where the refrigerant quantity determining operation is stable at this first target value Tlps1 is regarded as a first state (see the refrigerating cycle indicated by the lines including the dotted lines in FIG. 22). Note that, FIG. 22 is a Mollier diagram to show a refrigerating cycle of the air conditioner 101 during pipe volume determining operation for a liquid refrigerant communication pipe.

Next, the first state where the temperature Tlp of the refrigerant at the outlet on the main refrigerant circuit side of the subcooler 125 under liquid pipe temperature control is stable at the first target value Tlps1 is switched to a second state (see the refrigerating cycle indicated by the solid lines in FIG. 22) in which the target liquid pipe temperature value Tlps is changed to a second target value Tlps2 different from the first target value Tlps1 and stabilized without changing the conditions of other equipment controls, i.e., the conditions of the condensation pressure control, the superheat degree control, and the evaporation pressure control (i.e., without changing the target superheat degree SHrs and the target low-pressure value Tes). In the present embodiment, the second target value Tlps2 is a temperature higher than the first target value Tlps1.

In this way, by changing the refrigerant temperature Tlp from the stable state at the first state to the second state, the density of the refrigerant in the liquid refrigerant communication pipe 106 decreases, and therefore the refrigerant quantity Mlp in the liquid refrigerant communication pipe portion B3 in the second state decreases compared to the refrigerant quantity in the first state. Then, the refrigerant whose quantity has decreased in the liquid refrigerant communication pipe portion B3 moves to other portions in the refrigerant circuit 110. More specifically, as described above, the conditions of other equipment controls other than the liquid pipe temperature control are not changed, and therefore the refrigerant quantity Mog 1 in the high-pressure gas pipe portion E, the refrigerant quantity Mog 2 in the low-pressure gas pipe portion H, and the refrigerant quantity Mgp in the gas refrigerant communication pipe portion G are maintained substantially constant, and the refrigerant whose quantity has decreased in the liquid refrigerant communication pipe portion B3 will move to the condenser portion A, the high temperature liquid pipe portion B1, the low temperature liquid pipe portion B2, the indoor unit portion F, and the bypass circuit portion I. In other words, the refrigerant quantity Mc in the condenser portion A, the refrigerant quantity Mol1 in the high temperature liquid pipe portion B1, the refrigerant quantity Mol2 in the low temperature liquid pipe portion B2, the refrigerant quantity Mr in the indoor unit portion F, and the refrigerant quantity Mob in the bypass circuit portion I will increase by the quantity of the refrigerant that has decreased in the liquid refrigerant communication pipe portion B3.

Such control as described above is performed as the process in Step S121 by the controller 108 (more specifically, by the indoor side controllers 147 and 157, the outdoor side controller 137, and the transmission line 108*a* that connects between the controllers 137, 147 and 157) that functions as the pipe volume determining operation controlling means for performing pipe volume determining operation to calculate the refrigerant quantity Mlp of the liquid refrigerant communication pipe 106.

Next in Step S122, the volume Vlp of the liquid refrigerant communication pipe 106 is calculated by utilizing a phenomenon that the refrigerant quantity in the liquid refrigerant communication pipe portion B3 decreases and the refrigerant whose quantity has decreased moves to other portions in the refrigerant circuit 110 because of the change from the first state to the second state.

First, a calculation formula used in order to calculate the volume Vlp of the liquid refrigerant communication pipe 106 is described. Provided that the quantity of the refrigerant that has decreased in the liquid refrigerant communication pipe portion B3 and moved to the other portions in the refrigerant circuit 110 by the above described pipe volume determining operation is the refrigerant increase/decrease quantity ΔMlp, and that the increase/decrease quantity of the refrigerant in each portion between the first state and the second state is ΔMc, ΔMol1, ΔMol2, ΔMr, and ΔMob (here, the refrigerant quantity Mog 1, the refrigerant quantity Mog 2, and the refrigerant quantity Mgp are omitted since they are maintained substantially constant), the refrigerant increase/decrease quantity ΔMlp can be, for example, calculated by the following function expression:

$$\Delta Mlp=-(\Delta Mc+\Delta Mol1+\Delta Mol2+\Delta Mr+\Delta Mob)$$

Then, this ΔMlp value is divided by the density change quantity Δρlp of the refrigerant between the first state and the second state in the liquid refrigerant communication pipe 6, and thereby the volume Vlp of the liquid refrigerant communication pipe 106 can be calculated. Note that, although there is little effect on a calculation result of the refrigerant increase/decrease quantity ΔMlp, the refrigerant quantity Mog 1 and the refrigerant quantity Mog 2 may be included in the above described function expression.

$$Vlp=\Delta Mlp/\Delta\rho lp$$

Note that, ΔMc, ΔMol1, ΔMol2, ΔMr, and ΔMob can be obtained by calculating the refrigerant quantity in the first state and the refrigerant quantity in the second state by using the above described relational expression for each portion in the refrigerant circuit 110 and further by subtracting the refrigerant quantity in the first state from the refrigerant quantity in the second state. In addition, the density change quantity Δρlp can be obtained by calculating the density of the refrigerant at the outlet of the subcooler 125 in the first state and the density of the refrigerant at the outlet of the subcooler 125 in the second state and further by subtracting the density of the refrigerant in the first state from the density of the refrigerant in the second state.

By using the calculation formula as described above, the volume Vlp of the liquid refrigerant communication pipe 106 can be calculated from the operation state quantity of constituent equipment or the refrigerant flowing in the refrigerant circuit 110 in the first and second states.

Note that, in the present embodiment, the state is changed such that the second target value Tlps2 in the second state becomes a temperature higher than the first target value Tlps1 in the first state and therefore the refrigerant in the liquid refrigerant communication pipe portion B3 is moved to other portions in order to increase the refrigerant quantity in the other portions; thereby the volume Vlp in the liquid refrigerant communication pipe 106 is calculated from the increased quantity. However, the state may be changed such that the second target value Tlps2 in the second state becomes a temperature lower than the first target value Tlps1 in the first state and therefore the refrigerant is moved from other portions to the liquid refrigerant communication pipe portion B3 in order to decrease the refrigerant quantity in the other portions; thereby the volume Vlp in the liquid refrigerant communication pipe 106 is calculated from the decreased quantity.

In this way, the process in Step S122 is performed by the controller 108 that functions as the pipe volume calculating means for a liquid refrigerant communication pipe, which calculates the volume Vlp of the liquid refrigerant communication pipe 106 from the operation state quantity of constituent equipment or the refrigerant flowing in the refrigerant circuit 110 during pipe volume determining operation for the liquid refrigerant communication pipe 106.

(Steps S123, S124: Pipe Volume Determining Operation and Volume Calculation for the Gas Refrigerant Communication Pipe)

After the above described Step S121 and Step S122 are completed, pipe volume determining operation for the gas refrigerant communication pipe 107, including all indoor unit operation, condensation pressure control, liquid pipe temperature control, superheat degree control, and evaporation pressure control, is performed in Step S123. Here, the target low-pressure value Pes of the suction pressure Ps of the compressor 121 under the evaporation pressure control is regarded as a first target value Pes1, and the state where the refrigerant quantity determining operation is stable at this first target value Pes1 is regarded as a first state (see the refrigerating cycle indicated by the lines including the dotted lines in FIG. 23). Note that FIG. 23 is a Mollier diagram to show a refrigerating cycle of the air conditioner 101 during pipe volume determining operation for a gas refrigerant communication pipe.

Figure 23:
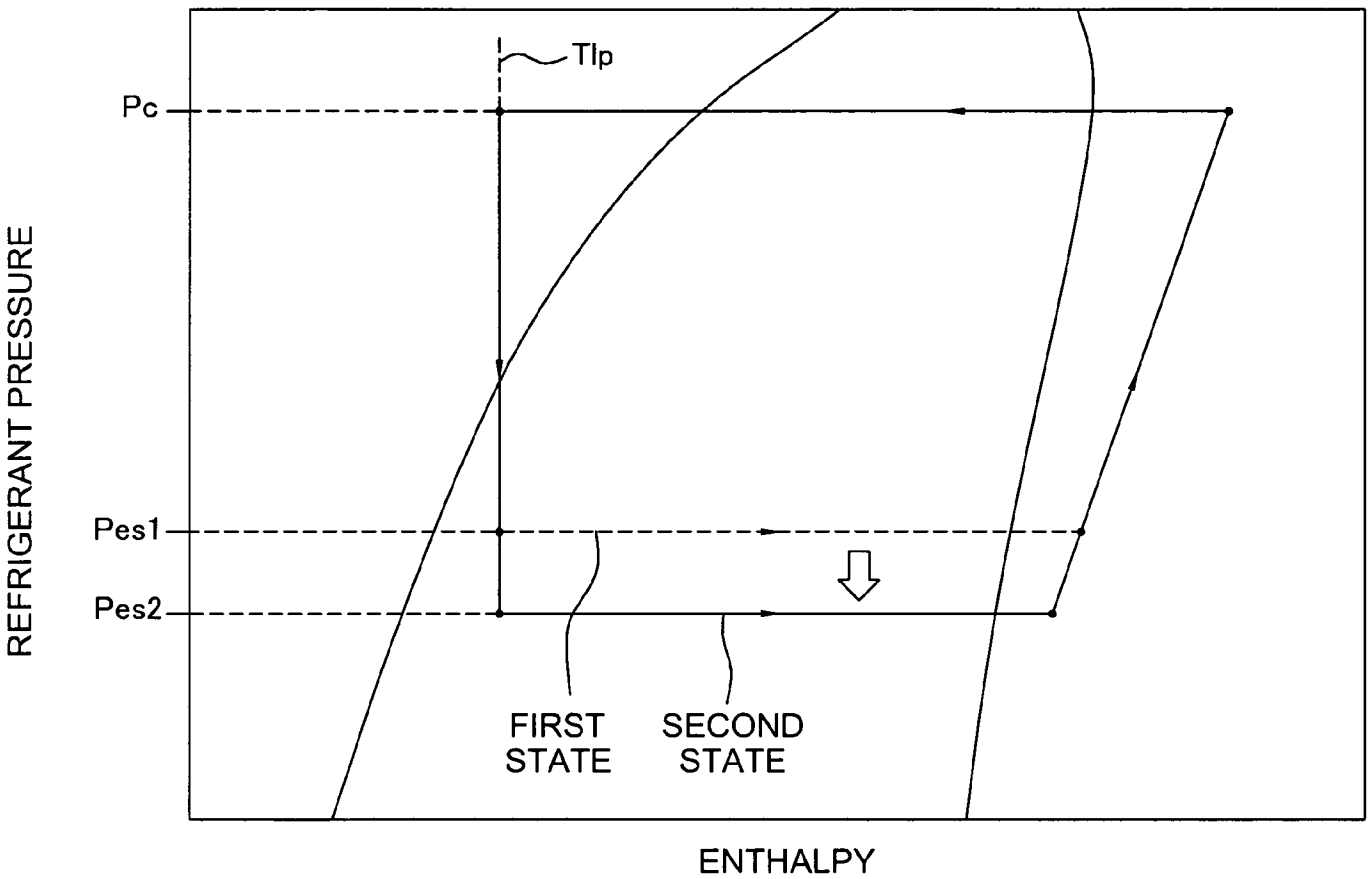
FIG. 23 is a Mollier diagram to show a refrigerating cycle of the air conditioner during the pipe volume determining operation for a gas refrigerant communication pipe.

Next, the first state where the target low-pressure value Pes of the suction pressure Ps in the compressor 121 under evaporation pressure control is stable at the first target value Pes1 is switched to a second state (see the refrigerating cycle indicated by only the solid lines in FIG. 23) in which the target low-pressure value Pes is changed to a second target value Pes2 different from the first target value Pes1 and stabilized without changing the conditions of other equipment controls, i.e., without the conditions of the liquid pipe temperature control, the condensation pressure control, and the superheat degree control (i.e., without changing target liquid pipe temperature value Tlps and target superheat degree SHrs). In the present embodiment, the second target value Pes 2 is a pressure lower than the first target value Pes1.

In this way, by changing the refrigerant temperature Tlp from the stable state at the first state to the second state, the density of the refrigerant in the gas refrigerant communication pipe 107 decreases, and therefore the refrigerant quantity Mgp in the gas refrigerant communication pipe portion G in the second state decreases compared to the refrigerant quantity in the first state. Then, the refrigerant whose quantity has decreased in the gas refrigerant communication pipe portion G will move to other portions in the refrigerant circuit 110. More specifically, as described above, the conditions of other equipment controls other than the evaporation pressure control are not changed, and therefore the refrigerant quantity Mog 1 in the high pressure liquid pipe portion E, the refrigerant quantity Mol1 in the high-temperature liquid pipe portion B1, the refrigerant quantity Mol2 in the low temperature liquid pipe portion B2, and the refrigerant quantity Mlp in the liquid refrigerant communication pipe portion B3 are maintained substantially constant, and the refrigerant whose quantity has decreased in the gas refrigerant communication pipe portion G will move to the low-pressure gas pipe portion H, the condenser portion A, the indoor unit portion F, and the bypass circuit portion I. In other words, the refrigerant quantity Mog 2 in the low-pressure gas pipe portion H, the refrigerant quantity Mc in the condenser portion A, the refrigerant quantity Mr in the indoor unit portion F, and the refrigerant quantity Mob in the bypass circuit portion I will increase by the quantity of the refrigerant that has decreased in the gas refrigerant communication pipe portion G.

Such control as described above is performed as the process in Step S123 by the controller 108 (more specifically, by the indoor side controllers 147 and 157, the outdoor side controller 137, and the transmission line 108*a* that connects between and the controllers 137 and 147, and 157) that functions as the pipe volume determining operation controlling means for performing pipe volume determining operation to calculate the volume Vgp of the gas refrigerant communication pipe 107.

Next in Step S124, the volume Vgp of the gas refrigerant communication pipe 107 is calculated by utilizing a phenomenon that the refrigerant quantity in the gas refrigerant communication pipe portion G decreases and the refrigerant whose quantity has decreased moves to other portions in the refrigerant circuit 110 because of the change from the first state to the second state.

First, a calculation formula used in order to calculate the volume Vgp of the gas refrigerant communication pipe 107 is described. Provided that the quantity of the refrigerant that has decreased in the gas refrigerant communication pipe portion G and moved to the other portions in the refrigerant circuit 110 by the above described pipe volume determining operation is the refrigerant increase/decrease quantity ΔMgp, and that the increase/decrease quantity of the refrigerant in each portion between the first state and the second state is ΔMc, ΔMog 2, ΔMr, and ΔMob (here, the refrigerant quantity Mog 1, the refrigerant quantity Mol1, the refrigerant quantity Mol2, and the refrigerant quantity Mlp are omitted since they are maintained substantially constant), the refrigerant increase/decrease quantity ΔMgp can be, for example, calculated by the following function expression:

$$\Delta Mgp=-(\Delta Mc+\Delta Mog2+\Delta Mr+\Delta Mob).$$

Then, this ΔMgp value is divided by the density change quantity Aρgp of the refrigerant between the first state and the second state in the gas refrigerant communication pipe 107, and thereby the volume Vgp of the gas refrigerant communication pipe 107 can be calculated. Note that, although there is little effect on a calculation result of the refrigerant increase/decrease quantity ΔMgp, the refrigerant quantity Mog 1, the refrigerant quantity Mol1, and the refrigerant quantity Mol2 may be included in the above described function expression.

$$Vgp=\Delta Mgp/A\rho gp$$

Note that, ΔMc, ΔMog 2, ΔMr and ΔMob can be obtained by calculating the refrigerant quantity in the first state and the refrigerant quantity in the second state by using the above described relational expression for each portion in the refrigerant circuit 110 and further by subtracting the refrigerant quantity in the first state from the refrigerant quantity in the second state. In addition, the density change quantity Aρgp can be obtained by calculating an average density between the density ρs of the refrigerant at the suction side of the compressor 121 in the first state and the density ρeo of the refrigerant at the outlets of the indoor heat exchangers 142 and 152 and by subtracting the average density in the first state from the average density in the second state.

By using such calculation formula as described above, the volume Vgp of the gas refrigerant communication pipe 107 can be calculated from the operation state quantity of constituent equipment or the refrigerant flowing in the refrigerant circuit 110 in the first and second states.

Note that, in the present embodiment, the state is changed such that the second target value Pes2 in the second state becomes a pressure lower than the first target value Pes1 in the first state and therefore the refrigerant in the gas refrigerant communication pipe portion G is moved to other portions in order to increase the refrigerant quantity in the other portions; thereby the volume Vlp in the gas refrigerant communication pipe 107 is calculated from the increased quantity. However, the state may be changed such that the second target value Pes2 in the second state becomes a pressure higher than the first target value Pes1 in the first state and therefore the refrigerant is moved from other portions to the gas refrigerant communication pipe portion G in order to decrease the refrigerant quantity in the other portions; thereby the volume Vlp in the gas refrigerant communication pipe 107 is calculated from the decreased quantity.

In this way, the process in Step S124 is performed by the controller 108 that functions as the pipe volume calculating means for a gas refrigerant communication pipe, which calculates the volume Vgp of the gas refrigerant communication pipe 107 from the operation state quantity of constituent equipment or the refrigerant flowing in the refrigerant circuit 110 during pipe volume determining operation for the gas refrigerant communication pipe 107.

(Step S125: Determining of the Adequacy of a Result of Pipe Volume Determining Operation)

After the above described Step S121 to Step S124 are completed, in Step S125, whether or not a result of pipe volume determining operation is appropriate, in other words, whether or not the volumes Vlp, Vgp of the refrigerant communication pipes 106 and 107 calculated by the pipe volume calculating means are appropriate is determined.

Specifically, as shown in an inequality expression below, it is determined by whether or not the ratio of the volume Vlp of the liquid refrigerant communication pipe 106 to the volume Vgp of the gas refrigerant communication pipe 107 obtained by the calculations is in a predetermined numerical value range.

$$\epsilon 1 < Vlp/Vgp < \epsilon 2$$

Here, $\epsilon 1$ and $\epsilon 2$ are values that are changed based on the minimum value and the maximum value of the pipe volume ratio in feasible combinations of the heat source unit and the utilization unit.

Then, when the volume ratio Vlp/Vgp satisfies the above described numerical value range, the process in Step S102 for pipe volume determining operation is completed. When the volume ratio Vlp/Vgp does not satisfy the above numerical value range, the process for pipe volume determining operation and volume calculation in Step S121 to Step S124 is performed again.

In this way, the process in Step S125 is performed by the controller 108 that functions as the adequacy determining means for determining whether or not a result of the above described pipe volume determining operation is appropriate, in other words, whether or not the volumes Vlp, Vgp of the refrigerant communication pipes 106 and 107 calculated by the pipe volume calculating means are appropriate.

Note that, in the present embodiment, pipe volume determining operation (Steps S121, S122) for the liquid refrigerant communication pipe 106 is first performed and then pipe volume determining operation for the gas refrigerant communication pipe 107 (Steps S123, S124) is performed. However, pipe volume determining operation for the gas refrigerant communication pipe 107 may be performed first.

In addition, in the above described Step S125, when a result of pipe volume determining operation in Steps S121 to S124 is determined not to be appropriate for a plurality of times, or when it is desired to more simply determine the volumes Vlp, Vgp of the refrigerant communication pipes 106 and 107, although it is not shown in FIG. 21, for example, in Step S125, after a result of pipe volume determining operation in Steps S121 to S124 is determined not to be appropriate, it is possible to proceed to the process for estimating the lengths of the refrigerant communication pipes 106 and 107 from the pressure loss in the refrigerant communication pipes 106 and 107 and calculating the volumes Vlp, Vgp of the refrigerant communication pipes 106 and 107 from the estimated pipe lengths and an average volume ratio, thereby obtaining the volumes Vlp, Vgp of the refrigerant communication pipes 106 and 107.

In addition, in the present embodiment, the case where pipe volume determining operation is performed to calculate the volumes Vlp, Vgp of the refrigerant communication pipes 106 and 107 is described on the premise that there is no information regarding the lengths, pipe diameters and the like of the refrigerant communication pipes 106 and 107 and the volumes Vlp, Vgp of the refrigerant communication pipes 106 and 107 are unknown. However, when the pipe volume calculating means has a function to calculate the volumes Vlp, Vgp of the refrigerant communication pipes 106 and 107 by inputting information regarding the lengths, pipe diameters and the like of the refrigerant communication pipes 106 and 107, such function may be used together.

Further, when the above described function to calculate the volumes Vlp, Vgp of the refrigerant communication pipes 106 and 107 by pipe volume determining operation and by using the operation results is not used but only the function to calculate the volumes Vlp, Vgp of the refrigerant communication pipes 106 and 107 by inputting information regarding the lengths, pipe diameters and the like of the refrigerant communication pipes 106 and 107 is used, the above described adequacy determining means (Step S125) may be used to determine whether or not the input information regarding the lengths, pipe diameters and the like of the refrigerant communication pipes 106 and 107 is appropriate.

(Step S103: Initial Refrigerant Quantity Detecting Operation)

Figure 24:
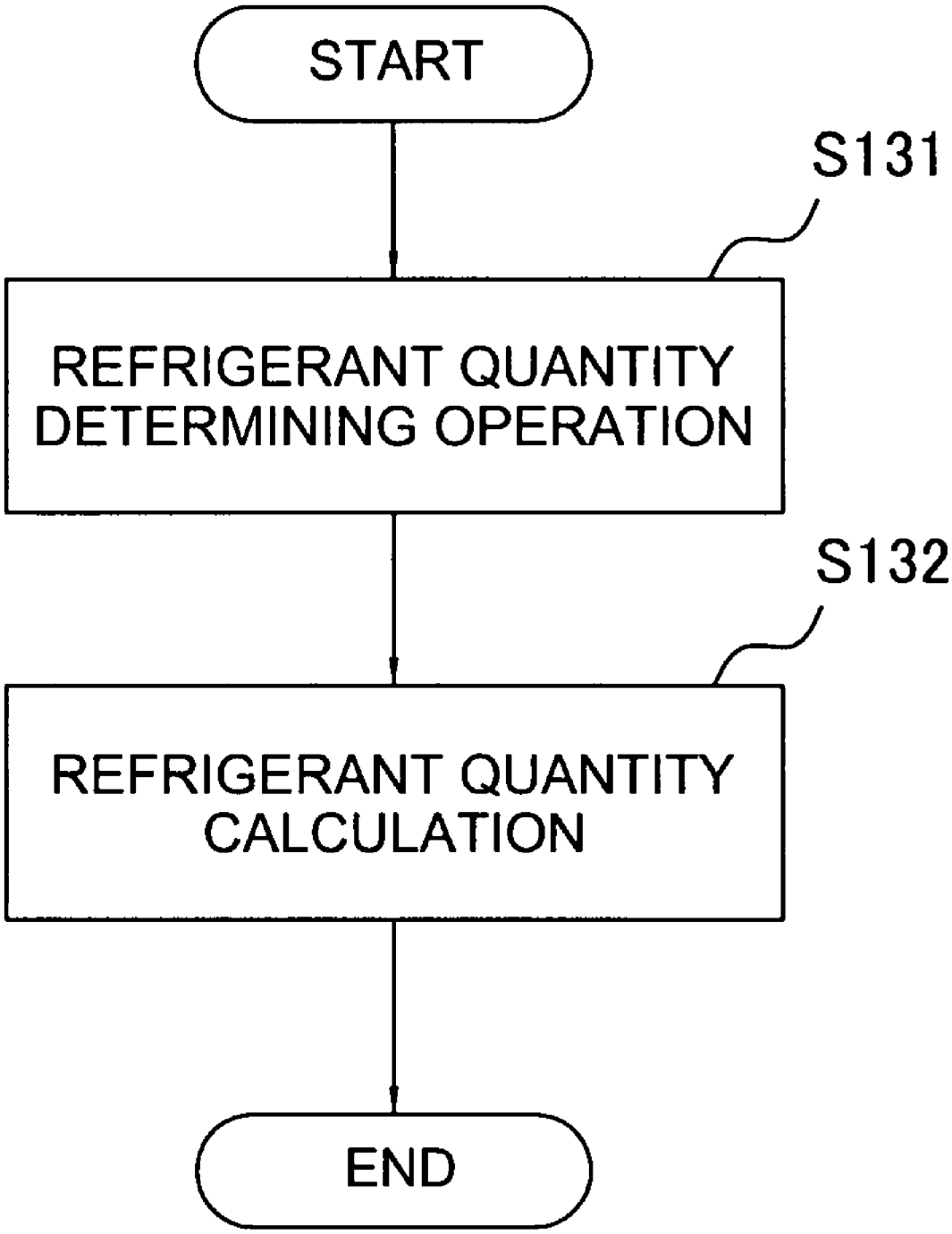
FIG. 24 is a flowchart of an initial refrigerant quantity determining operation.

When the above described pipe volume determining operation of Step S102 is completed, the process proceeds to initial refrigerant quantity determining operation of Step S103. In initial refrigerant quantity detecting operation, the process in Step S131 and Step S132 shown in FIG. 24 is performed by the controller 108. Here, FIG. 24 is a flowchart of initial refrigerant quantity detecting operation.

(Step S131: Refrigerant Quantity Determining Operation)

In Step S131, as is the case with the above described refrigerant quantity determining operation of Step S111 in automatic refrigerant charging operation, refrigerant quantity determining operation including all indoor unit operation, condensation pressure control, liquid pipe temperature control, superheat degree control, and evaporation pressure control is performed. Here, as a rule, values to be used for the target liquid pipe temperature value Tlps under the liquid pipe temperature control, the target superheat degree value SHrs under the superheat degree control, and the target low-pressure value Pes under the evaporation pressure control are same as the target values during refrigerant quantity determining operation of Step S11 in automatic refrigerant charging operation.

In this way, the process in Step S131 is performed by the controller 108 that functions as the refrigerant quantity determining operation controlling means for performing refrigerant quantity determining operation including all indoor unit operation, condensation pressure control, liquid pipe temperature control, superheat degree control, and evaporation pressure control.

(Step S132: Refrigerant Quantity Calculation)

Next, while performing the above described refrigerant quantity determining operation, the refrigerant quantity in the refrigerant circuit 110 is calculated in Step S132 by the controller 108 that functions as the refrigerant quantity calculating means from the operation state quantity of constituent equipment or the refrigerant flowing in the refrigerant circuit 110 during initial refrigerant quantity determining operation. Calculation of the refrigerant quantity in the refrigerant circuit 110 is performed by using the above described relational expression between the refrigerant quantity in each portion in the refrigerant circuit 110 and the operation state quantity of constituent equipment or the refrigerant flowing in the refrigerant circuit 110. However, at this time, the volumes Vlp and Vgp of the refrigerant communication pipes 106 and 107, which were unknown at the time of after installment of constituent equipment of the air conditioner 101, have been calculated and the values thereof are known. Thus, by multiplying the volumes Vlp and Vgp of the refrigerant communication pipes 106 and 107 by the density of the refrigerant, the refrigerant quantities Mlp, Mgp in the refrigerant communication pipes 106 and 107 can be calculated, and further by adding the refrigerant quantity in the other each portion, the initial refrigerant quantity in the entire refrigerant circuit 110 can be detected. This initial refrigerant quantity is used as the reference refrigerant quantity Mi of the entire refrigerant circuit 110, which serves as a reference for determining whether or not there is a refrigerant leak from the refrigerant circuit 110 during the below described refrigerant leak detection operation. Therefore, it is stored as a value of the operation state quantity in the memory of the controller 108 as the state quantity storing means.

In this way, the process in Step S132 is performed by the controller 108 that functions as the refrigerant quantity calculating means for calculating the refrigerant quantity of each portion in the refrigerant circuit 110 from the operation state quantity of constituent equipment or the refrigerant flowing in the refrigerant circuit 110 during initial refrigerant quantity detecting operation.

<Refrigerant Leak Detecting Operation Mode>

Figure 25:
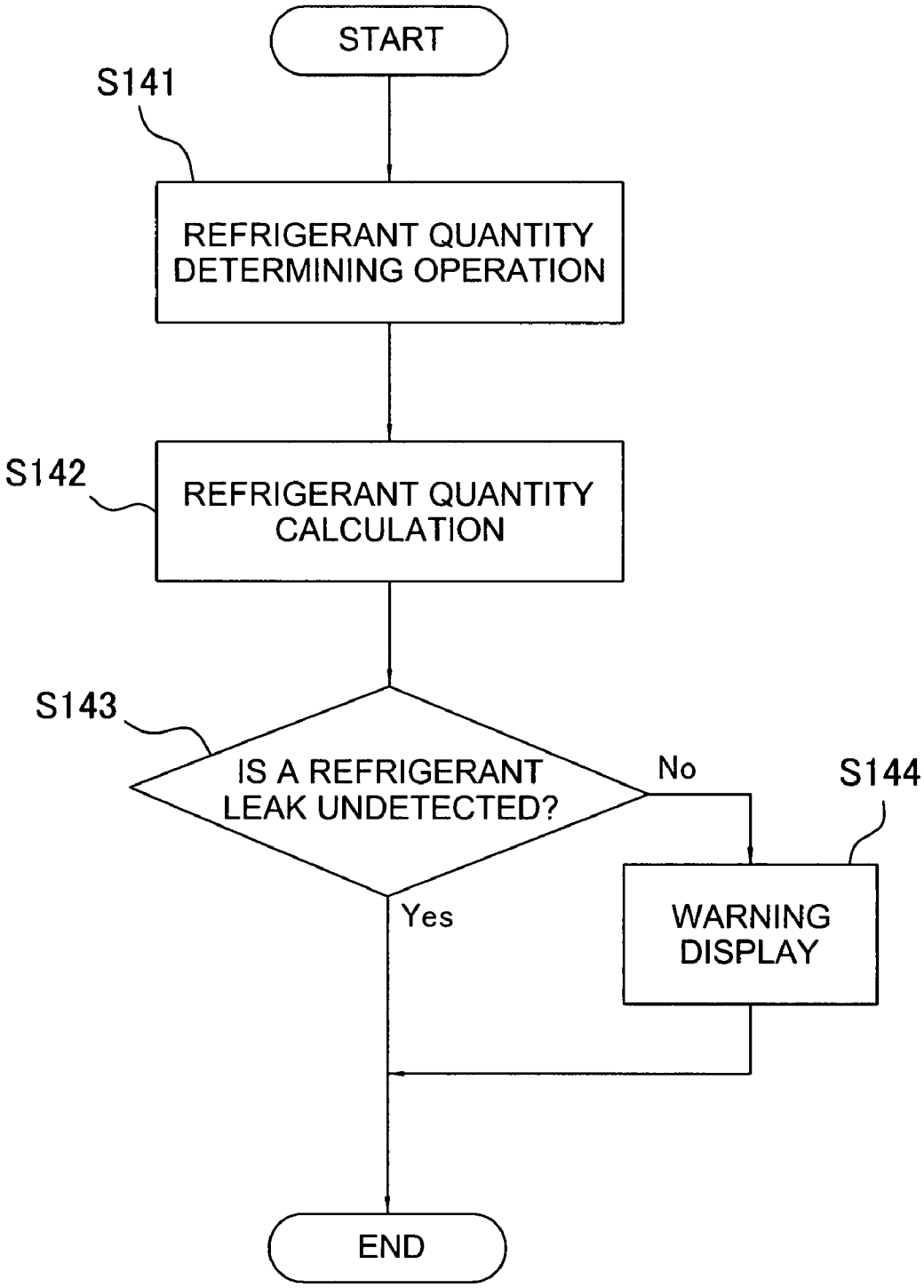
FIG. 25 is a flowchart of a refrigerant leak detecting operation mode.

Next, a refrigerant leak detecting operation mode is described with reference to FIGS. 16, 17, 20, and 25. Here, FIG. 25 is a flowchart of the refrigerant leak detecting operation mode.

In the present embodiment, an example of a case is described where, whether or not the refrigerant in the refrigerant circuit 110 is leaking to the outside due to an unforeseen factor is detected periodically (for example, during a period of time such as on a holiday or in the middle of the night when air conditioning is not needed).

(Step S141: Refrigerant Quantity Determining Operation)

First, when operation in the normal operation mode such as the above described cooling operation and heating operation has gone on for a certain period of time (for example, half a year to a year), normal operation mode is automatically or manually switched to the refrigerant leak detecting operation mode, and as is the case with refrigerant quantity determining operation in initial refrigerant quantity detecting operation, refrigerant quantity determining operation including all indoor unit operation, condensation pressure control, liquid pipe temperature control, superheat degree control, and evaporation pressure control is performed. Here, as a rule, values to be used for the target liquid pipe temperature value Tlps under the liquid pipe temperature control, the target superheat degree value SHrs under the superheat degree control, and the target low-pressure value Pes under the evaporation pressure control are same as the target values in Step S131 of the refrigerant quantity determining operation in initial refrigerant quantity detecting operation.

Note that, this refrigerant quantity determining operation is performed for every refrigerant leak detection operation. Even when the refrigerant temperature Tco at the outlet of the outdoor heat exchanger 123 fluctuates due to the different operating conditions, for example, such as when the condensation pressure Pc is different or when there is a refrigerant leak, the refrigerant temperature Tlp in the liquid refrigerant communication pipe 106 is maintained constant at the same target liquid pipe temperature value Tlps by the liquid pipe temperature control.

In this way, the process in Step S141 is performed by the controller 108 that functions as the refrigerant quantity determining operation controlling means for performing refrigerant quantity determining operation including all indoor unit operation, condensation pressure control, liquid pipe temperature control, superheat degree control, and evaporation pressure control.

(Step S142: Refrigerant Quantity Calculation)

Next, while performing the above described refrigerant quantity determining operation, the refrigerant quantity in the refrigerant circuit 110 is calculated by the controller 108 that functions as the refrigerant quantity calculating means from the operation state quantity of constituent equipment or the refrigerant flowing in the refrigerant circuit 110 during refrigerant leak detection operation in Step S142. Calculation of the refrigerant quantity in the refrigerant circuit 110 is performed by using the above described relational expression between the refrigerant quantity in each portion in the refrigerant circuit 110 and the operation state quantity of constituent equipment or the refrigerant flowing in the refrigerant circuit 110. However, at this time, as is the case with initial refrigerant quantity determining operation, the volumes Vlp and Vgp of the refrigerant communication pipes 106 and 107, which were unknown at the time of after installment of constituent equipment of the air conditioner 101, have been calculated and the values thereof are known. Thus, by multiplying the volumes Vlp and Vgp of the refrigerant communication pipes 106 and 107 by the density of the refrigerant, the refrigerant quantities Mlp, Mgp in the refrigerant communication pipes 106 and 107 can be calculated, and further by adding the refrigerant quantity in the other each portion, the refrigerant quantity M in the entire refrigerant circuit 110 can be calculated.

Here, as described above, the refrigerant temperature Tlp in the liquid refrigerant communication pipe 106 is maintained constant at the target liquid pipe temperature value Tlps by the liquid pipe temperature control. Therefore, regardless the difference in the operating conditions of the refrigerant leak detection operation, the refrigerant quantity Mlp in the liquid refrigerant communication pipe portion B3 will be maintained constant even when the refrigerant temperature Tco at the outlet of the outdoor heat exchanger 123 changes.

In this way, the process in Step S142 is performed by the controller 108 that functions as the refrigerant quantity calculating means for calculating the refrigerant quantity at each portion in the refrigerant circuit 110 from the operation state quantity of constituent equipment or the refrigerant flowing in the refrigerant circuit 110 during refrigerant leak detection operation.

(Steps S143, S144: Determination of the Adequacy of the Refrigerant Quantity, Warning Display)

When refrigerant leaks out from the refrigerant circuit 110, the refrigerant quantity in the refrigerant circuit 110 decreases. Then, when the refrigerant quantity in the refrigerant circuit 110 decreases, mainly, a tendency of a decrease in degree of subcooling $SC_o$ at the outlet of the outdoor heat exchanger 123 appears. Along with this, the refrigerant quantity Mc in the outdoor heat exchanger 123 decreases, and the refrigerant quantity in different portions tends to be maintained substantially constant. Consequently, the refrigerant quantity M of the entire refrigerant circuit 110 calculated in the above described Step S142 is smaller than the reference refrigerant quantity Mi detected during initial refrigerant quantity detecting operation when there is a refrigerant leak from the refrigerant circuit 110; whereas when there is no refrigerant leak from the refrigerant circuit 110, the refrigerant quantity M is substantially the same as the reference refrigerant quantity Mi.

By utilizing the above-described characteristics, whether or not there is a refrigerant leak is determined in Step S143. When it is determined in Step S143 that there is no refrigerant leak from the refrigerant circuit 110, the refrigerant leak detecting operation mode is finished.

On the other hand, when it is determined in Step S143 that there is a refrigerant leak from the refrigerant circuit 110, the process proceeds to Step S144, and a warning indicating that a refrigerant leak is detected is displayed on a warning display 109. Subsequently, the refrigerant leak detecting operation mode is finished.

In this way, the process from Steps S142 to S144 is performed by the controller 108 that functions as the refrigerant leak detection means, which is one of the refrigerant quantity determining means, and which detects whether or not there is a refrigerant leak by determining the adequacy of the refrigerant quantity in the refrigerant circuit 110 while performing refrigerant quantity determining operation in the refrigerant leak detecting operation mode.

As described above, in the air conditioner 101 in the present embodiment, the controller 108 functions as the refrigerant quantity determining operation means the refrigerant quantity calculating means, the refrigerant quantity determining means, the pipe volume determining operation means, the pipe volume calculating means, the adequacy determining means, and the state quantity storing means, and thereby configures the refrigerant quantity determining system for determining the adequacy of the refrigerant quantity charged in the refrigerant circuit 110.

(3) Characteristics of the Air Conditioner

The air conditioner 101 in the present embodiment has the following characteristics.

(A)

In the air conditioner 101 in the present embodiment, the refrigerant circuit 110 is divided into a plurality of portions, and a relational expression between the refrigerant quantity in each portion and the operation state quantity is defined. Consequently, compared to the conventional case where a simulation of characteristics of a refrigerating cycle is performed, the calculation load can be reduced, and a value of the operation state quantity that is important for calculation of the refrigerant quantity in each portion can be selectively incorporated as a variable of the relational expression, thus improving the calculation accuracy of the refrigerant quantity in each portion. As a result, the adequacy of the refrigerant quantity in the refrigerant circuit 110 can be determined with high accuracy.

For example, by using the relational expression, the controller 108 as the refrigerant quantity calculating means can quickly calculate the refrigerant quantity in each portion from the operation state quantity of constituent equipment or the refrigerant flowing in the refrigerant circuit 110 during automatic refrigerant charging operation to charge refrigerant into the refrigerant circuit 110. Moreover, by using the calculated refrigerant quantity in each portion, the controller 108 as the refrigerant quantity determining means can determine with high accuracy whether or not the refrigerant quantity in the refrigerant circuit 110 (specifically, a value obtained by adding the refrigerant quantity Mo in the outdoor unit 102 and the refrigerant quantity Mr in the indoor units 104 and 105) has reached the target charging value Ms.

In addition, by using the relational expression, the controller 108 can quickly calculate the initial refrigerant quantity as a reference refrigerant quantity Mi by calculating the refrigerant quantity in each portion from the operation state quantity of constituent equipment or the refrigerant flowing in the refrigerant circuit 110 during initial refrigerant quantity detecting operation to detect the initial refrigerant quantity after constituent equipment is installed or after the refrigerant is charged in the refrigerant circuit 110. Moreover, it is possible to highly accurately detect the initial refrigerant quantity.

Further, by using the relational expression, the controller 108 can quickly calculate the refrigerant quantity in each portion from the operation state quantity of constituent equipment or the refrigerant flowing in the refrigerant circuit 110 during refrigerant leak detection operation to determine whether or not there is a refrigerant leak in the refrigerant circuit 110. Moreover, the controller 108 can determine with high accuracy whether or not there is a refrigerant leak in the refrigerant circuit 110 by comparing the calculated refrigerant quantity in each portion with the reference refrigerant quantity Mi that serves as a reference to determine whether or not there is a refrigerant leak.

(B)

In the air conditioner 101 in the present embodiment, the subcooler 125 is disposed as the temperature adjustment mechanism capable of adjusting the temperature of the refrigerant sent from the outdoor heat exchanger 123 as a condenser to the indoor expansion valves 141 and 151 as expansion mechanisms. Performance of the subcooler 125 is controlled such that the temperature Tlp of the refrigerant sent from the subcooler 125 to the indoor expansion valves 141 and 151 as expansion mechanisms is maintained constant during refrigerant quantity determining operation, thereby preventing a change in the density pip of the refrigerant in the refrigerant pipes from the subcooler 125 to the indoor expansion valves 141 and 151. Therefore, even when the refrigerant temperature Tco at the outlet of the outdoor heat exchanger 123 as a condenser is different every time the refrigerant quantity determining operation is performed, the effect of the temperature difference as described above will extend only within the refrigerant pipes from the outlet of the outdoor heat exchanger 123 to the subcooler 125, and the error in determination due to the difference in the temperature Tco of the refrigerant at the outlet of the outdoor heat exchanger 123 (i.e., the difference in the density of the refrigerant) can be reduced when determining the refrigerant quantity.

In particular, as is the case with the present embodiment where the outdoor unit 102 as a heat source unit and the indoor units 104 and 105 as utilization units are interconnected via the liquid refrigerant communication pipe 106 and the gas refrigerant communication pipe 107, the lengths, pipe diameters and the like of the refrigerant communication pipes 106 and 107 that connect between the outdoor unit 102 and the indoor units 104 and 105 are different depending on conditions such as installing location. Therefore, when the volumes of the refrigerant communication pipes 106 and 107 are large, the difference in the refrigerant temperature Tco at the outlet of the outdoor heat exchanger 123 will be the difference in the temperature of the refrigerant in the liquid refrigerant communication pipe 106 that constitutes a large portion of the refrigerant pipes from the outlet of the outdoor heat exchanger 123 to the indoor expansion valves 141 and 151 and thus the error in determination tends to increase. However, as described above, along with the disposition of the subcooler 125, performance of the subcooler 125 is controlled such that the temperature Tlp of the refrigerant in the liquid refrigerant communication pipe 106 is constant during refrigerant quantity determining operation, thereby preventing a change in the density ρlp of the refrigerant in the refrigerant pipes from the subcooler 125 to the indoor expansion valves 141 and 151. As a result, the error in determination due to the difference in the temperature Tco of the refrigerant at the outlet of the outdoor heat exchanger 123 (i.e., the difference in the density of the refrigerant) can be reduced when determining the refrigerant quantity.

For example, during automatic refrigerant charging operation to charge refrigerant into the refrigerant circuit 110, it is possible to determine with high accuracy whether or not the refrigerant quantity in the refrigerant circuit 110 has reached the target charging value Ms. In addition, during initial refrigerant quantity detecting operation to detect the initial refrigerant quantity after constituent equipment is installed or after the refrigerant is charged in the refrigerant circuit 110, the initial refrigerant quantity can be detected with high accuracy. In addition, during refrigerant leak detection operation to determine whether or not there is a refrigerant leak in the refrigerant circuit 110, whether or not there is a refrigerant leak in the refrigerant circuit 110 can be determined with high accuracy.

In addition, in the air conditioner 101 in the present embodiment, by controlling constituent equipment such that the pressure (for example, the suction pressure Ps and the evaporation pressure Pe) of the refrigerant sent from the indoor heat exchangers 142 and 152 as evaporators to the compressor 121 during refrigerant quantity determining operation or such that the operation state quantity (for example, the evaporation temperature Te) equivalent to the pressure becomes constant, thereby preventing a change in the density ρgp of the refrigerant sent from the indoor heat exchangers 142 and 152 to the compressor 121. As a result, the error in determination due to the difference in the pressure of the refrigerant at the outlets of the indoor heat exchangers 142 and 152 or the operation state quantity equivalent to the pressure (i.e., the difference in the density of the refrigerant) can be reduced when determining the refrigerant quantity.

(C)

In the air conditioner 101 in the present embodiment, pipe volume determining operation is performed in which two states are created where the density of the refrigerant flowing in the refrigerant communication pipes 106 and 107 is different between the two states. Then, the increase/decrease quantity of the refrigerant between these two states is calculated from the refrigerant quantity in the portions other than the refrigerant communication pipes 106 and 107, and the increase/decrease quantity of the refrigerant is divided by the density change quantity of the refrigerant in the refrigerant communication pipes 106 and 107 between the first state and the second state, thereby the volumes of the refrigerant communication pipes 106 and 107 are calculated. Therefore, for example, even when the volumes of the refrigerant communication pipes 106 and 107 are unknown at the time of after installment of constituent equipment, the volumes of the refrigerant communication pipes 106 and 107 can be detected. Accordingly, the volumes of the refrigerant communication pipes 106 and 107 can be obtained while reducing laborious task of inputting information of the refrigerant communication pipes 106 and 107.

Also, in the air conditioner 101, the adequacy of the refrigerant quantity in the refrigerant circuit 110 can be determined by using the volumes of the refrigerant communication pipes 106 and 107 calculated by the pipe volume calculating means, and, the operation state quantity of constituent equipment or the refrigerant flowing in the refrigerant circuit 110. Therefore, even when the volumes of the refrigerant communication pipes 106 and 107 are unknown at the time of after installment of constituent equipment, the adequacy of the refrigerant quantity in the refrigerant circuit 110 can be determined with high accuracy.

For example, even when the volumes of the refrigerant communication pipes 106 and 107 are unknown at the time of after installment of constituent equipment, the refrigerant quantity in the refrigerant circuit 110 during initial refrigerant quantity determining operation can be calculated by using the volumes of the refrigerant communication pipes 106 and 107 calculated by the pipe volume calculating means. In addition, even when the volumes of the refrigerant communication pipes 106 and 107 are unknown at the time of after installment of constituent equipment, the refrigerant quantity in the refrigerant circuit 110 during refrigerant leak detection operation can be calculated by using the volumes of the refrigerant communication pipes 106 and 107 calculated by the pipe volume calculating means. Accordingly, it is possible to detect the initial refrigerant quantity necessary for detecting a refrigerant leak in the refrigerant circuit 110 and determine with high accuracy whether or not there is a refrigerant leak in the refrigerant circuit 110 while reducing laborious task of inputting information of the refrigerant communication pipes.

(D)

In the air conditioner 101 in the present embodiment, the volume Vlp of the liquid refrigerant communication pipe 106 and the volume Vgp of the gas refrigerant communication pipe 107 are calculated from information regarding the liquid refrigerant communication pipe 106 and the gas refrigerant communication pipe 107 (for example, operation results of pipe volume determining operation and information regarding the lengths, pipe diameters and the like of the refrigerant communication pipes 106 and 107, which is input by the operator and the like). Then, based on the results obtained by calculating the volume Vlp of the liquid refrigerant communication pipe 106 and the volume Vgp of the gas refrigerant communication pipe 107, whether or not the information regarding the liquid refrigerant communication pipe 106 and the gas refrigerant communication pipe 107 used for the calculation is appropriate is determined. Therefore, when it is determined to be appropriate, the volume Vlp of the liquid refrigerant communication pipe 106 and the volume Vgp of the gas refrigerant communication pipe 107 can be accurately obtained; whereas when it is determined not to be appropriate, it is possible to handle the situation by, for example, re-inputting appropriate information regarding the liquid refrigerant communication pipe 106 and the gas refrigerant communication pipe 107, re-performing pipe volume determining operation, and the like. Moreover, such determination method is not configured to determine by individually checking the volume Vlp of the liquid refrigerant communication pipe 106 and the volume Vgp of the gas refrigerant communication pipe 107 obtained by the calculation, but is configured to determine by checking whether or not the volume Vlp of the liquid refrigerant communication pipe 106 and the volume Vgp of the gas refrigerant communication pipe 107 satisfy a predetermined relation. Therefore, an appropriate determination can be made which also takes into consideration a relative relation between the volume Vlp of the liquid refrigerant communication pipe 106 and the volume Vgp of the gas refrigerant communication pipe 107.

(4) Alternative Embodiment

Also for the air conditioner 101 in the present embodiment, as is the case with the alternative embodiment 9 in the first embodiment, the refrigerant quantity determining system may be configured by achieving a connection between the air conditioner 101 and the local controller as a management device that manages each constituent equipment of the air conditioner and obtains the operation data, connecting the local controller via a network to a remote server of an information management center that receives the operation data of the air conditioner 101, and connecting a memory device such as a disk device as the state quantity storing means to the remote server.

Third Embodiment

A third embodiment of an air conditioner according the present invention is described below with reference to the drawings.

(1) Configuration of the Air Conditioner

Figure 26:
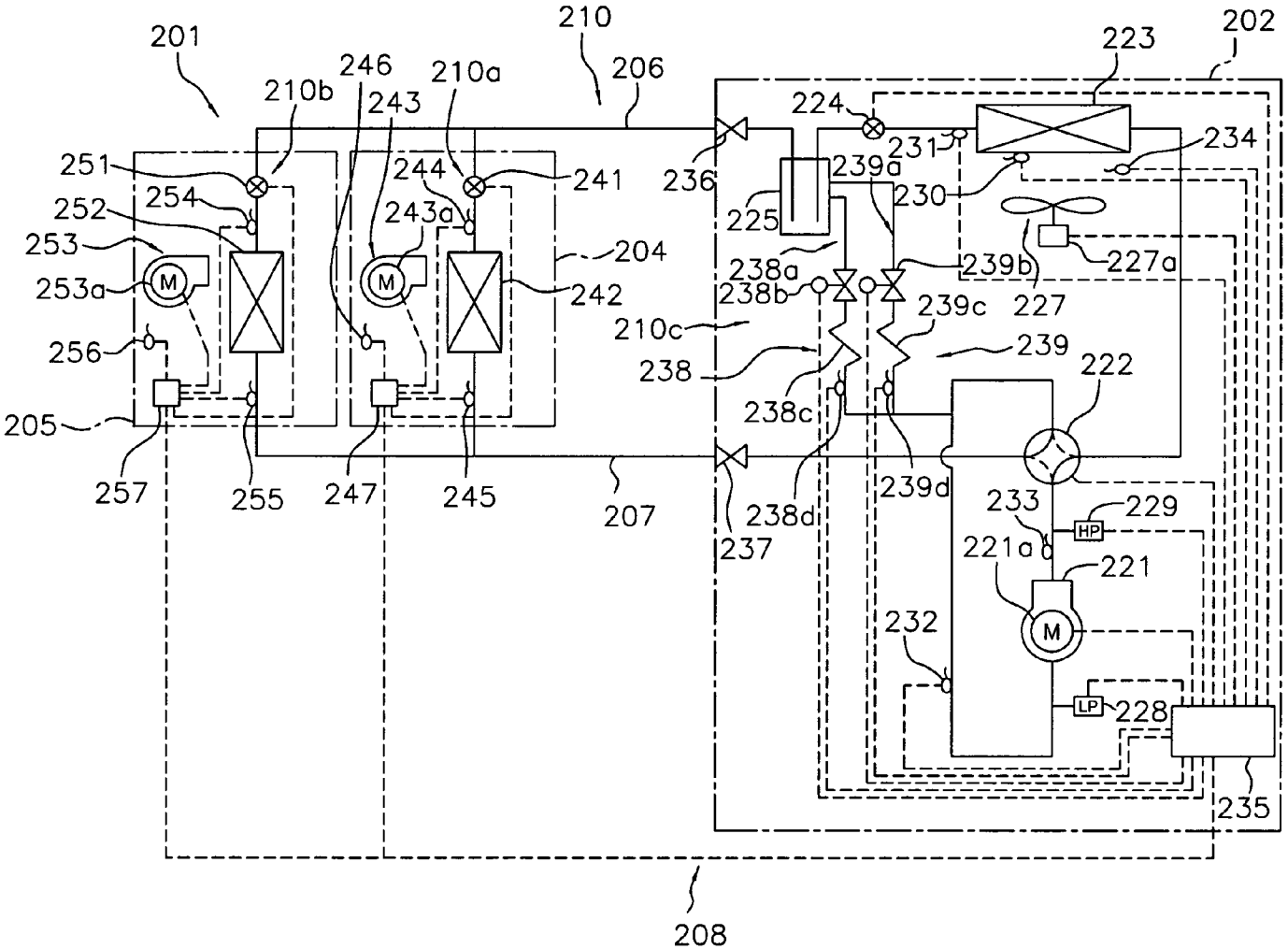
FIG. 26 is a schematic refrigerant circuit diagram of an air conditioner in which a refrigerant quantity determining system according to a third embodiment of the present invention is employed.

FIG. 26 is a schematic refrigerant circuit diagram of an air conditioner 201 according to the third embodiment of the present invention. The air conditioner 201 is a device that is used to cool and heat the inside of a building and the like by performing a vapor compression-type refrigeration cycle operation. The air conditioner 201 mainly comprises one outdoor unit 202 as a heat source unit, plural (two in the present embodiment) indoor units 204 and 205 as utilization units connected in parallel thereto, and a liquid refrigerant communication pipe 206 and a gas refrigerant communication pipe 207 as refrigerant communication pipes which interconnect the outdoor unit 202 and the indoor units 204 and 205. In other words, a vapor compression-type the refrigerant circuit 210 of the air conditioner 201 in the present embodiment is configured by the interconnection of the outdoor unit 202, the indoor units 204 and 205, and the liquid refrigerant communication pipe 206 and the gas refrigerant communication pipe 207.

<Indoor Unit>

The indoor units 204 and 205 are installed by being embedded in or hung from a ceiling inside a room in a building and the like or by being mounted on a wall surface inside a room. The indoor units 204 and 205 are connected to the outdoor unit 202 via the liquid refrigerant communication pipe 206 and the gas refrigerant communication pipe 207, and configure a part of the refrigerant circuit 210.

Note that, since the indoor units 204 and 205 have the same configuration as that of the indoor units 4 and 5 in the first embodiment, reference numerals in the 240s and 250s are used instead of reference numerals in the 40s and 50s representing the respective portions of the indoor units 4 and 5, and description of those respective portions are omitted.

<Outdoor Unit>

The outdoor unit 202 is installed on the roof and the like of a building and the like, is connected to the indoor units 204 and 205 via the liquid refrigerant communication pipe 206 and the gas refrigerant communication pipe 207, and configure the refrigerant circuit 210 with the indoor units 204 and 205.

Next, the configuration of the outdoor unit 202 is described. The outdoor unit 202 mainly comprises an outdoor side refrigerant circuit 210*c* that configures a part of the refrigerant circuit 210. The outdoor side refrigerant circuit 210*c* mainly comprises a compressor 221, a four-way switching valve 222, an outdoor heat exchanger 223 as a heat source side heat exchanger, an outdoor expansion valve 224 as a heat source side expansion valve, a receiver 225, a liquid side stop valve 236, and a gas side stop valve 237. Here, the compressor 221, the four-way switching valve 222, the outdoor heat exchanger 223, the liquid side stop valve 236, and the gas side stop valve 237 are the same as the compressor 21, the four-way switching valve 22, the outdoor heat exchanger 23, the liquid side stop valve 36, and the gas side stop valve 37 that constitute the outdoor unit 2 in the first embodiment, and therefore descriptions thereof will be omitted.

In the present embodiment, the outdoor unit 202 comprises an outdoor fan 227 for taking in outdoor air into the unit, supplying the air to the outdoor heat exchanger 223, and then discharging the air to the outside, so that the outdoor unit 202 is capable of performing heat exchange between the outdoor air and the refrigerant flowing in the outdoor heat exchanger 223. The outdoor fan 227 is a fan capable of varying the flow rate of the air it supplies to the outdoor heat exchanger 223, and in the present embodiment, is a propeller fan driven by a motor 227*a* comprising a DC fan motor.

In the present embodiment, the outdoor expansion valve 224 is an electrically powered expansion valve connected to a liquid side of the outdoor heat exchanger 223 in order to adjust the flow rate or the like of the refrigerant flowing in the outdoor side refrigerant circuit 210*c*.

Figure 27:
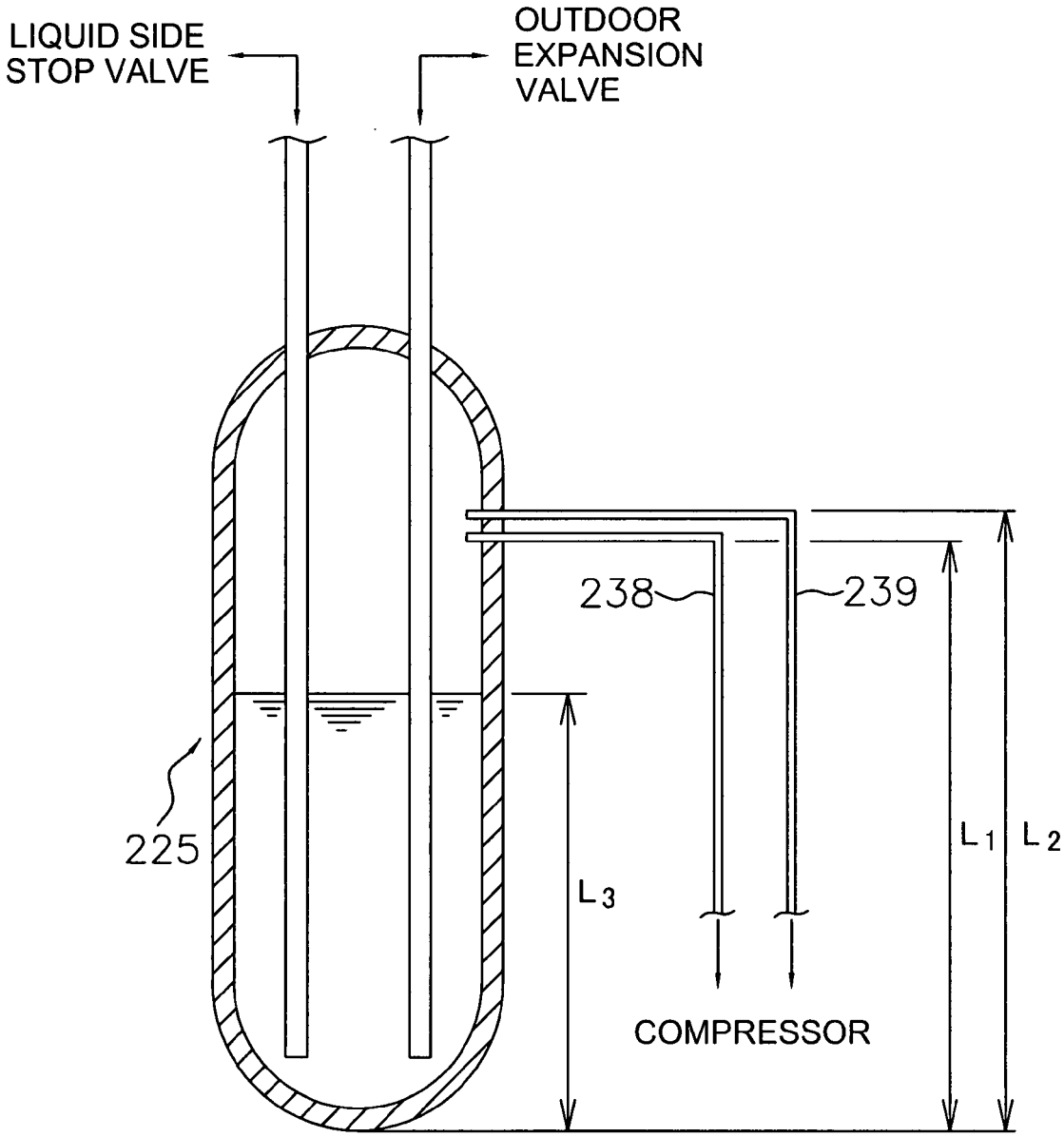
FIG. 27 is a schematic side cross sectional view of a receiver.

The receiver 225 is connected between the outdoor expansion valve 224 and the liquid side stop valve 236, and is a container capable of accumulating excess refrigerant generated in the refrigerant circuit 210 depending on the operation loads of the indoor units 204 and 205. As the receiver 225, for example, a container having a vertical cylindrical shape as shown in FIG. 27 is used. Here, FIG. 27 is a schematic side cross sectional view of the receiver 225.

In the present embodiment, the liquid level detection circuits 238 and 239 as liquid level detecting means for detecting the liquid level in the receiver 225 are connected to the receiver 225. Each of the liquid level detection circuits 238 and 239 is configured such that it is possible to extract a portion of the refrigerant in the receiver 225 from a predetermined position in the receiver 225, depressurize the same, measure the refrigerant temperature, and subsequently return the portion back to a suction side of the compressor 221. More specifically, as shown in FIGS. 26 and 27, mainly, the liquid level detection circuit 238 includes a detection tube 238*a* that interconnects a position of a first liquid level height $L_1$ at a lateral portion of the receiver 225 and the suction side of the compressor 221; a solenoid valve 238*b* disposed at the detection tube 238*a*; a capillary tube 238*c* disposed on the downstream side of the solenoid valve 238*b*; and a liquid level detection temperature sensor 238*d* that detects the refrigerant temperature on the downstream side of the capillary tube 238*c*. The liquid level detection circuit 239 has the same configuration as the liquid level detection circuit 238, and as shown in FIGS. 26 and 27, mainly, the liquid level detection circuit 239 includes a detection tube 239*a* that interconnects a position of a second liquid level height $L_2$ at the lateral portion of the receiver 225 and the suction side of the compressor 221; a solenoid valve 239*b* disposed at the detection tube 239*a*; a capillary tube 239*c* disposed on the downstream side of the solenoid valve 239*b*; and a liquid level detection temperature sensor 239*d* that detects the refrigerant temperature on the downstream side of the capillary tube 239*c*. In addition, expansion valves may be used instead of the solenoid valves 238*b* and 239*b* and the capillary tubes 238*c* and 239*c* of the liquid level detection circuits 238 and 239.

In addition, the second liquid level height $L_2$ is set at a position a little higher than the first liquid level height $L_1$. Further, the first liquid level height $L_1$ and the second liquid level height $L_2$ are set at positions higher than the liquid level height in the below described normal operation mode (more specifically, a possible maximum liquid level height $L_3$ of the liquid level in the normal operation mode).

Figure 28:
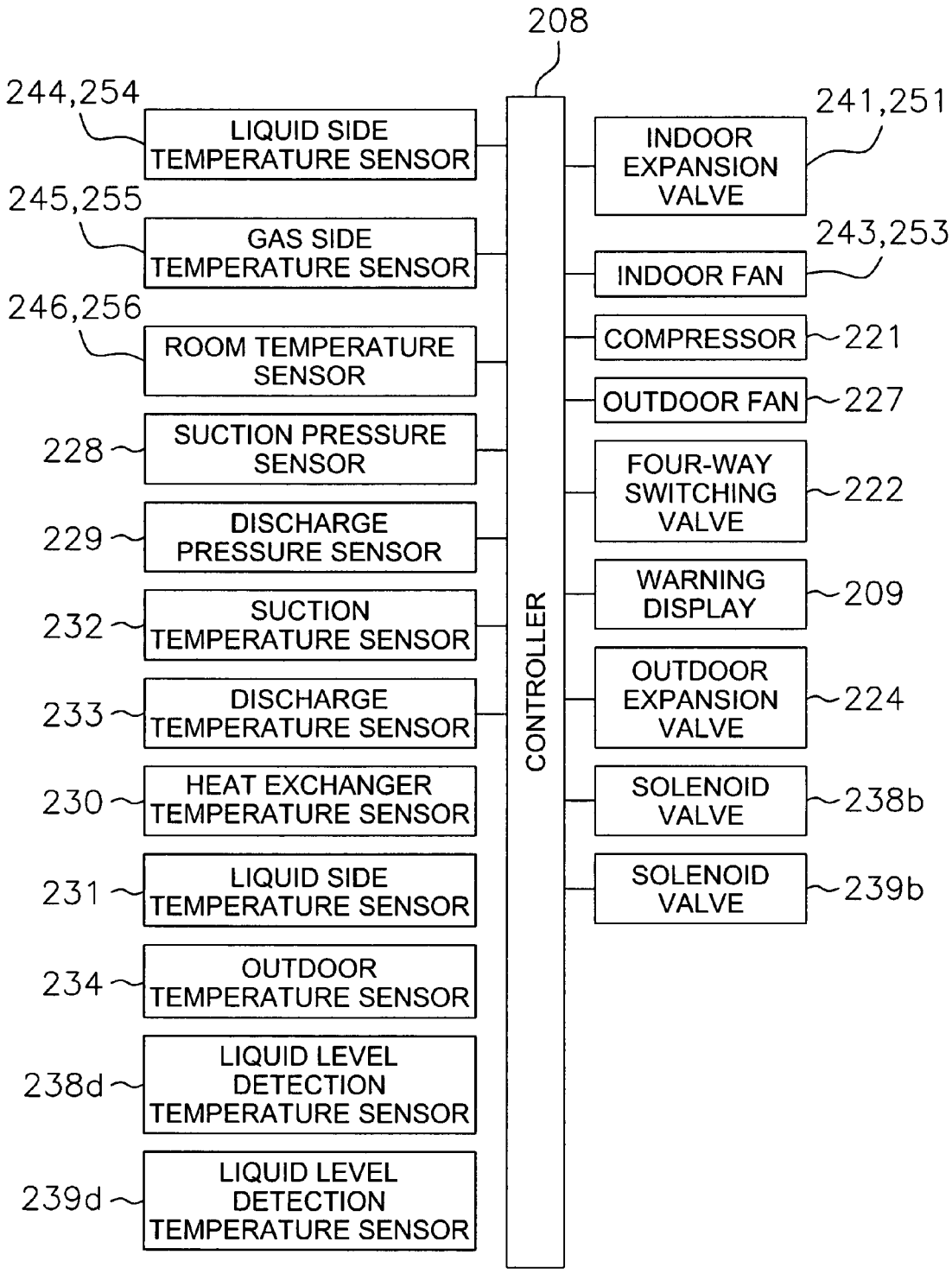
FIG. 28 is a control block diagram of the air conditioner.

In addition, the outdoor unit 202 is disposed with various sensors besides the above described liquid level detection temperature sensors 238*d* and 239*d*. Specifically, disposed in the outdoor unit 202 are an suction pressure sensor 228 that detects the suction pressure Ps of the compressor 221, a discharge pressure sensor 229 that detects the discharge pressure Pd of the compressor 221, a suction temperature sensor 232 that detects the suction temperature Ts of the compressor 221, and a discharge temperature sensor 233 that detects the discharge temperature Td of the compressor 221. A heat exchanger temperature sensor 230 that detects the refrigerant temperature flowing in the outdoor heat exchanger 223 (i.e., the refrigerant temperature corresponding to the condensation temperature Tc during cooling operation or the evaporation temperature Te during heating operation) is disposed in the outdoor heat exchanger 223. A liquid side temperature sensor 231 that detects the temperature of the refrigerant in a liquid state or gas-liquid two-phase state is disposed at the liquid side of the outdoor heat exchanger 223. An outdoor temperature sensor 234 that detects the temperature of the outdoor air that flows into the unit (i.e., the outdoor temperature Ta) is disposed at an outdoor air intake side of the outdoor unit 202. In addition, the outdoor unit 202 is disposed with an outdoor side controller 235 that controls the operation of each portion constituting the outdoor unit 202. Further, the outdoor side controller 235 includes a microcomputer disposed to control the outdoor unit 202, a memory, an inverter circuit that controls a motor 221*a*, and the like, and is configured such that it can exchange control signals and the like with indoor side controllers 247 and 257 of the indoor units 204 and 205. In other words, a controller 208 that performs operation control of the entire air conditioner 201 is configured by the indoor side controllers 247 and 257 and the outdoor side controller 235. As shown in FIG. 28, the controller 208 is connected so as to be able to receive detection signals of sensors 229 to 234, 238*d*, 239*d*, 244 to 246, and 254 to 256, and to be able to control various equipment and valves 221, 222, 224, 227*a*, 238*b*, 239*b*, 241, 243*a*, 251, and 253*a* based on these detection signals and the like. In addition, a warning display portion 209 comprising LEDs and the like, which is configured to indicate that a refrigerant leak is detected during the below described refrigerant leak detection mode, is connected to the controller 208. Here, FIG. 28 is a control block diagram of the air conditioner 201.

As described above, the refrigerant circuit 210 of the air conditioner 201 is configured by the interconnection of the indoor side refrigerant circuits 210*a* and 210*b*, the outdoor side refrigerant circuit 210*c*, and the refrigerant communication pipes 206 and 207. Further, with the controller 208 comprising the indoor side controllers 247 and 257 and the outdoor side controller 235, the air conditioner 201 in the present embodiment is configured to switch and operate between cooling operation and heating operation by the four-way switching valve 222 and control each equipment of the outdoor unit 202 and the indoor units 204 and 205 depending on the operation load of each of the indoor units 204 and 205.

(2) Operation of the Air Conditioner

Next, the operation of the air conditioner 201 in the present embodiment is described.

Operation modes of the air conditioner 201 in the present embodiment include: a normal operation mode where control of each equipment of the outdoor unit 202 and the indoor units 204 and 205 is performed depending on the operation load of each of the indoor units 204 and 205; a test operation mode where test operation to be performed after installment of the air conditioner 201 is performed; and a refrigerant leak detection mode where, after test operation is finished and normal operation has started, whether or not the refrigerant quantity charged in the refrigerant circuit 210 is adequate is determined by detecting the degree of superheating of the refrigerant at outlets of indoor heat exchangers 242 and 252 that function as evaporators while causing all of the indoor units 204 and 205 to perform cooling operation. The normal operation mode mainly includes cooling operation and heating operation. In addition, the test operation mode includes automatic refrigerant charging operation and control variables changing operation.

Operation in each operation mode of the air conditioner 201 is described below.

<Normal Operation Mode>

First, cooling operation in the normal operation mode is described with reference to FIGS. 26 to 28.

During cooling operation, the four-way switching valve 222 is in the state represented by the solid lines in FIG. 26, i.e., a state where a discharge side of the compressor 221 is connected to a gas side of the outdoor heat exchanger 223 and also a suction side of the compressor 221 is connected to gas sides of the indoor heat exchangers 242 and 252. In addition, the outdoor expansion valve 224, the liquid side stop valve 236, and the gas side stop valve 237 are opened, and the solenoid valves 238*b* and 238*b* are closed, and the opening degree of indoor expansion valves 241 and 251 is adjusted such that the degree of superheating of the refrigerant at the outlets of the indoor heat exchangers 242 and 252 becomes a predetermined value. In the present embodiment, the degree of superheating of the refrigerant at the outlets of the indoor heat exchangers 242 and 252 is detected by subtracting a refrigerant temperature value detected by the liquid side temperature sensors 244 and 254 from a refrigerant temperature value detected by the gas side temperature sensors 245 and 255, or is detected by converting the suction pressure Ps of the compressor 221 detected by the suction pressure sensor 228 to a saturated temperature value corresponding to the evaporation temperature Te, and subtracting this saturated temperature value of the refrigerant from a refrigerant temperature value detected by the gas side temperature sensors 245 and 255. Note that, although it is not employed in the present embodiment, the degree of superheating of the refrigerant at the outlets of the indoor heat exchangers 242 and 252 may be detected by subtracting a refrigerant temperature value corresponding to the evaporation temperature Te which is detected by the liquid side temperature sensors 244 and 254 from a refrigerant temperature value detected by the gas side temperature sensors 245 and 255; or a temperature sensor that detects the temperature of the refrigerant flowing in the indoor heat exchangers 242 and 252 may be disposed such that the degree of superheating of the refrigerant at the outlets of the indoor heat exchangers 242 and 252 is detected by subtracting a refrigerant temperature value corresponding to the evaporation temperature Te which is detected by this temperature sensor from a refrigerant temperature value detected by the gas side temperature sensors 245 and 255.

When the compressor 221, the outdoor fan 227, the indoor fans 243 and 253 are started in this state of the refrigerant circuit 210, low-pressure gas refrigerant is sucked into the compressor 221 and compressed into high-pressure gas refrigerant. Subsequently, the high-pressure gas refrigerant is sent to the outdoor heat exchanger 223 via the four-way switching valve 222, exchanges heat with the outdoor air supplied by the outdoor fan 227, and is condensed into high-pressure liquid refrigerant.

Then, this high-pressure liquid refrigerant is sent to the receiver 225 via the outdoor expansion valve 224, temporarily accumulated in the receiver 225, and is sent to the indoor units 204 and 205 via the liquid side stop valve 236 and the liquid refrigerant communication pipe 206. Here, as for inside the receiver 225, when excess refrigerant is generated in the refrigerant circuit 210 depending on the operation loads of the indoor units 204 and 205, for example, such as when the operation load of one of the indoor units 204 and 205 is small or one of them is stopped or when the operation loads of both of the indoor units 204 and 205 are small, the excess refrigerant is accumulated in the receiver 225, and the liquid level height in the receiver 225 is equal to or lower than the maximum liquid level height $L_3$.

The high-pressure liquid refrigerant sent to the indoor units 204 and 205 is depressurized by the indoor expansion valves 241 and 251, becomes refrigerant in a low-pressure gas-liquid two-phase state, is sent to the indoor heat exchangers 242 and 252, exchanges heat with the room air in the indoor heat exchangers 242 and 252, and is evaporated into low-pressure gas refrigerant. Here, the indoor expansion valves 241 and 251 control the flow rate of the refrigerant flowing in the indoor heat exchangers 242 and 252 such that the degree of superheating at the outlets of the indoor heat exchangers 242 and 252 becomes a predetermined value. Consequently, the low-pressure gas refrigerant evaporated in the indoor heat exchangers 242 and 252 is in a state of having a predetermined degree of superheating. In this way, the refrigerant whose flow rate corresponds to the operation loads required for the air-conditioned space where each of the indoor units 204 and 205 is installed flows in each of the indoor heat exchangers 242 and 252.

This low-pressure gas refrigerant is sent to the outdoor unit 202 via the gas refrigerant communication pipe 207 and is again sucked into the compressor 221 via the gas side stop valve 237 and the four-way switching valve 222.

Next, heating operation in the normal operation mode is described.

During heating operation, the four-way switching valve 222 is in the state represented by the dotted lines in FIG. 26, i.e., a state where the discharge side of the compressor 221 is connected to the gas sides of the indoor heat exchangers 242 and 252 and also the suction side of the compressor 221 is connected to the gas side of the outdoor heat exchanger 223. In addition, the outdoor expansion valve 224, the liquid side stop valve 236 and the gas side stop valve 237 are opened, the solenoid valves 238*b* and 238*b* are closed, and the opening degree of the indoor expansion valves 241 and 251 is adjusted such that the degree of subcooling of the refrigerant at the outlets of the indoor heat exchangers 242 and 252 becomes a predetermined value. In the present embodiment, the degree of subcooling of the refrigerant at the outlets of the indoor heat exchangers 242 and 252 is detected by converting the discharge pressure Pd of the compressor 221 detected by the discharge pressure sensor 229 to a saturated temperature value corresponding to the condensation temperature Tc, and subtracting from this saturated temperature value of the refrigerant a refrigerant temperature value detected by the liquid side temperature sensors 244 and 254. Note that, although it is not employed in the present embodiment, a temperature sensor that detects the temperature of the refrigerant flowing in the indoor heat exchangers 242 and 252 may also be disposed such that the degree of subcooling of the refrigerant at the outlets of the indoor heat exchangers 242 and 252 is detected by subtracting a refrigerant temperature value corresponding to the condensation temperature Tc which is detected by this temperature sensor from a refrigerant temperature value detected by the liquid side temperature sensors 244 and 254.

When the compressor 221, the outdoor fan 227, and the indoor fans 243 and 253 are started in this state of the refrigerant circuit 210, low-pressure gas refrigerant is sucked into the compressor 221, compressed into high-pressure gas refrigerant, and sent to the indoor units 204 and 205 via the four-way switching valve 222, the gas side stop valve 237, and the gas refrigerant communication pipe 207.

Then, the high-pressure gas refrigerant sent to the indoor units 204 and 205 exchanges heat with the room air in the outdoor heat exchangers 242 and 252 and is condensed into high-pressure liquid refrigerant. Subsequently, it is depressurized by the indoor expansion valves 241 and 251 and becomes refrigerant in a low-pressure gas-liquid two-phase state. Here, the indoor expansion valves 241 and 251 control the flow rate of the refrigerant flowing in the indoor heat exchangers 242 and 252 such that the degree of subcooling at the outlets of the indoor heat exchangers 242 and 252 becomes a predetermined value. Consequently, the high-pressure liquid refrigerant condensed in the indoor heat exchangers 242 and 252 is in a state of having a predetermined degree of subcooling. In this way, the refrigerant whose flow rate corresponds to the operation loads required for the air-conditioned space where each of the indoor units 204 and 205 is installed flows in each of the indoor heat exchangers 242 and 252.

This refrigerant in a low-pressure gas-liquid two-phase state is sent to the outdoor unit 202 via the liquid refrigerant communication pipe 206 and flows into the receiver 225 via the liquid side stop valve 236. The refrigerant that flowed into receiver 225 is temporarily accumulated in the receiver 225, and subsequently flows into the outdoor heat exchanger 223 via the outdoor expansion valve 224. Here, as for inside the receiver 225, when excess refrigerant is generated in the refrigerant circuit 210 depending on the operation loads of the indoor units 204 and 205, for example, such as when the operation load of one of the indoor units 204 and 205 is small or one of them is stopped or when the operation loads of both of the indoor units 204 and 205 are small, the excess refrigerant is accumulated in the receiver 225, and the liquid level height in the receiver 225 is equal to or lower than the maximum liquid level height $L_3$. Then, the refrigerant in a low-pressure gas-liquid two-phase state that flowed into the outdoor heat exchanger 223 exchanges heat with the outdoor air supplied by the outdoor fan 227, is condensed into low-pressure gas refrigerant, and is again sucked into the compressor 221 via the four-way switching valve 222.

In this way, the normal operation process that includes the above described cooling operation and heating operation is performed by the controller 208 that functions as a normal operation controlling means for performing normal operation that includes cooling operation and heating operation.

<Test Operation Mode>

Next, the test operation mode is described with reference to FIGS. 26 to 28, and FIG. 3. In the present embodiment, in the test operation mode, as is the case with the first embodiment, automatic refrigerant charging operation of Step S1 is first performed. Subsequently, control variable changing operation of Step S2 is performed.

In the present embodiment, an example of a case is described where, the outdoor unit 202 in which a prescribed refrigerant quantity is charged in advance and the indoor units 204 and 205 are installed and interconnected via the liquid refrigerant communication pipe 206 and the gas refrigerant communication pipe 207 to configure the refrigerant circuit 210 on site, and subsequently additional refrigerant is charged into the refrigerant circuit 210 whose refrigerant quantity is insufficient depending on the lengths of the liquid refrigerant communication pipe 206 and the gas refrigerant communication pipe 207.

<Step S1: Automatic Refrigerant Charging Operation>

First, the liquid side stop valve 236 and the gas side stop valve 237 of the outdoor unit 202 are opened and the refrigerant circuit 210 is filled with the refrigerant that is charged in the outdoor unit 202 in advance.

Next, when a person performing test operation issues a command to start test operation directly to the controller 208 or remotely by a remote controller (not shown) and the like, the controller 208 starts the process from Step S11 to Step S13 shown in FIG. 4, as is the case with the first embodiment.

<Step S11: Refrigerant Quantity Determining Operation>

When a command to start automatic refrigerant charging operation is issued, the refrigerant circuit 210, with the four-way switching valve 222 of the outdoor unit 202 in the state represented by the solid lines in FIG. 26, becomes a state where the indoor expansion valves 241 and 251 of the indoor units 204 and 205 are opened, the compressor 221, the outdoor fan 227, and the indoor fans 243 and 253 are started, and cooling operation is forcibly performed in regard to all of the indoor units 204 and 205 (hereinafter referred to as "all indoor unit operation").

Consequently, in the refrigerant circuit 210, the high-pressure gas refrigerant that has been compressed and discharged in the compressor 221 flows along a flow path from the compressor 221 to the outdoor heat exchanger 223 that functions as a condenser, the high-pressure refrigerant that undergoes phase-change from a gas state to a liquid state by heat exchange with the outdoor air flows into the outdoor heat exchanger 223 that functions as a condenser, the high-pressure liquid refrigerant flows along a flow path from the outdoor heat exchanger 223 to the indoor expansion valves 241 and 251 including the receiver 225 and the liquid refrigerant communication pipe 206, the low-pressure refrigerant that undergoes phase-change from a gas-liquid two-phase state to a gas state by heat exchange with the room air flows into the indoor heat exchangers 242 and 252 that function as evaporators, and the low-pressure gas refrigerant flows along a flow path from the indoor heat exchangers 242 and 252 to the compressor 221 including the gas refrigerant communication pipe 207.

Next, equipment control described below is performed to proceed to operation to stabilize the state of the refrigerant circulating in the refrigerant circuit 210. Specifically, the motor 221*a* of the compressor 221 is controlled such that the rotation frequency f becomes constant at a predetermined value (hereinafter referred to as "compressor rotation frequency constant control") and the indoor expansion valves 241 and 251 are controlled such that the liquid level in the receiver 225 becomes constant between the liquid level height $L_1$ and the liquid level height $L_2$ (hereinafter referred to as "receiver liquid level constant control"). Here, the reason to perform the rotation frequency constant control is to stabilize the flow rate of the refrigerant sucked into and discharged from the compressor 221. In addition, the reason to perform the liquid level constant control is to maintain a constant quantity of excess refrigerant in the receiver 225, and at the same time to cause the effect of a refrigerant leak to appear as a change in the operation state quantity, such as the degree of superheating $SH_i$ of the refrigerant at the outlets of the indoor heat exchangers 242 and 252 that function as evaporators, which fluctuates not due to the effect of a change in the amount of liquid in the receiver 225 but due to the effect of a change in the refrigerant quantity.

Consequently, in the refrigerant circuit 210, the state of the refrigerant circulating in the refrigerant circuit 210 becomes stabilized, and the refrigerant quantity in equipment other than the outdoor heat exchanger 223 and in the pipes becomes substantially constant. Therefore, when refrigerant is started to be charged into the refrigerant circuit 210 by additional refrigerant charging, which is performed subsequently, it is possible to create a state where the operation state quantity such as the degree of superheating $SH_i$ of the refrigerant at the outlets of the indoor heat exchangers 242 and 252 that function as evaporators changes according to a change in the refrigerant quantity (hereinafter this operation is referred to as "refrigerant quantity determining operation").

Figure 29:
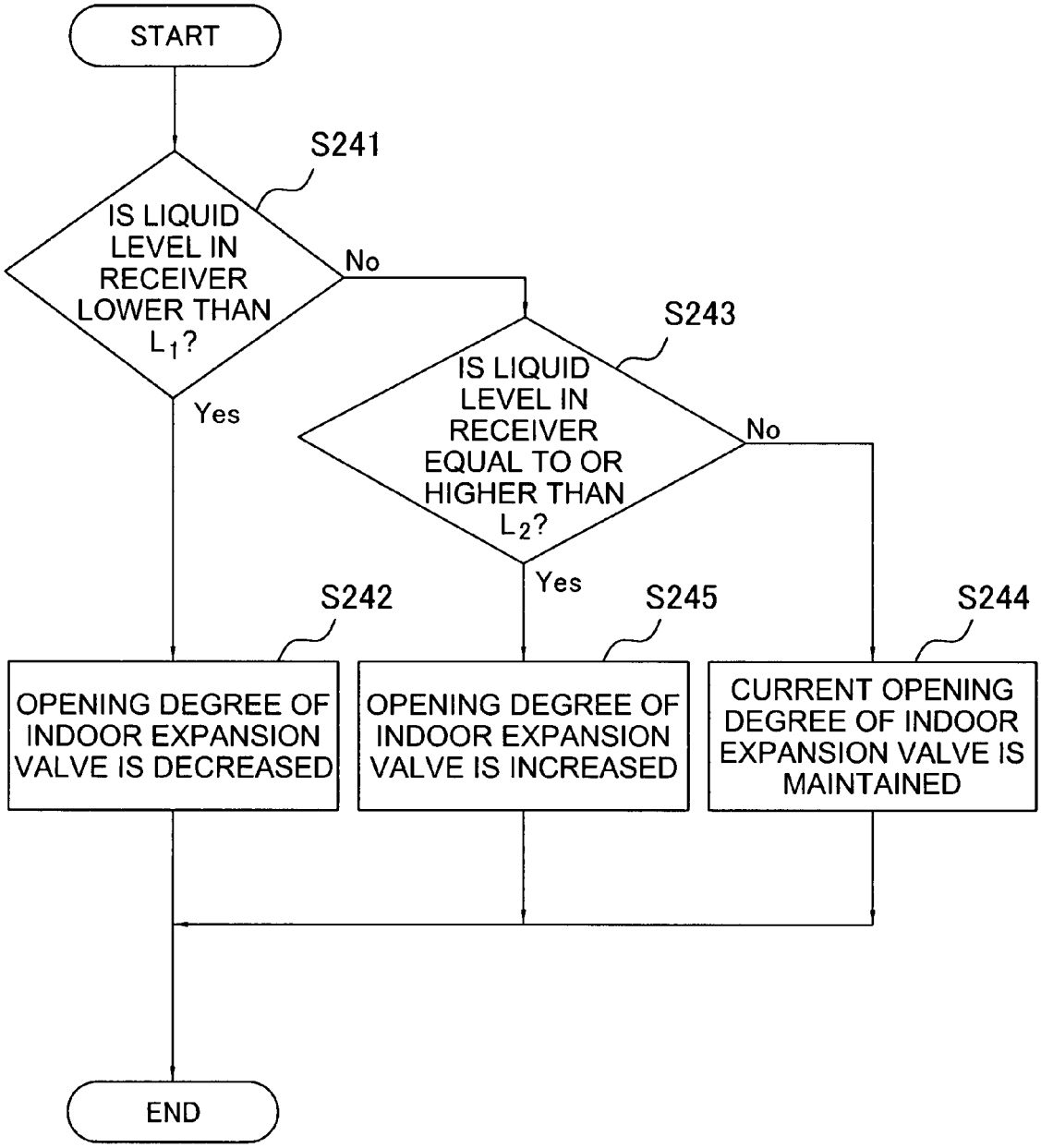
FIG. 29 is a flowchart of receiver liquid level constant control.

Here, the above mentioned receiver liquid level constant control is described including a method for detecting the liquid level in the receiver 225 by the liquid level detection circuits 238 and 239, with reference to FIG. 29. Here, FIG. 29 is a flowchart of the receiver liquid level constant control.

First, when a command for refrigerant quantity determining operation is issued, the solenoid valves 238*b* and 239*b* are opened, and a state is achieved where the refrigerant flows toward the suction side of the compressor 221 from the positions at the liquid level height $L_1$ and the liquid level height $L_2$ of the receiver 225. Here, the liquid level in the receiver 225 in a state before additional refrigerant is charged is lower than the liquid level height $L_1$ since the liquid level height $L_1$ and the liquid level height $L_2$ are set higher than the liquid level height $L_3$ in the normal operation mode. In other words, since the refrigerant that flows from the position of the liquid level height $L_1$ in the receiver 225 toward the suction side of the compressor 221 is in a gas state, the refrigerant is depressurized by the capillary tube 238*c* in the liquid level detection circuit 238, and flows into the suction side of the compressor 221 after a decrease in the temperature thereof occurs to some degree. However, the decrease in the temperature that occurs at this time is caused by the operation of depressurization of the refrigerant in a gas state, and therefore the decrease is relatively small. The temperature of the refrigerant after being subjected to the operation of depressurization decreases only to a temperature higher than the suction temperature Ts of the compressor 221. Accordingly, in Step S241, it is determined that the liquid level in the receiver 225 is lower than the liquid level height $L_1$, for example, based on that the temperature of the refrigerant detected by the liquid level detection temperature sensor 238*d* in the liquid level detection circuit 238 is higher than the suction temperature Ts by a predetermined temperature difference. Then in this case, the control to decrease the opening degree of the indoor expansion valves 241 and 251 is performed (Step S242).

Next, by performing the control to decrease the opening degree of the indoor expansion valves 241 and 251, the liquid level of the receiver 225 rises, and when the liquid level of the receiver 225 reaches the liquid level height $L_1$, the refrigerant that flows from the position of the liquid level height $L_1$ in the receiver 225 to the suction side of the compressor 221 becomes a liquid state. Consequently, the decrease in the temperature when the refrigerant in a liquid state is depressurized is greater than the decrease in the temperature when the refrigerant in a gas state is depressurized by evaporation of the refrigerant at the time of the operation of depressurization, and the temperature decreases to a temperature substantially the same as the suction temperature Ts in the compressor 221. Accordingly, in Step S241, it is determined that the liquid level in the receiver 225 is equal to or higher than the liquid level height $L_1$, for example, based on that the temperature difference between the temperature of the refrigerant detected by the liquid level detection temperature sensor 238*d* in the liquid level detection circuit 238 and the suction temperature Ts is smaller than a predetermined temperature difference. Then in this case, the process proceeds to Step S243.

In Step S243, whether or not the liquid level in the receiver 225 has reached the liquid level height $L_2$ is determined by using the liquid level detection circuit 239. First, in the case where the liquid level in the receiver 225 is lower than the liquid level height $L_2$, the refrigerant that flows from the position of the liquid level height $L_2$ in the receiver 225 toward the suction side of the compressor 221 is in a gas state, and therefore the temperature of the refrigerant after being subjected to the operation of depressurization in the liquid level detection circuit 239 decrease only to a temperature higher than the suction temperature Ts of the compressor 221. Accordingly, it is determined that the liquid level in the receiver 225 is equal to or higher than the liquid level height $L_1$ and also lower than the liquid level height $L_2$. Then in this case, it is determined that the opening degree of the indoor expansion valves 242 and 252 is adequate, and the control to maintain the current opening degree is performed (Step S244).

However, in the case where the liquid level in the receiver 225 becomes equal to or higher than the liquid level height $L_2$, and the refrigerant that flows from the position of the liquid level height $L_2$ in the receiver 225 toward the suction side of the compressor 221 becomes a liquid state, it is determined, in Step S243, that the liquid level in the receiver 225 is equal to or higher than the liquid level height $L_2$, for example, based on that the temperature difference between the temperature of the refrigerant detected by the liquid level detection temperature sensor 239*d* in the liquid level detection circuit 239 and the suction temperature Ts is smaller than a predetermined temperature difference. Then in this case, the control to increase the opening degree of the indoor expansion valves 241 and 251 is performed (Step S245).

In this way, the process in Step S11 is performed by the controller 208 that functions as the refrigerant quantity determining operation controlling means for performing refrigerant quantity determining operation including all indoor unit operation, compressor rotation frequency constant control, and receiver liquid level constant control.

Note that, unlike the present embodiment, when refrigerant is not charged in advance in the outdoor unit 202, it is necessary prior to Step S11 to charge refrigerant until the refrigerant quantity reaches a level where refrigerating cycle operation can be performed.

<Step S12: Operation Data Storing During Refrigerant Charging>

Next, additional refrigerant is charged in the refrigerant circuit 210 while performing the above described refrigerant quantity determining operation. At this time, in Step S12, the operation state quantity of constituent equipment or the refrigerant flowing in the refrigerant circuit 210 during additional refrigerant charging is obtained as the operation data and stored in the memory of the controller 208. In the present embodiment, the degree of superheating $SH_i$ at the outlets of the indoor heat exchangers 242 and 252, the outdoor temperature Ta, the room temperature Tr, the discharge pressure Pd, and the suction pressure Ps are stored in the memory of the controller 208 as the operation data during refrigerant charging. Note that, in the present embodiment, the degree of superheating $SH_i$ of the refrigerant at the outlets of the indoor heat exchangers 242 and 252 is detected, as described above, by subtracting a refrigerant temperature value detected by the liquid side temperature sensors 244 and 254 from a refrigerant temperature value detected by the gas side temperature sensors 245 and 255, or is detected by converting the suction pressure Ps of the compressor 221 detected by the suction pressure sensor 228 to a saturated temperature value corresponding to the evaporation temperature Te and subtracting this refrigerant saturated temperature value from the refrigerant temperature value detected by the gas side temperature sensors 245 and 255.

This Step S12 is repeated until the condition for determining the adequacy of the refrigerant quantity in the below described Step S13 is satisfied. Therefore, in the period from the start to the completion of additional refrigerant charging, the above described operation state quantity during refrigerant charging is stored, as the operation data during refrigerant charging, in the memory of the controller 208. Note that, as for the operation data stored in the memory of the controller 208, appropriately thinned-out operation data may be stored. For example, for the operation data in the period from the start to the completion of additional refrigerant charging, the degree of superheating $SH_i$ may be stored at each appropriate temperature interval and also a different value of the operation state quantity that corresponds to these degrees of superheating $SH_i$ may be stored, etc.

In this way, the process in Step S12 is performed by the controller 208 that functions as the state quantity storing means for storing, as the operation data, the operation state quantity of constituent equipment or the refrigerant flowing in the refrigerant circuit 210 during the operation that involves refrigerant charging. Therefore, it is possible to obtain, as the operation data, the operation state quantity in a state where refrigerant with less quantity than the refrigerant quantity after additional refrigerant charging is completed (hereinafter referred to as "initial refrigerant quantity") is charged in the refrigerant circuit 210.

<Step S13: Determination of the Adequacy of the Refrigerant Quantity>

Figure 30:
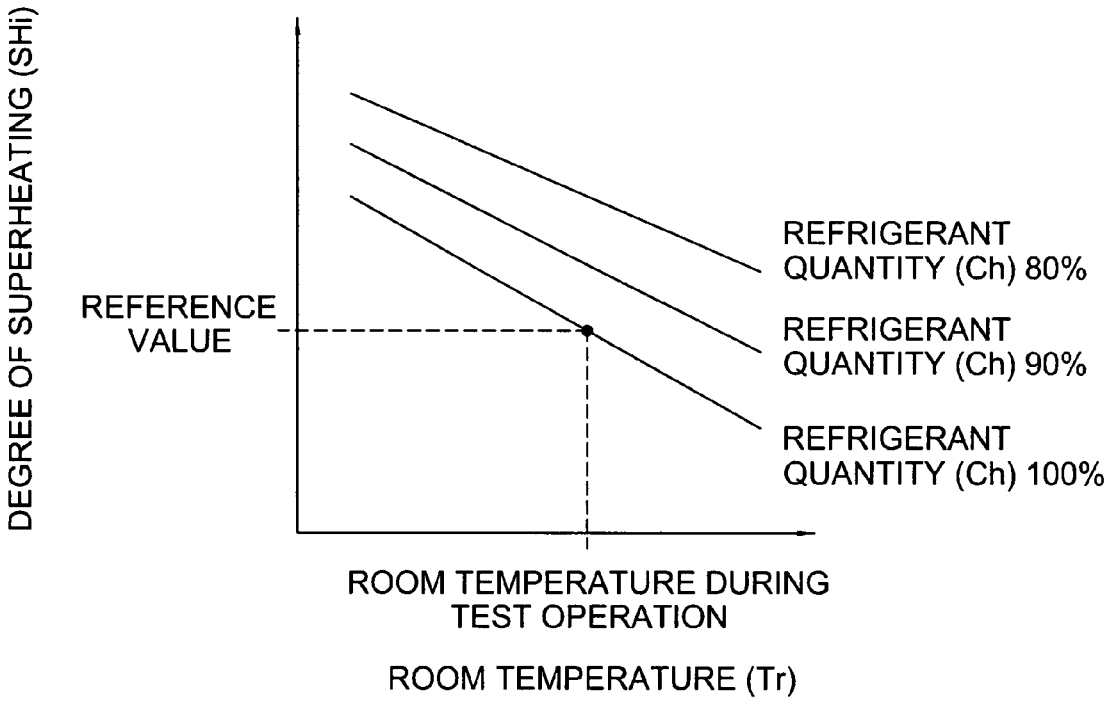
FIG. 30 is a graph to show a relationship between the degree of superheating at an outlet of an indoor heat exchanger, and the room temperature and the refrigerant quantity during a refrigerant quantity determining operation.

As described above, when additional refrigerant charging into the refrigerant circuit 210 starts, the refrigerant quantity in the refrigerant circuit 210 gradually increases. Consequently, a tendency of an increase in the refrigerant quantity that flows from the outdoor heat exchanger 223 into the receiver 225 appears. However, the refrigerant quantity accumulated in the receiver 225 is maintained constant by the receiver liquid level constant control. As a result, a tendency of a decrease in the degree of superheating $SH_i$ at the outlets of the indoor heat exchangers 242 and 252 appears. This tendency indicates that there is a correlation as shown in FIG. 30 between the degree of superheating $SH_i$ at the outlets of the indoor heat exchangers 242 and 252 and the refrigerant quantity charged in the refrigerant circuit 210. Here, FIG. 30 is a graph to show a relationship between the degree of superheating $SH_i$ at the outlets of the indoor heat exchangers 242 and 252, and the room temperature Tr and the refrigerant quantity Ch during refrigerant quantity determining operation. This correlation indicates a relationship between the room temperature Tr and a value of the degree of superheating $SH_i$ at the outlets of the indoor heat exchangers 242 and 252 when refrigerant is charged in the refrigerant circuit 210 in advance until a prescribed refrigerant quantity reached (hereinafter referred to as "prescribed value of the degree of superheating $SH_i$"), in the case where the above described refrigerant quantity determining operation was performed by using the air conditioner 201 in a state immediately after being installed on site and started to be used. In other words, it means that a prescribed value of the degree of superheating $SH_i$ at the outlets of the indoor heat exchangers 242 and 252 is determined by the room temperature Tr during test operation (specifically, during automatic refrigerant charging), and comparison between this prescribed value of the degree of superheating $SH_i$ and the current value of the degree of superheating $SH_i$ detected during refrigerant charging enables determination of the adequacy of the refrigerant quantity to be charged into the refrigerant circuit 210 by additional refrigerant charging.

Step S13 is a process to determine the adequacy of the refrigerant quantity charged in the refrigerant circuit 210 by additional refrigerant charging, by using correlation as described above.

In other words, when the additional refrigerant quantity to be charged is small and the refrigerant quantity in the refrigerant circuit 210 has not reached the initial refrigerant quantity, it is a state where the refrigerant quantity in refrigerant circuit 210 is small. Here, the state where the refrigerant quantity in the refrigerant circuit 210 is small means that the current value of the degree of superheating $SH_i$ at the outlets of the indoor heat exchangers 242 and 252 is greater than the prescribed value of the degree of superheating $SH_i$. Accordingly, when the degree of superheating $SH_i$ at the outlets of the indoor heat exchangers 242 and 252 is greater than the prescribed value and additional refrigerant charging is not completed, the process in Step S13 is repeated until the current value of the degree of superheating $SH_i$ reaches the prescribed value. In addition, when the current value of the degree of superheating $SH_i$ reaches the prescribed value, additional refrigerant charging is completed and Step S1 as a refrigerant quantity charging operation process is finished. Note that, it is considered that the initial refrigerant quantity after additional refrigerant charging is completed has reached the refrigerant quantity close to the prescribed refrigerant quantity. However, the value of the prescribed refrigerant quantity itself is the refrigerant quantity determined based on the pipe length, the capacities of constituent equipment, and the like, which are measured on site. Therefore, it is possible, as a result, that the prescribed refrigerant quantity is inconsistent with the initial refrigerant quantity in some cases. Accordingly, in the present embodiment, a value of the degree of superheating $SH_i$ and a different value of the operation state quantity at the time of completion of additional refrigerant charging are used as reference values of the operation state quantity such as the degree of superheating $SH_i$ in the below described refrigerant leak detection mode.

In this way, the process in Step S13 is performed by the controller 208 that functions as the refrigerant quantity determining means for determining the adequacy of the refrigerant quantity charged in the refrigerant circuit 210 during refrigerant quantity determining operation.

Note that, unlike the present embodiment, when additional refrigerant charging is not necessary and the refrigerant quantity that is charged in advance in the outdoor unit 202 is sufficient as the refrigerant quantity in the refrigerant circuit 210, practically, the automatic refrigerant charging operation will be an operation only to store the data of the operation state quantity with respect to the initial refrigerant quantity. Note that there are cases where the prescribed refrigerant quantity calculated on site from the pipe length, the capacities of constituent equipment, and the like is not consistent with the initial refrigerant quantity after additional refrigerant charging is completed. However, in the present embodiment, a value of the degree of superheating $SH_i$ and a different value of the operation state quantity at the time of completion of additional refrigerant charging are used as reference values of the operation state quantity such as the degree of superheating $SH_i$ in the below described refrigerant leak detection mode.

<Step S2: Control Variables Changing Operation>

When the above described automatic refrigerant charging operation of Step S1 is finished, the process proceeds to control variables changing operation of Step S2. During control variable changing operation, the process in Step S21 to Step S23 shown in FIG. 6 is performed by the controller 208, as is the case with the first embodiment.

<Step S21 to S23: Control Variables Changing Operation and Operation Data Storing During Control Variables Changing Operation>

In Step S21, after the above described automatic refrigerant charging operation is finished, the refrigerant quantity determining operation same as Step S11 is performed with the initial refrigerant quantity charged in the refrigerant circuit 210.

Here, in a state where refrigerant quantity determining operation is performed with refrigerant already charged up to the initial refrigerant quantity, the air flow rate of the outdoor fan 227 is changed, and thereby operation is performed for simulating a state where there was a fluctuation in the heat exchange performance of the outdoor heat exchanger 223 during test operation i.e., after installment of the air conditioner 201. Also, by changing the air flow rate of the indoor fans 243 and 253, operation is performed for simulating a state where there was a fluctuation in the heat exchange performance of the indoor heat exchangers 242 and 252 (hereinafter such operation is referred to as "control variables changing operation").

For example, during refrigerant quantity determining operation, when the air flow rate of the outdoor fan 227 is reduced, the heat transfer coefficient K of the outdoor heat exchanger 223 becomes smaller and the heat exchange performance drops. Consequently, as shown in FIG. 7, the condensation temperature Tc of the refrigerant in the outdoor heat exchanger 223 increases. This results in a tendency of an increase in the discharge pressure Pd of the compressor 221 corresponding to the condensation pressure Pc of the refrigerant in the outdoor heat exchanger 223. In addition, during refrigerant quantity determining operation, when the air flow rate of the indoor fans 243 and 253 is reduced, the heat transfer coefficient K of the indoor heat exchangers 242 and 252 becomes smaller and the heat exchange performance drops. Consequently, as shown in FIG. 8, the evaporation temperature Te of the refrigerant in the indoor heat exchangers 242 and 252 decreases. This results in a tendency of a decrease in the suction pressure Ps of the compressor 221 corresponding to the evaporation pressure Pe of the refrigerant in the indoor heat exchangers 242 and 252. When such control variables changing operation is performed, the operation state quantity of constituent equipment or the refrigerant flowing in the refrigerant circuit 210 changes depending on each operating conditions, while the initial refrigerant quantity charged in the refrigerant circuit 210 remains constant. Here, FIG. 7 a graph to show a relationship between the discharge pressure Pd and the outdoor temperature Ta during refrigerant quantity determining operation. FIG. 8 is a graph to show a relationship between the suction pressure Ps and the outdoor temperature Ta during refrigerant quantity determining operation.

In Step S22, the operation state quantity of constituent equipment or the refrigerant flowing in the refrigerant circuit 210 under each operating condition during control variables changing operation is obtained as the operation data and stored in the memory of the controller 208. In the present embodiment, the degree of superheating $SH_i$ at the outlets of the indoor heat exchangers 242 and 252, the outdoor temperature Ta, the room temperature Tr, the discharge pressure Pd, and the suction pressure Ps are stored, in the memory of the controller 208, as the operation data at the beginning of the refrigerant charging.

This Step S22 is repeated until it is determined in Step S23 that all the operating conditions for control variables changing operation have been executed.

In this way, the process in Steps S21 and S23 is performed by the controller 208 that functions as the control variables changing operation means for performing control variables changing operation including operation for simulating a state where there was a fluctuation in the heat exchange performance of the outdoor heat exchanger 223 and the indoor heat exchangers 242 and 252, by changing the air flow rate of the outdoor fan 227 and the indoor fans 243 and 253 while performing refrigerant quantity determining operation. In addition, the process in Step S22 is performed by the controller 208 that functions as the state quantity storing means for storing, as the operation data, the operation state quantity of constituent equipment or the refrigerant flowing in the refrigerant circuit 210 during control variables changing operation. Therefore, it is possible to obtain, as the operation data, the operation state quantity during operation for simulating a state where there was a fluctuation in the heat exchange performance of the outdoor heat exchanger 223 and the indoor heat exchangers 242 and 252.

<Refrigerant Leak Detection Mode>

Next, the refrigerant leak detection mode is described with reference to FIGS. 26, 27, and 9.

In the present embodiment, an example of a case is described where, at the time of cooling operation or heating operation in the normal operation mode, whether or not the refrigerant in the refrigerant circuit 210 is leaking to the outside due to an unforeseen factor is detected periodically (for example, once every month when a load is not required for an air-conditioned space).

<Step S31: Determining Whether or not the Normal Operation Mode has Gone on for a Certain Period of Time>

First, whether or not operation in the normal operation mode such as the above-described cooling operation or the heating operation has gone on for a certain period of time (every one month, etc.) is determined, and when operation in the normal operation mode has gone on for a certain period of time, the process proceeds to the next step S32.

<Step S32: Refrigerant Quantity Determining Operation>

When the operation in the normal operation mode has gone on for a certain period of time, as is the case with the above described automatic refrigerant charging operation of Step S11, refrigerant quantity determining operation including all indoor unit operation, compressor rotation frequency constant control, and receiver liquid level constant control is performed. Here, a value to be used for the rotation frequency f of the compressor 221 is same as a predetermined value of the rotation frequency f during refrigerant quantity determining operation of Step S11 in automatic refrigerant charging operation. In addition, the liquid level height of the receiver 225 is controlled so as to be the liquid level height between the liquid level height $L_1$ and the liquid level height $L_2$ during refrigerant quantity determining operation of Step S11 in automatic refrigerant charging operation.

In this way, the process in Step S32 is performed by the controller 208 that functions as the refrigerant quantity determining operation controlling means for performing refrigerant quantity determining operation including all indoor unit operation, compressor rotation frequency constant control, and receiver liquid level constant control.

<Step S33 to S35: Determination of the Adequacy of the Refrigerant Quantity, Returning to the Normal Operation, Warning Display>

When refrigerant in the refrigerant circuit 210 leaks out, the refrigerant quantity in the refrigerant circuit 210 decreases. Consequently, a tendency of an increase in the current value of the degree of superheating $SH_i$ at the outlets of the indoor heat exchangers 242 and 252 (see FIG. 30) appears. In other words, it means that the adequacy of the refrigerant quantity charged in the refrigerant circuit 210 can be determined through a comparison using the current value of the degree of superheating $SH_i$ at the outlets of the indoor heat exchangers 242 and 252. In the present embodiment, comparison is made between the current value of the degree of superheating $SH_i$ at the outlets of the indoor heat exchangers 242 and 252 during refrigerant leak detection operation and the reference value (prescribed value) of the degree of superheating $SH_i$ corresponding to the initial refrigerant quantity charged in the refrigerant circuit 210 at the completion of the above described automatic refrigerant charging operation, and thereby determination of the adequacy of the refrigerant quantity i.e., detection of a refrigerant leak is performed.

Here, when the reference value of the degree of superheating $SH_i$, which corresponds to the initial refrigerant quantity charged in the refrigerant circuit 210 at the completion of the above described automatic refrigerant charging operation is used as a reference value of the degree of superheating $SH_i$ during refrigerant leak detection operation, a drop in the heat exchange performance of the outdoor heat exchanger 223 and the indoor heat exchangers 242 and 252, caused by age-related degradation, poses a problem.

Therefore, in the air conditioner 201 in the present embodiment, as is the case with the air conditioner 1 in the first embodiment, the focus is placed on the fluctuations in the coefficients KA of the outdoor heat exchanger 223 and the indoor heat exchangers 242 and 252 according to the degree of age-related degradation. In other words, the focus is placed on the fluctuations in the correlation between the condensation pressure Pc in the outdoor heat exchanger 223 and the outdoor temperature Ta (see FIG. 7) and in the correlation between the evaporation pressure Pe in the indoor heat exchangers 242 and 252 and the room temperature Tr (see FIG. 8), which occur along with the fluctuation in the coefficient KA. Then, the current value of the degree of superheating $SH_i$ or the reference value of the degree of superheating $SH_i$, which is used when determining the adequacy of the refrigerant quantity, is corrected by using the discharge pressure Pd of the compressor 221 which corresponds to the condensation pressure Pc in the outdoor heat exchanger 223, the outdoor temperature Ta, the suction pressure Ps of the compressor 221 which corresponds to the evaporation pressure Pe in the indoor heat exchangers 242 and 252, and the room temperature Tr. Thereby, different degrees of superheating $SH_i$, which are detected in the air conditioner 201 comprising the outdoor heat exchanger 223 and the indoor heat exchangers 242 and 252 whose coefficients KA remain the same, can be compared with each other. In this way, the effect of the fluctuation in the degree of superheating $SH_i$ by age-related degradation is eliminated.

Note that, fluctuation in the heat exchange performance of the outdoor heat exchanger 223 may also occur due to the effect of weather conditions such as rain, heavy gale, etc., besides age-related degradation. Specifically, in case of rain, the plate fins and the heat transfer tube of the outdoor heat exchanger 223 get wet with rain, which can therefore cause a fluctuation in the heat exchange performance, i.e., a fluctuation in the coefficient KA. In addition, in case of heavy gale, the air flow rate of the outdoor fan 227 becomes larger or smaller by the heavy gale, which can therefore cause a fluctuation in the heat exchange performance, i.e., a fluctuation in the coefficient KA. Such effect of weather conditions on the heat exchange performance of the outdoor heat exchanger 223 will appear as a fluctuation in the correlation between the condensation pressure Pc in the outdoor heat exchanger 223 and the outdoor temperature Ta according to the fluctuation in the coefficient KA (see FIG. 7). Consequently, elimination of the effect of the fluctuation in the degree of superheating $SH_i$ by age-related degradation can result in the elimination of the effect of the fluctuation in the degree of superheating $SH_i$ by weather conditions.

As a specific correction method, for example, there is a method in which the refrigerant quantity Ch charged in the refrigerant circuit 210 is expressed as a function of the degree of superheating $SH_i$, the discharge pressure Pd, the outdoor temperature Ta, the suction pressure Ps, and the room temperature Tr. Then, the refrigerant quantity Ch is calculated from the current value of the degree of superheating $SH_i$ during refrigerant leak detection operation and the current values of the discharge pressure Pd, the outdoor temperature Ta, the suction pressure Ps and the room temperature Tr during the same operation. In this way, the current refrigerant quantity is compared with the initial refrigerant quantity which serves as a reference value of the refrigerant quantity, and thereby the effect of age-related degradation and weather conditions on the degree of superheating $SH_i$ at the outlet of the outdoor heat exchanger 223 is compensated.

Here, the refrigerant quantity Ch charged in the refrigerant circuit 210 can be expressed as a following multiple regression function:

$$Ch=k1\times SH_i+k2\times Pd+k3\times Ta+\times k4\times Ps+k5\times Tr+k6,$$

and accordingly, by using the operation data (i.e., data of the degree of superheating $SH_i$ at the outlet of the outdoor heat exchanger 223, the outdoor temperature Ta, the room temperature Tr, the discharge pressure Pd, and the suction pressure Ps) stored in the memory of the controller 208 during refrigerant charging and control variables changing operation in the above described test operation mode, a multiple regression analysis is performed in order to calculate parameters k1 to k6 and thereby a function of the refrigerant quantity Ch can be defined.

Note that, in the present embodiment, a function of the refrigerant quantity Ch is defined by the controller 208 in the period from after control variable changing operation in the above described test operation mode is performed until the mode is switched to the refrigerant quantity leak detection mode for the first time.

In addition, a process to determine a correction formula is performed by the controller 208 that functions as the state quantity correction formula computing means for defining a function in order to compensate the effects on the degree of superheating $SH_i$ by age-related degradation of the outdoor heat exchanger 223 and the indoor heat exchangers 242 and 252 and weather conditions when detecting whether or not there is a refrigerant leak in the refrigerant leak detection mode.

Then, the current value of the refrigerant quantity Ch is calculated from the current value of the degree of superheating $SH_i$ at the outlet of the outdoor heat exchanger 223 during refrigerant leak detection operation. When the current value is substantially the same as the reference value of the refrigerant quantity Ch (i.e., initial refrigerant quantity) for the reference value of the degree of superheating $SH_i$ (for example, the absolute value of the difference between the refrigerant quantity Ch corresponding to the current value of the degree of superheating $SH_i$ and the initial refrigerant quantity is less than a predetermined value), it is determined that there is no refrigerant leak. Then, the process proceeds to next Step S34 and the operation mode is returned to the normal operation mode.

On the other hand, the current value of the refrigerant quantity Ch is calculated from the current value of the degree of superheating $SH_i$ at the outlets of the indoor heat exchangers 242 and 252 during refrigerant leak detection operation, and when the current value is smaller than the initial refrigerant quantity (for example, the absolute value of the difference between the refrigerant quantity Ch corresponding to the current value of the degree of superheating $SH_i$ and the initial refrigerant quantity is equal to or greater than a predetermined value), it is determined that there is a refrigerant leak. Then, the process proceeds to Step S35 and a warning indicating that a refrigerant leak is detected is displayed on the warning display 209. Subsequently, the process proceeds to Step S34 and the operation mode is returned to the normal operation mode.

Accordingly, it is possible to obtain a result similar to that obtained when the current value of the degree of superheating $SH_i$ is compared with the reference value of the degree of superheating $SH_i$ under conditions substantially the same as those under which different degrees of superheating $SH_i$ which are detected in the air conditioner 201 comprising the outdoor heat exchanger 223 and the indoor heat exchangers 242 and 252 whose coefficients KA remain the same are compared with each other. Consequently, the effect of the fluctuation in the degree of superheating $SH_i$ by age-related degradation can be eliminated.

In this way, the process from Steps S33 to S35 is performed by the controller 208 that functions as the refrigerant leak detection means, which is one of the refrigerant quantity determining means, and which detects whether or not there is a refrigerant leak by determining the adequacy of the refrigerant quantity charged in the refrigerant circuit 210 while performing refrigerant quantity determining operation in the refrigerant leak detection mode. In addition, a part of the process in Step S33 is performed by the controller 208 that functions as the state quantity correcting means for compensating the effect on the degree of superheating $SH_i$ by age-related degradation of the outdoor heat exchanger 223 and the indoor heat exchangers 242 and 252 when detecting whether or not there is a refrigerant leak in the refrigerant leak detection mode.

As described above, in the air conditioner 201 in the present embodiment, the controller 208 functions as the refrigerant quantity determining operation means, the state quantity storing means, the refrigerant quantity determining means, the control variables changing operation means, the state quantity correction formula computing means, and the state quantity correcting means, and thereby configures the refrigerant quantity determining system for determining the adequacy of the refrigerant quantity charged in the refrigerant circuit 210.

(3) Characteristics of the Air Conditioner

The air conditioner 201 in the present embodiment has the following characteristics.

(A)

In the air conditioner 201 in the present embodiment, in the refrigerant quantity determining operation mode, operation (receiver liquid level constant control) is performed in which the liquid level in the receiver 225 is maintained constant based on detected values of the liquid level detection circuits 238 and 239 as the liquid level detecting means. Therefore, a constant quantity of excess refrigerant is maintained in the receiver 225, and at the same time it is possible to cause the effect of a refrigerant leak to appear as a change in the operation state quantity of constituent equipment or the refrigerant flowing in the refrigerant circuit 210 (specifically, the degree of superheating $SH_i$ at the outlets of the indoor heat exchangers 242 and 252), not as the fluctuation in the refrigerant quantity in the receiver 225. Therefore, unlike the conventional case where operation to drain refrigerant from the receiver 225, it is possible to suppress a rapid rise in the discharge temperature Td and the discharge pressure Pd of the compressor 221 in the refrigerant quantity determining operation mode, a rapid drop in the suction pressure Ps and the occurrence of wet compression of the compressor 221.

Note that, in the air conditioner 201 in the present embodiment, the liquid level in the receiver 225 in the refrigerant quantity determining operation mode is controlled to become constant at a liquid level higher (specifically, at a liquid level height between the liquid level height $L_1$ and the liquid level height $L_2$) than the liquid level in the receiver 225 in the normal operation mode (specifically, the liquid level height $L_3$). Therefore, especially, the occurrence of the rapid rise in the discharge temperature Td and the discharge pressure Pd of the compressor 221 can be suppressed.

Accordingly, in the air conditioner 201 in the present embodiment, even when there is an excess refrigerant in the receiver 225, it is possible to determine the adequacy of the refrigerant quantity charged in the air conditioner while maintaining a stable operation of the compressor 221.

(B)

In the air conditioner 201 in the present embodiment, the flow rate of the refrigerant that flows out from the receiver 225 is directly controlled by the indoor expansion valves 241 and 251, and thereby the liquid level in the receiver 225 is controlled. Consequently, relatively high controllability can be achieved and the accuracy for determining the adequacy of the refrigerant quantity charged in the air conditioner can be improved.

(C)

In the air conditioner 201 in the present embodiment, the liquid level in the receiver 225 is detected based on the temperature of the refrigerant measured after the refrigerant is depressurized; specifically, it is detected by disposing the liquid level detection circuits 238 and 239 that determine whether or not the refrigerant is accumulated up to a predetermined position in the receiver 225 (specifically, the liquid level heights $L_1$, $L_2$) by utilizing the difference in the decrease in the temperature at the time of depressurization between the case when the gas refrigerant is depressurized and the case when the liquid refrigerant is depressurized. As is the case with the present embodiment, the liquid level detection circuits 238 and 239 can be realized with a simple configuration comprising the detection tube 239*a* that interconnects the receiver 225 and the suction side of the compressor 221, the solenoid valve 239*b* disposed in the detection tube 239*a*, the capillary tube 239*c* disposed on the downstream side of the solenoid valve 239*b*, and the liquid level detection temperature sensor 239*d* that detects the temperature of the refrigerant on the downstream side of the capillary tube 239*c*, and thus the liquid level can be detected with reliability and low cost.

(D)

In the air conditioner 201 in the present embodiment, the focus is placed on the fluctuation in the coefficients KA of the outdoor heat exchanger 223 and the indoor heat exchangers 242 and 252 according to the degree of age-related degradation that has occurred since the outdoor heat exchanger 223 and the indoor heat exchangers 242 and 252 (i.e., the air conditioner 201) were in a state immediately after being installed on site and started to be used. In other words, the focus is placed on the fluctuations in the correlation between the condensation pressure Pc, which is the refrigerant pressure in the outdoor heat exchanger 223, and the outdoor temperature Ta and in the correlation between the evaporation pressure Pe, which is the refrigerant pressure in the indoor heat exchangers 242 and 252, and the room temperature Tr, which occur along with the fluctuation in the coefficient KA (see FIGS. 10 and 11). Then, by the controller 208 that functions as the refrigerant quantity determining means and the state quantity correcting means, the current value of the refrigerant quantity Ch is expressed as a function of the degree of superheating $SH_i$, the discharge pressure Pd, the outdoor temperature Ta, the suction pressure Ps, and the room temperature Tr, and the current value of the refrigerant quantity Ch is calculated from the current value of the degree of superheating $SH_i$ during refrigerant leak detection operation and the current values of the discharge pressure Pd, the outdoor temperature Ta, the suction pressure Ps and the room temperature Tr during the same operation. In this way, the current refrigerant quantity is compared with the initial refrigerant quantity which serves as a reference value of the refrigerant quantity, and thereby the effect of the fluctuation in the degree of superheating $SH_i$, as the operation state quantity, which is caused by age-related degradation, can be eliminated. Accordingly, in this air conditioner 201, even if the outdoor heat exchanger 223 and the indoor heat exchangers 242 and 252 are degraded due to aging, it is possible to accurately determine the adequacy of the refrigerant quantity charged in the air conditioner, i.e., whether or not there is a refrigerant leak.

In addition, the coefficient KA of the outdoor heat exchanger 223 may fluctuate due to fluctuation in weather conditions such as rain, heavy gale, etc. As is the case with age-related degradation, fluctuation in weather conditions causes fluctuation in the correlation between the condensation pressure Pc that is the refrigerant pressure in the outdoor heat exchanger 223, and the outdoor temperature Ta, along with the fluctuation in the coefficient KA. As a result, the effect of the fluctuation in the degree of superheating $SH_i$ in such a case can also be eliminated.

(E)

In the air conditioner 201 in the present embodiment, during test operation after installment of the air conditioner 201, the controller 208 that functions as the state quantity storing means stores the operation state quantity (specifically, the reference values of the degree of superheating $SH_i$, the discharge pressure Pd, the outdoor temperature Ta, the suction pressure Ps, and the room temperature Tr) in a state after the refrigerant is charged up to the initial refrigerant quantity by on-site refrigerant charging, and compares such operation state quantity as a reference value with the current value of the operation state quantity during refrigerant leak detection mode in order to determine the adequacy of the refrigerant quantity, i.e., whether or not there is a refrigerant leak. Therefore, the refrigerant quantity that has actually been charged in the air conditioner, i.e., the initial refrigerant quantity can be compared with the current refrigerant quantity during refrigerant leak detection.

Accordingly, in this air conditioner 201, even when the prescribed refrigerant quantity specified in advance before refrigerant is charged is inconsistent with the initial refrigerant quantity charged on site or even when the reference value of the operation state quantity (specifically, the degree of superheating $SH_i$) used for determining the adequacy of the refrigerant quantity fluctuates depending on the pipe length of the refrigerant communication pipes 206 and 207, combination of the plurality of indoor units 204 and 205, and the difference in the installation height among the units 202, 204, and 205, it is possible to accurately determine the adequacy of the refrigerant quantity charged in the air conditioner.

(F)

In the air conditioner 201 in the present embodiment, not only the operation state quantity in a state after the refrigerant is charged up to the initial refrigerant quantity (specifically, the reference values of the degree of superheating $SH_t$, the discharge pressure Pd, the outdoor temperature Ta, the suction pressure Ps, and the room temperature Tr) but also the control variables of constituent equipment of the air conditioner 201 such as the outdoor fan 227 and the indoor fans 243 and 253 are changed. In this way, an operation to simulate operating conditions different from those during test operation is performed, and the operation state quantity during this operation can be stored in the controller 208 that functions as the state quantity storing means.

Accordingly, in the air conditioner 201, based on the data of the operation state quantity during operation with the control variables of constituent equipment such as the outdoor fan 227, the indoor fans 243 and 253, and the like changed, a correlation and a correction formula and the like of various values of the operation state quantity for the different operating conditions, such as when the outdoor heat exchanger 223 and the indoor heat exchangers 242 and 252 are degraded due to aging, are determined. Using such a correlation and a correction formula, it is possible to compensate differences in the operating conditions when comparing the reference value of the operation state quantity during test operation with the current value of the operation state quantity. In this way, in this air conditioner 201, based on the data of the operation state quantity during operation with the control variables of constituent equipment changed, it is possible to compensate differences in the operating conditions when comparing the reference value of the operation state quantity during test operation with the current value of the operation state quantity. Therefore, the accuracy for determining the adequacy of the refrigerant quantity charged in the air conditioner can be further improved.

(4) Alternative Embodiment

Also for the air conditioner 201 in the present embodiment, as is the case with the alternative embodiment 9 in the first embodiment, the refrigerant quantity determining system may be configured by achieving a connection between the air conditioner 201 and the local controller as the management device to manage each constituent equipment of the air conditioner 201 and obtain the operation data, connecting the local controller via a network to a remote server of an information management center that receives the operation data of the air conditioner 201, and connecting a memory device such as a disk device as the state quantity storing means to the remote server.

Fourth Embodiment

A fourth embodiment of an air conditioner according to the present invention is described below with reference to the drawings.

(1) Configuration of the Air Conditioner

Figure 31:
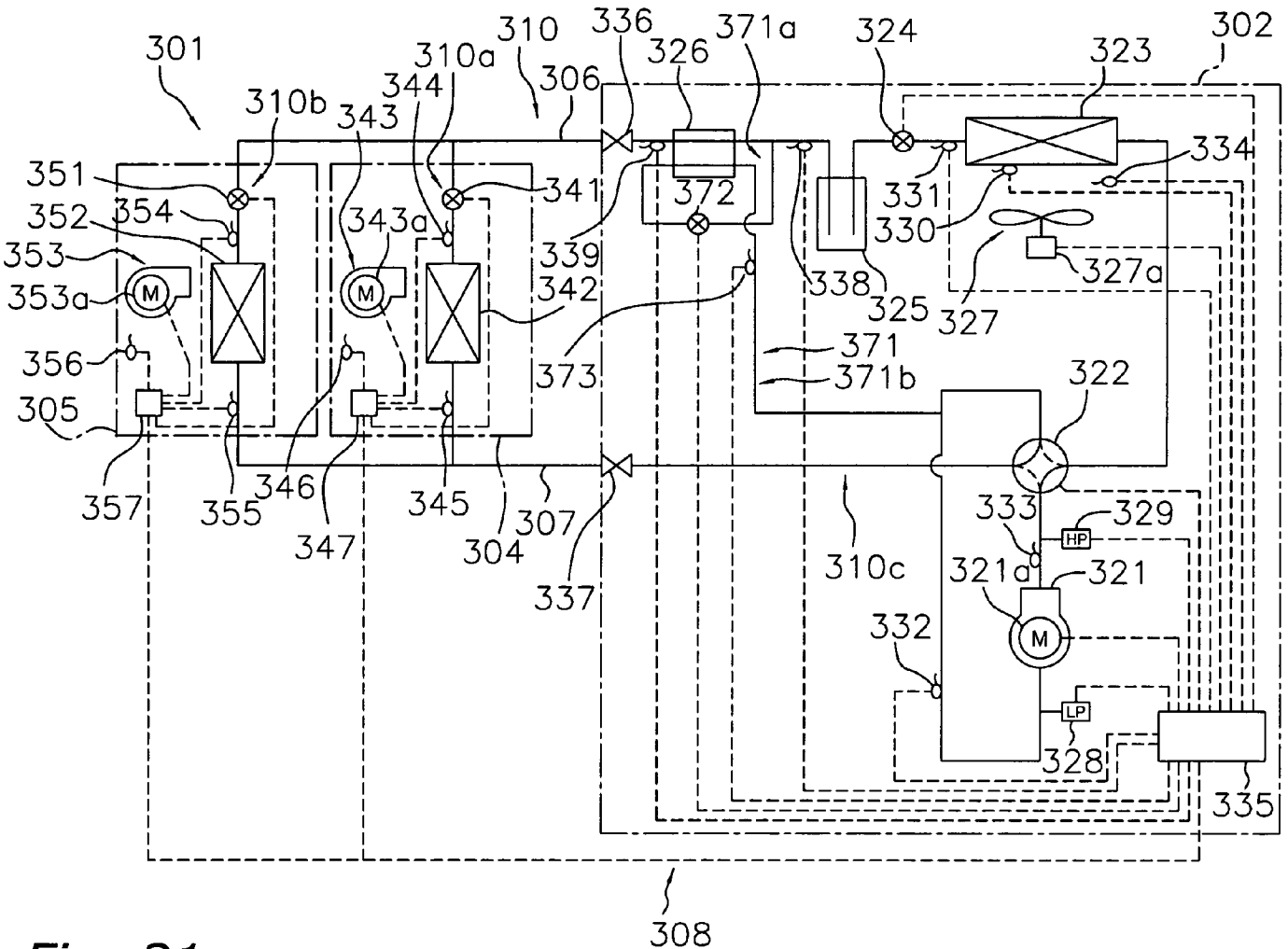
FIG. 31 is a schematic refrigerant circuit diagram of an air conditioner in which a refrigerant quantity determining system according to a fourth embodiment of the present invention is employed.

FIG. 31 is a schematic refrigerant circuit diagram of an air conditioner 301 according to an embodiment of the present invention. The air conditioner 301 is a device that is used to cool and heat the inside of a building and the like by performing a vapor compression-type refrigeration cycle operation. The air conditioner 301 mainly comprises one outdoor unit 302 as a heat source unit, a plurality of (two in the present embodiment) indoor units 304 and 305 as utilization units connected in parallel thereto, and a liquid refrigerant communication pipe 306 and a gas refrigerant communication pipe 307 as refrigerant communication pipes which interconnect the outdoor unit 302 and the indoor units 304 and 305. In other words, a vapor compression-type refrigerant circuit 310 of the air conditioner 301 in the present embodiment is configured by the interconnection of the outdoor unit 302, the indoor units 304 and 305, and the liquid refrigerant communication pipe 306 and the gas refrigerant communication pipe 307.

<Indoor Unit>

The indoor units 304 and 305 are installed by being embedded in or hung from a ceiling inside the building and the like or by being mounted on a wall surface inside a room. The indoor units 304 and 305 are connected to the outdoor door unit 302 via the liquid refrigerant communication pipe 306 and the gas refrigerant communication pipe 307, and configure a part of the refrigerant circuit 310.

Next, the configurations of the indoor units 304 and 305 are described. Note that, since the indoor units 304 and 305 have the same configuration, only the configuration of the indoor unit 304 is described here, and in regard to the configuration of the indoor unit 305, reference numerals in the 350s are used instead of reference numerals in the 340s representing the respective portions of the indoor unit 304, and description of those respective portions are omitted.

<Outdoor Unit>

The outdoor unit 302 is installed on the roof or the like of a building and the like, is connected to the indoor units 304 and 305 via the liquid refrigerant communication pipe 306 and the gas refrigerant communication pipe 307, and configures the refrigerant circuit 310 with the indoor units 304 and 305.

Next, the configuration of the outdoor unit 302 is described. The outdoor unit 302 mainly comprises an outdoor side refrigerant circuit 310*c* that configures a part of the refrigerant circuit 310. The outdoor side refrigerant circuit 310*c* mainly comprises a compressor 321, a four-way switching valve 322, an outdoor heat exchanger 323 as a heat source side heat exchanger, an outdoor expansion valve 324 as a heat source side expansion valve, a receiver 325, a subcooler 326, a liquid side stop valve 336, and a gas side stop valve 337. Here, since the compressor 321, the four-way switching valve 322, and the outdoor heat exchanger 323 are the same as the compressor 21, the four-way switching valve 22, and the outdoor heat exchanger 23 that constitute the outdoor unit 2 in the first embodiment, descriptions thereof will be omitted.

In the present embodiment, the outdoor unit 302 comprises an outdoor fan 327 for taking in outdoor air into the unit, supplying the outdoor air to the outdoor heat exchanger 323, and then exhausting the air to the outside, and is capable of performing heat exchange between the outdoor air and the refrigerant flowing in the outdoor heat exchanger 323. The outdoor fan 327 is a fan capable of varying the flow rate of the air it supplies to the outdoor heat exchanger 323, and in the present embodiment, is a propeller fan, which is driven by a motor 327*a* comprising a DC fan motor.

In the present embodiment, the outdoor expansion valve 324 is an electrically powered expansion valve connected to a liquid side of the outdoor heat exchanger 323 in order to adjust the flow rate or the like of the refrigerant flowing in the indoor outdoor side refrigerant circuit 310*a*.

The receiver 325 is connected between the outdoor expansion valve 324 and the liquid side stop valve 336, and is a container capable of accumulating excess refrigerant generated in the refrigerant circuit 310 depending on the operation loads of the indoor units 304 and 305.

In the present embodiment, the subcooler 326 is a double tube heat exchanger, and is disposed to cool the refrigerant sent to indoor expansion valves 341 and 351 after refrigerant is condensed in the outdoor heat exchanger 323 and temporarily accumulated in the receiver 325. In the present embodiment, the subcooler 326 is connected between the receiver 325 and the liquid side stop valve 336.

In the present embodiment, a bypass refrigerant circuit 371 is disposed as a cooling source of the subcooler 326. Note that, in the description below, a portion corresponding to the refrigerant circuit 310 excluding the bypass refrigerant circuit 371 is referred to as a main refrigerant circuit for convenience sake.

The bypass refrigerant circuit 371 is connected to the main refrigerant circuit so as to cause a portion of the refrigerant sent from the outdoor heat exchanger 323 to indoor heat exchangers 342 and 352 to branch from the main refrigerant circuit and return to a suction side of the compressor 321. Specifically, the bypass refrigerant circuit 371 has a branch circuit 371*a* connected to an outlet of the receiver 325 and an inlet on a bypass refrigerant circuit side of the subcooler 326, and a merging circuit 371*b* connected to the suction side of the compressor 321 so as to return the refrigerant from an outlet on the bypass refrigerant circuit side of the subcooler 326 to the suction side of the compressor 321. Further, the branch circuit 371*a* is disposed with a bypass side refrigerant flow rate adjusting valve 372 for adjusting the flow rate of the refrigerant flowing in the bypass refrigerant circuit 371. Here, the bypass side refrigerant flow rate adjusting valve 372 is a motor-operated expansion valve for adjusting the flow rate of the refrigerant to be flowed to the subcooler 326. In this way, the refrigerant flowing in the main refrigerant circuit is cooled in the subcooler 326 by the refrigerant returned to the suction side of the compressor 321 from an outlet of the bypass side refrigerant flow rate adjusting valve 372.

The liquid side stop valve 336 and the gas side stop valve 337 are valves disposed at ports connected to external equipment and pipes (specifically, the liquid refrigerant communication pipe 306 and the gas refrigerant communication pipe 307). The liquid side stop valve 336 is connected to the subcooler 326. The gas side stop valve 337 is connected to the four-way switching valve 322.

Figure 32:
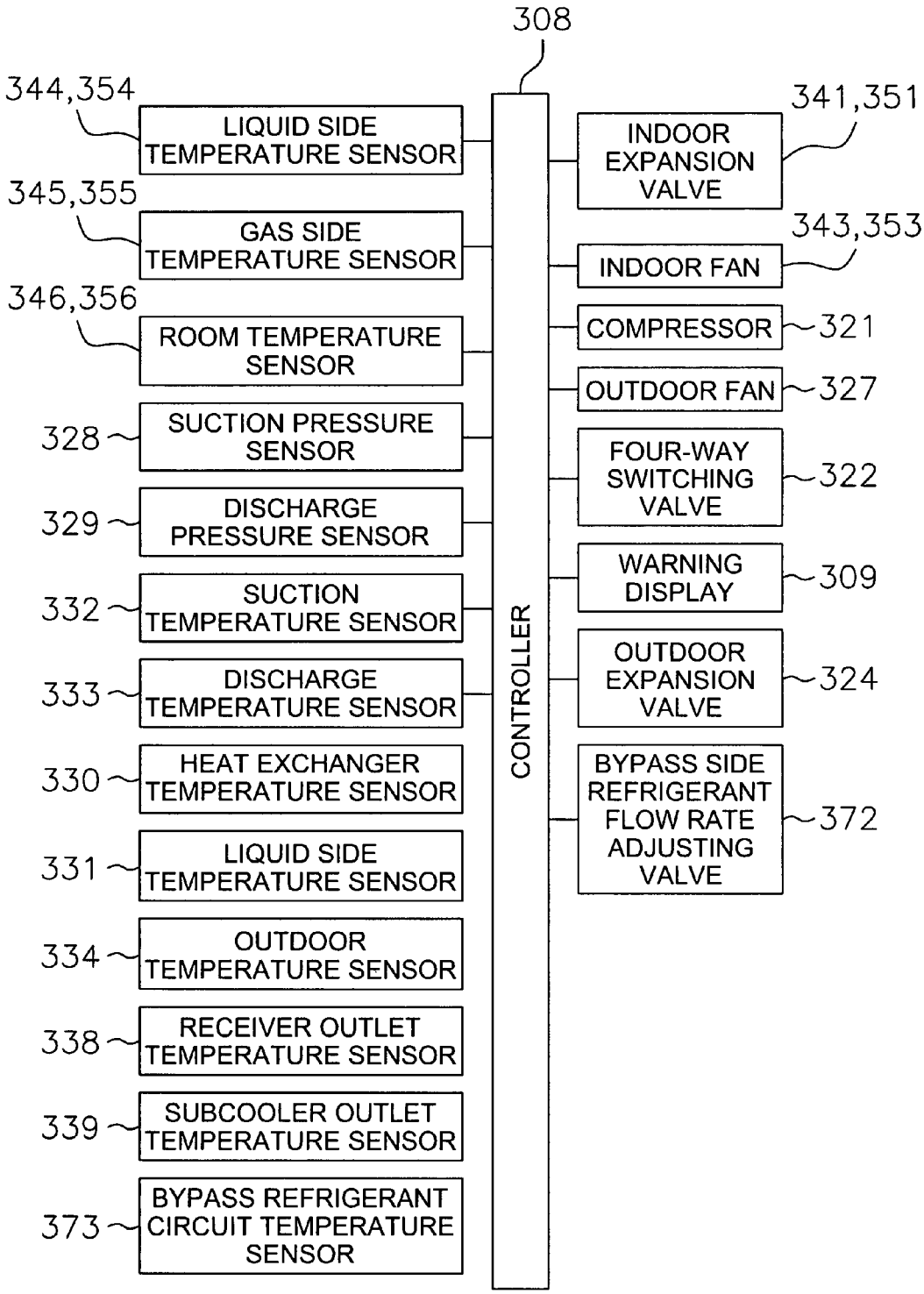
FIG. 32 is a control block diagram of the air conditioner.

In addition, various types of sensors are disposed in the outdoor unit 302. Specifically, disposed in the outdoor unit 302 are an suction pressure sensor 328 that detects the suction pressure Ps of the compressor 321, a discharge pressure sensor 329 that detects the discharge pressure Pd of the compressor 321, a suction temperature sensor 332 that detects the suction temperature Ts of the compressor 321, and a discharge temperature sensor 333 that detects the discharge temperature Td of the compressor 321. A heat exchanger temperature sensor 330 that detects the temperature of the refrigerant flowing in the outdoor heat exchanger 323 (i.e., the refrigerant temperature corresponding to the condensation temperature Tc during cooling operation or the evaporation temperature Te during heating operation) is disposed in the outdoor heat exchanger 323. A liquid side temperature sensor 331 that detects the temperature of the refrigerant in a liquid state or gas-liquid two-phase state is disposed at the liquid side of the outdoor heat exchanger 323. A receiver outlet temperature sensor 338 that detects the temperature of the refrigerant in a liquid state or gas-liquid two-phase state is disposed at the outlet of the receiver 325. A subcooler outlet temperature sensor 339 that detects the temperature of the refrigerant in a liquid state or gas-liquid two-phase state is disposed at the outlet on the main refrigerant circuit side of the subcooler 326. The merging circuit 371*b* of the bypass refrigerant circuit 371 is disposed with a bypass refrigerant circuit temperature sensor 373 for detecting the degree of superheating of the refrigerant flowing at the outlet on the bypass refrigerant circuit side of the subcooler 326. An outdoor temperature sensor 334 that detects the temperature of the outdoor air that flows into the unit (i.e., the outdoor temperature Ta) is disposed at an outdoor air intake side of the outdoor unit 302. In addition, the outdoor unit 302 comprises an outdoor side controller 335 that controls the operation of each portion constituting the outdoor unit 302. Additionally, the outdoor side controller 335 includes a microcomputer and a memory disposed in order to control the outdoor unit 302, an inverter circuit that controls the motor 321*a*, and the like, and is configured such that it can exchange control signals and the like with the indoor side controllers 347 and 357 of the indoor units 304 and 305. In other words, a controller 308 that performs operation control of the entire air conditioner 301 is configured by the indoor side controllers 347 and 357 and the outdoor side controller 335. As shown in FIG. 32, the controller 308 is connected so as to be able to receive detection signals of sensors 329 to 334, 338, 339, 344 to 346, 354 to 356, and 373, and to be able to control various equipment and valves 321, 322, 324, 327*a*, 341, 343*a*, 351, 353*a*, and 372 based on these detection signals. In addition, a warning display 309 comprising LEDs and the like, which is configured to indicate that a refrigerant leak is detected during the below described refrigerant leak detection mode, is connected to the controller 308. Here, FIG. 32 is a control block diagram of the air conditioner 301.

As described above, the refrigerant circuit 310 of the air conditioner 301 is configured by the interconnection of the indoor side refrigerant circuits 310*a* and 310*b*, the outdoor side refrigerant circuit 310*c*, and the refrigerant communication pipes 306 and 307. It can also be said that the refrigerant circuit 310 comprises the bypass refrigerant circuit 371 and the main refrigerant circuit excluding the bypass refrigerant circuit 371. Further, with the controller 308 comprising the indoor side controllers 347 and 357 and the outdoor side controller 335, the air conditioner 301 in the present embodiment is configured to switch and operate between cooling operation and heating operation by the four-way switching valve 322 and control each equipment of the outdoor unit 302 and the indoor units 304 and 305 depending on the operation load of each of the indoor units 304 and 305.

(2) Operation of the Air Conditioner

Next, the operation of the air conditioner 301 in the present embodiment is described.

The operation modes of the air conditioner 301 in the present embodiment include: a normal operation mode where control of each equipment of the outdoor unit 302 and the indoor units 304 and 305 is performed depending on the operation load of each of the indoor units 304 and 305; a test operation mode where test operation to be performed after installment of the air conditioner 301 is performed; and a refrigerant leak detection mode where, after test operation is finished and normal operation has started, whether or not the refrigerant quantity charged in the refrigerant circuit 310 is adequate is determined by detecting the degree of superheating of the refrigerant at outlets of the indoor heat exchangers 342 and 352 that function as evaporators while causing the indoor units 304 and 305 to perform cooling operation. The normal operation mode mainly includes cooling operation and heating operation. In addition, the test operation mode includes automatic refrigerant charging operation and control variables changing operation.

Operation in each operation mode of the air conditioner 301 is described below.

<Normal Operation Mode>

First, cooling operation in the normal operation mode is described with reference to FIGS. 31 and 32.

During cooling operation, the four-way switching valve 322 is in the state represented by the solid lines in FIG. 31, i.e., a state where a discharge side of the compressor 321 is connected to a gas side of the outdoor heat exchanger 323 and also the suction side of the compressor 321 is connected to gas sides of the indoor heat exchangers 342 and 352. In addition, the outdoor expansion valve 324, the liquid side stop valve 336 and the gas side stop valve 337 are opened and the bypass side refrigerant flow rate adjusting valve 372 is closed. Accordingly, the subcooler 326 is in a state where heat exchange between the refrigerant flowing in the main refrigerant circuit and the refrigerant flowing in the bypass refrigerant circuit 371 is not performed. Further, the opening degree of the indoor expansion valves 341 and 351 is adjusted such that the degree of superheating of the refrigerant at the outlets of the indoor heat exchangers 342 and 352 becomes a predetermined value. In the present embodiment, the degree of superheating of the refrigerant at the outlets of the indoor heat exchangers 342 and 352 is detected by subtracting a refrigerant temperature value detected by the liquid side temperature sensors 344 and 354 from a refrigerant temperature value detected by the gas side temperature sensors 345 and 355, or is detected by converting the suction pressure Ps of the compressor 321 detected by the suction pressure sensor 328 to a saturated temperature value corresponding to the evaporation temperature Te, and subtracting this saturated temperature value of the refrigerant from a refrigerant temperature value detected by the gas side temperature sensors 345 and 355. Note that, although it is not employed in the present embodiment, the degree of superheating of the refrigerant at the outlets of indoor heat exchangers 342 and 352 may be detected by subtracting a refrigerant temperature value, which corresponds to the evaporation temperature Te, detected by the liquid side temperature sensors 344 and 354 from a refrigerant temperature value detected by the gas side temperature sensors 345, 355; or a temperature sensor that detects the temperature of the refrigerant flowing in the indoor heat exchangers 342 and 352 may be disposed such that the degree of superheating of the refrigerant at the outlets of the indoor heat exchangers 342 and 352 is detected by subtracting the refrigerant temperature value corresponding to the evaporation temperature Te which is detected by this temperature sensor from a refrigerant temperature value detected by the gas side temperature sensors 345 and 355.

When the compressor 321, the outdoor fan 327, the indoor fans 343 and 353 are started in this state of the refrigerant circuit 310, low-pressure gas refrigerant is sucked into the compressor 321 and compressed into high-pressure gas refrigerant. Subsequently, the high-pressure gas refrigerant is sent to the outdoor heat exchanger 323 via the four-way switching valve 322, exchanges heat with the outdoor air supplied by the outdoor fan 327, and is condensed into high-pressure liquid refrigerant.

Then, this high-pressure liquid refrigerant is sent to the receiver 325 via the outdoor expansion valve 324, temporarily accumulated in the receiver 325, and sent to the indoor units 304 and 305 via the subcooler 326, the liquid side stop valve 336 and the liquid refrigerant communication pipe 306. Here, as for inside the receiver 325, when excess refrigerant is generated in the refrigerant circuit 310 depending on the operation loads of the indoor units 304 and 305, for example, such as when the operation load of one of the indoor units 304 and 305 is small or one of them is stopped or when the operation loads of both of the indoor units 304 and 305 are small, the excess refrigerant is accumulated in the receiver 325.

The high-pressure liquid refrigerant sent to the indoor units 304 and 305 is depressurized by the indoor expansion valves 341 and 351, becomes refrigerant in a low-pressure gas-liquid two-phase state, is sent to the indoor heat exchangers 342 and 352, exchanges heat with the room air in the indoor heat exchangers 342 and 352, and is evaporated into low-pressure gas refrigerant. Here, the indoor expansion valves 341 and 351 control the flow rate of the refrigerant flowing in the indoor heat exchangers 342 and 352 such that the degree of superheating at the outlets of the indoor heat exchangers 342 and 352 becomes a predetermined value. Consequently, the low-pressure gas refrigerant evaporated in the indoor heat exchangers 342 and 352 is in a state of having a predetermined degree of superheating. In this way, the refrigerant whose flow rate corresponds to the operation loads required for the air-conditioned space where each the indoor units 304 and 305 is installed flows in each of the indoor heat exchangers 342 and 352.

This low-pressure gas refrigerant is sent to the outdoor unit 302 via the gas refrigerant communication pipe 307 and is again sucked into the compressor 321 via the gas side stop valve 337 and the four-way switching valve 322.

Next, heating operation in the normal operation mode is described.

During heating operation, the four-way switching valve 322 is in the state represented by the dotted lines in FIG. 31, i.e., a state where the discharge side of the compressor 321 is connected to the gas sides of the indoor heat exchangers 342 and 352 and also the suction side of the compressor 321 is connected to the gas side of the outdoor heat exchanger 323. In addition, the outdoor expansion valve 324, the liquid side stop valve 336 and the gas side stop valve 337 are opened, and the bypass side refrigerant flow rate adjusting valve 372 is closed. Accordingly, the subcooler 326 is in a state where heat exchange between the refrigerant flowing in the main refrigerant circuit and the refrigerant flowing in the bypass refrigerant circuit 371 is not performed. Further, the opening degree of the indoor expansion valves 341 and 351 is adjusted such that the degree of subcooling of the refrigerant at the outlets of the indoor heat exchangers 342 and 352 becomes a predetermined value. In the present embodiment, the degree of subcooling of the refrigerant at the outlets of the indoor heat exchangers 342 and 352 is detected by converting the discharge pressure Pd of the compressor 321 detected by the discharge pressure sensor 329 to a saturated temperature value corresponding to the condensation temperature Tc, and subtracting a refrigerant temperature value detected by the liquid side temperature sensors 344 and 354 from this saturated temperature value of the refrigerant. Although it is not employed in the present embodiment, a temperature sensor that detects the temperature of the refrigerant flowing in the indoor heat exchangers 342 and 352 may be disposed such that the degree of subcooling of the refrigerant at the outlets of the indoor heat exchangers 342 and 352 is detected by subtracting a refrigerant temperature value corresponding to the condensation temperature Tc which is detected by this temperature sensor from a refrigerant temperature value detected by the liquid side temperature sensors 344 and 354.

When the compressor 321, the outdoor fan 327, and the indoor fans 343 and 353 are started in this state of the refrigerant circuit 310, low-pressure gas refrigerant is sucked into the compressor 321, compressed into high-pressure gas refrigerant, and sent to the indoor units 304 and 305 via the four-way switching valve 322, the gas side stop valve 337, and the gas refrigerant communication pipe 307.

Then, the high-pressure gas refrigerant sent to the indoor units 304 and 305 exchanges heat with the room air in the indoor heat exchangers 342 and 352 and is condensed into high-pressure liquid refrigerant. Subsequently, it is depressurized by the indoor expansion valves 341 and 351 and becomes refrigerant in a low-pressure gas-liquid two-phase state. Here, the indoor expansion valves 341 and 351 control the flow rate of the refrigerant flowing in the indoor heat exchangers 342 and 352 such that the degree of subcooling at the outlets of the indoor heat exchangers 342 and 352 becomes a predetermined value. Consequently, the high-pressure liquid refrigerant condensed in the indoor heat exchangers 342 and 352 is in a state of having a predetermined degree of subcooling. In this way, the refrigerant whose flow rate corresponds to the operation loads required for the air-conditioned space where each of the indoor units 304 and 305 is installed flows in each of the indoor heat exchangers 342 and 352.

This refrigerant in a low-pressure gas-liquid two-phase state is sent to the outdoor unit 302 via the liquid refrigerant communication pipe 306 and flows into the receiver 325 via the liquid side stop valve 336 and the subcooler 326. The refrigerant that flowed into receiver 325 is temporarily accumulated in the receiver 325, and subsequently flows into the outdoor heat exchanger 323 via the outdoor expansion valve 324. Here, as for inside the receiver 325, when excess refrigerant is generated in the refrigerant circuit 310 depending on the operation loads of the indoor units 304 and 305, for example, such as when the operation load of one of the indoor units 304 and 305 is small or one of them is stopped or when the operation loads of both of the indoor units 304 and 305 are small, the excess refrigerant is accumulated in the receiver 325. Then, the refrigerant in a low-pressure gas-liquid two-phase state flowing into the outdoor heat exchanger 323 exchanges heat with the outdoor air supplied by the outdoor fan 327, is condensed into low-pressure gas refrigerant, and is again sucked into the compressor 321 via the four-way switching valve 322.

In this way, the normal operation process that includes the above described cooling operation and heating operation is performed by the controller 308 that functions as a normal operation controlling means for performing normal operation that includes cooling operation and heating operation.

<Test Operation Mode>

Next, the test operation mode is described with reference to FIGS. 31, 32, and 3. In the present embodiment, in the test operation mode, as is the case with the first embodiment, automatic refrigerant charging operation in Step S1 is first performed. Subsequently, control variables changing operation in Step S2 is performed.

In the present embodiment, an example of a case is described where, the outdoor unit 302 in which a prescribed refrigerant quantity is charged in advance and the indoor units 304 and 305 are installed and interconnected via the liquid refrigerant communication pipe 306 and the gas refrigerant communication pipe 307 to configure the refrigerant circuit 310 on site, and subsequently additional refrigerant is charged in the refrigerant circuit 310 whose refrigerant quantity is insufficient depending on the lengths of the liquid refrigerant communication pipe 306 and the gas refrigerant communication pipe 307.

<Step S1: Automatic Refrigerant Charging Operation>

First, the liquid side stop valve 336 and the gas side stop valve 337 of the outdoor unit 302 are opened and the refrigerant circuit 310 is filled with the refrigerant that is charged in the outdoor unit 302 in advance.

Next, when a person performing test operation issues a command to start test operation directly to the controller 308 or remotely by a remote controller (not shown) and the like, the controller 308 starts the process from Step S11 to Step S13 shown in FIG. 4, as is the case with the first embodiment.

<Step S11: Refrigerant Quantity Determining Operation>

When a command to start automatic refrigerant charging operation is issued, the refrigerant circuit 310, with the four-way switching valve 322 of the outdoor unit 302 in the state represented by the solid lines in FIG. 31, becomes a state where the indoor expansion valves 341 and 351 of the indoor units 304 and 305 are opened, the compressor 321, the outdoor fan 327, and the indoor fans 343 and 353 are started, and cooling operation is forcibly performed in regard to all of the indoor units 304 and 305 (hereinafter referred to as "all indoor unit operation").

Consequently, in the refrigerant circuit 310, the high-pressure gas refrigerant that has been compressed and discharged in the compressor 321 flows along a flow path from the compressor 321 to the outdoor heat exchanger 323 that functions as a condenser, the high-pressure refrigerant that undergoes phase-change from a gas state to a liquid state by heat exchange with the outdoor air flows into the outdoor heat exchanger 323 that functions as a condenser, the high-pressure liquid refrigerant flows along a flow path from the outdoor heat exchanger 323 to the indoor expansion valves 341 and 351 including the receiver 325 and the liquid refrigerant communication pipe 306, the low-pressure refrigerant that undergoes phase-change from a gas-liquid two-phase state to a gas state by heat exchange with the room air flows into the indoor heat exchangers 342 and 352 that function as evaporators, and the low-pressure gas refrigerant flows along a flow path from the indoor heat exchangers 342 and 352 to the compressor 321 including the gas refrigerant communication pipe 307.

Next, equipment control as described below is performed to proceed to operation to stabilize the state of the refrigerant circulating in the refrigerant circuit 310. Specifically, the motor 321*a* of the compressor 321 is controlled such that the rotation frequency f becomes constant at a predetermined value (compressor rotation frequency constant control), and the control is performed such that the refrigerant at the outlet on the main refrigerant circuit side of the receiver 325 becomes subcooled ("receiver outlet refrigerant subcooling control"). Here, the reason to perform the rotation frequency constant control is to stabilize the flow rate of the refrigerant sucked into and discharged from the compressor 321. In addition, the reason to perform the subcooling control is to seal the portion from the subcooler 326 to the indoor expansion valves 341 and 351 via the liquid refrigerant communication pipe 306 with liquid refrigerant; to maintain conditions in which the refrigerant quantity in the refrigerant circuit 310 becomes maximum; and to cause the fluctuation in the quality of wet vapor of the refrigerant at the outlet on the main refrigerant circuit side of the receiver 325 due to the fluctuation in the refrigerant quantity to appear as a fluctuation in the operation state quantity which fluctuates according to the fluctuation in the degree of subcooling $SC_s$ and the degree of subcooling $SC_s$.

Further, when the refrigerant pressure in the outdoor heat exchanger 323, i.e., the condensation pressure Pc of the refrigerant (which corresponds to the discharge pressure Pd in the compressor 321) is lower than a predetermined value, the control to increase the refrigerant pressure in the outdoor heat exchanger 323 (condensation pressure control) is performed, according to need, by controlling the flow rate of air by the outdoor fan 327 which is supplied to the outdoor heat exchanger 323. Here, the reason to perform the condensation pressure control is to create conditions in which heat is sufficiently exchanged between the refrigerant at the main refrigerant circuit side and the refrigerant at the bypass refrigerant circuit side of the subcooler 326.

Consequently, in the refrigerant circuit 310, the state of the refrigerant circulating in the refrigerant circuit 310 becomes stabilized, and the refrigerant quantity in equipment other than the outdoor heat exchanger 323 and in the pipes becomes maintained substantially constant. Therefore, when refrigerant charging in the refrigerant circuit 310 starts by additional refrigerant charging, which is performed subsequently, it is possible to create a state where the operation state quantity such as the degree of subcooling $SC_s$ of the refrigerant at the outlet on the main refrigerant circuit side of the subcooler 326 changes according to a change in the refrigerant quantity (hereinafter this operation is referred to as "refrigerant quantity determining operation").

Here, the above mentioned receiver outlet refrigerant subcooling control is described.

First, when a command to start refrigerant quantity determining operation is issued, the bypass side refrigerant flow rate adjusting valve 372 is opened. Consequently, a flow is formed in which a portion of the refrigerant flowing from the receiver 325 toward the subcooler 326 is branched from the main refrigerant circuit and returned to the suction side of the compressor 321 via the bypass refrigerant circuit 371 while its flow rate is adjusted by the bypass side refrigerant flow rate adjusting valve 372. Here, the refrigerant that passes through the bypass side refrigerant flow rate adjusting valve 372 is depressurized close to the suction pressure Ps of the compressor 321, and thereby a portion thereof evaporates and becomes a gas-liquid two-phase state. Then, the refrigerant in a gas-liquid two-phase state that flows from the outlet of a bypass side refrigerant flow rate adjusting valve 72 of the bypass refrigerant circuit 371 toward the suction side of the compressor 321 will exchange heat with the refrigerant flowing on the main refrigerant circuit side of the subcooler 326, which is sent from the outdoor heat exchanger 323 to the indoor heat exchangers 342 and 352, when passing through the bypass refrigerant circuit side of the subcooler 326.

Here, the opening degree of the bypass side refrigerant flow rate adjusting valve 372 is adjusted such that the degree of superheating $SH_b$ of the refrigerant at the outlet on the bypass refrigerant circuit side of the subcooler 326 becomes a predetermined value. In the present embodiment, the degree of superheating $SH_b$ of the refrigerant at the outlet on the bypass refrigerant circuit side of the subcooler 326 is detected by converting the suction pressure Ps of the compressor 321 detected by the suction pressure sensor 328 to a saturated temperature value corresponding to the evaporation temperature Te, and subtracting this refrigerant saturation temperature value from a refrigerant temperature value detected by the bypass refrigerant circuit temperature sensor 373. Note that, although it is not employed in the present embodiment, a temperature sensor may be separately disposed at an inlet on the bypass refrigerant circuit side of the subcooler 326 such that the degree of superheating $SH_b$ of the refrigerant at the outlet on the bypass refrigerant circuit side of the subcooler 326 is detected by subtracting a refrigerant temperature value detected by this temperature sensor from a refrigerant temperature value detected by the bypass refrigerant circuit temperature sensor 373. Consequently, the refrigerant that flows in the bypass refrigerant circuit 371 is returned to the suction side of the compressor 321 after passing through the subcooler 326 and then being heated such that the degree of superheating $SH_b$ becomes a predetermined value.

Consequently, the refrigerant that flows on the main refrigerant circuit side of the subcooler 326 from the outlet of the receiver 325 becomes subcooled as a result of heat exchange with the refrigerant that flows on the bypass refrigerant circuit 371 side, and therefore the subcooled refrigerant will flow between the subcooler 326 and the indoor expansion valves 341 and 351 via the refrigerant communication pipe 306.

In this way, the process in Step S11 is performed by the controller 308 that functions as the refrigerant quantity determining operation controlling means for performing refrigerant quantity determining operation including all indoor unit operation, compressor rotation frequency constant control, and receiver outlet refrigerant subcooling control (condensation pressure control according to need).

Note that, unlike the present embodiment, when refrigerant is not charged in advance in the outdoor unit 302, it is necessary prior to Step S11 to charge refrigerant until the refrigerant quantity reaches a level where refrigerating cycle operation can be performed.

<Step S12: Operation Data Storing During Refrigerant Charging>

Next, additional refrigerant is charged into the refrigerant circuit 310 while performing the above described refrigerant quantity determining operation. At this time, in Step S12, the operation state quantity of constituent equipment or the refrigerant flowing in the refrigerant circuit 310 during additional refrigerant charging is obtained as the operation data and stored in the memory of the controller 308. In the present embodiment, the degree of subcooling $SC_s$ at the outlet on the main refrigerant circuit side of the subcooler 326, the outdoor temperature Ta, the room temperature Tr, the discharge pressure Pd, and the suction pressure Ps are stored in the memory of the controller 308 as the operation data during refrigerant charging.

This Step S12 is repeated until the condition for determining the adequacy of the refrigerant quantity in the below described Step S13 is satisfied. Therefore, in the period from the start to the completion of additional refrigerant charging, the above described operation state quantity during refrigerant charging is stored, as the operation data during refrigerant charging, in the memory of the controller 308. Note that, as for the operation data stored in the controller 308, appropriately thinned-out operation data may be stored. For example, for the operation data in the period from the start to the completion of additional refrigerant charging, the degree of subcooling $SC_s$ may be stored at each appropriate temperature interval and also a different value of the operation state quantity that corresponds to these degrees of subcooling $SC_s$ may be stored.

In this way, the process in Step S12 is performed by the controller 308 that functions as the state quantity storing means for storing as the operation data of the operation state quantity of constituent equipment or the refrigerant flowing in the refrigerant circuit 310 during the operation that involves refrigerant charging. Therefore, it is possible to obtain, as the operation data, the operation state quantity in a state where refrigerant with less quantity than the refrigerant quantity after additional refrigerant charging is completed (hereinafter referred to as the initial refrigerant quantity) is charged in the refrigerant circuit 310.

<Step S13: Determination of the Adequacy of the Refrigerant Quantity>

Figure 33:
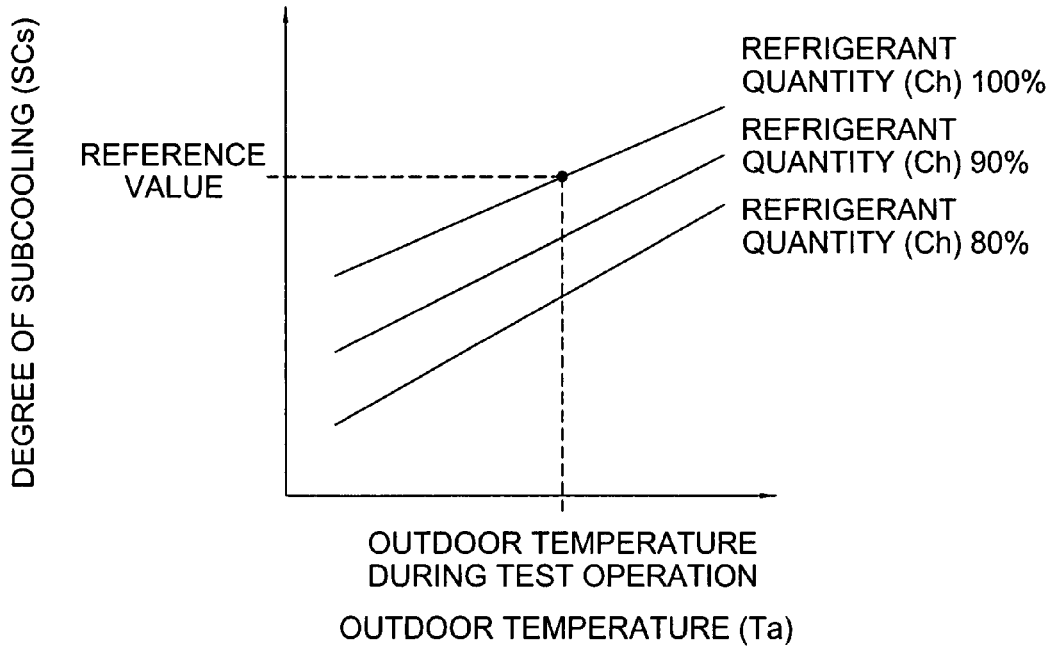
FIG. 33 is a graph to show a relationship between the degree of subcooling at an outlet on a main refrigerant circuit side of a subcooler, and the outdoor temperature and the refrigerant quantity during a refrigerant quantity determining operation.
Figure 34:
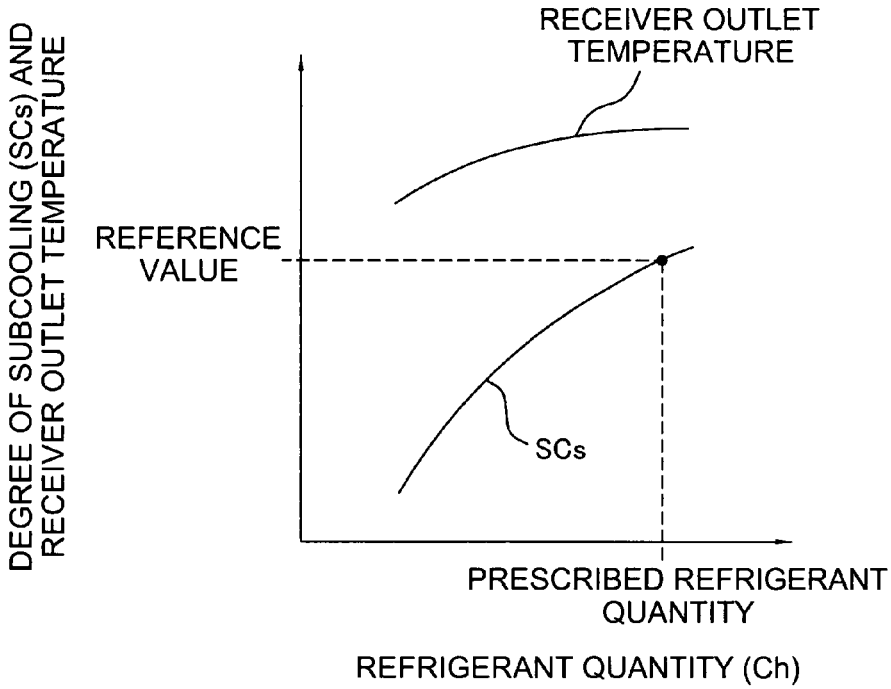
FIG. 34 is a graph to show a relationship between the degree of subcooling at the outlet on the main refrigerant circuit side of the subcooler and the refrigerant temperature at an outlet of a receiver, and the refrigerant quantity during the refrigerant quantity determining operation.

As described above, when additional refrigerant charging into the refrigerant circuit 310 starts, the refrigerant quantity in the refrigerant circuit 310 gradually increases. Consequently, a tendency of an increase in the refrigerant pressure at the outlet of the receiver 325 according to the increase in the refrigerant quantity at such a time appears (in other words, the refrigerant temperature tends to increase). Consequently, the refrigerant temperature at the outlet of the receiver 325 increases, which results in an increase in the temperature difference between the temperature of the refrigerant flowing into the main refrigerant circuit side and the temperature of the refrigerant flowing into the bypass refrigerant circuit side of the subcooler 326. As a result, the quantity of heat exchange in the subcooler 326 increases, and a tendency of an increase in the degree of subcooling $SC_s$ of the refrigerant at the outlet on the main refrigerant circuit side of the subcooler 326 appears. This tendency indicates that there is a correlation as shown in FIGS. 33 and 34 between the degree of subcooling $SC_s$ at the outlet on the main refrigerant circuit side of the subcooler 326 and the refrigerant quantity charged in the refrigerant circuit 310. Here, FIG. 33 is a graph to show a relationship between the degree of subcooling $SC_s$ at the outlet on the main refrigerant circuit side of subcooler 326, and the outdoor temperature Ta and the refrigerant quantity Ch during refrigerant quantity determining operation. FIG. 34 is a graph to show a relationship between the degree of subcooling $SC_s$ at the outlet on the main refrigerant circuit side of subcooler 326 and the refrigerant temperature at the outlet of the receiver 325, and the refrigerant quantity Ch during refrigerant quantity determining operation. This correlation in FIG. 33 indicates a relationship between a value of the degree of subcooling $SC_s$ at the outlet on the main refrigerant circuit side of the subcooler 326 (hereinafter referred to as a prescribed value of the degree of subcooling $SC_s$) and the outdoor temperature Ta, when refrigerant is charged in the refrigerant circuit 310 in advance until a prescribed refrigerant quantity is reached, in the case where the above described refrigerant quantity determining operation was performed by using the air conditioner 301 in a state immediately after being installed on site and started to be used. In other words, it means that a prescribed value of the degree of subcooling $SC_s$ at the outlet on the main refrigerant circuit side of the subcooler 326 is determined by the outdoor temperature Ta during test operation (specifically, during automatic refrigerant charging), and comparison between this prescribed value of the degree of subcooling $SC_s$ and the current value of the degree of subcooling $SC_s$ detected during refrigerant charging enables determination of the adequacy of the refrigerant quantity charged in the refrigerant circuit 310 by additional refrigerant charging.

Step S13 is a process to determine the adequacy of the refrigerant quantity charged in the refrigerant circuit 310 by additional refrigerant charging, by using correlation as described above.

In other words, when the additional refrigerant quantity to be charged is small and the refrigerant quantity in the refrigerant circuit 310 has not reached the initial refrigerant quantity, it is a state where the refrigerant quantity in the refrigerant circuit 310 is small. Here, the state where the refrigerant quantity in refrigerant circuit 310 is small means that the current value of the degree of subcooling $SC_s$ at the outlet on the main refrigerant circuit side of the subcooler 326 is smaller than the prescribed value of the degree of subcooling $SC_s$. Accordingly, when the degree of subcooling $SC_s$ at the outlet on the main refrigerant circuit side of the subcooler 326 is smaller than the prescribed value and additional refrigerant charging is not completed, the process in Step S13 is repeated until the current value of the degree of subcooling $SC_s$ reaches the prescribed value. In addition, when the current value of the degree of subcooling $SC_s$ reaches the prescribed value, additional refrigerant charging is completed and Step S1 as an automatic refrigerant charging operation process is finished. Note that there are cases where the prescribed refrigerant quantity calculated on site based on the pipe length, the capacities of constituent equipment, and the like is not consistent with the initial refrigerant quantity after additional refrigerant charging is completed. In the present embodiment, a value of the degree of subcooling $SC_s$ and a different value of the operation state quantity at the time of completion of additional refrigerant charging are used as reference values of the operation state quantity such as the degree of subcooling $SC_s$ in the below described refrigerant leak detection mode.

In this way, the process in Step S13 is performed by the controller 308 that functions as the refrigerant quantity determining means for determining the adequacy of the refrigerant quantity charged in the refrigerant circuit 310 during refrigerant quantity determining operation.

Note that, unlike the present embodiment, when additional refrigerant charging is not necessary and the refrigerant quantity that is charged in advance in the outdoor unit 302 is sufficient as the refrigerant quantity in the refrigerant circuit 310, practically, the automatic refrigerant charging operation will be an operation only to store the data of the operation state quantity with respect to the initial refrigerant quantity.

<Step S2: Control Variables Changing Operation>

When the above described automatic refrigerant charging operation of Step S1 is finished, the process proceeds to control variables changing operation of Step S2. During control variables changing operation, the process in Step S21 to Step S23 shown in FIG. 6 is performed by the controller 308, as is the case with the first embodiment.

<Step S21 to S23: Control Variables Changing Operation and Operation Data Storing During Control Variables Changing Operation>

In Step S21, after the above described automatic refrigerant charging operation is finished, refrigerant quantity determining operation same as Step S11 is performed with the initial refrigerant quantity charged in the refrigerant circuit 310.

Here, in a state where refrigerant quantity determining operation is performed with refrigerant already charged up to the initial refrigerant quantity, the air flow rate of the outdoor fan 327 is changed, and thereby perform operation for simulating a state where there was a fluctuation in the heat exchange performance of the outdoor heat exchanger 323 during test operation i.e., after installment of the air conditioner 301. Also, by changing the air flow rate of the indoor fans 343 and 353, perform operation for simulating a state where there was a fluctuation in the heat exchange performance of the indoor heat exchangers 342 and 352 (hereinafter such operation is referred to as "control variables changing operation").

For example, during refrigerant quantity determining operation, when the air flow rate of the outdoor fan 327 is reduced, the heat transfer coefficient K of the outdoor heat exchanger 323 becomes smaller and the heat exchange performance drops. Consequently, as shown in FIG. 7, the condensation temperature Tc of the refrigerant in the outdoor heat exchanger 323 increases. This results in a tendency of an increase in the discharge pressure Pd of the compressor 321 corresponding to the condensation pressure Pc of the refrigerant in the outdoor heat exchanger 323. In addition, during refrigerant quantity determining operation, when the air flow rate of the indoor fans 343 and 353 is reduced, the heat transfer coefficient K of the indoor heat exchangers 342 and 352 becomes smaller and the heat exchange performance drops. Consequently, as shown in FIG. 8, the evaporation temperature Te of the refrigerant in the indoor heat exchangers 342 and 352 decreases. This results in a tendency of a decrease in the suction pressure Ps of the compressor 321 corresponding to the evaporation pressure Pe of the refrigerant in the indoor heat exchangers 342 and 352. When such control variables changing operation is performed, the operation state quantity of constituent equipment or the refrigerant flowing in the refrigerant circuit 310 changes depending on each operating condition, while the initial refrigerant quantity charged in the refrigerant circuit 310 remains constant.

In Step S22, the operation state quantity of constituent equipment or the refrigerant flowing in the refrigerant circuit 310 under each operating condition of control variables changing operation is obtained as the operation data and stored in the memory of the controller 308. In the present embodiment, the degree of subcooling $SC_s$ at the outlets of the indoor heat exchangers 342 and 352, the outdoor temperature Ta, the room temperature Tr, the discharge pressure Pd, and the suction pressure Ps are stored, as the operation data at the beginning of the refrigerant charging, in the memory of the controller 308.

This Step S22 is repeated until it is determined in Step S23 that all the operating conditions for control variables changing operation have been executed.

In this way, the process in Steps S21 and S23 is performed by the controller 308 that functions as the control variables changing operation means for performing control variables changing operation that includes operation for simulating a state where there was a fluctuation in the heat exchange performance of the outdoor heat exchanger 323 and the indoor heat exchangers 342 and 352, by changing the air flow rate of the outdoor fan 327 and the indoor fans 343 and 353 while performing refrigerant quantity determining operation. In addition, the process in Step S22 is performed by the controller 308 that functions as the state quantity storing means for storing, as the operation data, the operation state quantity of constituent equipment or the refrigerant flowing in the refrigerant circuit 310 during control variables changing operation. Thus, it is possible to obtain, as the operation data, the operation state quantity during operation for simulating a state where there was a fluctuation in the heat exchange performance of the outdoor heat exchanger 323 and the indoor heat exchangers 342 and 352.

<Refrigerant Leak Detection Mode>

Next, the refrigerant leak detection mode is described with reference to FIGS. 31, 32, and 9.

In the present embodiment, an example of a case is described where, at the time of cooling operation or heating operation in the normal operation mode, whether or not the refrigerant in the refrigerant circuit 310 is leaking to the outside due to an unforeseen factor is detected periodically (for example, during a period of time such as on a holiday or in the middle of the night when air conditioning is not needed).

<Step S31: Determining Whether or not the Normal Operation Mode has Gone on for a Certain Period of Time>

First, whether or not operation in the normal operation mode such as the above-described cooling operation or heating operation has gone on for a certain period of time (every one month, etc.) is determined, and when operation in the normal operation mode has gone on for a certain period of time, the process proceeds to the next step S32.

<Step S32: Refrigerant Quantity Determining Operation>

When the operation in the normal operation mode has gone on for a certain period of time, as is the case with the process in Step S11 of the above described automatic refrigerant charging operation, refrigerant quantity determining operation including all indoor unit operation, compressor rotation frequency constant control, and receiver outlet refrigerant subcooling control is performed. Here, a value to be used for the rotation frequency f of the compressor 321 is same as the predetermined value of the rotation frequency f during refrigerant quantity determining operation of Step S11 in automatic refrigerant charging operation. In addition, a predetermined value to be used for the degree of superheating $SH_B$ under the superheat degree control by the bypass side refrigerant flow rate adjusting valve 372 in the bypass refrigerant circuit 371 under the receiver outlet refrigerant subcooling control is same as the predetermined value of degree of superheating $SH_b$ during refrigerant quantity determining operation in Step S11.

In this way, the process in Step S32 is performed by the controller 308 that functions as the refrigerant quantity determining operation controlling means for performing refrigerant quantity determining operation including all indoor unit operation, compressor rotation frequency constant control, and receiver outlet refrigerant subcooling control (condensation pressure control according to need).

<Steps S33 to S35: Determination of the Adequacy of the Refrigerant quantity, returning to the normal operation, Warning Display>

When refrigerant in the refrigerant circuit 310 leaks out, the refrigerant quantity in the refrigerant circuit 310 decreases. Consequently, a tendency of a decrease in the current value of the degree of subcooling $SC_s$ at the outlet on the main refrigerant circuit side of the subcooler 326 appears (see FIGS. 33 and 34). In other words, it means that the adequacy of the refrigerant quantity charged in the refrigerant circuit 310 can be determined by comparing the current value of the degree of subcooling $SC_s$ at the outlet on the main refrigerant circuit side of the subcooler 326. In the present embodiment, comparison is made between the current value of the degree of subcooling $SC_s$ at the outlet on the main refrigerant circuit side of the subcooler 326 during refrigerant leak detection operation and the reference value (prescribed value) of the degree of subcooling $SC_s$ corresponding to the initial refrigerant quantity charged in the refrigerant circuit 310 at the completion of the above described automatic refrigerant charging operation, and thereby determination of the adequacy of the refrigerant quantity i.e., detection of a refrigerant leak is performed.

Here, when the reference value of the degree of subcooling $SC_s$ which corresponds to the initial refrigerant quantity charged in the refrigerant circuit 310 at the completion of the above described automatic refrigerant charging operation is used as a reference value of the degree of subcooling $SC_s$ during refrigerant leak detection operation, a drop in the heat exchange performance of the outdoor heat exchanger 323 and the indoor heat exchangers 342 and 352, caused by age-related degradation, poses a problem.

Therefore, in the air conditioner 301 in the present embodiment, as is the case with the air conditioner 1 in the first embodiment, the focus is placed on the fluctuations in the coefficients KA of the outdoor heat exchanger 323 and the indoor heat exchangers 342 and 352 according to the degree of age-related degradation. In other words, the focus is placed on the fluctuations in the correlation between the condensation pressure Pc in the outdoor heat exchanger 323 and the outdoor temperature Ta (see FIG. 7) and in the correlation between the evaporation pressure Pe in the indoor heat exchangers 342 and 352 and the room temperature Tr (see FIG. 8), which occur along with the fluctuation in the coefficient KA. Then, the current value of the degree of subcooling $SC_s$ or the reference value of the degree of subcooling $SC_s$, which is used when determining the adequacy of the refrigerant quantity, is corrected by using the discharge pressure Pd of the compressor 321 which corresponds to the condensation pressure Pc in the outdoor heat exchanger 323, the outdoor temperature Ta, the suction pressure Ps of the compressor 321 which corresponds to the evaporation pressure Pe in the indoor heat exchangers 342 and 352, and the room temperature Tr. Thereby, different degrees of subcooling $SC_s$, which are detected in the air conditioner 301 comprising the outdoor heat exchanger 323 and the indoor heat exchangers 342 and 352 whose coefficients KA remain the same, can be compared with each other. In this way, the effect of the fluctuation in the degree of subcooling $SC_s$ by age-related degradation is eliminated.

Note that, fluctuation in the heat exchange performance of the outdoor heat exchanger 323 may also occur due to the effect of weather conditions such as rain, heavy gale, etc., besides age-related degradation. Specifically, in case of rain, the plate fins and the heat transfer tube of the outdoor heat exchanger 323 get wet with rain, which can therefore cause a fluctuation in the heat exchange performance, i.e., a fluctuation in the coefficient KA. In addition, in case of heavy gale, the air flow rate of the outdoor fan 327 becomes larger or smaller by the heavy gale, which can therefore cause a fluctuation in the heat exchange performance, i.e., a fluctuation in the coefficient KA. Such effect of weather conditions on the heat exchange performance of the outdoor heat exchanger 323 will appear as a fluctuation in the correlation between the condensation pressure Pc in the outdoor heat exchanger 323 and the outdoor temperature Ta according to the fluctuation in the coefficient KA (see FIG. 7). Consequently, elimination of the effect of the fluctuation in the degree of subcooling $SC_s$ by age-related degradation can result in the elimination of the effect of the fluctuation in the degree of subcooling $SC_s$ by weather conditions.

As a specific correction method, for example, there is a method in which the refrigerant quantity Ch charged in the refrigerant circuit 310 is expressed as a function of the degree of subcooling $SC_s$, the discharge pressure Pd, the outdoor temperature Ta, the suction pressure Ps, and the room temperature Tr. Then, the refrigerant quantity Ch is calculated from the current value of the degree of subcooling $SC_s$ during refrigerant leak detection operation and the current values of the discharge pressure Pd, the outdoor temperature Ta, the suction pressure Ps and the room temperature Tr during the same operation. In this way, the current refrigerant quantity is compared with the initial refrigerant quantity which serves as a reference value of the refrigerant quantity, and thereby the effect of age-related degradation and weather conditions on the degree of subcooling $SC_s$ at the outlet of the outdoor heat exchanger 323 is compensated.

Here, the refrigerant quantity Ch charged in the refrigerant circuit 310 can be expressed as a following multiple regression function:

$$Ch=k1\times SC_s+k2\times Pd+k3\times Ta+\times k4\times Ps+k5\times Tr+k6,$$

and accordingly, by using the operation data (i.e., data of the degree of subcooling $SC_s$ at the outlet of the outdoor heat exchanger 323, the outdoor temperature Ta, the room temperature Tr, the discharge pressure Pd, and the suction pressure Ps) stored in the memory of the controller 308 during refrigerant charging and control variable changing operation in the above described test operation mode, a multiple regression analysis is performed in order to calculate parameters k1 to k6 and thereby a function of the refrigerant quantity Ch can be defined.

Note that, in the present embodiment, a function of the refrigerant quantity Ch is defined by the controller 308 in the period from after control variable changing operation in the above described test operation mode is performed until the mode is switched to the refrigerant quantity leak detection mode for the first time.

In this way, a process to determine a correction formula is performed by the controller 308 that functions as the state quantity correction formula computing means for defining a function in order to compensate the effects on the degree of subcooling $SC_s$ by age-related degradation of the outdoor heat exchanger 323 and the indoor heat exchangers 342 and 352 and weather conditions when detecting whether or not there is a refrigerant leak in the refrigerant leak detection mode.

Then, the current value of the refrigerant quantity Ch is calculated from the current value of the degree of subcooling $SC_s$ at the outlet of the outdoor heat exchanger 323 during refrigerant leak detection operation. When the current value is substantially the same as the reference value of the refrigerant quantity Ch (i.e., initial refrigerant quantity) for the reference value of the degree of subcooling $SC_s$ (for example, the absolute value of the difference between the refrigerant quantity Ch corresponding to the current value of the degree of subcooling $SC_s$ and the initial refrigerant quantity is less than a predetermined value), it is determined that there is no refrigerant leak. Then, the process proceeds to next Step S34 and the operation mode is returned to the normal operation mode.

On the other hand, the current value of the refrigerant quantity Ch is calculated from the current value of the degree of subcooling $SC_s$ at the outlets of the indoor heat exchangers 342 and 352 during refrigerant leak detection operation, and when the current value is smaller than the initial refrigerant quantity (for example, the absolute value of the difference between the refrigerant quantity Ch corresponding to the current value of the degree of subcooling $SC_s$ and the initial refrigerant quantity is equal to or greater than a predetermined value), it is determined that there is a refrigerant leak. Then, the process proceeds to Step S35 and a warning indicating that a refrigerant leak is detected is displayed on the warning display 309. Subsequently, the process proceeds to next Step S34 and the operation mode is returned to the normal operation mode.

Accordingly, it is possible to obtain a result similar to that obtained when the current value of the degree of subcooling $SC_s$ is compared with the reference value of the degree of subcooling $SC_s$ under conditions substantially the same as those under which different degrees of subcooling $SC_s$, which are detected in the air conditioner 301 comprising the outdoor heat exchanger 323 and the indoor heat exchangers 342 and 352 whose coefficients KA remain the same, are compared with each other. Consequently, the effect of the fluctuation in the degree of superheating $SH_i$ by age-related degradation can be eliminated.

In this way, the process from Steps S33 to S35 is performed by the controller 308 that functions as the refrigerant leak detection means, which is one of the refrigerant quantity determining means, and which detects whether or not there is a refrigerant leak by determining the adequacy of the refrigerant quantity charged in the refrigerant circuit 310 while performing refrigerant quantity determining operation in the refrigerant leak detection mode. In addition, a part of the process in Step S33 is performed by the controller 308 that functions as the state quantity correcting means for compensating the effect on the degree of subcooling $SC_s$ by age-related degradation of the outdoor heat exchanger 323 and the indoor heat exchangers 342 and 352 when detecting whether or not there is a refrigerant leak in the refrigerant leak detection mode.

As described above, in the air conditioner 301 in the present embodiment, the controller 308 functions as the refrigerant quantity determining operation means, the state quantity storing means, the refrigerant quantity determining means, the control variables changing operation means, the state quantity correction formula computing means, and the state quantity correcting means, and thereby configures the refrigerant quantity determining system for determining the adequacy of the refrigerant quantity charged in the refrigerant circuit 310.

(3) Characteristics of the Air Conditioner

The air conditioner 301 in the present embodiment has the following characteristics.

(A)

The air conditioner 301 in the present embodiment can perform an operation to cause outdoor heat exchanger 323 as a heat source side heat exchanger to function as a condenser of the refrigerant compressed in the compressor 321 and also cause the indoor heat exchangers 342 and 352 as utilization side heat exchangers to function as an evaporator for the refrigerant sent from the outdoor heat exchanger 323 via the receiver 325 and the indoor expansion valves 341 and 351 as utilization expansion valves. At this time, when the refrigerant quantity in the refrigerant circuit 310 starts to decrease, the degree of subcooling of the refrigerant at the outlet of the outdoor heat exchanger 323 becomes lower or saturated. Consequently, the refrigerant condensed in the outdoor heat exchanger 323 becomes saturated or gas-liquid two-phase state before it reaches the inlet of the receiver 325 because of the pressure loss in the flow path between the outlet of the outdoor heat exchanger 323 and the inlet of the receiver 325, and it flows into the receiver 325. As a result, the refrigerant that flows along a flow path from the outlet of the receiver 325 to the inlet of the subcooler 326 also becomes saturated. Accordingly, the degree of subcooling $SC_s$ of the refrigerant at the outlet of the subcooler 326 decreases as the quality of wet vapor of the refrigerant at the outlet of the receiver 325 (i.e., the inlet of the subcooler 326) increases, and ultimately a state is reached in which the quality of wet vapor is zero (i.e., refrigerant in a saturated liquid state). This indicates that when the refrigerant at the outlet of the receiver 325 becomes saturated and the degree of subcooling $SC_s$ of the refrigerant at the outlet of the subcooler 326 starts to decrease, a certain quantity of the refrigerant is accumulated in the receiver 325, however when the degree of subcooling $SC_s$ of the refrigerant at the outlet of the subcooler 326 becomes close to zero, the refrigerant accumulated in the receiver 325 becomes low in the quantity. In other words, in this air conditioner 301, the fluctuation in the quality of wet vapor of the refrigerant at the outlet of the receiver 325 due to the fluctuation in the refrigerant quantity in the receiver 325 can be understood as a fluctuation in the degree of subcooling $SC_s$ of the refrigerant at the outlet of the subcooler.

In this way, in this air conditioner 301, the fluctuation in the refrigerant quantity in the main refrigerant circuit can be clearly expressed as a fluctuation in the degree of subcooling $SC_s$ of the refrigerant at the outlet of the subcooler 326. Therefore, by utilizing this characteristic, it is possible to determine the adequacy of the refrigerant quantity even though the refrigerant circuit has the receiver 325.

(B)

In the air conditioner 301 in the present embodiment, the bypass side refrigerant flow rate adjusting valve 372 is controlled such that degree of superheating $SH_b$ of the refrigerant at the outlet on the bypass refrigerant circuit side of the subcooler 326 becomes a predetermined value. Therefore, when the refrigerant pressure at the outlet of the receiver 325 decreases, so does the temperature difference between the temperature of the refrigerant at the outlet of the receiver 325, which flows into the main refrigerant circuit side of the subcooler 326, and the temperature of the refrigerant at the outlet of the bypass side refrigerant flow rate adjusting valve 372, which flows into the bypass refrigerant circuit side of the subcooler 326. Accordingly, the quantity of heat exchange in the subcooler 326 decreases, and as a result, the degree of subcooling $SC_s$ of the refrigerant at the outlet on the main refrigerant circuit side of the subcooler 326 becomes extremely low. In other words, because of the effect of a decrease in the quantity of heat exchange in the subcooler 326 due to the above described superheat degree control of the bypass side refrigerant flow rate adjusting valve 372, when the refrigerant quantity accumulated in the receiver 325 is small, the degree of subcooling $SC_s$ of the refrigerant at the outlet on the main refrigerant circuit side of the subcooler 326 further decreases compared to when the refrigerant quantity accumulated in the receiver 325 is large. Therefore, the accuracy for determining the adequacy of the refrigerant quantity can be improved.

(C)

In the air conditioner 301 in the present embodiment, when the adequacy of the refrigerant quantity is determined by the refrigerant quantity determining means, the refrigerant pressure in the outdoor heat exchanger 323 is controlled by the outdoor fan 327 (condensation pressure control) to be equal to or higher than a predetermined value, thereby enabling to create conditions in which heat is sufficiently exchanged between the refrigerant at the main refrigerant circuit side and the refrigerant at the bypass refrigerant circuit side of the subcooler 326. Accordingly, the fluctuation in the refrigerant quantity in the main refrigerant circuit can be further clearly expressed as a fluctuation in the degree of subcooling $SC_s$ of the refrigerant at the outlet of the subcooler 326, and therefore the accuracy for determining the adequacy of the refrigerant quantity can be improved.

(D)

In the air conditioner 301 in the present embodiment, the focus is placed on the fluctuations in the coefficients KA of the outdoor heat exchanger 323 and the indoor heat exchangers 342 and 352 according to the degree of age-related degradation that has occurred since the outdoor heat exchanger 323 and the indoor heat exchangers 342 and 352 (i.e., the air conditioner 301) were in a state immediately after being installed on site and started to be used. In other words, the focus is placed on the fluctuations in the correlation between the condensation pressure Pc, which is the refrigerant pressure in the outdoor heat exchanger 323, and the outdoor temperature Ta and in the correlation between the evaporation pressure Pe, which is the refrigerant pressure in the indoor heat exchangers 342 and 352, and the room temperature Tr, which occur along with the fluctuation in the coefficient KA (see FIGS. 10 and 11). Then, by the controller 308 that functions as the refrigerant quantity determining means and the state quantity correcting means, the current value of the refrigerant quantity Ch is expressed as a function of the degree of subcooling $SC_s$, the discharge pressure Pd, the outdoor temperature Ta, the suction pressure Ps, and the room temperature Tr, and the current value of the refrigerant quantity Ch is calculated from the current value of the degree of subcooling $SC_s$ during refrigerant leak detection operation and the current values of the discharge pressure Pd, the outdoor temperature Ta, the suction pressure Ps and the room temperature Tr during the same operation. In this way, the current refrigerant quantity is compared with the initial refrigerant quantity which serves as a reference value of the refrigerant quantity, and thereby the effect of the fluctuation in the degree of subcooling $SC_s$ as the operation state quantity, which is caused by age-related degradation, can be eliminated.

Accordingly, in this air conditioner 301, even if the outdoor heat exchanger 323 and the indoor heat exchangers 342 and 352 are degraded due to aging, the adequacy of the refrigerant quantity charged in the air conditioner, i.e., whether or not there is a refrigerant leak can be accurately determined.

In addition, in particular, the coefficient KA of the outdoor heat exchanger 323 may fluctuate due to fluctuation in weather conditions such as rain, heavy gale, etc. As is the case with age-related degradation, fluctuation in weather conditions causes fluctuation in the correlation between the condensation pressure Pc that is the refrigerant pressure in the outdoor heat exchanger 323, and the outdoor temperature Ta, along with the fluctuation in the coefficient KA. As a result, the effect of the fluctuation in the degree of subcooling $SC_s$ in such a case can also be eliminated.

(E)

In the air conditioner 301 in the present embodiment, during test operation after installment of the air conditioner 301, the controller 308 that functions as the state quantity storing means stores the operation state quantity (specifically, the reference values of the degree of subcooling $SC_s$, the discharge pressure Pd, the outdoor temperature Ta, the suction pressure Ps, and the room temperature Tr) in a state after the refrigerant is charged up to the initial refrigerant quantity by on-site refrigerant charging, and compares such operation state quantity as a reference value with the current value of the operation state quantity during refrigerant leak detection mode in order to determine the adequacy of the refrigerant quantity, i.e., whether or not there is a refrigerant leak. Therefore, the refrigerant quantity that has actually been charged in the air conditioner, i.e., the initial refrigerant quantity can be compared with the current refrigerant quantity during refrigerant leak detection.

Accordingly, in this air conditioner 301, even when the prescribed refrigerant quantity specified in advance before refrigerant is charged is inconsistent with the initial refrigerant quantity charged on site or even when the reference value of the operation state quantity (specifically, the degree of subcooling $SC_s$) used for determining the adequacy of the refrigerant quantity fluctuates depending on the pipe length of the refrigerant communication pipes 306 and 307, combination of the plurality of indoor units 304 and 305, and the difference in the installation height among the units 302, 304, and 305, it is possible to accurately determine the adequacy of the refrigerant quantity charged in the air conditioner.

(F)

In the air conditioner 301 in the present embodiment, not only the operation state quantity in a state after the refrigerant is charged up to the initial refrigerant quantity (specifically, the reference values of the degree of subcooling $SC_s$, the discharge pressure Pd, the outdoor temperature Ta, the suction pressure Ps, and the room temperature Tr) but also the control variables of constituent equipment of the air conditioner 301 such as the outdoor fan 327 and the indoor fans 343 and 353 are changed. In this way, an operation to simulate operating conditions different from those during test operation is performed, and the operation state quantity during this operation can be stored in the controller 308 that functions as the state quantity storing means.

Accordingly, in the air conditioner 301, based on the data of the operation state quantity during operation with the control variable of constituent equipment such as the outdoor fan 327, the indoor fans 343 and 353, and the like changed, a correlation or a correction formula and the like of various values of the operation state quantity for the different operating conditions, such as when the outdoor heat exchanger 323 and the indoor heat exchangers 342 and 352 are degraded due to aging, are determined. Using such a correlation and a correction formula, it is possible to compensate differences in the operating conditions when comparing the reference value of the operation state quantity during test operation with the current value of the operation state quantity. In this way, in this air conditioner 301, based on the data of the operation state quantity during operation with a changed control variable of constituent equipment, it is possible to compensate differences in the operating conditions when comparing the reference value of the operation state quantity during test operation with the current value of the operation state quantity. Therefore, the accuracy for determining the adequacy of the refrigerant quantity charged in the air conditioner can be further improved.

(4) Alternative Embodiment

Also for the air conditioner 301 in the present embodiment, as is the case with the alternative embodiment 9 in the first embodiment, the refrigerant quantity determining system may be configured by achieving a connection between the air conditioner 301 and the local controller as the management device that manages each constituent equipment of the air conditioner 301 and obtains the operation data, connecting the local controller via a network to a remote server of an information management center that receives the operation data of the air conditioner 301, and connecting a memory device 65 such as a disk device as the state quantity storing means to the remote server.

Fifth Embodiment

A method for adding a refrigerant quantity determining function of an air conditioner according to the present invention and a fourth embodiment of an air conditioner to which a refrigerant quantity determining function is added are described with reference to the drawings below.

(1) Configuration of the Existing Air Conditioner

Figure 35:
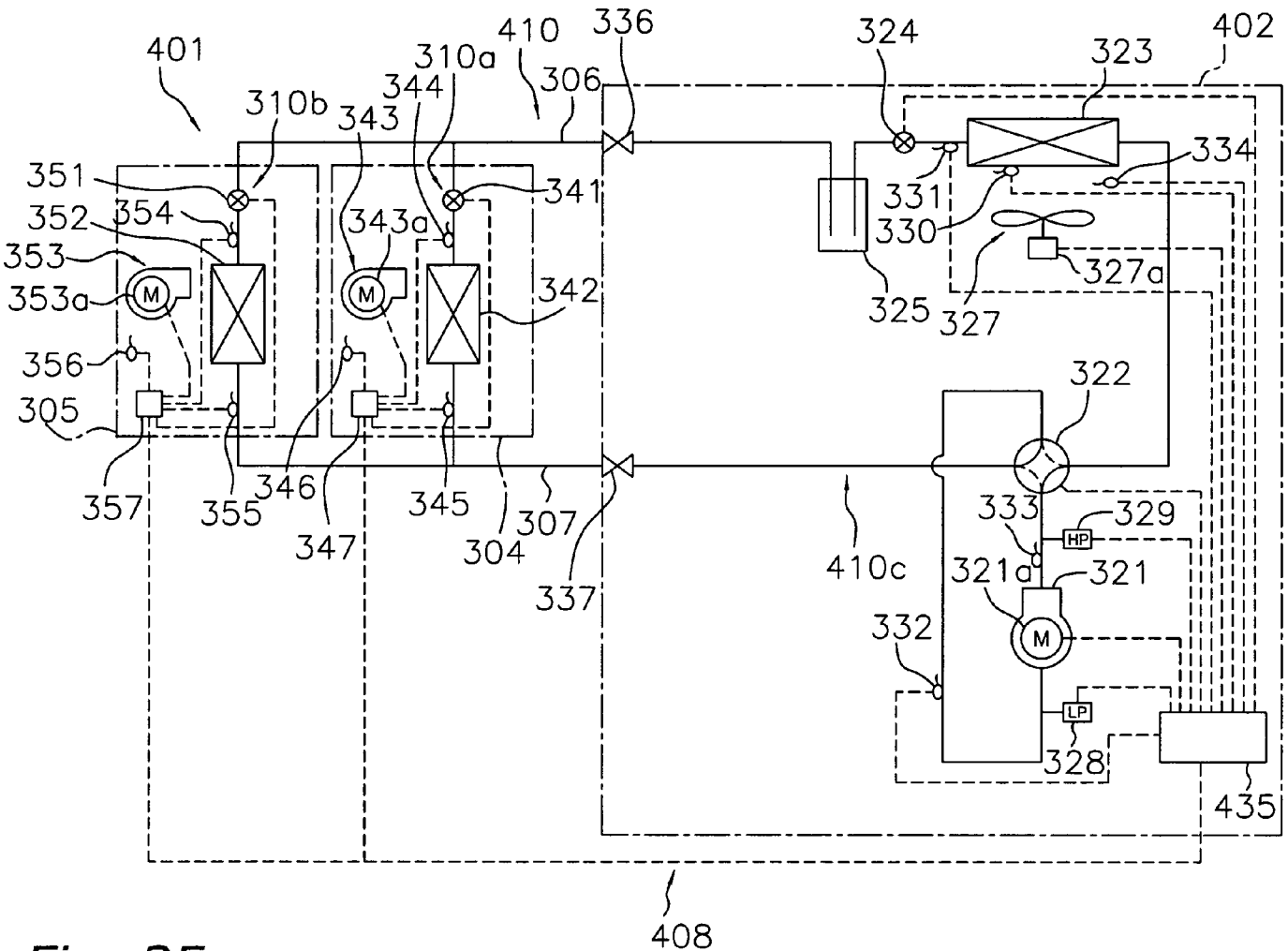
FIG. 35 is a schematic refrigerant circuit diagram of an existing air conditioner before a refrigerant quantity determining function is added by a method for adding a refrigerant quantity determining function of an air conditioner according to a fifth embodiment of the present invention.

FIG. 35 is a schematic refrigerant circuit diagram of an existing air conditioner 401 before a refrigerant quantity determining function is added by a method for adding a refrigerant quantity determining function of an air conditioner according to the present invention. The air conditioner 401 has the configuration of the air conditioner 301 in the third embodiment in a state where work to install the subcooler 326 as a subcooling device (see FIG. 31) in an outdoor unit 402 (hereinafter referred to as "subcooling device installation work") and work to add the refrigerant quantity determining means by replacing a control board and the like that constitute the controller 308 (hereinafter referred to as "refrigerant quantity determining means installation work") are not performed.

<Indoor Unit>

The indoor units 304 and 305 are installed by being embedded in or hung from a ceiling inside a room in a building and the like or by being mounted on a wall surface inside a room or the like. The indoor units 304 and 305 are connected to the outdoor unit 402 via the liquid refrigerant communication pipe 306 and the gas refrigerant communication pipe 307, and configure a part of the refrigerant circuit 410. Note that, since the indoor units 304 and 305 have the same configuration as that of the indoor units 304 and 305 in the third embodiment, descriptions of respective portions are omitted here.

<Outdoor Unit>

The outdoor unit 402 is installed on the roof or the like of a building and the like, is connected to the indoor units 304 and 305 via the liquid refrigerant communication pipe 306 and the gas refrigerant communication pipe 307, and configures the refrigerant circuit 410 with the indoor units 304 and 305.

Next, the configuration of the outdoor unit 402 is described. The outdoor unit 402 mainly comprises an outdoor side refrigerant circuit 410*c* that configures a part of the refrigerant circuit 410. As is the case with the outdoor side refrigerant circuit 310*c* in the third embodiment, the outdoor side refrigerant circuit 410*c* mainly comprises the compressor 321, the four-way switching valve 322, the outdoor heat exchanger 323 as a heat source side heat exchanger, the outdoor expansion valve 324 as the heat source side expansion valve, the receiver 325, the liquid side stop valve 336, and the gas side stop valve 337.

As is the case with the third embodiment, the outdoor unit 402 is disposed with the outdoor fan 327 for taking in outdoor air into the unit, supplying the air to the outdoor heat exchanger 323, and subsequently discharging the air to the outside.

Figure 36:
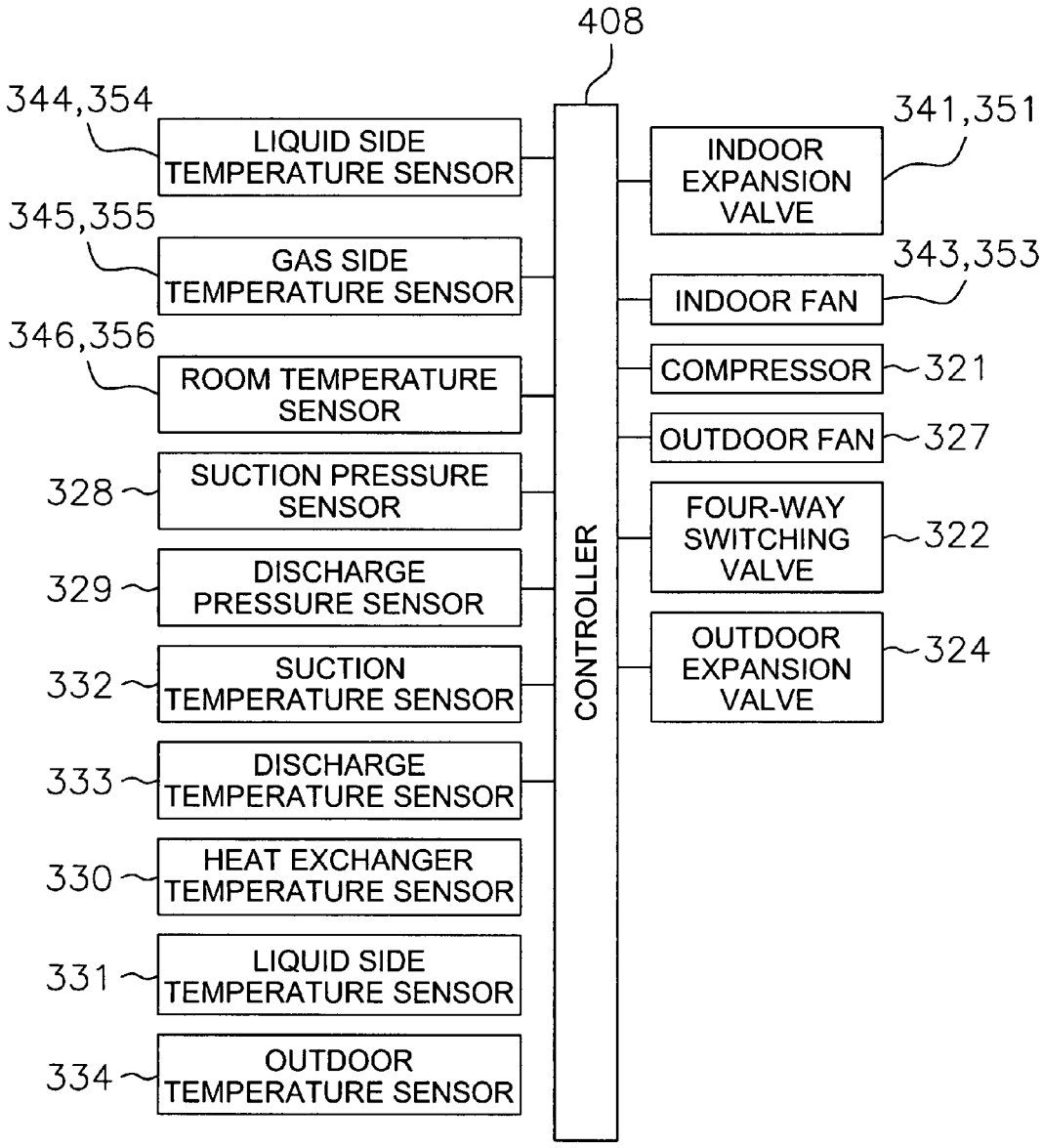
FIG. 36 is a control block diagram of the existing air conditioner.

In addition, various types of sensors are disposed in the outdoor unit 402. Specifically, as is the case with the third embodiment, disposed in the outdoor unit 402 are the suction pressure sensor 328 that detects the suction pressure Ps of the compressor 321, the discharge pressure sensor 329 that detects the discharge pressure Pd of the compressor 321, the suction temperature sensor 332 that detects the suction temperature Ts of the compressor 321, and the discharge temperature sensor 333 that detects the discharge temperature Td of the compressor 321. The heat exchanger temperature sensor 330 that detects the refrigerant temperature flowing in the outdoor heat exchanger 323 (i.e., the refrigerant temperature corresponding to the condensation temperature Tc during cooling operation or the evaporation temperature Te during heating operation) is disposed in the outdoor heat exchanger 323. The liquid side temperature sensor 331 that detects the temperature of the refrigerant in a liquid state or gas-liquid two-phase state is disposed at the liquid side of the outdoor heat exchanger 323. The outdoor temperature sensor 334 that detects the temperature of the outdoor air that flows into the unit (i.e., the outdoor temperature Ta) is disposed at an outdoor air intake side of the outdoor unit 402. In addition, the outdoor unit 402 comprises an outdoor side controller 435 that controls the operation of each portion constituting the outdoor unit 402. Further, the outdoor side controller 435 includes a microcomputer and a memory disposed in order to control the outdoor unit 402, the inverter circuit that controls the motor 321*a*, and the like, and is configured such that it can exchange control signals and the like with the indoor side controllers 347 and 357 of the indoor units 304 and 305. In other words, a controller 408 that performs operation control of the entire air conditioner 401 is configured by the indoor side controller 347, 357 and the outdoor side controller 435. As shown in FIG. 36, the controller 408 is connected so as to be able to receive detection signals of sensors 329 to 334, 344 to 346, and 354 to 356, and to be able to control various equipment and valves 321, 322, 324, 327*a*, 341, 343*a*, 351, and 353*a* based on these detection signals and the like. Here, FIG. 36 is a control block diagram of the air conditioner 401.

As described above, the refrigerant circuit 410 of the existing air conditioner 401 is configured by the interconnection of the indoor side refrigerant circuits 310*a* and 310*b*, the outdoor side refrigerant circuit 410*c*, and the refrigerant communication pipes 306 and 307. Further, with the controller 408 comprising the indoor side controllers 347 and 357 and the outdoor side controller 435, the existing air conditioner 401 is configured to switch and operate between cooling operation and heating operation by the four-way switching valve 322 and control each equipment of the outdoor unit 402 and the indoor units 304 and 305 depending on the operation load of each of the indoor units 304 and 305.

(2) Modification to Add the Refrigerant Quantity Determining Function to an Existing Air Conditioner Next, modification to add the refrigerant quantity determining function to the above described existing air conditioner 401 by the method for adding a refrigerant quantity determining function of an air conditioner in the present embodiment is described.

First, the existing air conditioner 401 before modification for adding the refrigerant quantity determining function is the one that has actual use history. Here, the air conditioner 401 refers to an air conditioner at least whose manufacturing process has been completed and the refrigerant has been charged in the outdoor unit 402, as in a state of having been used for operations such as cooling operation, heating operation, and the like after being installed on site and constituting the refrigerant circuit 410.

The method for adding a refrigerant quantity determining function of an air conditioner in the present embodiment mainly comprises work to extract refrigerant from the refrigerant circuit 410 (hereinafter referred to as "refrigerant extraction work"), work to install a subcooler 426 (see FIG. 31) as a subcooling device in the outdoor unit 402 (hereinafter referred to as "subcooling device installation work"), and work to add the refrigerant quantity determining means by replacing a control board and the like that constitute the controller 408 (hereinafter referred to as "refrigerant quantity determining means installation work").

<Refrigerant Extraction Work>

The refrigerant extraction work is work that is performed prior to the subcooling device installation work mainly in order to prevent refrigerant from being released to the outside from refrigerant circuit 410 at the time of the subcooling device installation work. The refrigerant extraction work is, for example, performed by extracting refrigerant to the outside of the refrigerant circuit 410 by using a refrigerant collecting device and the like (not shown) from a service port and the like (not shown) installed at the shut-off valves 336 and 337 and the like.

<Subcooling Device Installation Work>

The subcooling device installation work mainly comprises the work to install the subcooler 326 (see FIG. 31) as a subcooling device and the bypass refrigerant circuit 371 (see FIG. 31) as a subcooling refrigerant circuit that supplies the refrigerant flowing in the refrigerant circuit 410 as a cooling source of the subcooler 326 in the outdoor unit 402 after the refrigerant extraction work. Here, FIG. 31 is a schematic refrigerant circuit diagram of the air conditioner 401 after modification of the existing air conditioner 401 by adding a refrigerant quantity determining function by the method for adding a refrigerant quantity determining function of an air conditioner in the present embodiment.

The subcooler 326 is a heat exchanger connected between the receiver 325 and the liquid side stop valve 336, and has the same configuration as the subcooler 326 in the third embodiment.

The bypass refrigerant circuit 371 is connected to the refrigerant circuit 410 so as to cause a portion of the refrigerant sent from the outdoor heat exchanger 323 to the indoor heat exchangers 342 and 352 to branch from the refrigerant circuit 410 and return to the suction side of the compressor 321. The bypass refrigerant circuit 371 has the same configuration as the bypass refrigerant circuit 371 in the third embodiment.

The subcooling device installation work is work to connect the above described subcooler 326 and the bypass refrigerant circuit 371 to the main refrigerant circuit. By disposing the subcooler 326 and the bypass refrigerant circuit 371 and by thus enabling the refrigerant flowing in the refrigerant circuit 410 (specifically, the refrigerant returned from the outlet of the bypass side refrigerant flow rate adjusting valve 372 to the suction side of the compressor 321) to be supplied as a cooling source to the subcooler 326, the refrigerant circuit 410 of the existing air conditioner 401 can be modified to be the same as the refrigerant circuit 310 (see FIG. 31) in the third embodiment, which is a circuit configuration capable of cooling the refrigerant flowing between the receiver 325 and indoor heat exchangers 342 and 352.

<Refrigerant Quantity Determining Means Installation Work>

The refrigerant quantity determining means installation work mainly comprises work to add sensors for detecting the operation state quantity that changes according to a change in the degree of subcooling or the degree of subcooling of the subcooler 326; and work to add the following functions to the controller 408: a function to perform refrigerant quantity determining operation that involves the control to make the refrigerant at the outlet of the receiver 325 subcool by using the subcooler 326 and the bypass refrigerant circuit 371, and a function to determine the adequacy of the refrigerant quantity during refrigerant quantity determining operation.

For the work to add sensors, as is the case with the air conditioner 301 in the third embodiment, the receiver outlet temperature sensor 338, the subcooler outlet temperature sensor 339, and the bypass refrigerant circuit temperature sensor 373 are disposed. Note that, unlike the existing air conditioner 401 in the present embodiment, in case of an existing air conditioner that has a temperature sensor that can be substituted for one of these temperature sensors 338, 339, and 373, it suffice to add only temperature sensors excluding such a substitutable temperature sensor from the temperature sensors 338, 339, and 373.

For the work to add to the controller 408 the function to perform refrigerant quantity determining operation and the function to determine the adequacy of the refrigerant quantity, the control board and the like that constitute the controller 408 are replaced, and thereby the controller 408 is modified to be the same as the controller 308 (see FIG. 32) of the air conditioner 301 in the third embodiment, in which the function to perform refrigerant quantity determining operation and the function to determine the adequacy of the refrigerant quantity during the refrigerant quantity determining operation are added. In addition, the warning display 309 comprising LEDs and the like, which is configured to indicate that a refrigerant leak is detected during the below described refrigerant leak detection mode, is connected to the controller 308.

In this way, by adding to the refrigerant circuit 410 of the existing air conditioner 401 (i.e., the outdoor side refrigerant circuit 410*c* that constitutes the outdoor unit 402) the subcooler 326, the bypass refrigerant circuit 371, and the sensors 338, 339, and 373, the refrigerant circuit 410 is modified to have a circuit configuration same as the refrigerant circuit 310 (i.e., the outdoor side refrigerant circuit 310*c* that constitutes the outdoor unit 302) of the air conditioner 301 in the third embodiment. Further, the control board and the like that constitute the controller 408 (i.e., the outdoor side controller 435 that constitutes the outdoor unit 402) of the existing air conditioner 401 are replaced with a control board and the like that has the function to perform the refrigerant quantity determining operation and the function to determine the adequacy of the refrigerant quantity. Thereby, the function to perform refrigerant quantity determining operation and the function to determine the adequacy of the refrigerant quantity during the refrigerant quantity determining operation, which are the same functions as those of the controller 308 (i.e., the outdoor side controller 335 that constitutes the outdoor unit 302) of the air conditioner 301 in the third embodiment, are added, which results in an air conditioner having the same configuration as the air conditioner 301 in the third embodiment.

(3) Characteristics of the Method for Adding a Refrigerant Quantity Determining Function of an Air Conditioner and the Air Conditioner to which the Refrigerant Quantity Determining Function is Added The method for adding a refrigerant quantity determining function of an air conditioner in the present embodiment, and the modified air conditioner 301 to which the refrigerant quantity determining function is added have the following characteristics.

(A)

The modified air conditioner 301 in the present embodiment, as is the case with the air conditioner 301 in the third embodiment, the fluctuation in the refrigerant quantity in the refrigerant circuit 310 can be clearly expressed as a fluctuation in the degree of subcooling $SC_s$ of the refrigerant at the outlet of the subcooler 326. Therefore, by utilizing this characteristic, it is possible to determine the adequacy of the refrigerant quantity even though the refrigerant circuit has the receiver 325. In addition, even if the outdoor heat exchanger 323 and the indoor heat exchangers 342 and 352 are degraded due to aging and fluctuation in weather conditions occurs, the adequacy of the refrigerant quantity charged in the air conditioner, i.e., whether or not there is a refrigerant leak can be accurately determined.

(B)

With the method for adding a refrigerant quantity determining function of an air conditioner in the present embodiment, in the existing air conditioner 401 of separate type comprising the refrigerant circuit 410 having the receiver 325, the above described function to determine the adequacy of the refrigerant quantity can be easily added, by a simple modification to add to the refrigerant circuit 410 the subcooler 326 as a subcooling device and the refrigerant quantity determining means by replacing the control board and the like of the controller 408.

Moreover, since the refrigerant that flows in the refrigerant circuit 410 is used as a cooling source of the subcooler 326, the function to determine the adequacy of the refrigerant quantity can be added without a need to add a cooling source from the outside.

(4) Alternative Embodiment 1

Figure 37:
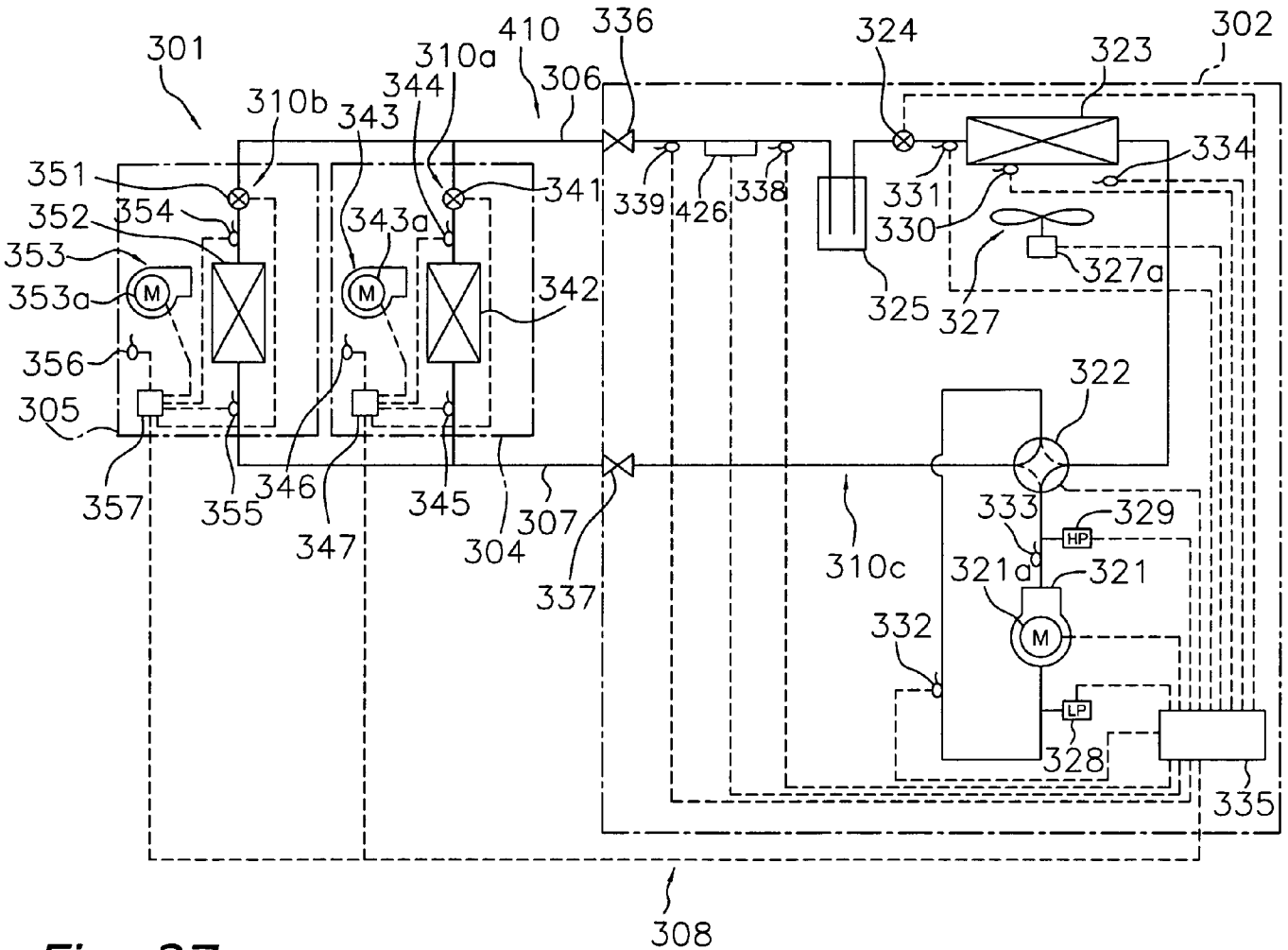
FIG. 37 is a schematic refrigerant circuit diagram of an air conditioner after modifying the existing air conditioner by adding a refrigerant quantity determining function thereto by a method for adding a refrigerant quantity determining function of an air conditioner according to an alternative embodiment of the fifth embodiment of the present invention.

In the above described embodiment, in the subcooling device installation work, the subcooler 326 comprising a double tube heat exchanger is added. However, it is not limited thereto. For example, as shown in FIG. 37, a peltier element 426 as a subcooling device may be disposed in the outdoor unit 402.

The peltier element 426 is a heat transfer element capable of causing heat transfer by supplying DC electricity, and is attached so as to be able to externally cool the refrigerant pipe that interconnects the receiver 325 and the indoor heat exchangers 342 and 352 (specifically, the liquid side stop valve 336). Accordingly, the subcooling device comprising the peltier element 426 can be disposed in the outdoor unit 402 without a need to perform the work to extract the refrigerant from the refrigerant circuit 410 in advance.

In this way, with the method for adding a refrigerant quantity determining function of an air conditioner in the alternative embodiment, unlike the above described embodiment, the subcooling device installation work and the refrigerant quantity determining means installation work can be performed without a need for the refrigerant extraction work that is performed in advance before the subcooling device installation work. Therefore, the modification in which the refrigerant quantity determining function is easily added to the existing air conditioner 401 can be performed.

Note that, in this alternative embodiment, during automatic refrigerant charging operation and refrigerant quantity determining operation in the refrigerant leak detection mode, the receiver outlet refrigerant subcooling control is performed by controlling the electric current and the voltage supplied to the peltier element 426; whereas in the above described embodiment, the receiver outlet refrigerant subcooling control is performed by controlling the bypass side refrigerant flow rate adjusting valve 372 that constitutes the bypass refrigerant circuit 371. Although this alternative embodiment is different in this point, other operations are same as the operations of the above described embodiment, and therefore the descriptions thereof are omitted.

In addition, a different device can be employed as a subcooling device instead of the peltier element 426 as long as it can externally cool the refrigerant pipe that interconnects the receiver 325 and the indoor heat exchangers 342 and 352 (specifically, the liquid side stop valve 336).

Figure 38:
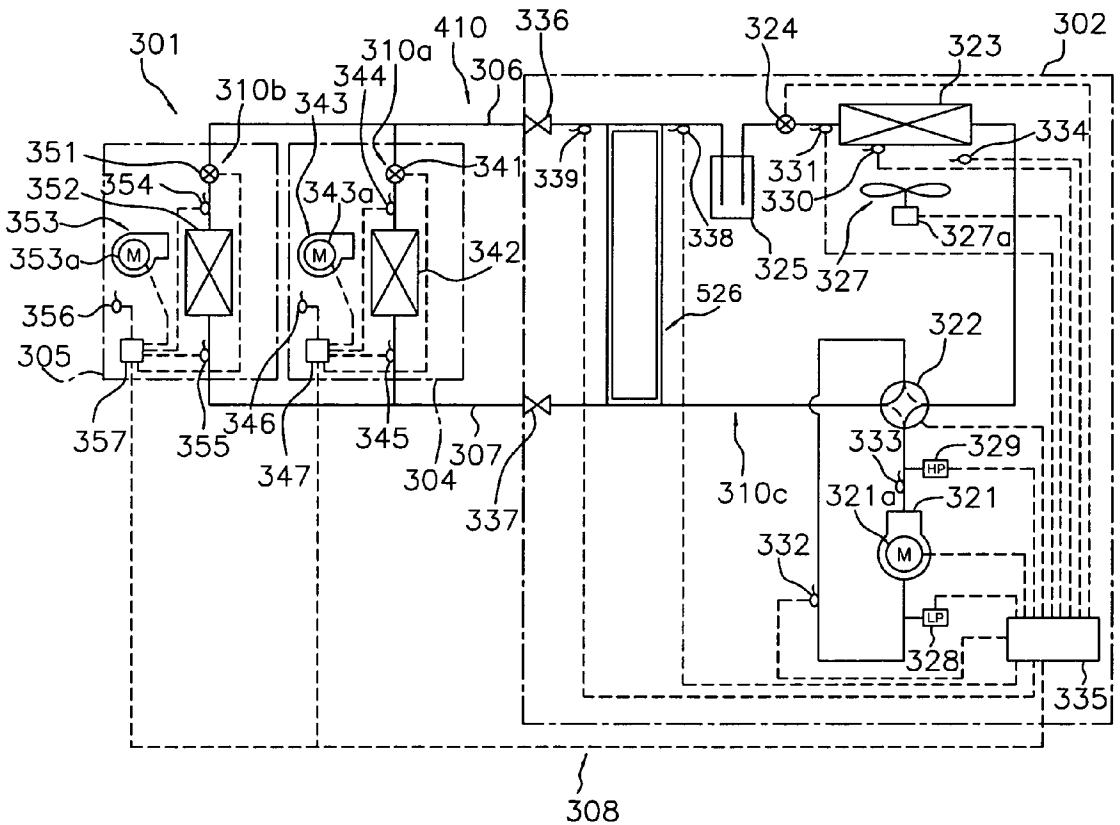
FIG. 38 is a schematic refrigerant circuit diagram of an air conditioner after modifying the existing air conditioner by adding a refrigerant quantity determining function by a method for adding a refrigerant quantity determining function of an air conditioner according to the alternative embodiment of the fifth embodiment of the present invention.

For example, as shown in FIG. 38, a subcooling device comprising a heat pipe 526 may be disposed in the outdoor unit 402 in order to provide indirect exchange heat between the refrigerant pipe that interconnects the receiver 325 and the indoor heat exchangers 342 and 352 (specifically, the liquid side stop valve 336) and the refrigerant pipe that interconnects the gas side stop valve 337 and the suction side of the compressor 321.

Figure 39:
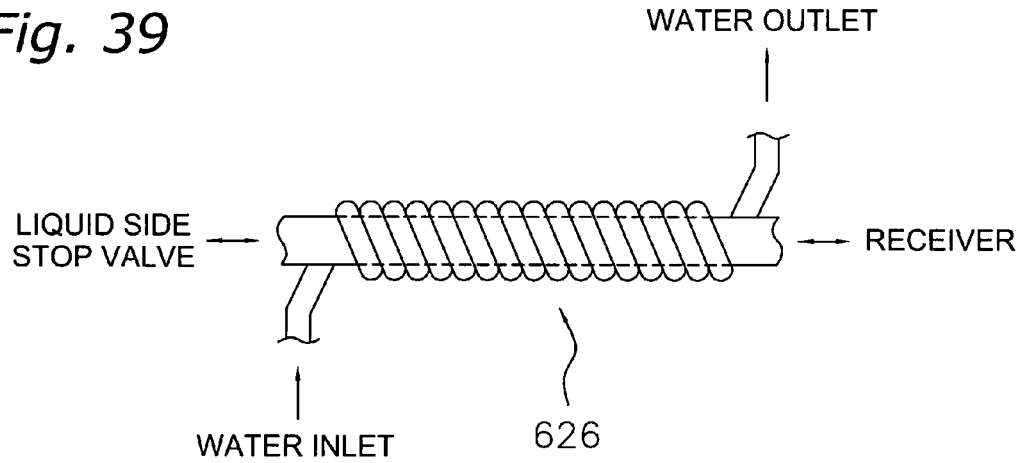
FIG. 39 is a drawing to show a configuration of a refrigerant pipe that a water pipe as a subcooling device according to the alternative embodiment of the fifth embodiment of the present invention is disposed to a refrigerant pipe that connects a receiver and a liquid side stop valve.

In addition, as shown in FIG. 39, cooling may be performed by disposing a water piping 626 on an outer circumference side of the refrigerant pipe that interconnects the receiver 325 and the liquid side stop valve 336.

Even in these cases, as is the case where the peltier element 426 is employed, it suffices to attach the heat pipe 526 and the water piping 626 so as to contact the refrigerant pipe from the outside. Accordingly, the modification in which the refrigerant quantity determining function is easily added to the existing air conditioner 401 can be performed without performing the work to extract the refrigerant from the refrigerant circuit 410.

(5) Alternative Embodiment 2

Also for the modified air conditioner 301 in the present embodiment, as is the case with the alternative embodiment 9 in the first embodiment, the refrigerant quantity determining system may be configured by achieving a connection between the air conditioner 301 and the local controller as the management device that manages each constituent equipment of the air conditioner 301 and obtains the operation data, connecting the local controller via a network to a remote server of an information management center that receives the operation data of the air conditioner 301, and connecting a memory device such as a disk device as the state quantity storing means to the remote server.

Other Embodiment

While preferred embodiments of the present invention have been described with reference to the figures, the scope of the present invention is not limited to the above embodiments, and the various changes and modifications may be made without departing from the scope of the present invention.

For example, in the above described embodiments, the case where the present invention is applied to an air conditioner capable of switching and performing cooling operation and heating operation. However, it is not limited thereto, and the present invention may be applied to a cooling only air conditioner and an air conditioner capable of simultaneously performing heating operation and cooling operation. In addition, in the above described embodiments, the case where the present invention is applied to an air conditioner comprising a single outdoor unit. However, it is not limited thereto, and the present invention may be applied to an air conditioner comprising a plurality of outdoor units.

INDUSTRIAL APPLICABILITY

Application of the present invention enables, in a multi-type air conditioner in which a heat source unit and a plurality of utilization units are interconnected via refrigerant communication pipes, an accurate judgment of the adequacy of the refrigerant quantity charged in the air conditioner, even when the refrigerant quantity charged on site is inconsistent, or even when a reference value of operation state quantity, which is used for determining the adequacy of the refrigerant quantity, fluctuates depending on the pipe length of the refrigerant communication pipes, combination of the utilization units, and the difference in the installation height among each unit.

The invention claimed is:

1. A refrigerant quantity determining system of an air conditioner including a refrigerant circuit configured by the interconnection between a heat source unit and a plurality of utilization units via refrigerant communication pipes, the refrigerant quantity determining system configured to determine the adequacy of the refrigerant quantity, the refrigerant quantity determining system comprising:

a state quantity storing means configured to store a reference value corresponding to an operation state quantity of refrigerant present in at least one of constituent equipment and refrigerant flowing in the refrigerant circuit in which refrigerant is charged up to an initial refrigerant quantity by on-site refrigerant charging during a test operation after installation of the air conditioner on site, the state quantity storing means being further configured and arranged without the reference value stored thereon prior to installation on site, and to store the operation state quantity of refrigerant after charging the initial refrigerant quantity to obtain the reference value, and a refrigerant quantity determining means configured to compare the reference value with a current value of operation state quantity of refrigerant present in at least one of constituent equipment and refrigerant flowing in the refrigerant circuit and thereby determine the adequacy of the refrigerant quantity.

2. The refrigerant quantity determining system according to claim 1, wherein the test operation includes refrigerant charging into the refrigerant circuit, and the state quantity storing means is configured to store operation state quantity of refrigerant present in at least one of constituent equipment and refrigerant flowing in the refrigerant circuit during refrigerant charging.

3. The refrigerant quantity determining system of the air conditioner according to claim 1, wherein the test operation includes changing control variables of constituent equipment of the air conditioner, and the state quantity storing means is configured to store operation state quantity of at least one of constituent equipment and refrigerant flowing in the refrigerant circuit during the changing of the control variables.

4. The refrigerant quantity determining system of the air conditioner according to claim 1, wherein a state quantity obtaining means is configured to manage the air conditioner, and the state quantity storing means and the refrigerant quantity determining means are located remotely from the air conditioner and are connected to the state quantity obtaining means via a communication circuit.

5. The refrigerant quantity determining system of the air conditioner according to claim 1, further comprising a refrigerant quantity calculating means is configured to calculate refrigerant quantity from the operation state quantity during the test operation, and the refrigerant quantity calculated from the operation state quantity during the test operation is stored in the state quantity storing means as the reference value.

6. The refrigerant quantity determining system of the air conditioner according to claim 2, wherein the state quantity storing means is further configured to store not only operation state quantity in a state after the refrigerant is charged up to the initial refrigerant quantity but also operation state quantity in a state where less refrigerant than the initial refrigerant quantity is charged in the refrigerant circuit.

7. The refrigerant quantity determining system of the air conditioner according to claim 3, wherein the refrigerant quantity determining means is further configured such that based on the operation state quantity during operation with the control variables of constituent equipment changed, it is possible to compensate for differences in operating conditions by comparing operation state quantity during the test operation to a current value of operation state quantity.

8. The refrigerant quantity determining system according to claim 1, wherein the refrigerant circuit operates in a forced cooling mode with indoor and outdoor fans operating during the refrigerant quantity determining operation.

9. A method of determining adequacy of refrigerant quantity in an air conditioner including a refrigerant circuit configured by the interconnection between a heat source unit and a plurality of utilization units via refrigerant communication pipes, the method comprising:

storing a reference value corresponding to an operation state quantity of refrigerant present in at least one of constituent equipment and refrigerant flowing in the refrigerant circuit in which refrigerant is charged up to an initial refrigerant quantity by on-site refrigerant charging during a test operation after installation of the air conditioner on site using a state quantity storing means in the air conditioner, a reference value not being stored prior to installation on site, and an operation state quantity of refrigerant after charging the initial refrigerant quantity being stored to obtain the reference value;

comparing the reference value with a current value of operation state quantity of refrigerant present in at least one of constituent equipment and refrigerant flowing in the refrigerant circuit using a refrigerant quantity determining means in the air conditioner; and determining the adequacy of the refrigerant quantity based on the comparing using the refrigerant quantity determining means in the air conditioner.

10. The method of determining adequacy of refrigerant quantity according to claim 9, wherein the test operation includes refrigerant charging into the refrigerant circuit, and the operation state quantity of refrigerant present in at least one of constituent equipment and refrigerant flowing in the refrigerant circuit is stored during refrigerant charging.

11. The method of determining adequacy of refrigerant quantity according to claim 9, wherein the test operation includes changing control variables of constituent equipment of the air conditioner, and the operation state quantity of at least one of constituent equipment and refrigerant flowing in the refrigerant circuit is stored during operation with the control variables changed.

12. The method of determining adequacy of refrigerant quantity according to claim 9, wherein the storing, the comparing and the determining occur at a location remote from the air conditioner.

13. The method of determining adequacy of refrigerant quantity according to claim 9, further comprising calculating refrigerant quantity from the operation state quantity during the test operation, the refrigerant quantity calculated being stored as the reference value.

14. The method of determining adequacy of refrigerant quantity according to claim 10, wherein not only operation state quantity in a state after the refrigerant is charged up to the initial refrigerant quantity but also operation state quantity in a state where less refrigerant than the initial refrigerant quantity is charged in the refrigerant circuit can be stored during the storing.

15. The method of determining adequacy of refrigerant quantity according to claim 11, wherein based on the operation state quantity during operation with the control variables of constituent equipment changed, it is possible to compensate for differences in operating conditions by comparing operation state quantity during the test operation to a current value of operation state quantity.

16. The method of determining adequacy of refrigerant quantity according to claim 9, wherein the refrigerant circuit operates in a forced cooling mode with indoor and outdoor fans operating during the method of determining adequacy of refrigerant quantity.

* * * * *